US011614089B2

(12) United States Patent
Juan et al.

(10) Patent No.: US 11,614,089 B2
(45) Date of Patent: Mar. 28, 2023

(54) ROTARY FLUID FLOW DEVICE

(71) Applicant: Exponential Technologies, Inc., Calgary (CA)

(72) Inventors: Alejandro Juan, Calgary (CA); Michael Sereda-Mohr, Calgary (CA); Erik Farrell, Calgary (CA)

( * ) Notice: Subject to any disclaimer, the term of this patent is extended or adjusted under 35 U.S.C. 154(b) by 0 days.

(21) Appl. No.: 17/229,679

(22) Filed: Apr. 13, 2021

(65) Prior Publication Data

US 2021/0301825 A1 Sep. 30, 2021

Related U.S. Application Data

(62) Division of application No. 16/219,692, filed on Dec. 13, 2018, now Pat. No. 10,975,869.

(Continued)

(51) Int. Cl.

| | |
|---|---|
| ***F01C 1/08*** | (2006.01) |
| ***F01C 3/08*** | (2006.01) |
| ***F04C 3/08*** | (2006.01) |
| ***F04C 18/08*** | (2006.01) |
| ***F04C 18/56*** | (2006.01) |

(Continued)

(52) U.S. Cl.

CPC ..... *F04C 29/042* (2013.01); *F01C 1/084* (2013.01); *F01C 3/08* (2013.01); *F01C 21/001* (2013.01); *F04C 3/08* (2013.01); *F04C 13/00* (2013.01); *F04C 15/00* (2013.01); *F04C 18/084* (2013.01); *F04C 18/56* (2013.01); *F04C 25/00* (2013.01); *F04C 29/00* (2013.01); *F04C 29/0007* (2013.01); *F04C 29/0057* (2013.01); *F04C 29/04* (2013.01); *F04C 18/54* (2013.01); *F04C 2210/22* (2013.01); *F04C 2240/20* (2013.01); *F04C 2240/54* (2013.01)

(58) Field of Classification Search

CPC .... F01C 1/084; F01C 3/08; F04C 3/08; F04C 18/084; F04C 18/56; F04C 18/48; F04C 29/042; F04C 15/00

See application file for complete search history.

(56) References Cited

U.S. PATENT DOCUMENTS

| | | | |
|---|---|---|---|
| 32,372 | A | 5/1861 | Jones |
| 351,129 | A | 10/1886 | Salomo |

(Continued)

FOREIGN PATENT DOCUMENTS

| | | | |
|---|---|---|---|
| AU | 2009295220 | A1 | 3/2010 |
| AU | 2014202553 | A1 | 6/2014 |

(Continued)

OTHER PUBLICATIONS

Figliolini, Algorithms for Involute and Octoidal Bevel-Gear Generation, ASME, vol. 127, Jul. 2005, 9 pages.

(Continued)

*Primary Examiner* — Deming Wan

(74) *Attorney, Agent, or Firm* — Dwayne E Rogge

(57) ABSTRACT

A positive displacement device that converts energy, namely positive displacement compressors that rotate in a single rotational direction to displace working fluid contained in operating chambers. The device described herein is particularity advantageous for the ability to achieve high compression ratios in combination with high discharge pressure and high volumetric throughput in a single stage.

8 Claims, 53 Drawing Sheets

Related U.S. Application Data

(60) Provisional application No. 62/598,260, filed on Dec. 13, 2017.

(51) Int. Cl.

| | |
|---|---|
| ***F04C 18/48*** | (2006.01) |
| ***F04C 29/04*** | (2006.01) |
| ***F04C 15/00*** | (2006.01) |
| ***F04C 29/00*** | (2006.01) |
| ***F01C 21/00*** | (2006.01) |
| ***F04C 25/00*** | (2006.01) |
| ***F04C 13/00*** | (2006.01) |
| *F04C 18/54* | (2006.01) |

(56) References Cited

U.S. PATENT DOCUMENTS 514,990 A 2/1894 Habersang et al.
815,485 A 3/1906 Stewart
855,106 A 5/1907 Hensel
914,155 A 3/1909 Mills et al.
991,576 A 5/1911 White, Jr.
1,088,174 A 2/1914 Perrot
1,285,870 A 11/1918 Wingqvist
1,295,231 A 2/1919 Stewart et al.
1,379,653 A 5/1921 Shoemaker
1,647,167 A 11/1927 Wildhaber
1,682,759 A 9/1928 Kocourek
1,739,756 A 12/1929 Granville
1,748,813 A 2/1930 Wildhaber
1,804,475 A 5/1931 Nash
2,101,051 A 12/1937 Cuny
2,101,428 A 12/1937 Cuny
2,242,058 A 5/1941 Cuny
2,266,108 A 12/1941 Welter
2,280,845 A 4/1942 Parker
2,316,243 A 4/1943 Hubbard
RE22,555 E 10/1944 Brooks
2,397,003 A 3/1946 Hambelton
2,431,817 A 12/1947 Mann
2,491,298 A 12/1949 Carter
2,496,351 A 2/1950 Mazzoni
2,551,735 A 5/1951 Goff
2,578,763 A 12/1951 Trbojevich
2,578,764 A 12/1951 Trbojevich
2,582,413 A 1/1952 Clark
2,828,695 A 4/1958 Wilmott
3,101,700 A 8/1963 Bowdish
3,103,126 A 9/1963 Textrom
3,106,912 A 10/1963 Kahlert
3,141,313 A 7/1964 Brickett et al.
3,156,222 A 11/1964 Miller, Jr.
3,236,186 A 2/1966 Wildhaber
3,272,130 A 9/1966 Mosbacher
3,273,341 A 9/1966 Ernest
3,384,425 A 5/1968 Maurice
3,508,430 A 4/1970 Edmondson
3,653,790 A 4/1972 Ifield
3,769,944 A 11/1973 Raymond
3,773,442 A 11/1973 Mitchell et al.
3,816,038 A 6/1974 Berry
3,816,039 A 6/1974 Berry
3,820,923 A 6/1974 Zweifel
3,845,562 A 11/1974 Dallas
3,856,440 A 12/1974 Wildhaber
3,884,050 A 5/1975 Borcuk
3,911,759 A 10/1975 Tanaka et al.
3,927,899 A 12/1975 Bough
3,971,603 A 7/1976 Bjerk
3,982,861 A 9/1976 Gibson
4,036,566 A 7/1977 Konopeskas
4,078,809 A 3/1978 Garrick et al.
4,180,188 A 12/1979 Aonuma et al.
4,252,511 A 2/1981 Bowdish
4,373,881 A 2/1983 Matsushita
4,478,553 A 10/1984 Leibowitz et al.
4,489,615 A 12/1984 Ward
4,579,351 A 4/1986 Daffron
4,642,046 A 2/1987 Saito et al.
4,702,206 A 10/1987 Harries
4,721,445 A 1/1988 Hoffmann
4,799,694 A 1/1989 Brauers
4,799,870 A 1/1989 McMaster
4,872,815 A 10/1989 Takai
4,877,379 A 10/1989 Okabe
4,947,942 A 8/1990 Lightle et al.
4,969,371 A 11/1990 Allen
4,984,432 A 1/1991 Corey
5,027,653 A 7/1991 Foran, Jr.
5,031,922 A 7/1991 Heydrich
5,042,823 A 8/1991 MacKay et al.
5,056,314 A 10/1991 Paul et al.
5,108,116 A 4/1992 Johnson et al.
5,171,138 A 12/1992 Forrest
5,275,043 A 1/1994 Cotton
5,281,032 A 1/1994 Slocum
5,427,068 A 6/1995 Palmer
5,513,969 A 5/1996 Arnold
5,589,671 A 12/1996 Hackbarth et al.
5,613,914 A 3/1997 Gleasman et al.
5,674,053 A 10/1997 Paul et al.
5,695,201 A 12/1997 Wheeler
5,709,388 A 1/1998 Skinner et al.
5,755,196 A 5/1998 Klassen
5,908,195 A 6/1999 Sharrer
5,941,685 A 8/1999 Bagepalli et al.
5,964,467 A 10/1999 Hirata
5,971,400 A 10/1999 Turnquist et al.
5,992,230 A 11/1999 Scarpa et al.
6,032,636 A 3/2000 Kajino
6,036,463 A 3/2000 Klassen
6,062,018 A 5/2000 Bussing
6,146,120 A 11/2000 Harms
6,161,839 A 12/2000 Walton et al.
6,196,550 B1 3/2001 Arora et al.
6,226,986 B1 5/2001 Driver et al.
6,239,361 B1 5/2001 Snaper
6,266,660 B1 7/2001 Liu et al.
6,336,389 B1 1/2002 English et al.
6,343,792 B1 2/2002 Shinohara et al.
6,364,316 B1 4/2002 Arora
6,431,550 B1 8/2002 Tong
6,457,450 B1 10/2002 Luzhkov
6,481,410 B1 11/2002 Ogilvie
6,494,698 B2 12/2002 Arnold
6,497,564 B2 12/2002 Klassen
6,565,094 B2 5/2003 Wright et al.
6,585,270 B2 7/2003 Tong
6,612,821 B1 9/2003 Kuijpers et al.
6,634,873 B2 10/2003 Klassen
6,655,696 B1 12/2003 Fang et al.
6,694,858 B2 2/2004 Grimes
6,695,316 B2 2/2004 Popa et al.
6,705,161 B1 3/2004 Klassen
6,736,401 B2 5/2004 Chung et al.
6,739,852 B1 5/2004 Klassen
6,769,889 B1 8/2004 Raney et al.
6,887,057 B2 5/2005 Klassen
6,923,055 B2 8/2005 Klassen
6,932,349 B2 8/2005 Coppola
6,991,235 B2 1/2006 Ebert et al.
7,111,606 B2 9/2006 Klassen
7,182,345 B2 2/2007 Justak
7,275,920 B2 10/2007 Arnold
7,340,903 B2 3/2008 Lu et al.
7,351,047 B2 4/2008 Kawakami et al.
7,410,173 B2 8/2008 Justak
7,510,086 B2 3/2009 Henssler et al.
7,538,464 B2 5/2009 Hemmi et al.
7,604,239 B2 10/2009 Chitren et al.
7,721,523 B2 5/2010 Tangirala et al.
7,726,660 B2 6/2010 Datta
7,726,940 B2 6/2010 Snowsill
7,758,334 B2 7/2010 Shimo et al.

(56) References Cited

U.S. PATENT DOCUMENTS

| | | | | |
|---|---|---|---|---|
| 7,806,410 | B2 | 10/2010 | El-Aini et al. | |
| 8,562,318 | B1 | 10/2013 | Gottfried et al. | |
| 8,602,758 | B2 | 12/2013 | Juan et al. | |
| 8,689,766 | B2 | 4/2014 | Oledzki | |
| 8,740,225 | B2 | 6/2014 | Patterson et al. | |
| 8,834,140 | B2 | 9/2014 | Arnold et al. | |
| 8,887,592 | B2 | 11/2014 | Patterson et al. | |
| 9,115,646 | B2 | 8/2015 | Patterson et al. | |
| 9,121,275 | B2 | 9/2015 | Patterson et al. | |
| 9,316,102 | B2 | 4/2016 | Patterson et al. | |
| 9,359,973 | B2 | 6/2016 | Farshchian et al. | |
| 9,447,688 | B2 | 9/2016 | Juan et al. | |
| 9,732,600 | B2 | 8/2017 | Farshchian et al. | |
| 9,777,729 | B2 | 10/2017 | Juan et al. | |
| 9,856,878 | B2 | 1/2018 | Santos et al. | |
| 9,874,097 | B2 | 1/2018 | Patterson et al. | |
| 10,337,328 | B2 | 7/2019 | Juan et al. | |
| 10,975,869 | B2 | 4/2021 | Juan et al. | |
| 2001/0031215 | A1 | 10/2001 | Klassen | |
| 2001/0055992 | A1 | 12/2001 | Basstein | |
| 2002/0020171 | A1 | 2/2002 | Driver | |
| 2002/0037228 | A1 | 3/2002 | Arnold | |
| 2002/0043238 | A1 | 4/2002 | McMaster et al. | |
| 2002/0157636 | A1 | 10/2002 | Klassen | |
| 2003/0025274 | A1 | 2/2003 | Allan et al. | |
| 2003/0111797 | A1 | 6/2003 | Chung et al. | |
| 2003/0122266 | A1 | 7/2003 | Nau et al. | |
| 2003/0209221 | A1 | 11/2003 | Klassen | |
| 2003/0231971 | A1 | 12/2003 | Klassen | |
| 2004/0000760 | A1 | 1/2004 | Aksit et al. | |
| 2004/0113367 | A1 | 6/2004 | Martins et al. | |
| 2004/0155410 | A1 | 8/2004 | Proctor et al. | |
| 2004/0211387 | A1 | 10/2004 | Morgado | |
| 2005/0098957 | A1 | 5/2005 | Goss et al. | |
| 2005/0098958 | A1 | 5/2005 | Ebert et al. | |
| 2005/0276714 | A1 | 12/2005 | Klassen | |
| 2006/0125190 | A1 | 6/2006 | Addis | |
| 2006/0214378 | A1 | 9/2006 | Zheng | |
| 2007/0063448 | A1 | 3/2007 | Kowalczyk | |
| 2007/0096397 | A1 | 5/2007 | Justak | |
| 2007/0151227 | A1 | 7/2007 | Worrell | |
| 2007/0180810 | A1 | 8/2007 | Chapin et al. | |
| 2007/0207049 | A1 | 9/2007 | Ooi | |
| 2007/0245712 | A1 | 10/2007 | Shimo et al. | |
| 2007/0252336 | A1 | 11/2007 | Grabeldinger | |
| 2007/0253851 | A1 | 11/2007 | Arnold | |
| 2007/0274853 | A1 | 11/2007 | Merendeiro et al. | |
| 2008/0008579 | A1 | 1/2008 | Mikulec | |
| 2008/0029968 | A1 | 2/2008 | Addis | |
| 2008/0107525 | A1 | 5/2008 | Adis et al. | |
| 2008/0122183 | A1 | 5/2008 | Braun et al. | |
| 2008/0136112 | A1 | 6/2008 | Addis | |
| 2009/0194948 | A1 | 8/2009 | Wirt | |
| 2010/0021247 | A1 | 1/2010 | Aldred et al. | |
| 2010/0074786 | A1 | 3/2010 | Juan et al. | |
| 2010/0122685 | A1 | 5/2010 | Oledzki | |
| 2010/0133834 | A1 | 6/2010 | Nimberger | |
| 2010/0215531 | A1 | 8/2010 | Arnold | |
| 2011/0121519 | A1 | 5/2011 | Justak | |
| 2011/0204064 | A1 | 8/2011 | Crane et al. | |
| 2011/0311351 | A1 | 12/2011 | Patterson et al. | |
| 2012/0121411 | A1 | 5/2012 | Endo et al. | |
| 2012/0299248 | A1 | 11/2012 | Cordiner et al. | |
| 2012/0308367 | A1 | 12/2012 | Luczak | |
| 2013/0200634 | A1 | 8/2013 | Patterson et al. | |
| 2013/0281220 | A1 | 10/2013 | Flow et al. | |
| 2014/0308151 | A1* | 10/2014 | Nowitzky et al. | F04C 3/08 418/204 |
| 2015/0260184 | A1* | 9/2015 | Farrell | F04C 3/08 418/51 |
| 2015/0361794 | A1 | 12/2015 | Patterson et al. | |
| 2017/0130583 | A1 | 5/2017 | Juan et al. | |
| 2019/0271317 | A1 | 9/2019 | Juan et al. | |
| 2020/0291935 | A1 | 9/2020 | Gottfried et al. | |

FOREIGN PATENT DOCUMENTS

| | | | |
|---|---|---|---|
| AU | 2012245033 | B2 | 5/2016 |
| AU | 2012357567 | B2 | 3/2017 |
| CA | 1080990 | A | 7/1980 |
| CA | 2069607 | A1 | 11/1993 |
| CA | 2491298 | A1 | 6/2006 |
| CA | 2735567 | A1 | 3/2010 |
| CA | 2759433 | A1 | 10/2010 |
| CA | 2771470 | A1 | 3/2011 |
| CA | 2803250 | A1 | 12/2011 |
| CA | 2807402 | A1 | 2/2012 |
| CA | 2833593 | A1 | 10/2012 |
| CA | 2859772 | A1 | 6/2013 |
| CA | 2903906 | A1 | 9/2014 |
| CA | 2759433 | C | 7/2017 |
| CA | 2735567 | C | 8/2018 |
| CA | 2859772 | C | 8/2019 |
| CA | 3010961 | C | 8/2020 |
| CN | 1045149 | A | 9/1990 |
| CN | 201354837 | Y | 12/2009 |
| CN | 103649584 | A | 3/2014 |
| CN | 102203386 | B | 9/2014 |
| CN | ZL2009801442425 | | 9/2014 |
| CN | 103052762 | A | 7/2016 |
| CN | 103069142 | B | 8/2016 |
| CN | ZL2011800387663 | | 8/2016 |
| DE | 1551081 | A1 | 4/1970 |
| DE | 2639760 | A1 | 3/1978 |
| DE | 3221994 | A1 | 12/1983 |
| DE | 212014000032 | U1 | 10/2015 |
| EP | 1366289 | B1 | 4/2007 |
| EP | 2582917 | A1 | 4/2013 |
| EP | 2699821 | B1 | 3/2017 |
| EP | 3724507 | A1 | 10/2020 |
| FR | 916277 | A | 12/1946 |
| GB | 190205686 | A | 11/1902 |
| GB | 805370 | A | 12/1958 |
| GB | 1099085 | A | 1/1968 |
| GB | 1269063 | A | 3/1972 |
| ID | P00045984 | | 5/2017 |
| IN | 10875DELNP2012 | | 10/2014 |
| IN | 9120DELNP2013 | A | 12/2014 |
| IT | 268459 | A1 | 1/1933 |
| JP | 4329764 | B2 | 12/1943 |
| JP | 52014904 | | 2/1977 |
| JP | S5572683 | A | 5/1980 |
| JP | 61112860 | A | 3/1986 |
| JP | H04329764 | A | 11/1992 |
| JP | 2001355401 | A | 12/2001 |
| JP | 2002021979 | A | 1/2002 |
| JP | 2005048903 | A | 2/2005 |
| JP | 3657530 | B2 | 6/2005 |
| JP | 2006250382 | A | 9/2006 |
| JP | 3853355 | B2 | 12/2006 |
| JP | 2014517187 | A | 7/2014 |
| JP | 5572683 | B2 | 8/2014 |
| JP | 5723278 | B2 | 5/2015 |
| JP | 5913298 | B2 | 5/2016 |
| JP | 5991719 | B2 | 9/2016 |
| JP | 6193213 | B2 | 9/2017 |
| KR | 1020100003873 | | 1/2010 |
| KR | 20130124283 | A | 11/2013 |
| KR | 101589966 | B1 | 2/2016 |
| KR | 101645266 | B1 | 8/2016 |
| KR | 101916493 | B1 | 11/2018 |
| MX | 2011002829 | A | 4/2011 |
| MX | 344134 | B | 12/2016 |
| MX | 359421 | B | 9/2018 |
| PH | 12011500566 | | 6/2014 |
| RU | 2156862 | C1 | 9/2000 |
| RU | 2549007 | C2 | 4/2015 |
| RU | 2575514 | C2 | 2/2016 |
| RU | 2014128985 | A | 2/2016 |
| RU | 2619153 | C2 | 5/2017 |
| RU | 2015108412 | A3 | 10/2018 |
| SG | 169570 | | 4/2011 |
| SG | 194353 | A1 | 11/2013 |
| WO | 9533936 | A1 | 12/1995 |

(56) References Cited

FOREIGN PATENT DOCUMENTS

| | | | |
|---|---|---|---|
| WO | 9628641 | A1 | 9/1996 |
| WO | 9911944 | A1 | 3/1999 |
| WO | 9961753 | A1 | 12/1999 |
| WO | 2007099768 | A1 | 9/2007 |
| WO | 2007112442 | A2 | 10/2007 |
| WO | 2010031173 | A1 | 3/2010 |
| WO | 2010047602 | A1 | 4/2010 |
| WO | 2010139065 | A1 | 12/2010 |
| WO | 2011025160 | A2 | 3/2011 |
| WO | 2011156924 | A1 | 12/2011 |
| WO | 2013091098 | A1 | 6/2013 |
| WO | 2017198720 | A1 | 11/2017 |
| WO | 2019113704 | A1 | 6/2019 |
| WO | 2020181387 | A1 | 9/2020 |

OTHER PUBLICATIONS

George, Granco Positive Displacement Pump, Plant Engineering Magazine, Dec. 10, 1981, 9 pages.
International Searching Authority, International Search Report PCT/CA2012/050257, dated Jun. 15, 2012, 1 page.
International Searching Authority, International Search Report, PCT/CA2012/050303, dated Aug. 3, 2012, 10 pages.
International Searching Authority, International Search Report, PCT/CA2018/051598, dated Mar. 19, 2019, 12 pages.
International Searching Authority, International Search Report, PCTCA2009001307, dated Jan. 28, 2010, 8 pages.
International Searching Authority, International Search Report, PCTCA2011050369, dated Sep. 2, 2011, 3 pages.
International Searching Authority, International Search Report, PCTCA2012050917, dated Feb. 26, 2013, 8 pages.
International Searching Authority, International Search Report, PCTCA2020050338, dated May 28, 2020, 3 pages.
Kapelevich, "Geometry and Design of Involute Spur Gears With Asymmetric Teeth", Apr. 27, 1998, 14 pages.
Kopscisk, "Application And Operating History of Moderate-Speed API 618 Reciprocating Compressors," Proceedings for the Thirty-Third Turbomachinery Symposium, 2004, 10 pages.
NASA, Pressure-Balanced, Low-Hysteresis Finger Seal Developed and Tested. Updated Apr. 24, 2000. http://www.grc.nasa.gov/WWW/RT/RT1999/50001/~proctor.html.
Park et al., "The spherical Involute bevel gear: its geometry, kinematic behavior and standardization", Journal of Mechanical Science and Technology 25 (4) (2011) 1023-1034, Manuscript.
Pillis, Basics Of Operation And Application of Oil Flooded Rotary Screw Compressors, 1999, 10 pages.
Sage Energy Corporation, "Screw Compressors Misconception or Reality," www.drivetrainpower.com, Apr. 27, 2013, 25 pages.
Wankel, Felix, Rotary Piston Machines, Jan. 1, 1965, 16 pages.
Wikipedia, Gear Coupling, http://en.wikipedia.org/wiki/Gear_coupling, May 4, 2011, 1 page.

* cited by examiner

ROTARY FLUID FLOW DEVICE

This application is a divisional of U.S. Ser. No. 16/219,692 filed Dec. 13, 2018, which claims priority benefit of U.S. Provisional Ser. No. 62/598,260 filed Dec. 13, 2017, incorporated herein by reference.

FIELD OF THE DISCLOSURE

This disclosure relates to positive displacement machines that convert energy, in one example, positive displacement compressors comprising rotors that rotate in a single rotational direction to displace a working fluid contained in operating chambers of the rotors. In one example the rotors of the rotary fluid flow device may be rotationally reversible without modification to the structures. The device disclosed herein in one example is particularity advantageous for the ability to achieve high compression ratios in combination with high discharge pressure and high volumetric throughput in single stage compression applications. Said rotary fluid flow device may achieve comparably high expansion ratios in combination with a high pressure input and high volumetric throughput in a single stage.

BACKGROUND

With many mechanical products for example a pump, compressor, or a combustion engine; a wider operating range is often more beneficial to the end user for standardization and to avoid the necessity for purchasing multiple components to accomplish what could be done with fewer or one component(s).

As an example, in the case of natural gas compression, transportation lines across North America can often range in pressure from 200 to 1500 and up to 1800 pounds per square inch gauge (psig) typically. In other examples, the pressure may be 1500 to 1900 psig. In other examples, the pressure can be over 1900 psig. Natural gas is often moved through transportation pipelines at high pressure to reduce the volume of natural gas being transported by up to 600 times. Wells in a natural gas field in production are expected to eventually experience a decline in pressure as the supply is diminished. Therefore, in many cases there is a need to boost the pressure of natural gas in the well for production. In some examples the pressure will be boosted by 110 times or more. As this well pressure naturally declines over time below the desired discharge line pressure, a fluid flow device (e.g., compressor) is utilized to increase pressure flow into the higher pressure pipeline. In some cases, when the fluid flow device (e.g., compressor) is initially installed, the pressure boost (i.e. Ratio of absolute discharge pressure relative to absolute inlet pressure) may be near 1.

Absolute pressure is the summation of gauge pressure and atmospheric pressure. As such, a compressor that is capable of boosting gas pressure throughout a range of 1-110 times absolute inlet pressure or more is desirable in some applications. Currently, to meet the requirements of high compression ratios in combination with high discharge pressures of 1500 psig (as an example) often requires multiple stages on a reciprocating compressor and in some examples in combination with screw compressor(s) for boosting pressure prior to the reciprocating compressor(s). Screw compressors are commonly limited to a maximum discharge pressure of 350 psig, when used in conjunction with a reciprocating compressor, which is common, they are used to boost pressure on the upstream side of the system.

It is known that gas temperature increases with a higher ratio of pressure boost/compression and some components such as valves and lubricating fluid require lower temperatures to operate as intended. Thus, it has been common industry practice to control temperatures on the discharge side of compressors. The American Petroleum Institute (API) Code 618 recommends that the maximum discharge temperature be limited to 300 F (150 C). Reciprocating compressors control this temperature by way of intercooling the gas between stages, while screw compressors are often single stage and use liquid oil injection to control this temperature.

To accomplish high compression ratios within a single stage of compression, it is common to utilize liquid injection cooling. Such liquid injection cooling is known in the art of oil flooded screw compressors. It is not industry practice to use liquid cooling with reciprocating compressors in that "water hammer" could lead to over-stressing components and potentially lead to failure. "Water hammer" is also sometimes more generally referred to as "fluid hammer". The term describes a pressure surge or wave caused when a fluid in motion is forced to stop or change direction suddenly. This pressure change is more of a concern with liquids as opposed to gases in that liquids are less compressible than gases. Liquids are commonly considered to be incompressible. In addition, higher density liquids have higher pressure resistance. Furthermore, liquids are generally incompressible which may lead to a pressure spike when a piston reaches the end of its stroke in a cylinder comprising of liquids and gases. Since liquid cooling in some examples may not be used to control the gas temperature without reducing the operating speed of reciprocating compressors, multi-stage (more than one cylinder) compression is commonly utilized where gas being boosted in pressure by around 4 times is cooled in a heat exchanger before entering the sequential compression stage. Multi-stage compression often leading to reciprocating compressors that are physically large and many interoperating components. While oil flooded screw compressors are well regarded for high speed (and thus high-volume capacity) in addition to high compression ratios, screw compressors are commonly constrained in terms of efficient discharge pressure capability because of the intermeshing rotor geometry being forced apart (rotor deflection) and leaking. This rotor deflection can lead to efficiency losses and rotor to housing contact which may lead to device failure.

Oil flooded screw compressors that attempted operating at discharge pressures much higher than 350 psig have experienced wear and/or other mechanical design issues that make such devices unreliable, and thus not widely adopted. Thus, the constraint for high discharge pressures with screw compressors has been mechanical design, and not a lack of pursuit or understanding of the appeal of very high compression ratios in combination with high discharge pressures in a single stage and with controlled temperatures. An example of the known appeal of such operating conditions is presented in U.S. Pat. No. 5,674,053 "High pressure compressor with controlled cooling during the compression phase" incorporated herein by reference where it is stated that "a single stage compression of gas at ambient to 4000 psig would result in a gas temperature of over 600° C. This temperature exceeds the desired operating temperature of valves, seals and other components in the compressor. To avoid the use of exotic materials, it is often desirable to maintain the gas charge at substantially lower temperatures. The term substantially used herein to indicate being largely but not necessarily wholly that which is specified, nearly.

Where it is desired to compress a gas in one stage with pressure ratios of 30, 40, or 80 to 1, excessive gas temperatures have been a barrier to single stage compression."

Oil flooded screw compressors typically inject coolant oil into the inlet port, which in many applications is not as efficient as injecting coolant during the actual compression event. As highlighted in U.S. Pat. No. 3,820,923 "Single stage or multistage rotary compressor", injecting oil directly into the intake port is not as efficient as injection oil directly into the compression chamber. This patent also discloses the benefit of atomization injection during the latter stages of compression for maximum efficiency and also references an example of 8:1 compression in a single stage.

U.S. Pat. No. 6,266,660 B1 discloses an atomized liquid cooling device including "The concept of spraying liquid into a compression chamber as a means of absorbing the heat of compression is well known, and is commonly referred to in the art as wet compression".

Furthermore, as highlighted in U.S. Pat. No. 2,280,845 "Air compressor system", if only a limited timeframe is available (e.g., thousands of a second), heat transfer can be increased by using smaller atomized droplets because of the increase in surface area to volume ratio. U.S. Pat. No. 4,478,553 disclosed preferential droplet sizes of between 2 and 10 microns. Patent application US2011/0204064 A1 disclosed preferential droplet sizes of <100 microns. The patent application "Atomizing device" US20030122266 A1 disclosed injecting oil cooling at least partially contrary to the flow direction of the gas flow for potentially greater cooling efficiency.

The concept of near isothermal compression and expansion utilizing a liquid fluid misted into the compression and expansion chambers as a means of absorbing the heat of compression was disclosed in U.S. Pat. No. 4,984,432 as well as making use of a heat exchanger in the process.

Having a wide operating range for a compressor, as an example, would not only include a range of acceptable low to high suction pressures (i.e. below atmospheric pressure to 2000 psig), a range of acceptable low to high discharge pressures (i.e. near atmospheric pressure to 2000 psig) and a range of acceptable low to high compression ratios (i.e. near 1:1 to 80:1 or higher), but also a variety of speed ranges (i.e. near 0 RPM to 3600 RPM or higher) to suit the various electric and engine drivers known while minimizing or eliminating the need to adjust the speed of a driver shaft relative to a compressor shaft.

Compressors operating at speeds ranging from 200 to 20,000 rpm exist in the market and it may be obvious to someone skilled in the art that a compressor that is not limited to a specific speed would have a wider potential market opportunity and that the greater the speed capability, the greater the potential throughput for given size and weight of compressor.

As those skilled in the art regard isothermal compression/expansion as the most promising process in many applications, numerous researchers and inventors have tried various methods to achieve this goal often with concepts known in the art for decades but commercial viability has been elusive for various reasons including high mechanical overhead, equipment costs, limited operating ranges and impractical design.

It is therefore an object of this invention to be a cost effective, near isothermal compressor and/or expander.

A still further object of the invention is to be a near isothermal compressor and/or expander with relatively low mechanical overhead.

A still further object of the present invention is to be a near isothermal compressor and/or expander with a very wide operating range.

SUMMARY OF THE DISCLOSURE

The foregoing examples indicate that high compression ratios (i.e., 80:1 or higher as an example) in a single stage, in combination with high discharge pressures (i.e., up to 4,000 psig or more as an example) is desirable and that controlling discharge temperature (i.e., <250° C.) from high compression ratios can be done by liquid cooling, including liquid cooling via atomization of the coolant fluid directly into the compression chamber and during the later stages of compression.

The term "isothermal" as used herein, denotes any non-adiabatic compression or expansion process that derives increased efficiency or other energetic benefit through the deliberate transfer of heat to or from the quantity of gas subject to the compression or expansion process.

A compressor that can operate at a wide speed range in combination with very high compression ratios in a single stage and high discharge pressures is desired in some applications. The design constraints of screw compressors (reliable operation at discharge pressures much higher than 350 psig) and reciprocating compressors (inability to liquid cool due to hydrolock) are well known. The lack of commercial natural gas compressors that combine the prior art design features of high flows in combination with high discharge pressures and injection cooling, with a variety of speeds and production scenarios that already exist in the natural gas industry, can be primarily attributable to the mechanical constraints of reliability, safety, efficiency, load capacity and long component life.

Frusto-conical shapes forming a rotary positive displacement device have the potential of high pumping flow rates and compression ratios in combination with liquids as disclosed, for example, U.S. Pat. No. 8,562,318 B1 Multiphase Pump with High Compression Ratio implies a liquid fill fraction of a working fluid of over 0.5%. Other features of frusto-conical shapes are: the capacity for high speeds and high compression ratios as disclosed in U.S. Pat. No. 6,497,564 B2 where it is stated in one of the embodiments "This is particularly advantageous for high speed rotation rotors with high compression ratios".

The term frusto used herein to define a segment or section of a geometric shape or surface. For example, the term frusto-spherical surface defines a surface lying on a sphere, but not only a segment of the entire sphere. In other words, the term frusto is used herein to define a portion of the surface of a solid. For example, the term frusto-spherical when referring to the outer surface of the rotors, defines a surface lying on a sphere. The spherical surface has regions removed; thus the surface does not form a continuous sphere. Similarly, a frusto-cylindrical surface is a surface lying on a cylinder and a frusto-conical surface is a surface lying on a cone.

The rotary fluid flow device disclosed herein in one example is generally directed to a gas or vapor compression system which includes a rotor compressor for compressing a gas or vapor "working fluid". Thus, the terms "rotary fluid flow device" and "compressor" will be used interchangeably to denote the same device. An "oil" may generally be used as a "coolant" to achieve near isothermal compression or expansion processes in a single stage. Thus, the terms "coolant" and "oil" may be used interchangeably in this disclosure in that they both represent a coolant fluid or bearing fluid that may have a higher heat capacity than the working fluid and therefore influence the temperature of the working fluid during a compression or expansion process. In one example the coolant fluid is water, and the bearing fluid is oil. In another example, both the coolant fluid and bearing fluid are both fluid, which may be an oil. The coolant temperature prior to entering the rotary fluid flow device is lower, higher, or the same temperature as the working fluid entering the rotary fluid flow device. The compressor in one example comprises a housing and a housing cover, each in one example including bores with non-parallel intersecting axes, mounting a drive rotor assembly and idler rotor assembly, closing off the ends of the housing. In one example, the drive rotor and idler rotor have axes of rotation that are offset from collinear and intersecting. In one example, the drive rotor and idler rotor have radially outward surfaces that are frusto-spherical. In one example, the intersection of the drive rotor rotational axis, idler rotor rotational axis, radial center of the drive rotor, and radial center of idler rotor are the same point in space. The term drive or driver rotors used to define the rotor or rotors that are powered to rotate by an external force. The term idler rotors used to define the rotor or rotors that are provided rotational force through the driver rotors. Intermeshed rotors are mounted for rotation about the rotor axes and collaborate with an immediately adjacent frusto-spherical inner surface to define compression chamber(s) there between. Surfaces of the housing define a low pressure suction port and high pressure discharge port within the compressor opening to the intermeshed rotors and to the compression chamber and components for feeding a low pressure working fluid suction gas or vapor to the suction port for compression within the compression chamber. The idler rotor assembly and driver rotor assembly in one example each contain a bearing collar comprising hybrid bearing surfaces which are to be defined in more detail below. Also disclosed is an adjustment system to account for thermal expansion, and gear teeth, intermeshed via a gear arrangement. The collar of one example may be immediately adjacent to the compression chamber(s) with a port supplying a plurality of chamber(s). In one example, hybrid bearings may have a fluid outlet in an immediately adjacent gear cavity while the gears remain submerged in high pressure gas. The respective outer frusto-spherical rotor surfaces of these assemblies comprise multi-dimensional (non-planar) self-compensating hybrid bearings, with a fluid outlet to the immediately adjacent chambers, thereby minimizing or eliminating working fluid leakage losses and parasitic losses while maximizing bearing load capacity.

The respective rotor shafts in one example are stabilized via frusto-spherical hybrid bearings, cylindrical hybrid bearings, and thrust hybrid bearings, which may be used in combination with cylindrical roller bearings. In one example, the cylindrical and/or thrust hybrid bearings comprise a novel self-adjusting hydrostatic bearing configured to provide additional capacity to resist radial, thrust and bending moment loads from the hydrodynamic effect. The fluid pressure at the inner frusto-spherical ball may be adjusted to optimize the hybrid bearing performance. In one example, the idler rotor assembly comprises a sliding seal ring assembly, creating potential pressure ratios of 0-110× or more and efficiently providing 0-100% flow reduction adjustments without requiring the compressor to be shut off. The idler rotor assembly and driver rotor assembly of one example each comprise removable component(s) immediately adjacent to the chamber thereby minimizing or eliminating leakage that would otherwise occur at the inner radial frusto-spherical surfaces of longitudinally distant intermeshed multi-lobe rotors. The removable assembly of the idler rotor assembly comprises high volume atomizing injectors with coolant fluid fed through the idler rotor shaft, thereby generating an atomized droplet spray pattern directed into the compression chamber as the working fluid is compressed and as the compression chamber rotates relative to the immediately adjacent, stationary housing. The term stationary, defined as a frame of reference not moving, it is to be understood that, for example, the housing may be defined as stationary to define a fixed frame of reference, but the housing may be moved by force, for transportation etc. The idler rotor assembly comprises a load balanced rotary valve capable of adjusting the coolant fluid flow rate from near zero to 100% flow and modifying initiation and culmination of injection into the compression chamber. In one example, the driver rotor assembly comprises stationary recessed coolant fluid galleries with similar capabilities, absent of moving components. In one example, the fluid galleries are independently supplied with fluid. In one example, the novel high volume atomizing fluid injectors may be removable with only removal of the intake pipe, but no housing components.

The rotary fluid flow device may be used as a compressor when power is supplied to the drive shaft and/or used to supply work to the drive shaft when used as an expander. Since the operating range may be several times larger than current units that are capable of both compression and expansion, this technology may be ideally suited in Compressed Air Energy Storage (CAES) applications. Ejector technology may be used upstream of the rotary fluid flow device operating as a booster compressor to increase volumetric throughput flexibility. Convenient introduction of wellhead hydrocarbon liquids and/or water may be introduced into the novel multiphase compressor in this manner.

These and other objects, along with the advantages and features of the present invention herein disclosed, will become apparent through reference to the following description, accompanying drawings, and the claims. Furthermore, it is to be understood that the features of the various examples described herein are not mutually exclusive and may exist in various combinations and permutations.

BRIEF DESCRIPTION OF THE DRAWINGS

Like reference characters in the drawings generally refer to the same parts throughout the different views.

FIG. 50 is substantially conical (see FIG. 52).

FIG. 103C is an enlarged view of the region 103C of FIG. 103.

FIG. 103D is an enlarged view of the region 103D of FIG. 103.

FIG. 103E is an enlarged view of the region 103E of FIG. 103.

FIG. 104A is a top/exploded view of the example shown in FIG. 102.

FIG. 104B is a top view of the some of the components shown in FIG. 102.

FIG. 105 is a rear top view of the example shown in FIG. 102 taken perpendicular to the intake connection.

FIG. 106 is a top view of the example shown in FIG. 102.

FIG. 107 is a cutaway view of the example shown in FIG. 106 taken along section line 107-107.

FIG. 108A is a cutaway view of the example shown in FIG. 106 taken along section line 108A-108A with components configured to allow for high volumetric throughput.

FIG. 108B is a cutaway view of the example shown in FIG. 106 taken along section line 108B-108B with components configured to allow for reduced volumetric throughput and/or complete bypass.

FIG. 109 is a cutaway view of the example shown in FIG. 106 taken along section line 109-109.

FIG. 110 is a cutaway view of the example shown in FIG. 106 taken along section line 110-110.

Figure 106:
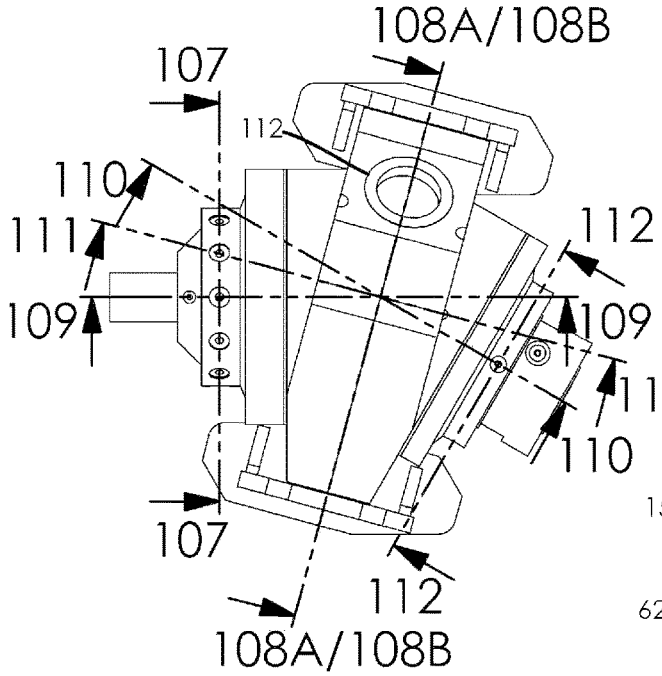
Figure 111:
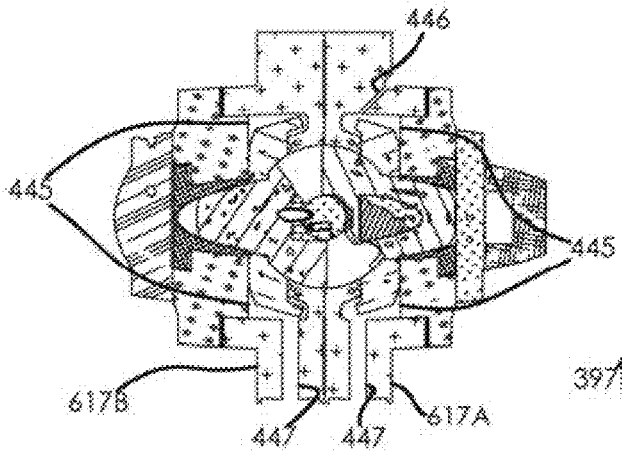

FIG. 111 is a cutaway view of the example shown in FIG. 106 taken along section line 111-111.

Figure 112:
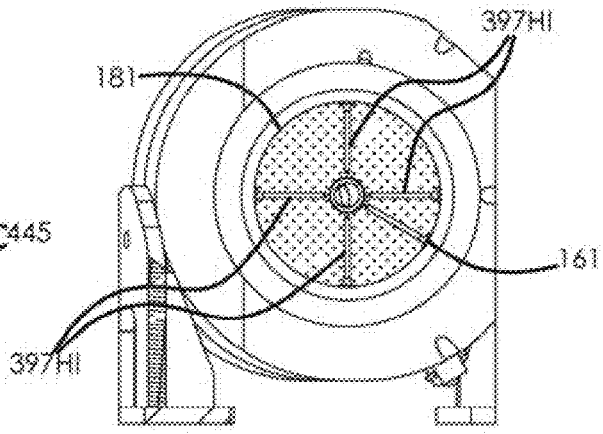

FIG. 112 is a cutaway view of the example shown in FIG. 106 taken along section line 112-112.

Figure 102:
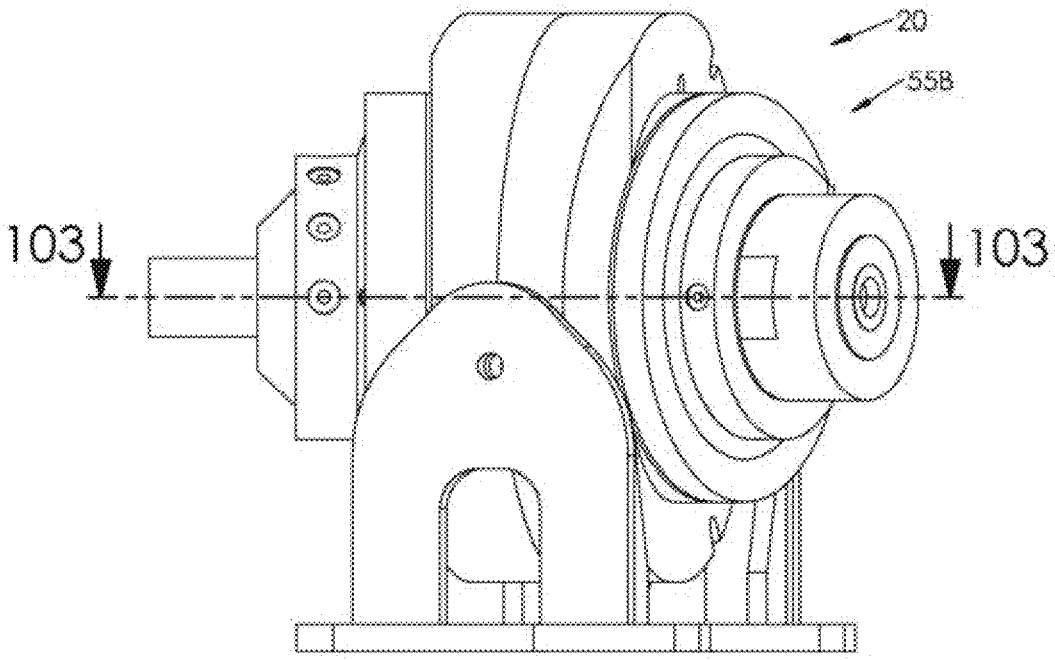
FIG. 102 is a side view of another example of the disclosed rotary fluid flow device.
Figure 113:
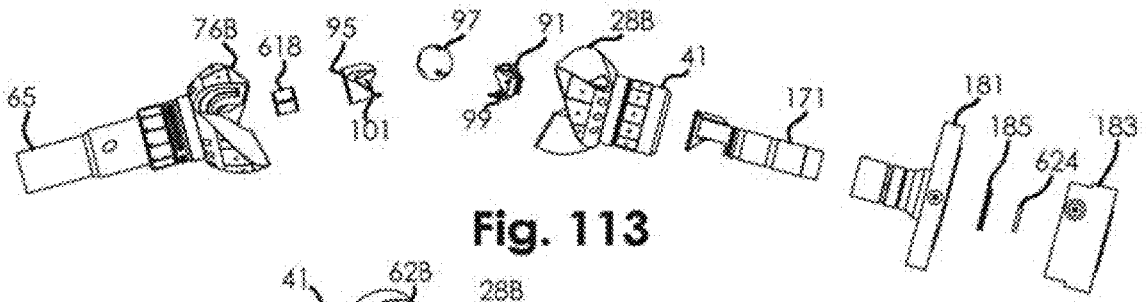

FIG. 113 is a top/exploded view of several components shown in FIG. 102.

Figure 114:
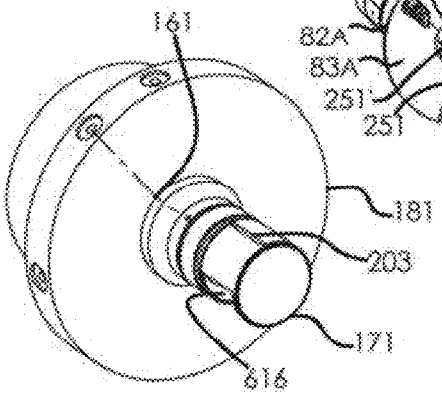

FIG. 114 is an isometric view of several components shown in FIG. 113.

Figure 115:
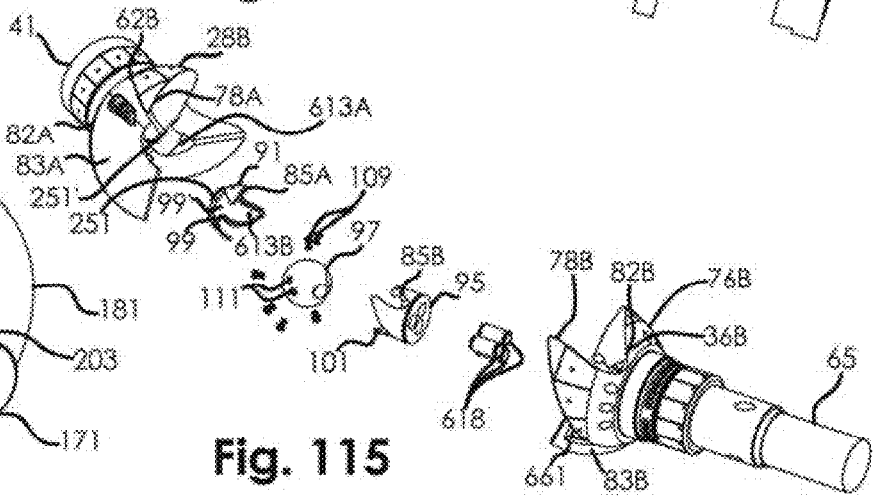

FIG. 115 is an isometric/exploded view of several components shown in FIG. 113.

Figure 116:
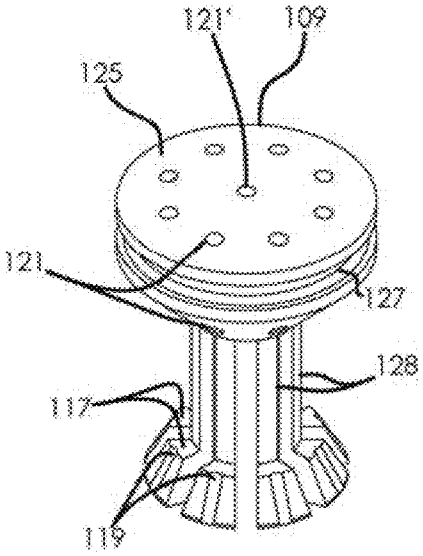

FIG. 116 is an isometric view of a fluid injector component shown in FIG. 115.

Figure 117:
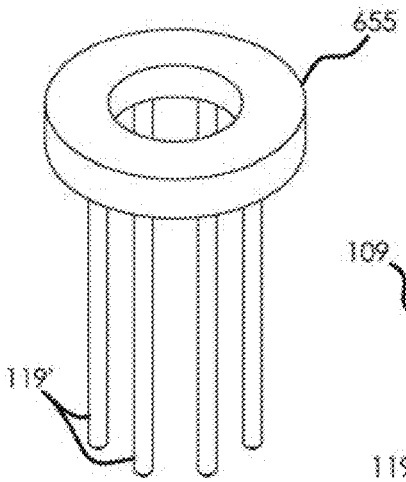

FIG. 117 is an isometric view of an example of a tool utilized in one step to remove the fluid injector component shown in FIG. 116.

Figure 118:
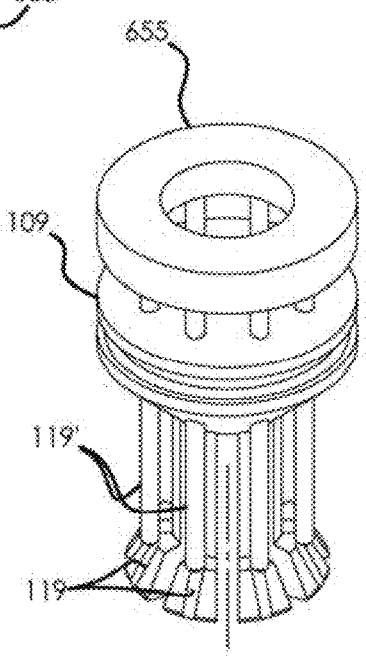

FIG. 118 is an isometric view of the tool in FIG. 117 inserted in the fluid injector component shown in FIG. 116

Figure 118A:
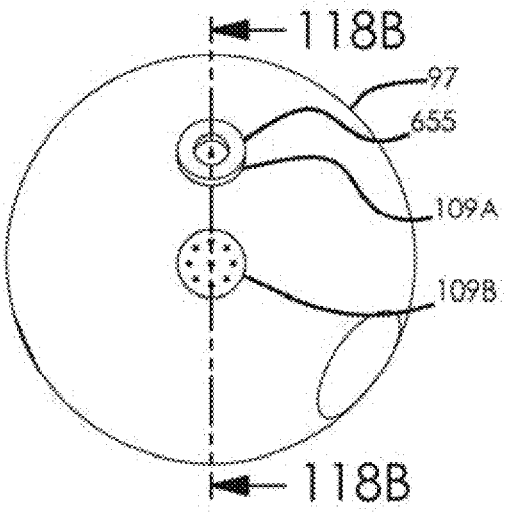

FIG. 118A is a side view of some of the components shown in FIG. 102 including the fluid injector removal tool shown in FIG. 117.

Figure 118B:
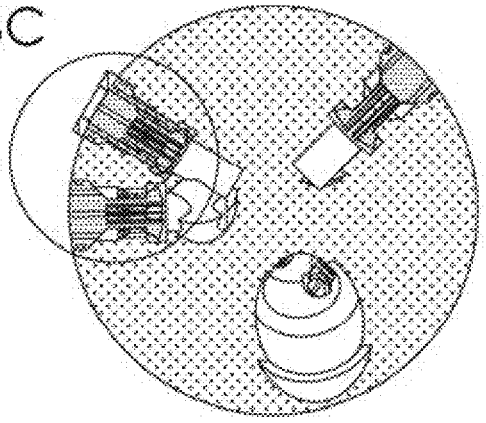

FIG. 118B is a cutaway view of the example shown in FIG. 118A.

Figure 118C:
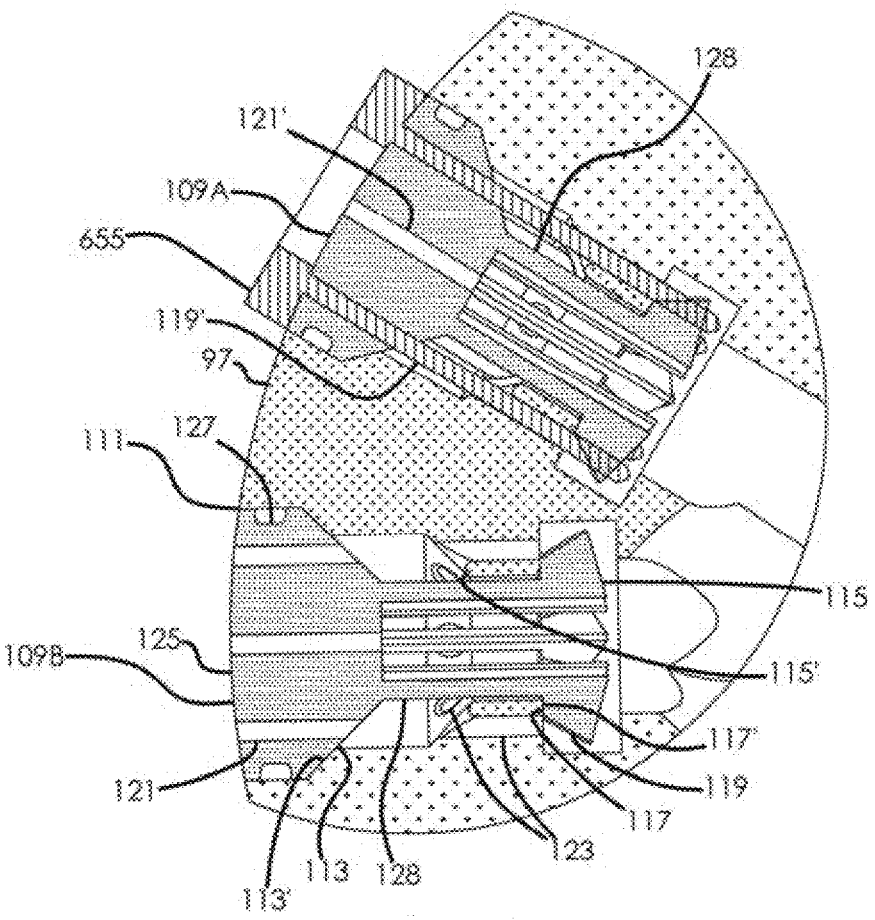

FIG. 118C is an enlarged view of the region 118C of FIG. 118B.

Figure 119:
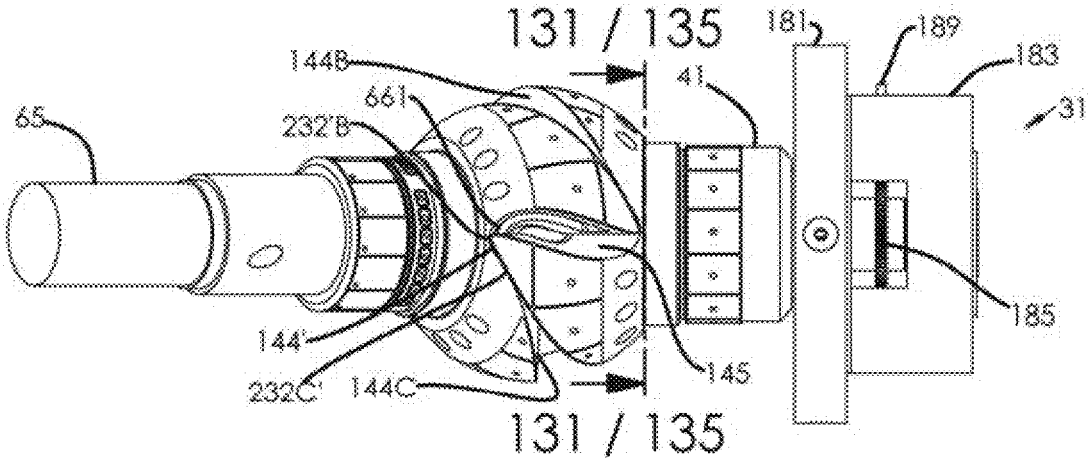

FIG. 119 is a side view of the example shown in FIG. 102 with several components removed to show internal components configured to direct the flow of the working fluid with the rotors in a first rotational position.

Figure 120:
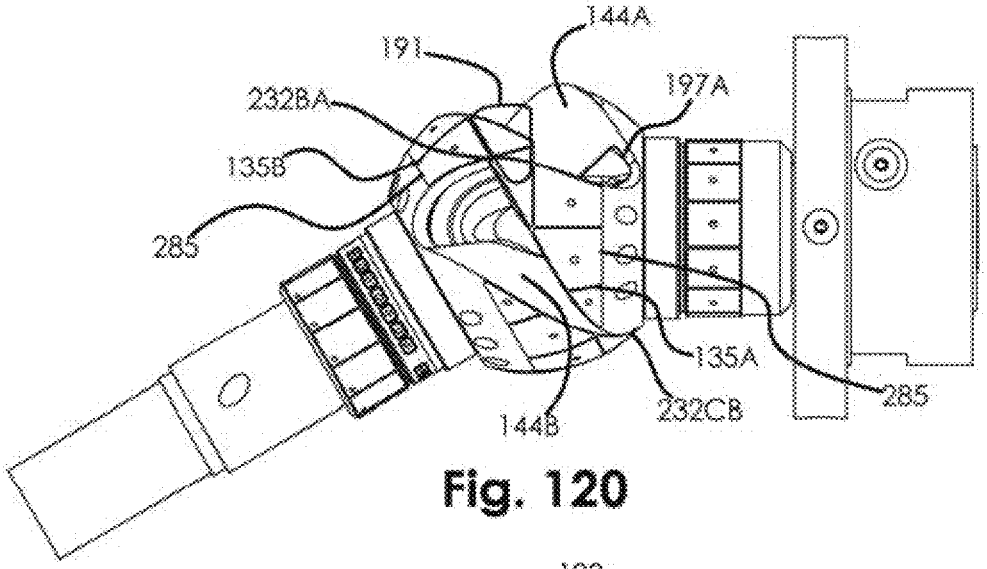

FIG. 120 is a top view of the example shown in FIG. 119.

Figure 121:
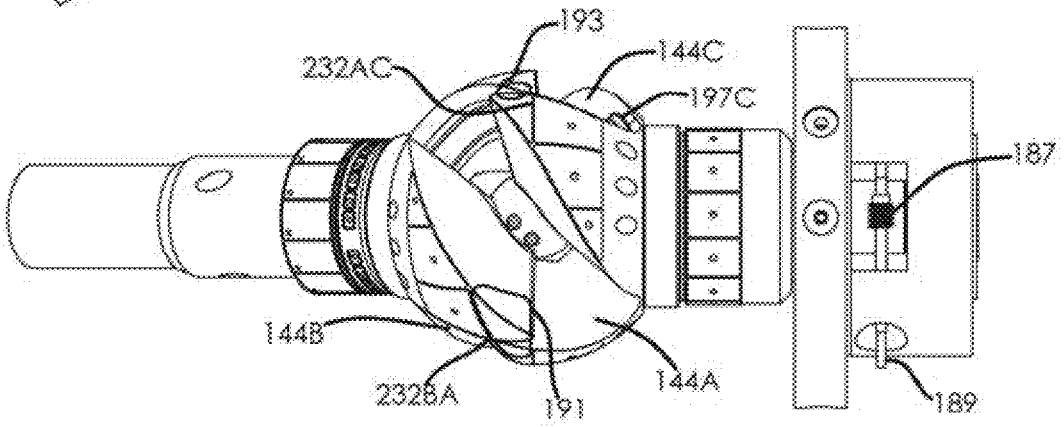

FIG. 121 is a side view taken from the opposing side shown in FIG. 119.

Figure 122:
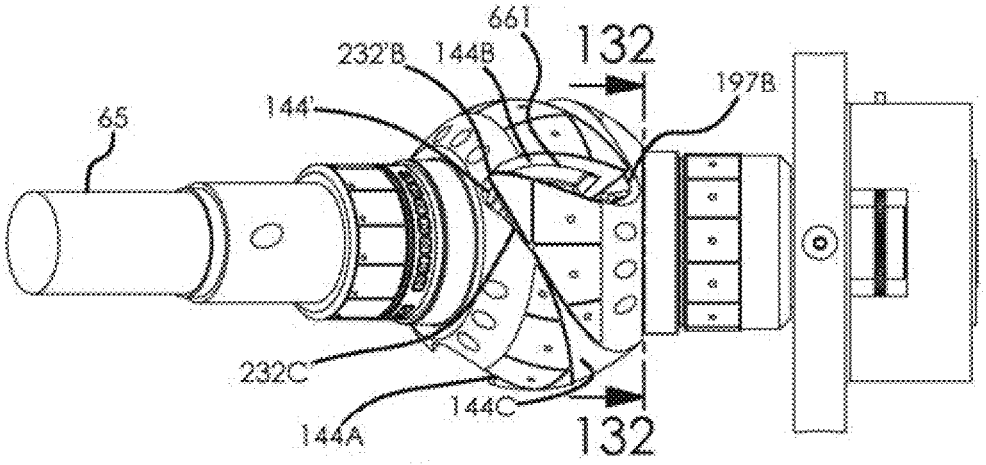

FIG. 122 is a side view of the example shown in FIG. 102 with several components removed to show internal components configured to direct the flow of the working fluid with the rotors in a second rotational position.

Figure 123:
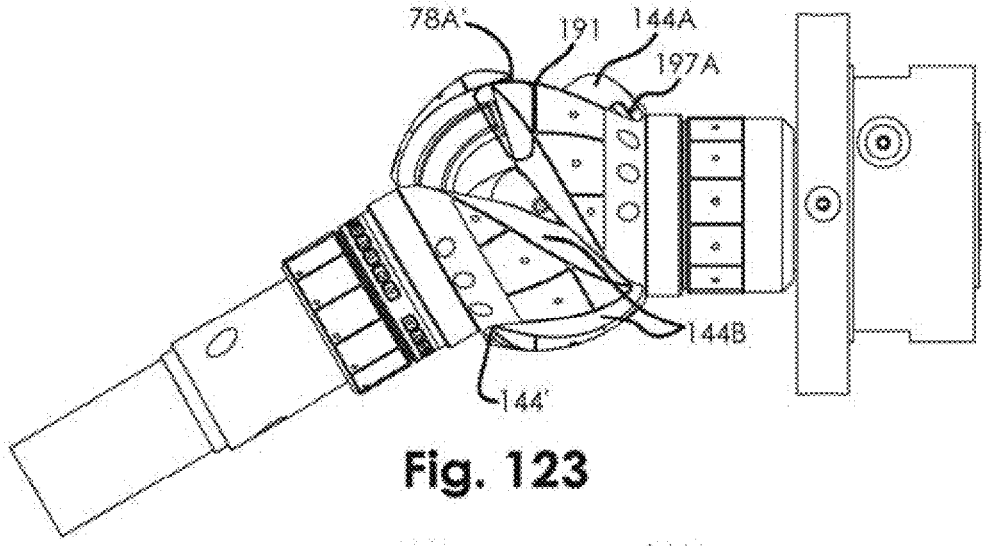

FIG. 123 is a top view of the example shown in FIG. 122.

Figure 124:
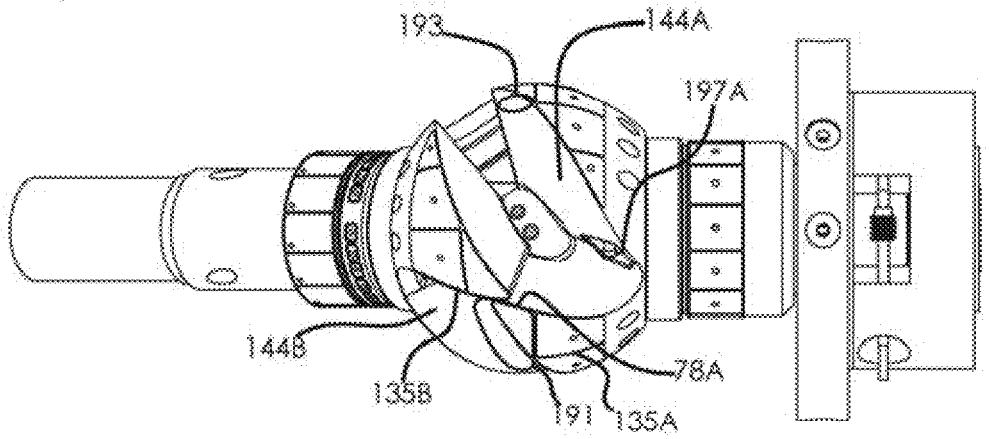

FIG. 124 is a side view taken from the opposing side shown in FIG. 122.

Figure 125:
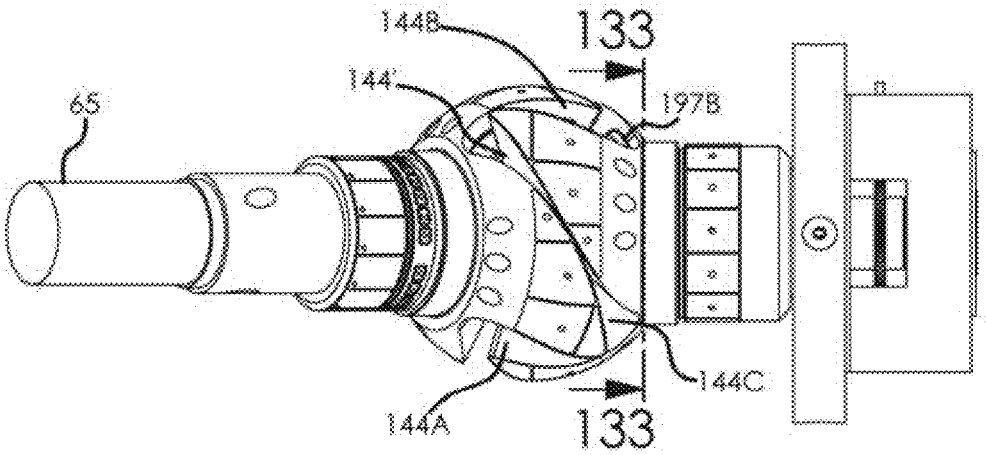

FIG. 125 is a side view of the example shown in FIG. 102 with several components removed to show internal components configured to direct the flow of the working fluid with the rotors in a third rotational position.

Figure 126:
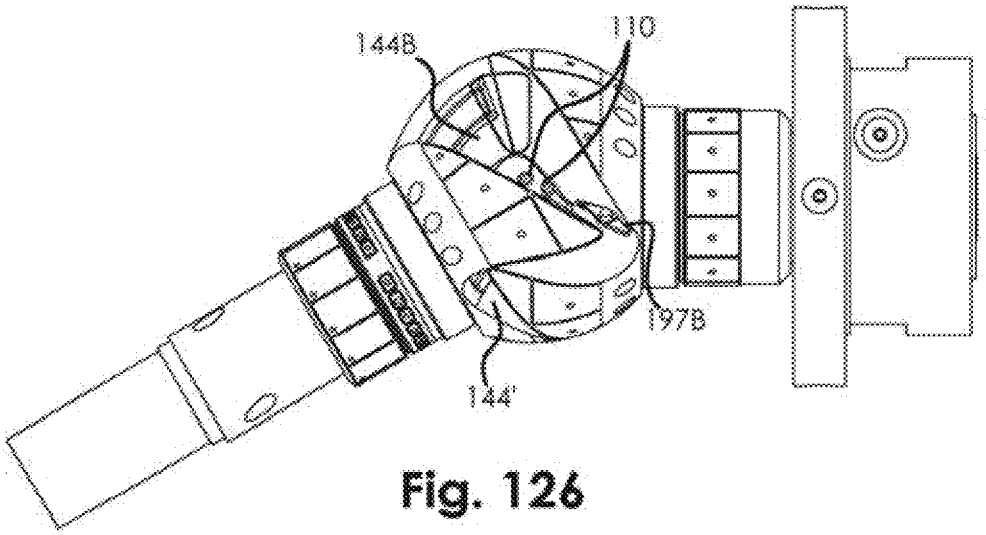

FIG. 126 is a top view of the example shown in FIG. 125.

Figure 127:
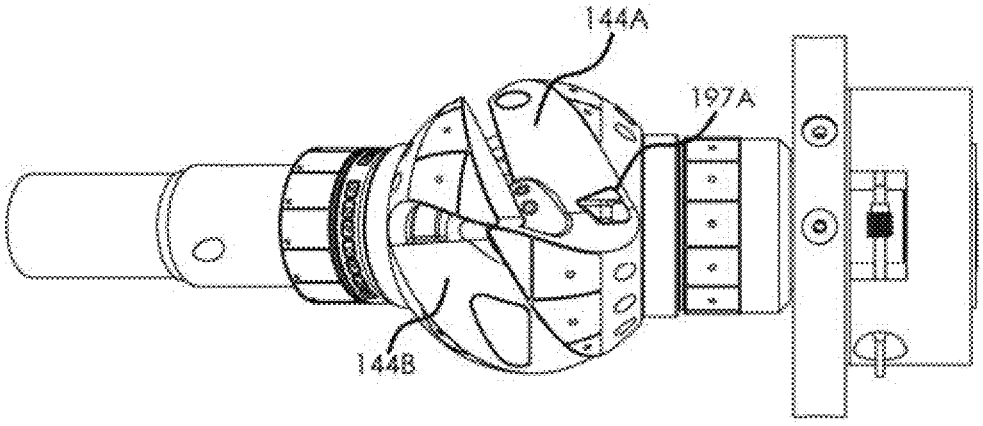

FIG. 127 is a side view taken from the opposing side shown in FIG. 125.

Figure 128:
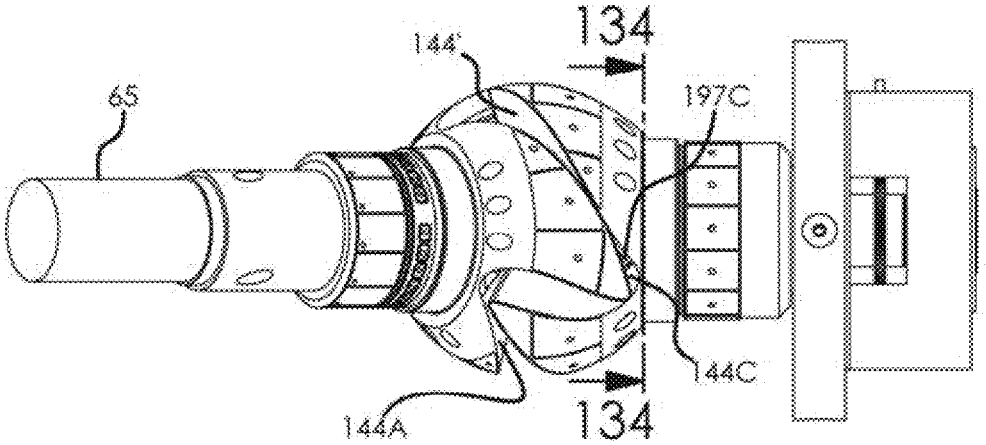

FIG. 128 is a side view of the example shown in FIG. 102 with several components removed to show internal components configured to direct the flow of the working fluid with the rotors in a fourth rotational position.

Figure 129:
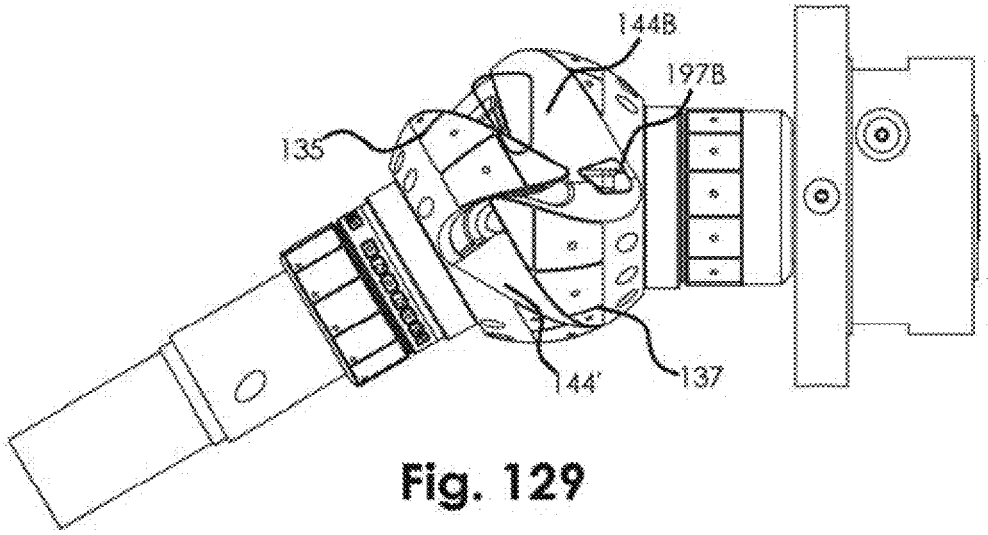

FIG. 129 is a top view of the example shown in FIG. 128.

Figure 130:
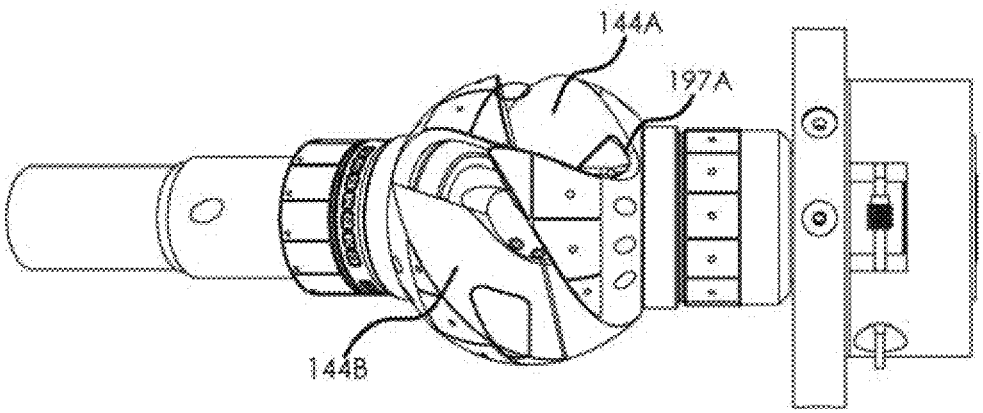

FIG. 130 is a side view taken from the opposing side shown in FIG. 128.

Figure 131:
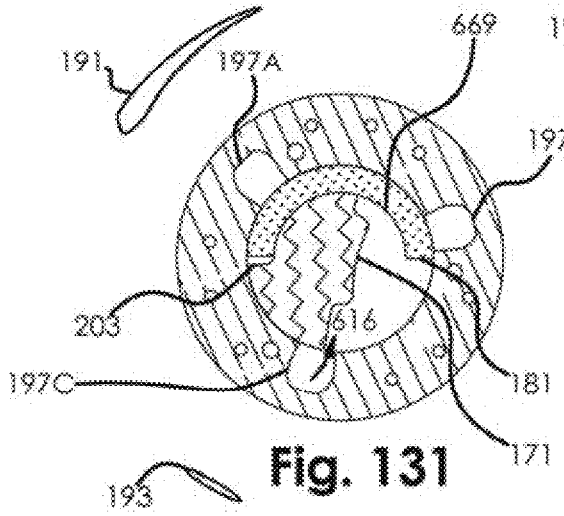

FIG. 131 is a section view of the example shown in FIG. 119 taken along section line 131-131.

Figure 132:
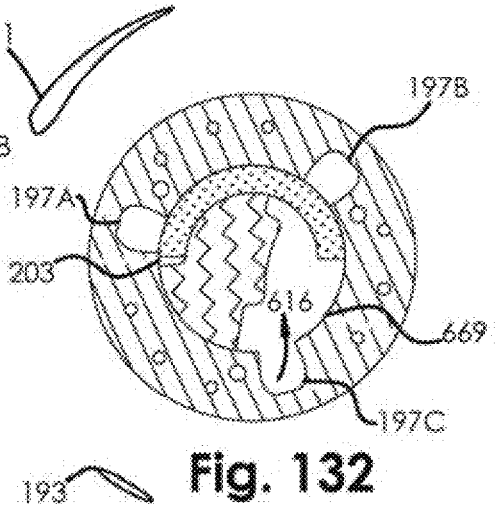

FIG. 132 is a section view of the example shown in FIG. 122 taken along section line 132-132.

Figure 133:
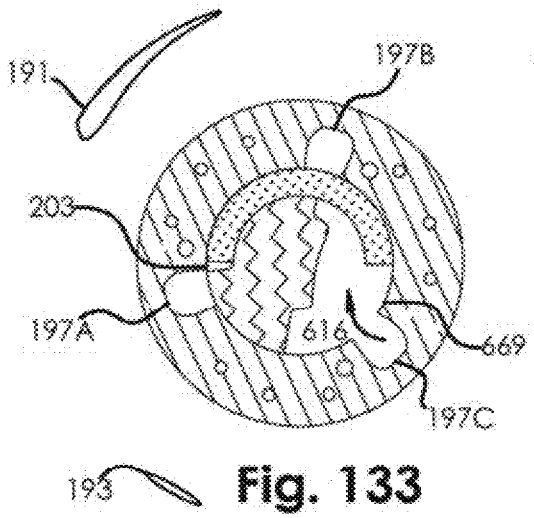

FIG. 133 is a section view of the example shown in FIG. 125 taken along section line 131-131.

Figure 134:
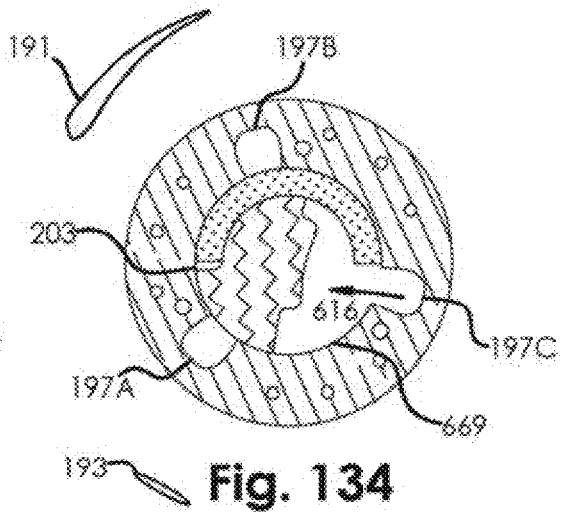

FIG. 134 is a section view of the example shown in FIG. 128 taken along section line 128-128.

Figure 135:
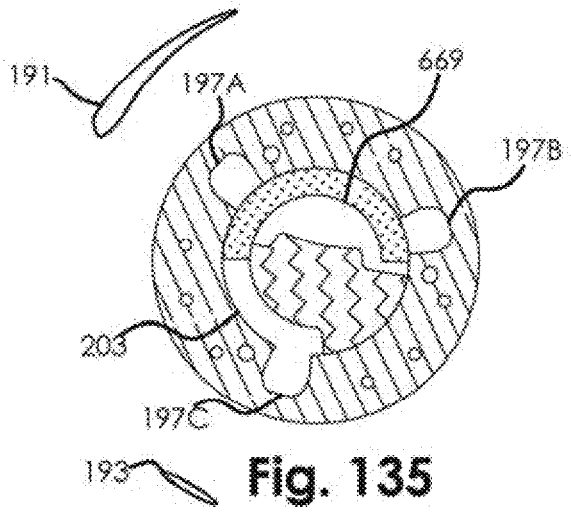

FIG. 135 is a section view of the example shown in FIG. 119 taken along section line 135-135.

Figure 136:
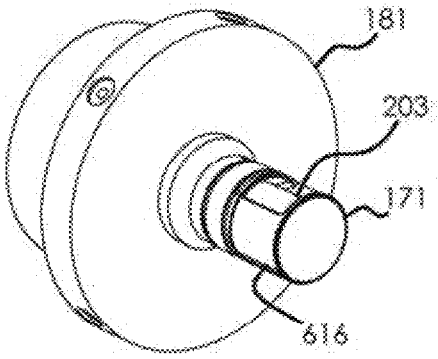

FIG. 136 is an isometric view of the components shown in FIG. 114 configured to direct the flow of the working fluid.

Figure 137:
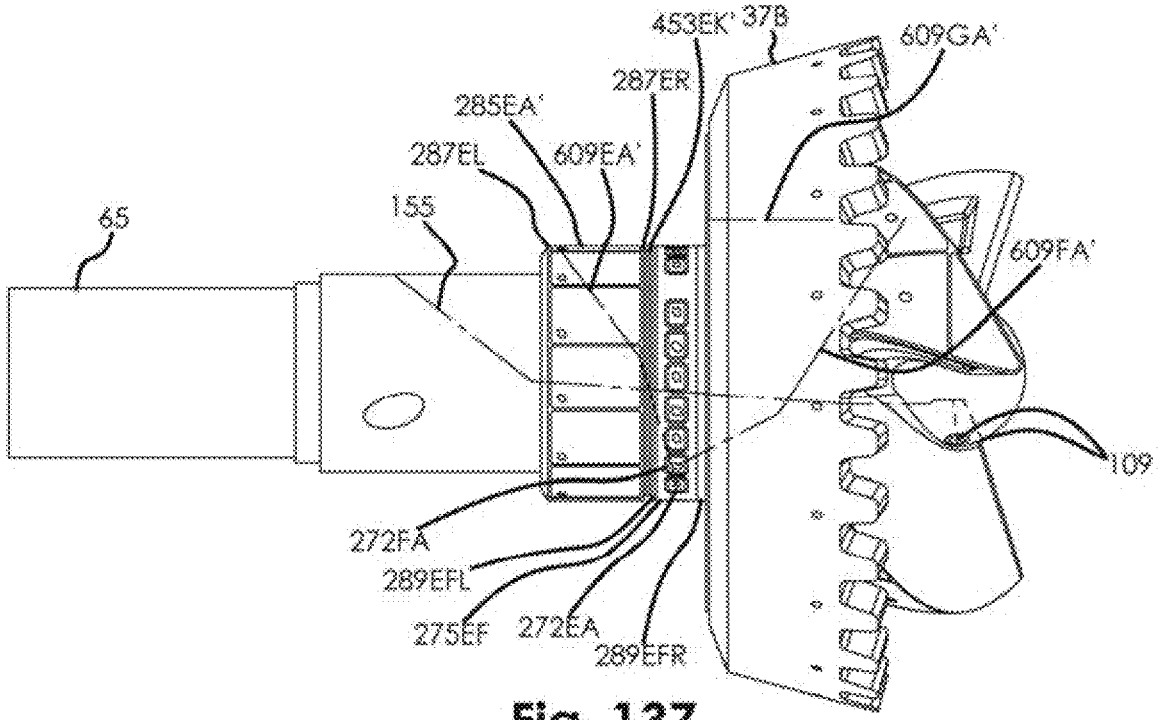

FIG. 137 is a side view of the example shown in FIG. 102 with several components removed to show the flow of the coolant fluid and hybrid bearing examples "E", "F" and "G".

Figure 138:
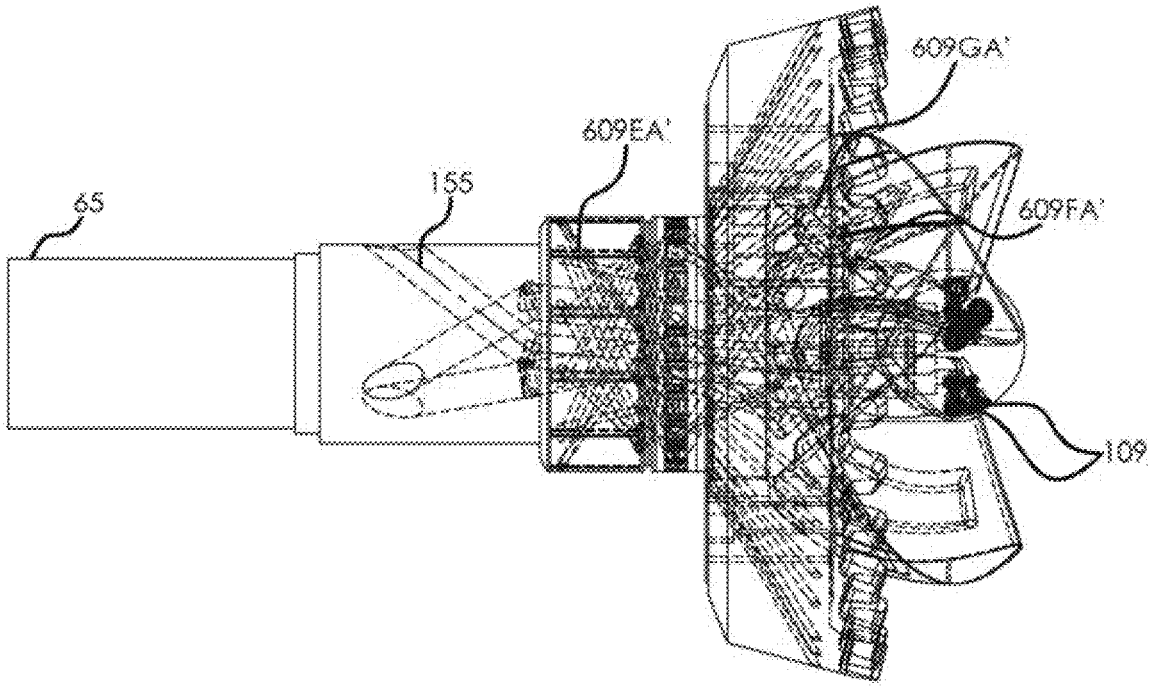

FIG. 138 is a side/hidden line view of the components shown in FIG. 137.

Figure 139:
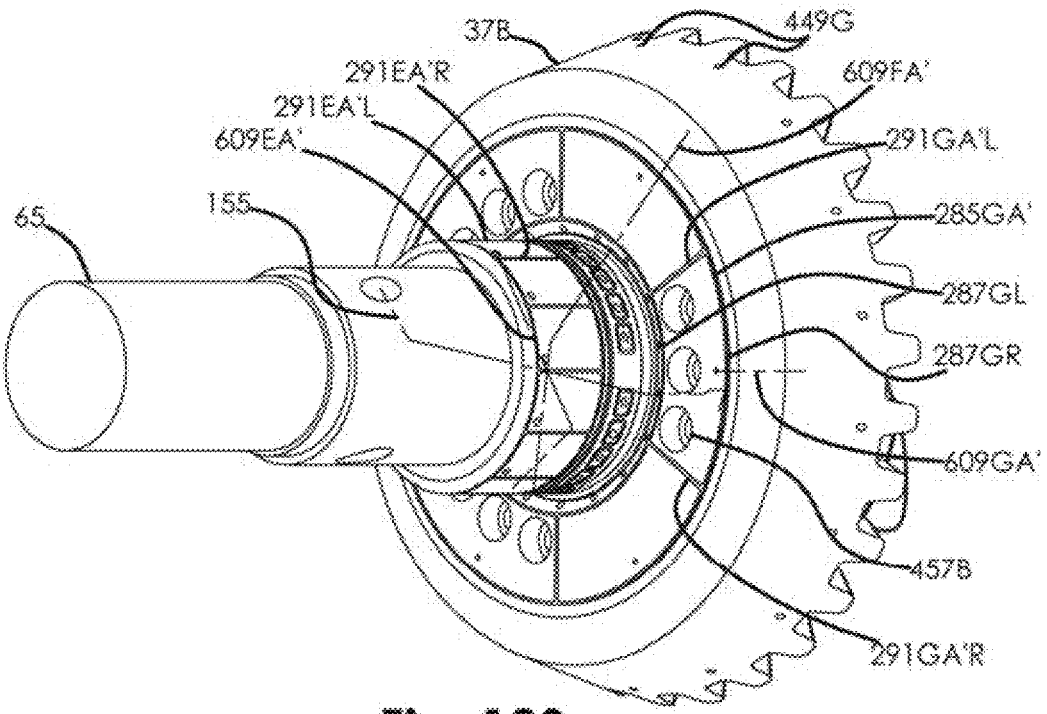

FIG. 139 is an isometric view of the example shown in FIG. 137 showing the rear of the components.

Figure 140:
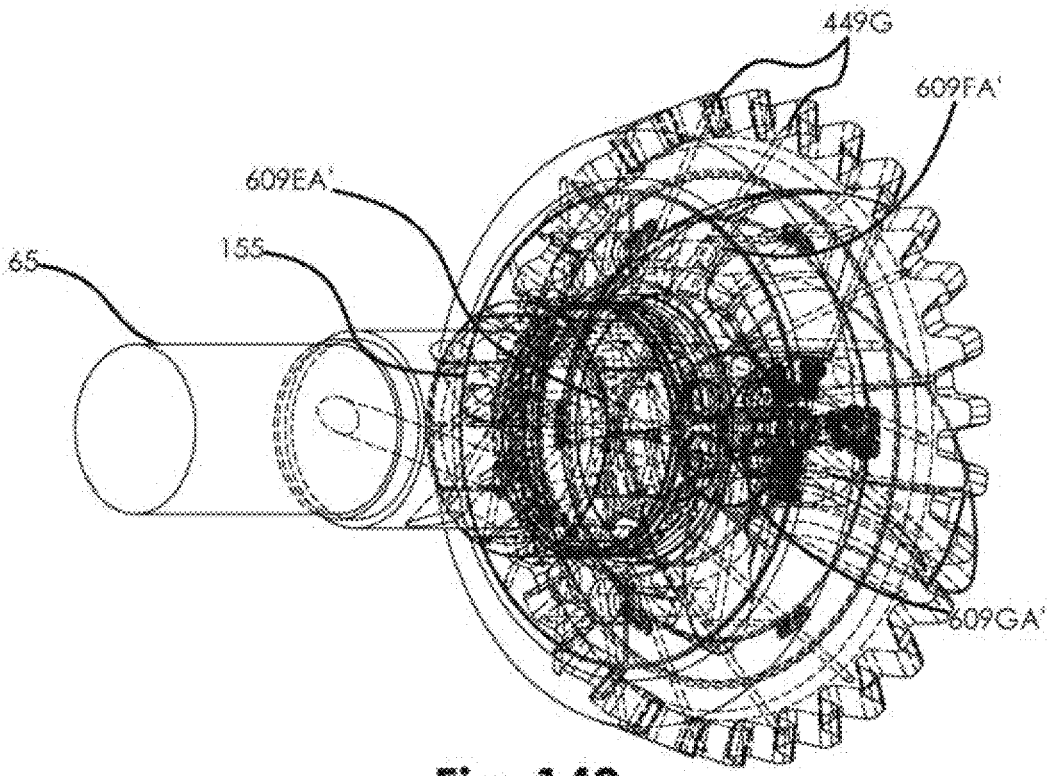

FIG. 140 is an isometric/hidden line view of the components shown in FIG. 139.

Figure 141:
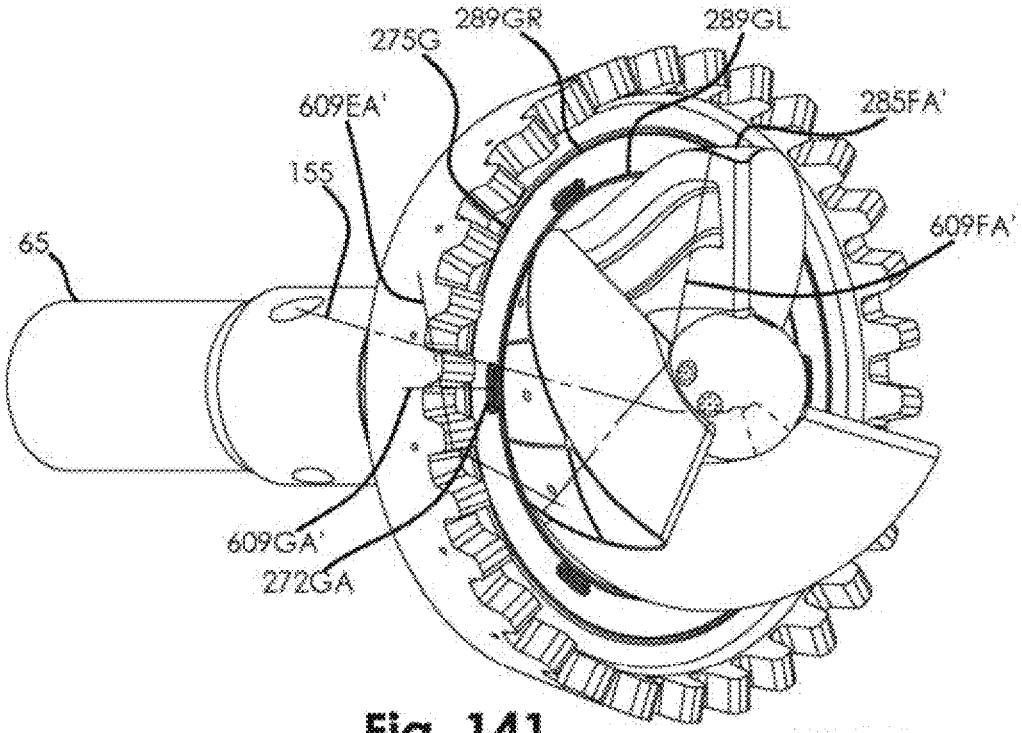

FIG. 141 is an isometric view of the example shown in FIG. 137 showing the front of the components.

Figure 142:
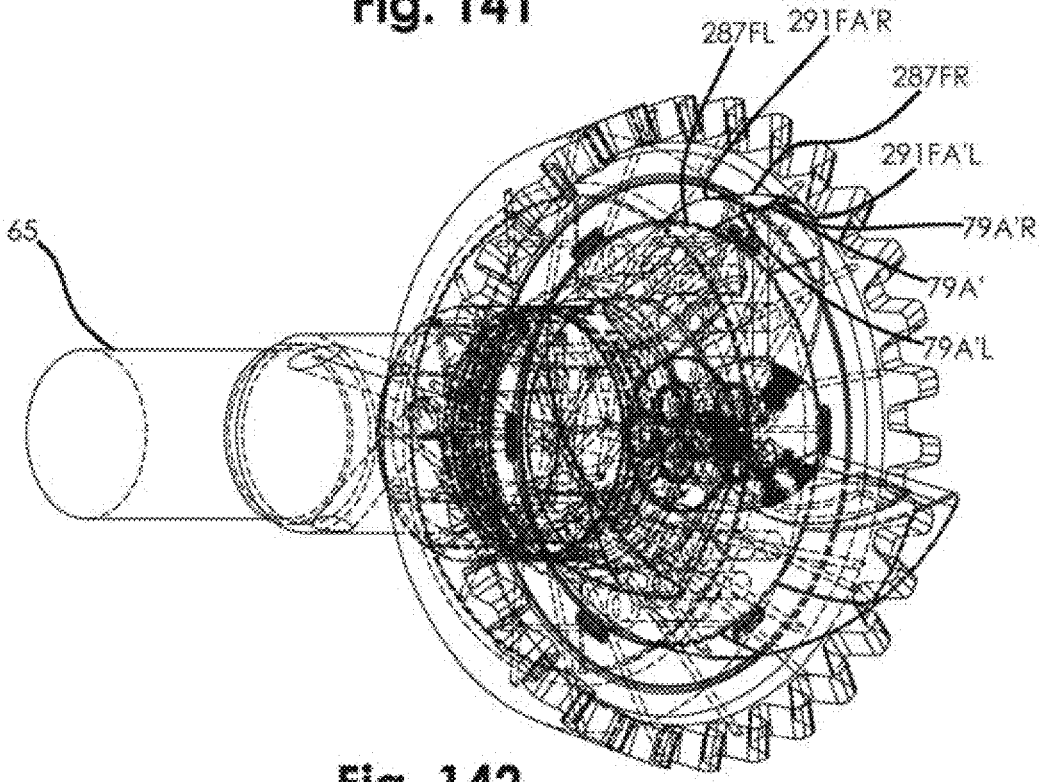

FIG. 142 is an isometric/hidden line view of the components shown in FIG. 141.

Figure 143:
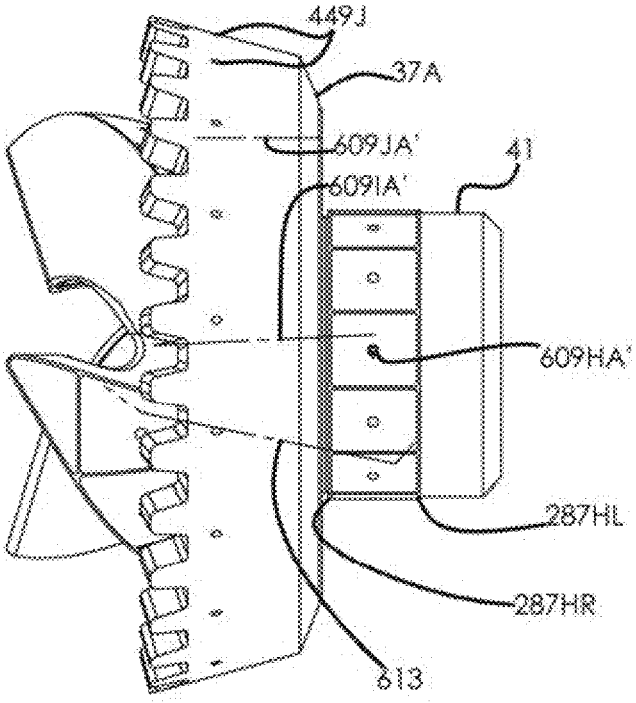

FIG. 143 a side view of the example shown in FIG. 102 with several components removed to show the flow of the coolant fluid and hybrid bearing examples "H", "I" and "J".

Figure 144:
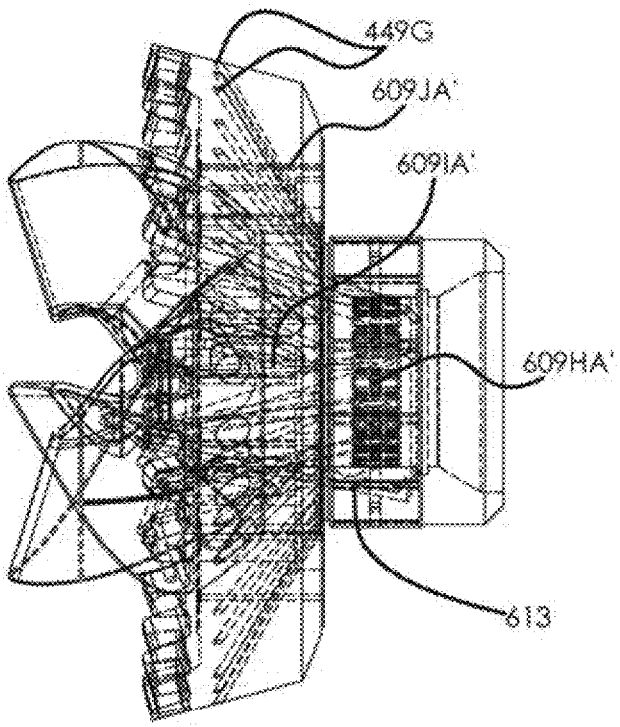

FIG. 144 is a side/hidden line view of the components shown in FIG. 143.

Figure 145:
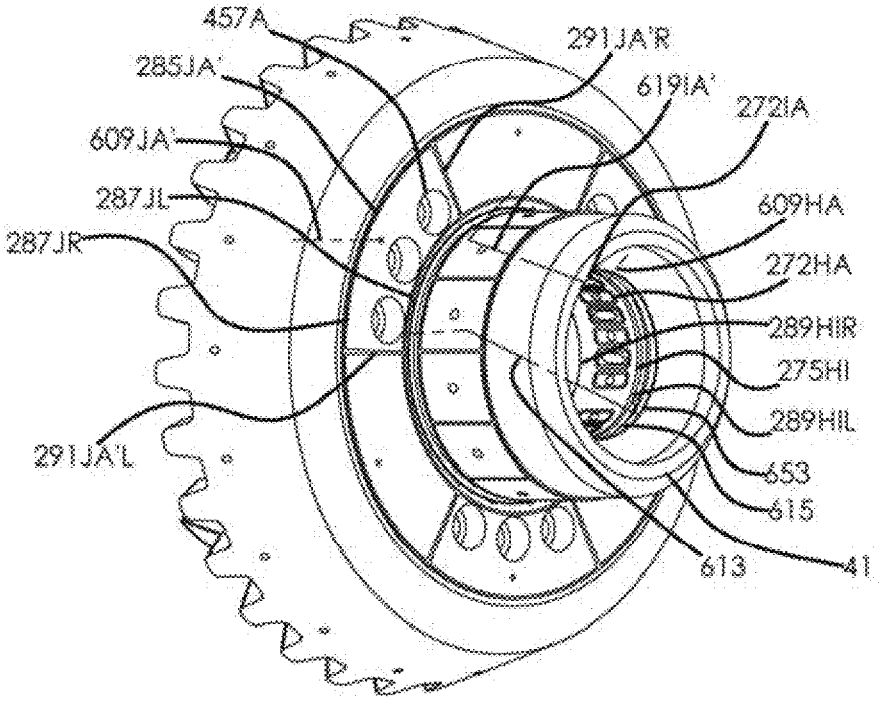

FIG. 145 is an isometric view of the example shown in FIG. 143 showing the rear of the components.

Figure 146:
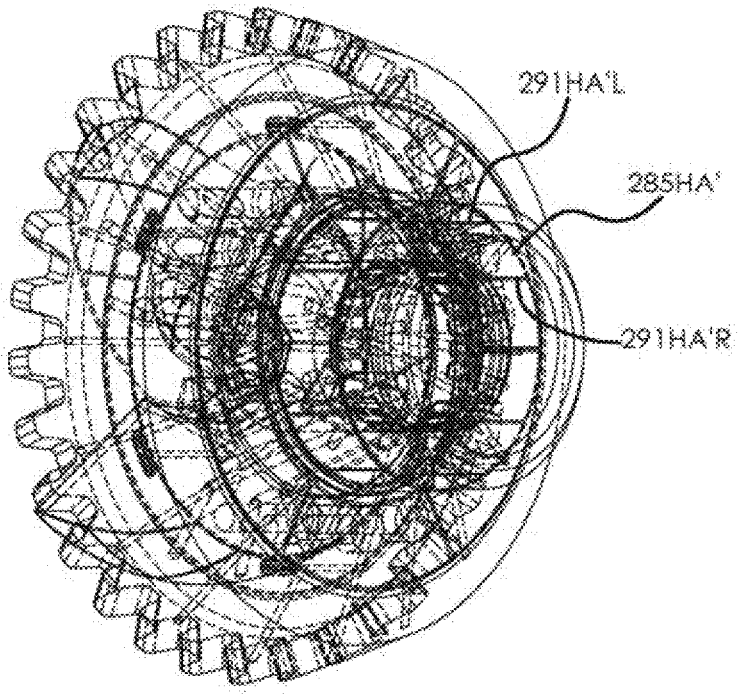

FIG. 146 is an isometric/hidden line view of the components shown in FIG. 145.

Figure 147:
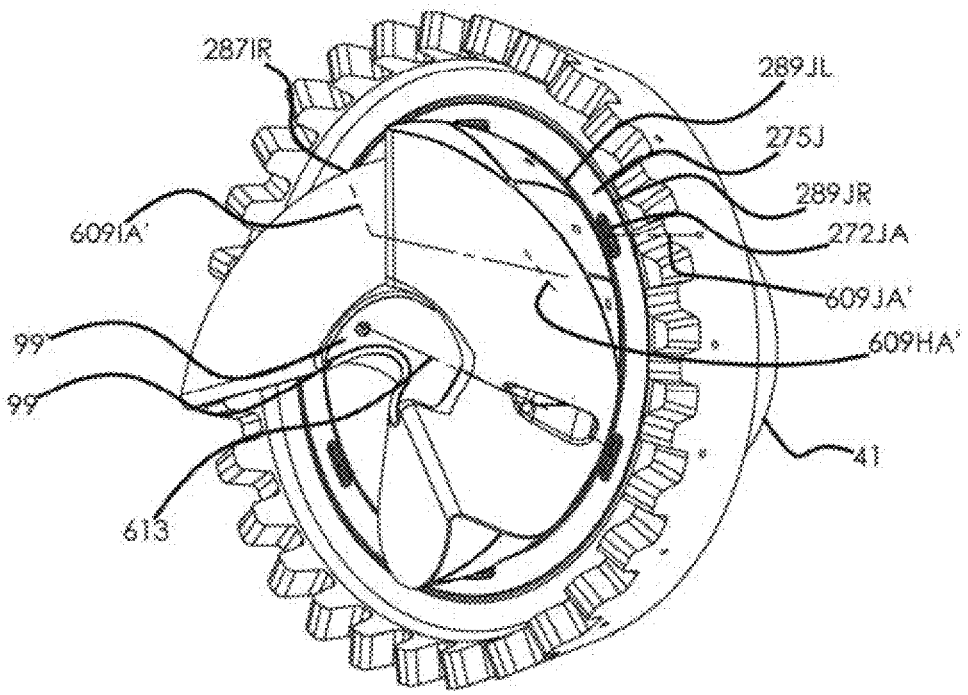

FIG. 147 is an isometric view of the example shown in FIG. 143 showing the front of the components.

Figure 148:
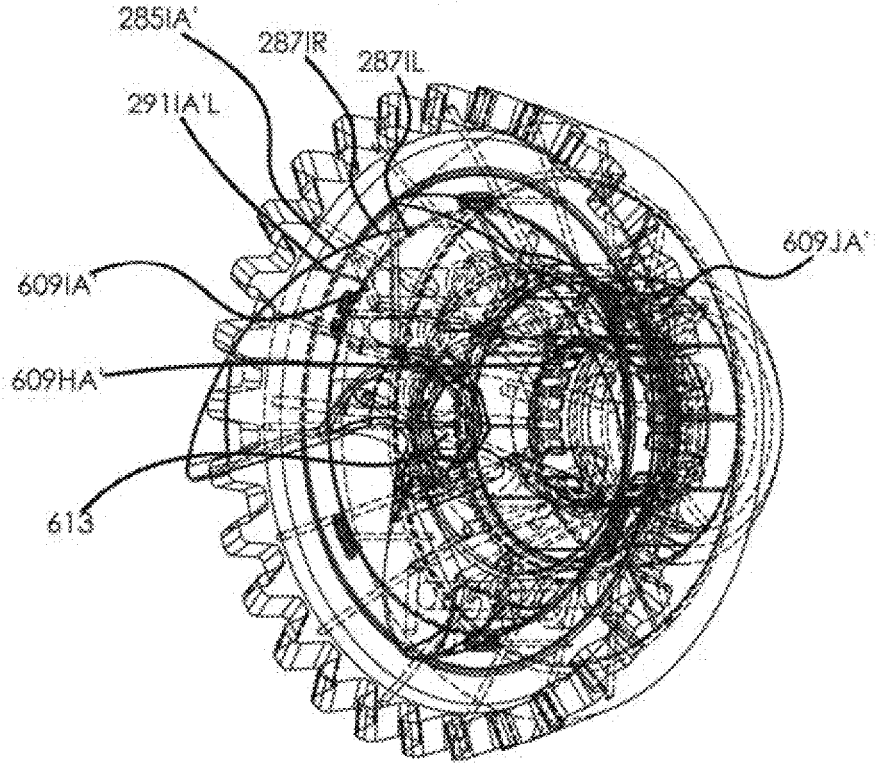

FIG. 148 is an isometric/hidden line view of the components shown in FIG. 147.

Figure 149:
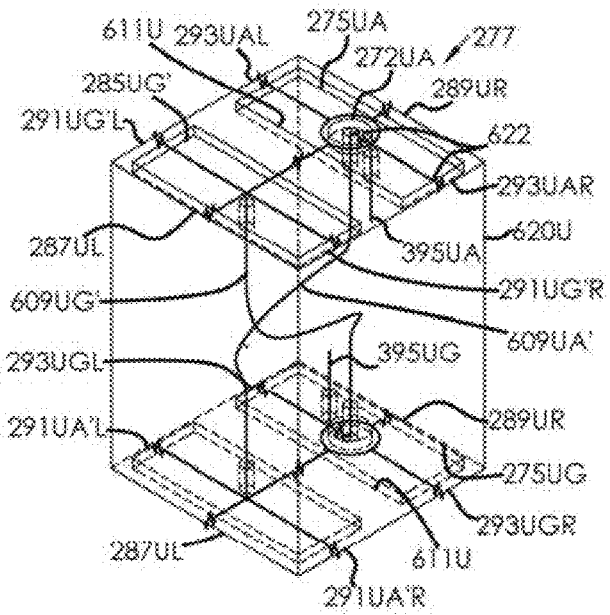

FIG. 149 is an isometric view of another example of a novel disclosed bearing without opposing bearing pocket(s).

Figure 150:
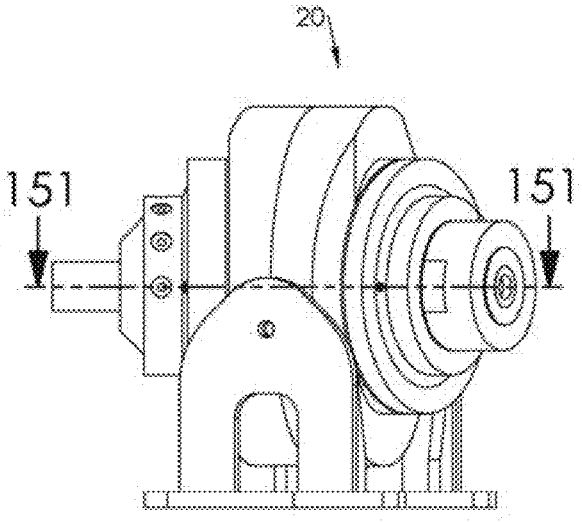

FIG. 150 is a side view of another example of the disclosed rotary fluid flow device.

Figure 151:
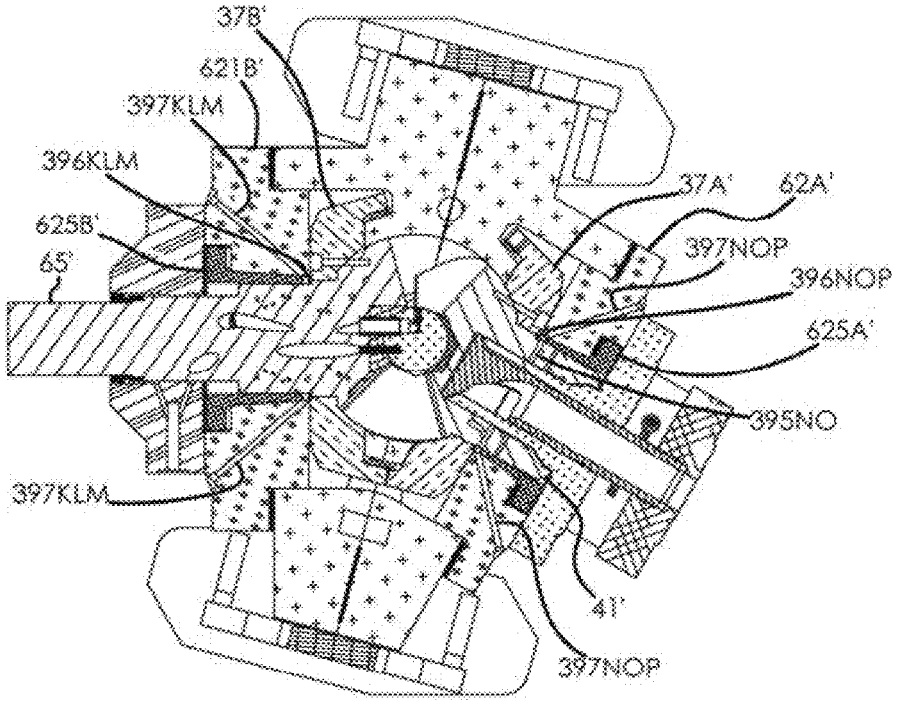

FIG. 151 is a cutaway view of the example shown in FIG. 150 taken along section line 151-151.

Figure 152:
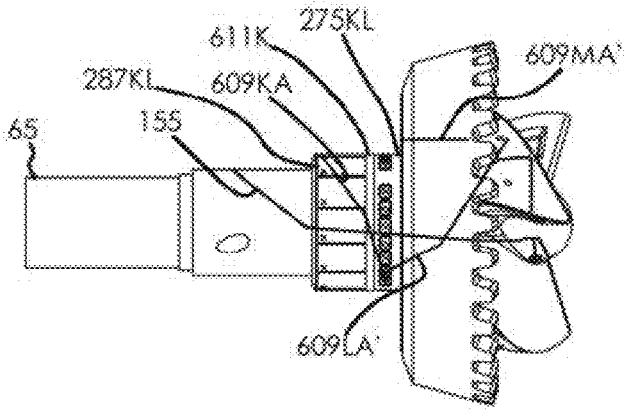

FIG. 152 is a side view of the example shown in FIG. 150 with several components removed to show the flow of the coolant fluid and hybrid bearing examples.

Figure 153:
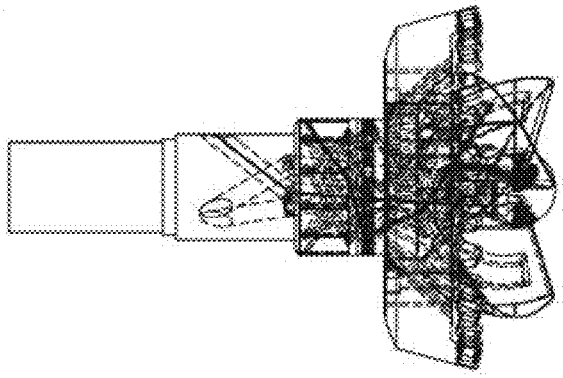

FIG. 153 is a side/hidden line view of the components shown in FIG. 152.

Figure 154:
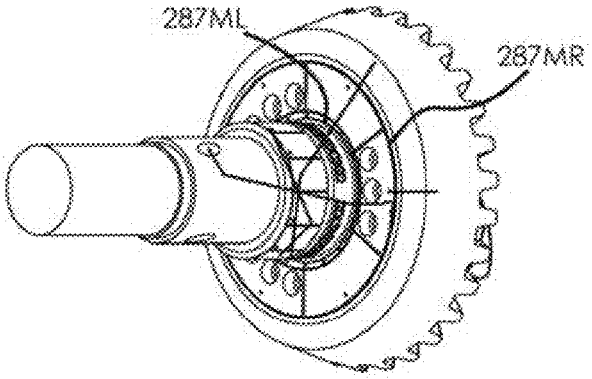

FIG. 154 is an isometric view of the example shown in FIG. 152 showing the rear of the components.

Figure 155:
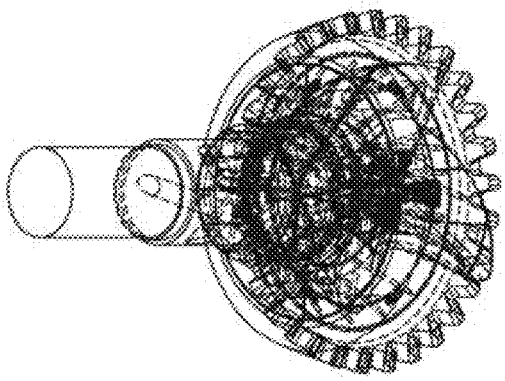

FIG. 155 is an isometric/hidden line view of the components shown in FIG. 154.

Figure 156:
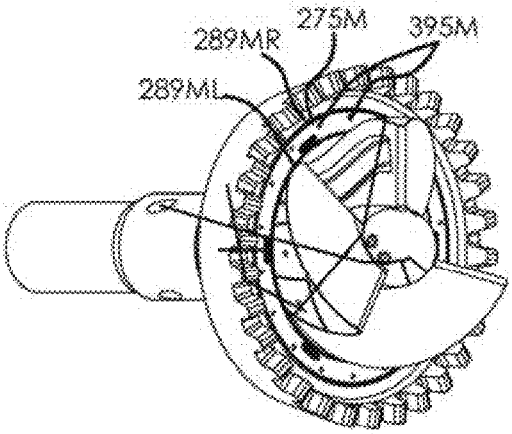

FIG. 156 is an isometric view of the example shown in FIG. 152 showing the front of the components.

Figure 157:
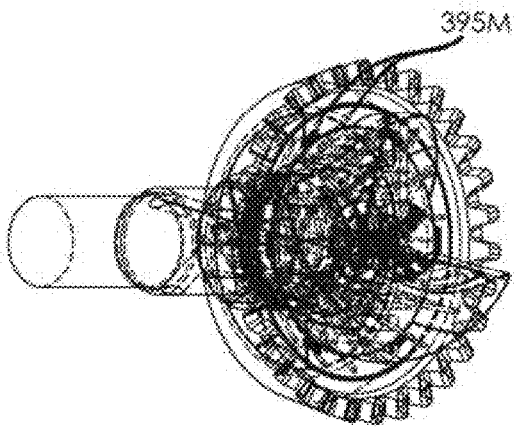

FIG. 157 is an isometric/hidden line view of the components shown in FIG. 156.

Figure 158:
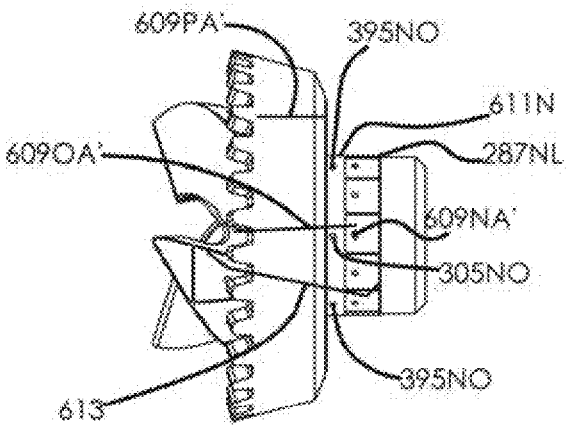

FIG. 158 a side view of the example shown in FIG. 150 with several components removed to show the flow of the coolant fluid and hybrid bearing examples.

Figure 159:
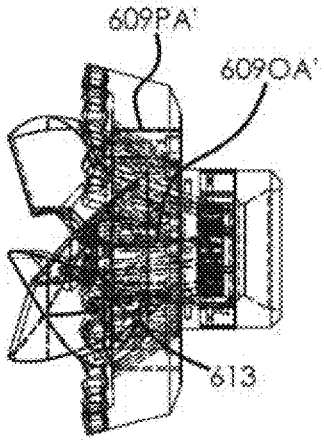

FIG. 159 is a side/hidden line view of the components shown in FIG. 158.

Figure 160:
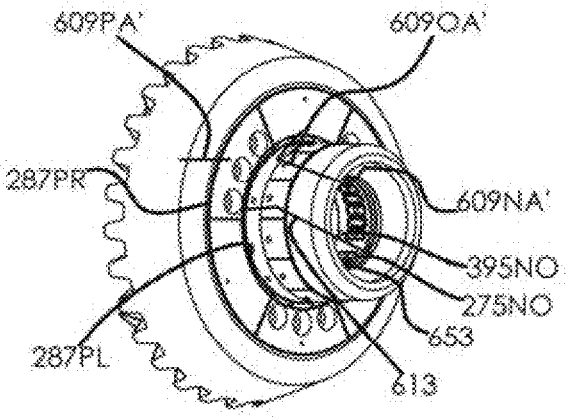

FIG. 160 is an isometric view of the example shown in FIG. 158 showing the rear of the components.

Figure 161:
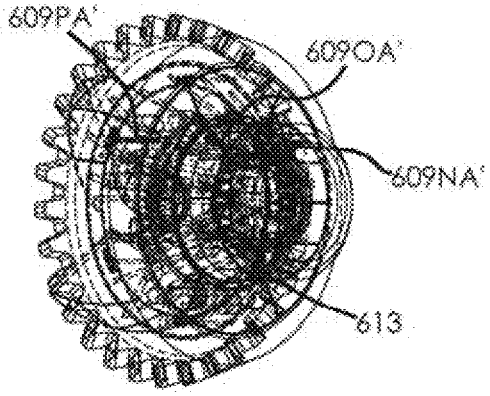

FIG. 161 is an isometric/hidden line view of the components shown in FIG. 160.

Figure 162:
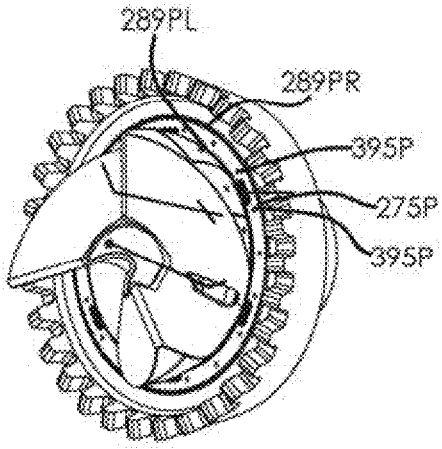

FIG. 162 is an isometric view of the example shown in FIG. 158 showing the front of the components.

Figure 163:
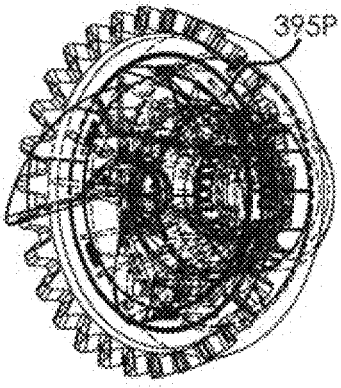

FIG. 163 is an isometric/hidden line view of the components shown in FIG. 162.

DETAILED DESCRIPTION OF THE DISCLOSURE

This disclosure includes several examples of rotary positive displacement devices having a high power to mass ratio, wide operating range and low production cost. This device in one example forms an exemplary compressor.

In some instances, to aid in description, and reduce the length of the text, specific examples of a component include an alphabetic suffix denoting the specific example of a more generic example. For instance, the rotor lobes are generally labeled 78, where specific lobes 78 of the idler rotor 28 are labeled 78A, specific lobes of the driver rotor 76 are labeled 78B. In some examples, a specific label is shown in the drawing, and the generic label is used in the specification indicative of the specific example and equivalents.

To provide some background, there are many types of compressor design known. Such compressor designs include positive displacement, dynamic and hermetically sealed, open or semi-hermetic. Compressors of the positive displacement type are typically reciprocating or rotary screw, but other examples may include ionic liquid piston, rotary vane, rolling piston, scroll or diaphragm compressors.

Several rotary fluid flow devices/compressors 20 disclosed herein are of the rotary lobe positive displacement design. These rotary lobe positive displacement devices are formed by two spinning rotors. In one example the rotational axes of the rotors are offset from linear and may intersect. Each spinning rotor having a face comprising lobes and valleys. These lobes and valleys of one rotor intermesh the valleys and lobes of the opposing rotor and cooperate with each other and with adjacent inner frusto-spherical surfaces of a housing 55A/55B (FIG. 1/FIG. 102) to define chambers that change volume with rotation of the rotor pair. In one example, the intersect of the rotational axes of the rotors intersects at the center 77 of the frusto-spherical surfaces 114 of the housing 55A.

Figure 1:
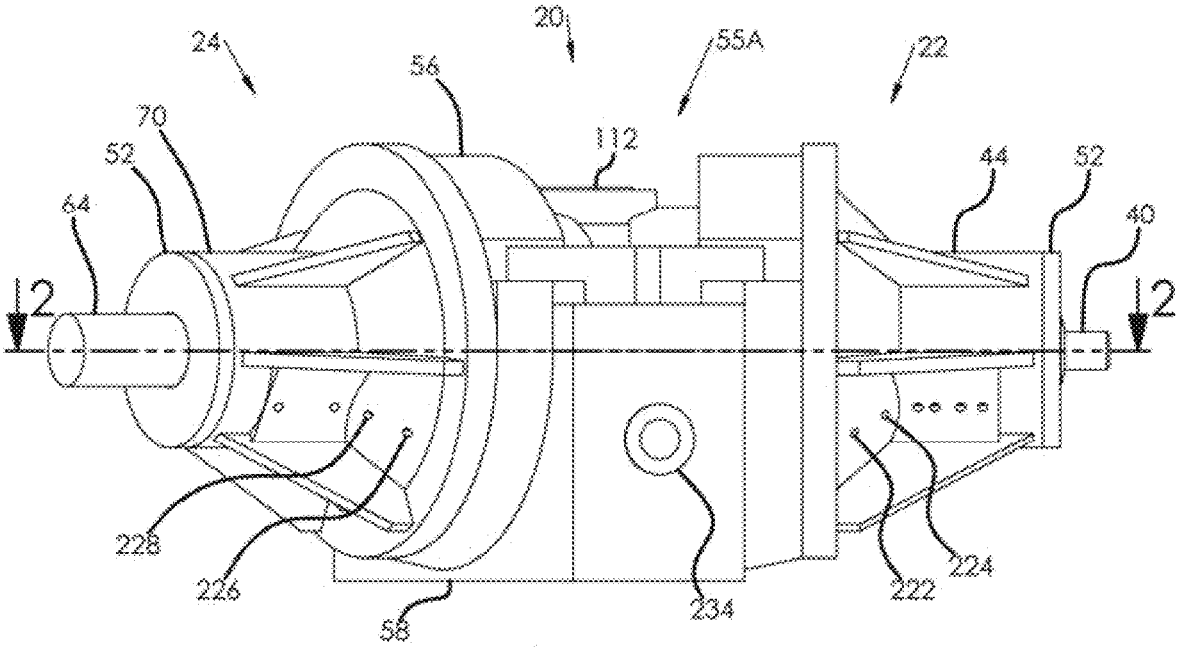
FIG. 1 is a side view of one example of the disclosed fluid flow device.
Figure 2:
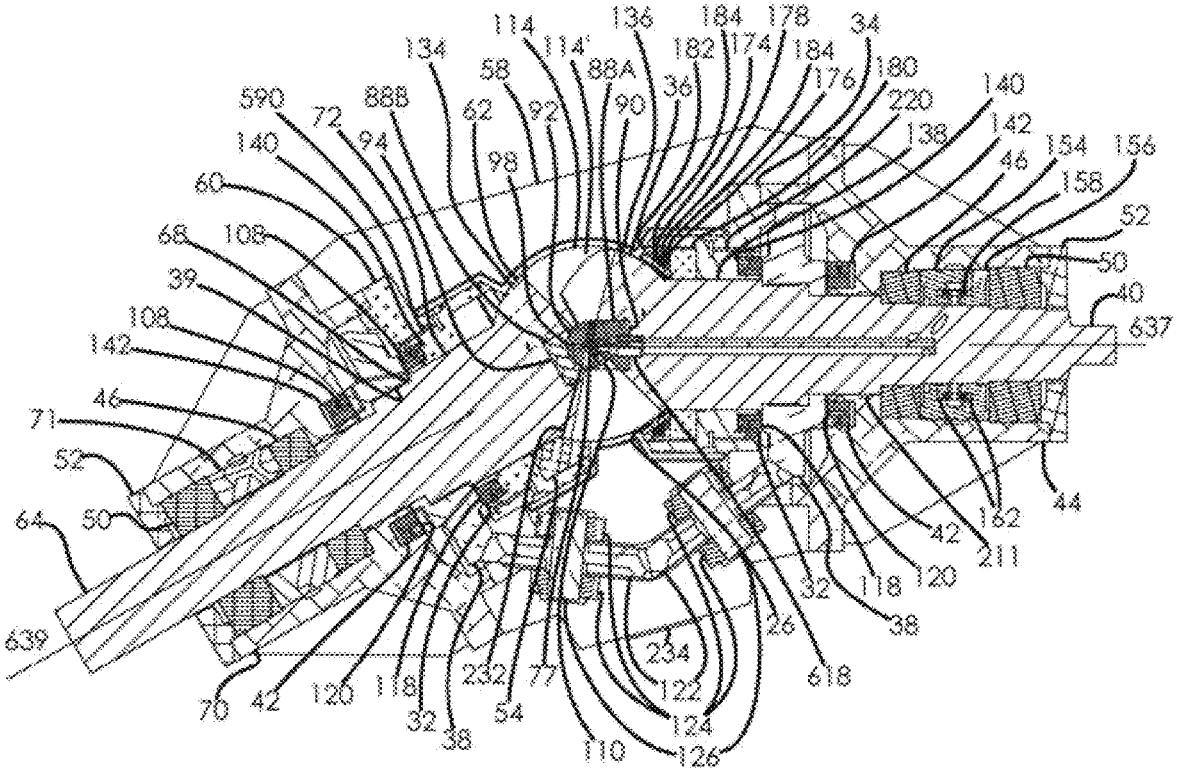
FIG. 2 is a cutaway top view of the example shown in FIG. 1 taken along section line 2-2.
Figure 39:
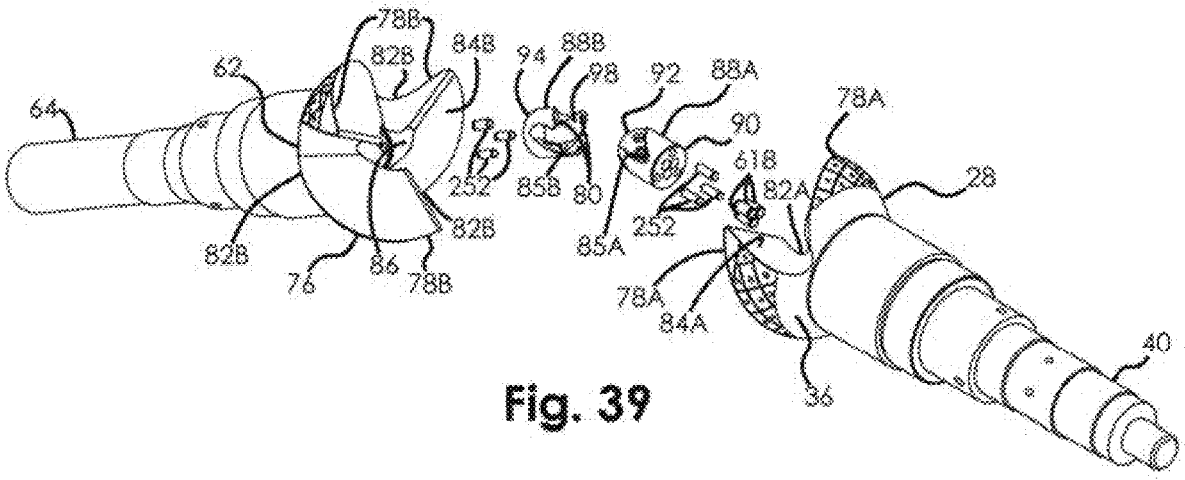
FIG. 39 is an exploded view of several internal components of the example shown in FIG. 1.

In one example, such a compressor is disclosed, including two spinning rotors 28/76 within a housing 55A. In one example of such a compressor, a first rotor 76 is driven (driver) attached to a power-driven shaft 64 and a second rotor (idler) 28 is caused to rotate through gearing connected to the driven shaft 64 or rotated by forces exerted through the rotor faces 84B/84A (FIG. 39). In one example, as seen in FIGS. 1-2, the housing 55A has a base 58 and a cover 56, each including bores with non-parallel intersecting axes 637 and 639 as seen in FIG. 2. The housing 55A comprises a frusto-spherical inner facing surface 114 adjacent the radially outer surfaces 36/62 of the rotors 28/76. In one example, each rotor 28/76 is mounted on, or formed as a part of shafts 64/40 that in one example terminates in the cavity (frusto-spherical housing surfaces), the axis of the driver rotor and the rotational axis of the idler rotor in one example are at an angle to each other, with the center 77 of frusto-spherical surfaces 36, 62 of both rotors 28/76 being at the center of the frusto-spherical surface 114 defining cavity 114'. The driver rotor and the idler rotor intermesh with each other at the opposing faces (lobes and valleys) to define chambers radially adjacent to the common center. In the example shown in FIGS. 6-8A, the lobes 78 and valleys 82 were formed using "involute curves". U.S. Pat. No. 9,316,102 incorporated herein by reference describes in detail how rotors may be formed using involute curves. Alternate examples of rotor lobes and valleys are shown in U.S. Pat. No. 6,705,161. Ports for intake and exhaust in one example are generally configured to the position of the chambers relative to the housing. In this example, only one suction port and one discharge port are shown. An additional suction port may be added such as for capacity control.

The term fluid is used herein to denote a substance, as a liquid, gas, or combination/mixture of the two that is capable of flowing and that changes its shape at a steady rate when acted upon by a force tending to change its shape.

Definition of Hybrid Bearing

The term "hybrid bearing" is used herein to denote a hydrostatic bearing of a particular structure described herein. Several examples are shown that in one example are configured to derive additional capacity to resist displacement and/or deflection from the "hydrodynamic effect". Thus, the term "hybrid" is used herein to describe a hydrostatic bearing that in some examples may derive additional capacity to resist displacement and/or deflection from the "hydrodynamic effect". The term hybrid bearing denotes a bearing comprising a landing, a bearing pocket, and a supply of fluid under pressure fed to the bearing pocket wherein the bearing may optionally comprise of a plurality of bearing pockets. The rotation of a component relative to a stationary component causes a significant relative surface speed between opposing walls of the bearing gap. Provided that sufficient bearing fluid is present between opposing walls of the bearing gap, the velocity of the moving surface relative to the stationary surface "pumps" the bearing fluid between the two surfaces. As the dynamic film of the bearing fluid is compressed between the two surfaces, the local pressure of the fluid changes with variations in gap height. This is known as the "hydrodynamic effect". If the bearing gap between the two surfaces is reduced, the local pressure of the fluid increases. Conversely, if the bearing gap between the two surfaces is increased, the local pressure of the fluid decreases. If a load causes a gap to decrease, the reaction force that is caused from the "hydrodynamic effect" may be substantially opposite to the initial load. As this gap becomes smaller, the reaction force may increase. The hybrid bearing as disclosed herein in one example is configured that contact does not occur between the components. Thus, the hydrodynamic effect formed between two substantially concentric or parallel surfaces with a substantial relative velocity may be "self-compensating" in that the relative position of the components may not substantially change in the direction of applied loads where contact may otherwise occur. This compensation may be done without external methods of control. The hydrodynamic effect may be near zero at low relative surface speeds, while the hydrostatic contribution may not require a relative surface speed between opposing walls of the bearing gap.

The term "hybrid bearing" so termed as a hybrid bearing gains load capacity from hydrostatic pressures. When connected to a spinning shaft, the hybrid bearings may gain load capacity from the hydrodynamic effect between the spinning shaft and an adjacent component. In operation, a high-pressure fluid 'wedge' is formed in the gap between the components that helps to resist contact. At very low RPMs there may be little, if any, benefit from this effect. Some bearings (e.g., Journal bearings) rely solely on the hydrodynamic effect.

Since no direct contact is expected between components of a hybrid bearing, there may be little to no wear and/or maintenance expected. Conventional roller style bearings on the contrary operate based on metal-to-metal contact and therefore may have a limited lifespan. In one example, the gap heights between components in a hybrid bearing may be as small as one thousand of an inch or less, which may be smaller than the movement expected in conventional roller style bearings. This opportunity for hybrid bearings to be stiffer than conventional roller style bearings may be particularly advantageous in high precision devices, as is found in some of the more precise Computer Numerical Control (CNC) machines to minimize tool deflection. In one example, a fluid such as water may be used for the bearing fluid. In another example, a higher viscosity fluid, such as an oil may be used for the bearing fluid. The ability for hybrid bearings to resist loads may be increased by increasing the supply pressure (for example from a pump) to the hybrid bearings. This may be a distinct benefit in comparison to conventional roller style bearings, which may generally have a much lower capacity to resist loads. Furthermore, this capacity to resist loads in conventional roller style type bearings may be decreased and/or the lifespan may decrease at higher operational speeds whereas the capacity to resist loads in a hybrid bearing may increase at higher operational speeds if benefits are derived from the hydrodynamic effect.

Capillary Orifice Self-Compensating Spherical Hybrid Bearings

Figure 5:
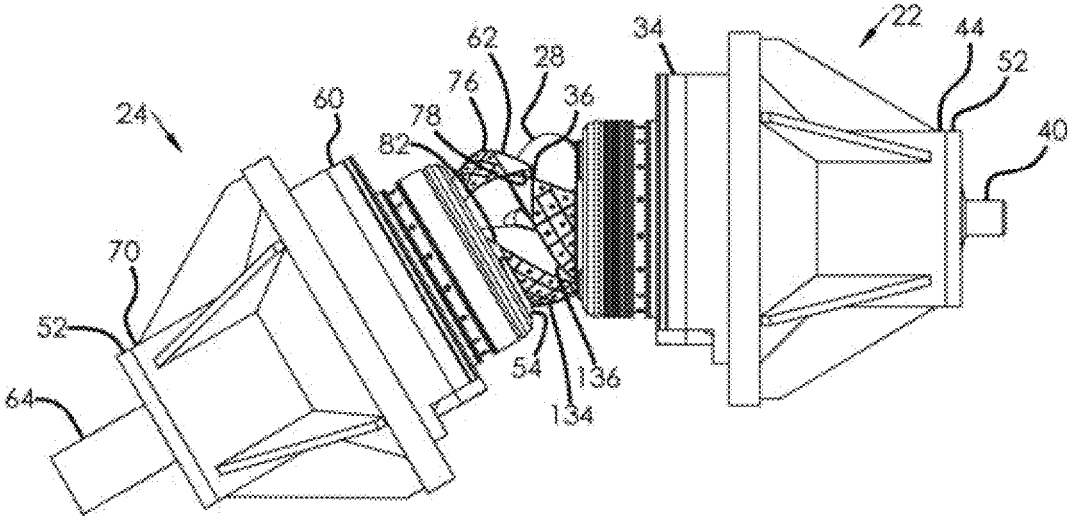
FIG. 5 is a top view of the example shown in FIG. 4.
Figure 59A:
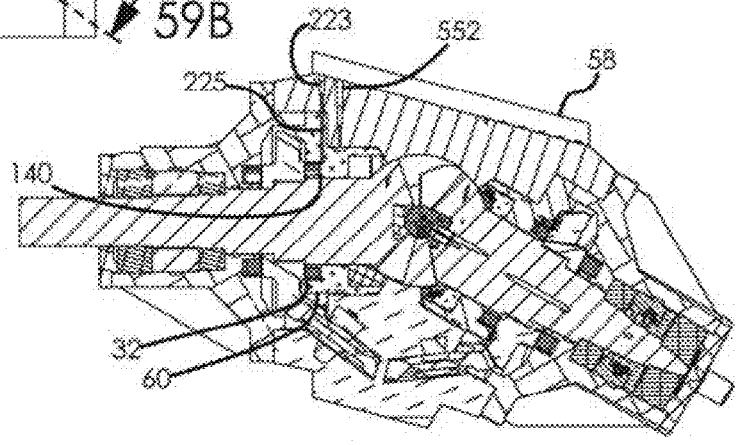
FIG. 59A is a cutaway view taken along section line 59A-59A of FIG. 58.
Figure 59B:
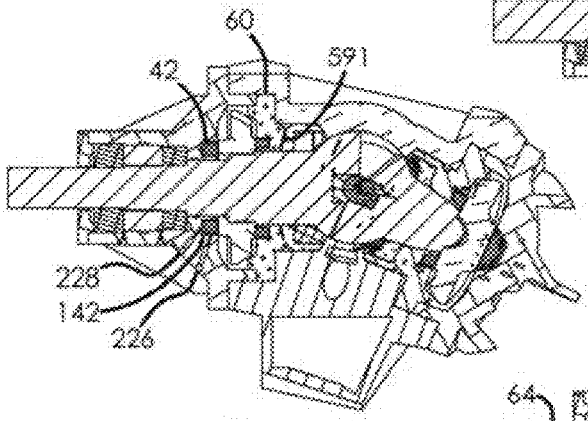
FIG. 59B is a cutaway view taken along section line 59B-59B of FIG. 58
Figure 59C:
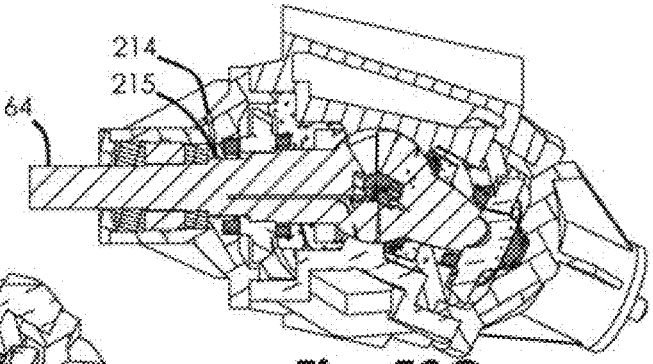
FIG. 59C is a cutaway view taken along section line 59B-59B of FIG. 58.
Figure 59D:
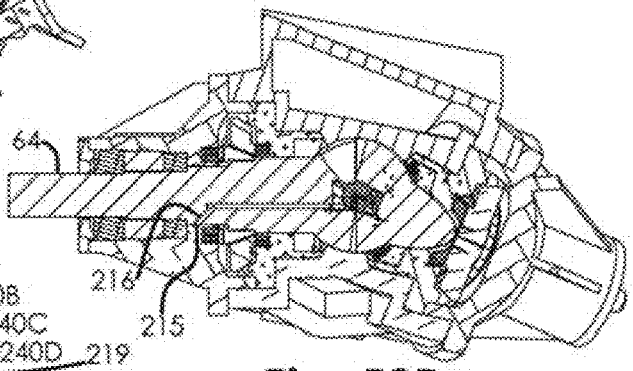
FIG. 59D is a cutaway view taken along section line 59D-59D of FIG. 58.
Figure 64:
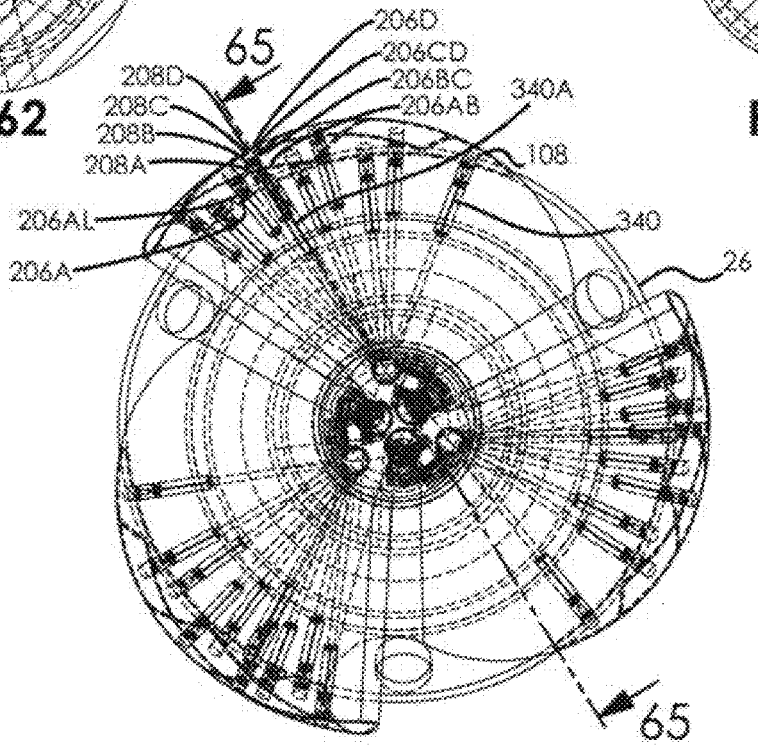
FIG. 64 is a front/hidden line view of the components shown in FIG. 61.
Figure 65:
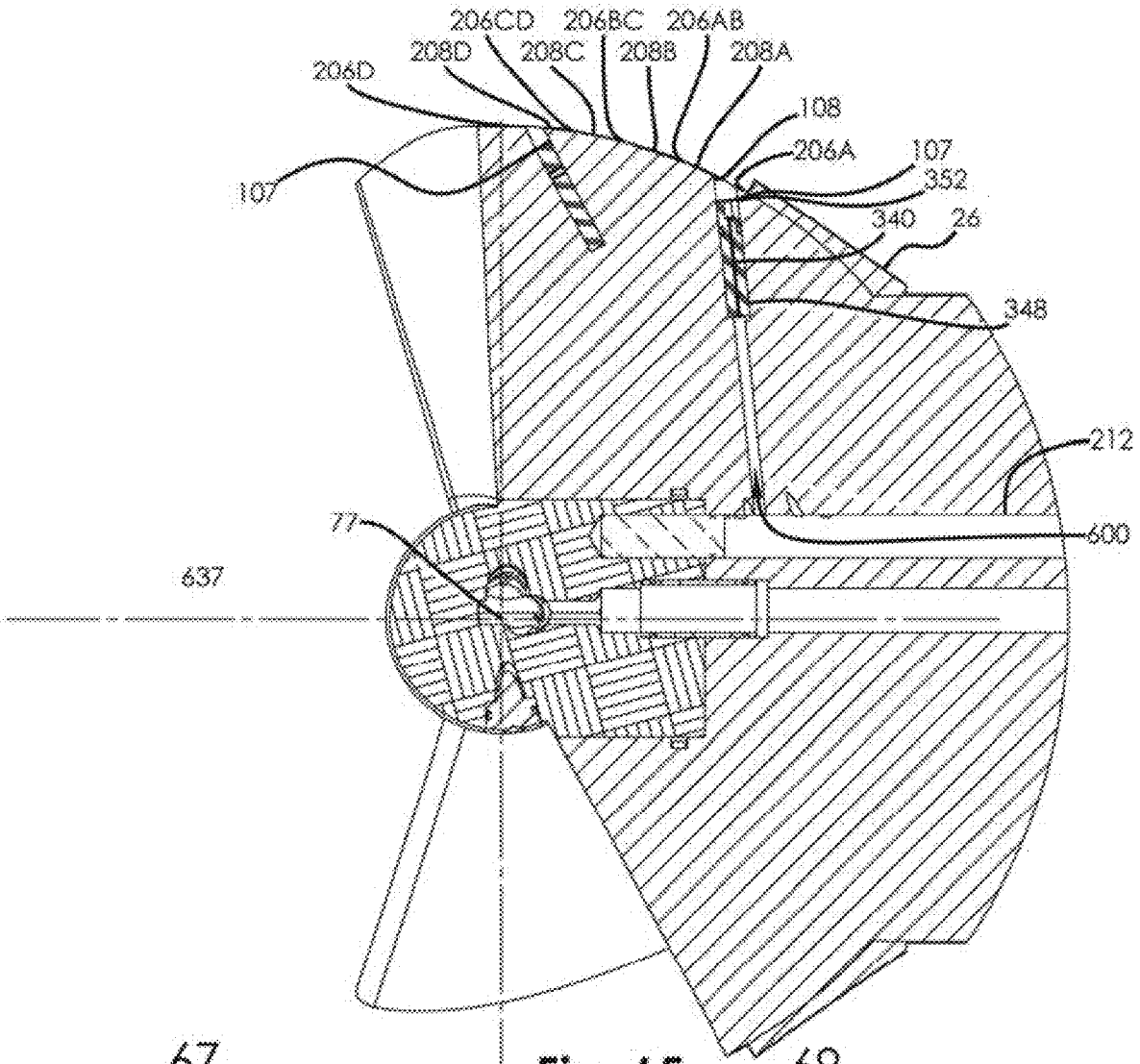
FIG. 65 is a cutaway view taken along section line 65-65 of FIG. 64.
Figure 66:
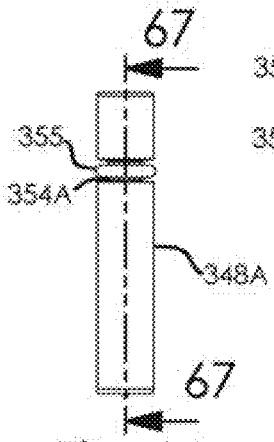
FIG. 66 is a side view of one of the components shown in FIG. 65.
Figure 67:
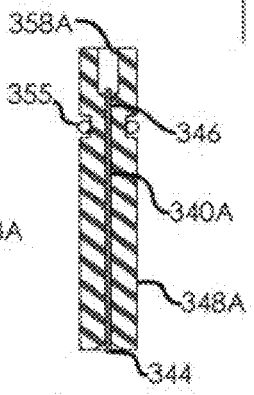
FIG. 67 is a cutaway view taken along section line 67-67 of FIG. 66.

As seen in the example shown in FIGS. 5-8A and FIGS. 56-69, a capillary fed hydrostatic bearing 134/136 (FIG. 5) may be utilized to force high pressure fluid through a long, thin hole (capillary orifice) 340 (FIG. 65), into a (recessed) bearing pocket 208A of the bearing. The perimeter of the bearing pocket is referred to as a landing 206A, 206AB, 206AL, the interrelation of the pocket and the landing will be described in detail. In this example, high pressure fluid 600 may enter the rotary fluid flow device 20 through housing hole 210 (FIG. 60C) in the idler rear bearing housing 44. The housing hole 210 is in fluid communication with the shaft groove 211 formed around the shaft in the housing, or alternately in the shaft. The housing hole 210 is also in fluid communication with surfaces defining holes 212 (FIG. 61) in the idler rotor shaft 40. Similarly, in one example, high pressure fluid may enter the compressor 20 through surfaces defining a housing hole 214 (FIG. 59C) in the driver rear bearing housing 70, which is in fluid communication with the groove 215 and holes 216 (FIG. 59D) in the driver rotor shaft 64. In both cases the fluid then may move substantially radially outwards through a long, thin hole (capillary orifice) 340A (FIG. 64) into a recessed bearing pocket 208A before passing the perimeter of the bearing pockets at the landings 206A, 206AB, 206AL. When the surfaces defining holes 340 provide an appropriate fluid restriction, the holes 340 serve as "capillary orifices". In some examples, the diameter of the hole 340 may be less than a millimeter. The length of the hole 340 in one example is substantially 100 times the diameter. In the example shown, a removable component (restrictor body) or pin 348 may be fastened that obstructs some of the flow area through the holes 340. As shown in FIGS. 66-69, this component may be a pin 348/set screw that is fastened in place and contains one or more long, thin holes 340. The term set screw denoting a type of screw normally not using a nut. Set screws are usually headless (also called blind), meaning that the screw is fully threaded and has no head projecting past the major diameter of the screw thread. A groove 352 in the surface defining holes 108 may contain a retaining ring 107 to prevent the pin 348 or set screw (not shown) from loosening or exiting the holes 108 without removal of the retaining ring 107. Groove 354A/354B also may contain an O-ring 355 to minimize leakage around the restrictor body 348A/348B. In one example, a thin tube 344 may be soldered, brazed, press fit, or otherwise fastened to the interior hole 346 of the restrictor body (pin) 348A. The interior surfaces of a thin tube 344 may define a long, thin hole (capillary orifice) 340. Variations in diameter of some holes 340 relative to others could in some applications degrade the performance of the bearing 134/136 by reducing the capacity to resist load and/or by increasing pumping requirements. If one or more of the capillary orifices 340 of the bearing become clogged, the clog may have substantial impacts on the capability of the bearing to resist load. Thus, one example comprises a thin tube 344 functioning as a capillary orifice comprising a removable component, as shown in FIGS. 65-67. In one example, a hypodermic needle is used as a thin tube 344 in that the variations in inner diameter and length of a batch of hypodermic needles may only vary slightly. Variations in gap height at the landings 206 may be compensated for by using a different size (i.e. diameter and/or length) tube 344.

Figure 68:
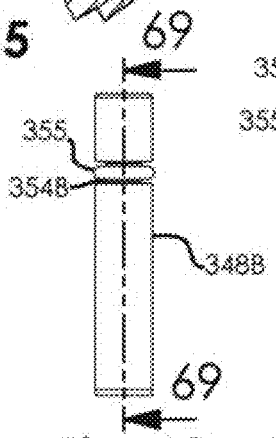
FIG. 68 is a side view showing another example of the example shown in FIG. 66 removed from the rotor.
Figure 69:
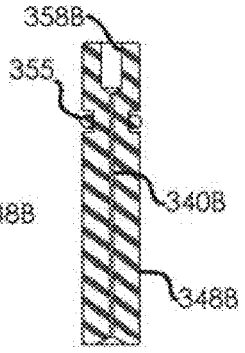
FIG. 69 is a cutaway view taken along section line 69-69 of FIG. 68.

The example shown in FIGS. 68-69 is similar to the example of FIGS. 66-67, but without a removable tube 344. Groove 354B of the pin 348B in one example cooperates with an O-ring 355 to minimize leakage around the restrictor body 348B. The interior surfaces of the restrictor 348B in one example contain the capillary orifice 340B. In either of the removable restrictors 348A/348B, threads 358A/358B may be incorporated in the restrictor body so that methods and tools known by people skilled in the art can be used to remove the restrictor bodies (pins) 348A/348B. A slide hammer is one such tool used to remove pins, where the end of a rod is threaded to engage the threads of a pin and the slide hammer utilized to forcibly remove the pin. Alternatively, screw, such as set screws could be used instead of pins but may be more time consuming for insertion and removal.

It should be understood that there is normally a surface in close proximity to bearing landings 206. A gap may be present between the bearing landings and the opposing surface. The interstitial space "gap" formed between the bearing landing 206 and the opposing surface is referred to hereafter as the "gap height" at a landing 206. This gap height may be a few thousands of an inch or less in one example. For example, in FIGS. 2-5 the interior frusto-spherical housing surface 114 is shown to be substantially close to the landings contained of the frusto-spherical bearings 134/136. The landings 206 may be near the surface of the adjacent component to minimize the amount of fluid that leaks away from the pocket 208 past the landing 206 while maximizing the stiffness (compression resistance) of the bearing pockets. The flow of fluid to a pocket 208 may be regulated by flow restriction through one or more long, thin holes 340 (capillary orifice). This reduction in fluid flow may cause a differential pressure to exist across the restriction(s). Where the bearing pocket is recessed relative to the landings, the fluid pressure in the bearing pocket may be substantially uniform and a substantial pressure gradient may exist across the landings. In operation, when a force is applied to the shaft, the bearing gap in the region where the force is applied decreases, and the gap on the diametrically opposite side increases. As the gap at the landings of the bearing pocket decrease, the resistance of the fluid out of the loaded bearing pocket increases resulting in a pressure increase on the loaded pocket and a corresponding pressure reduction on the substantially diametrically opposite pocket(s). The resulting higher pressure in the bearing pocket produces a higher force acting to separate the components until the load and differential pressure between the two pockets balance. Therefore, the bearing compensates for the applied load (force).

As seen in the example provided in FIGS. 61-65, a plurality of bearing pockets 208 are shown on the outer frusto-spherical surface 36 of the idler rotor 28. Although several examples show multiple pockets 208 on each lobe 78 alternatively, in one example, fewer (as few as one) bearing pocket 208 may be provided on each lobe 78. However, the capacity to resist loads ("load capacity") may be substantially reduced in this example as the bearing landings surrounding a pocket may be substantially circumferentially or longitudinally distant to each other. The load capacity of the bearing in one example is substantially dependent on the product of the projected area, opposing displacement and maximum pressures that may be obtained in a bearing pocket or plurality of bearing pockets 208 at the location of the bearing where minimum gap heights are present (i.e., where contact may otherwise occur). The pressure in each bearing pocket 208 may be maximized when the gap heights at the surrounding landings are at a minimum in that the fluid flow rate out of the bearing pocket may be substantially reduced. The pressure in each bearing pocket may be calculated in in a similar manner that voltage is calculated in an electrical circuit diagram. Electrical resistance, voltage and current in such an analogy are considered analogous to flow resistance, pressure and flow rate, respectively. Thus, the equivalent flow resistance leaving a bearing pocket in one example, may be higher than the flow resistance entering a bearing pocket to maximize the pressure in each pocket. The flow resistance at a given landing 206 may be substantially dependent on the gap height at the given landing. The equivalent flow resistance of all the landings surrounding a bearing pocket may be calculated as a plurality of parallel flow resistances. As is understood by someone familiar with equivalent electrical circuit calculations, if two landings were in series on one of the sides of the bearing pocket, the equivalent series flow resistance of the two landings would be calculated and then that equivalent resistance would be calculated as a parallel flow resistance to the other parallel flow resistances. The maximum load capacity in each direction of the bearing may be defined as the maximum displacement in said direction that a load may be applied before contact occurs. Thus, if one or more gap heights at landings surrounding a pocket are still substantially large at this near-contact position, then the overall equivalent flow resistance of said landings may not be substantially larger than the flow resistance through the capillary orifice. This may substantially reduce the maximum pressure that may be obtained in each bearing pocket. The calculation method described above may only consider the contribution from the hydrostatics/pressure driven flow ("Poiseuille Flow"), while the hydrodynamic effect may further increase load capacity.

Figure 3:
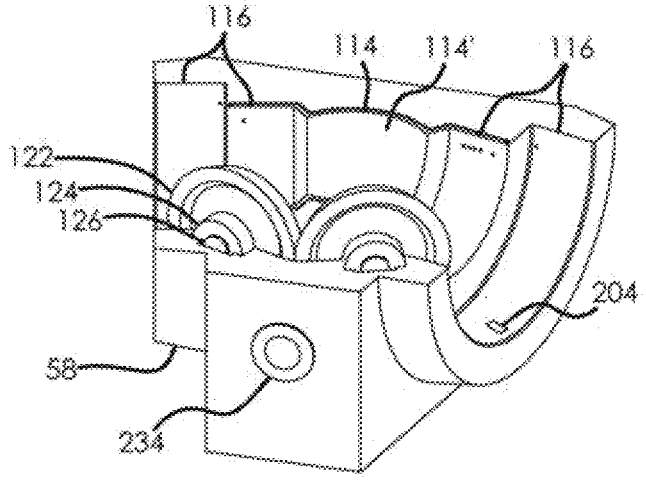
FIG. 3 is an isometric view of a housing component and indexing gear of the example shown in FIG. 1.
Figure 4:
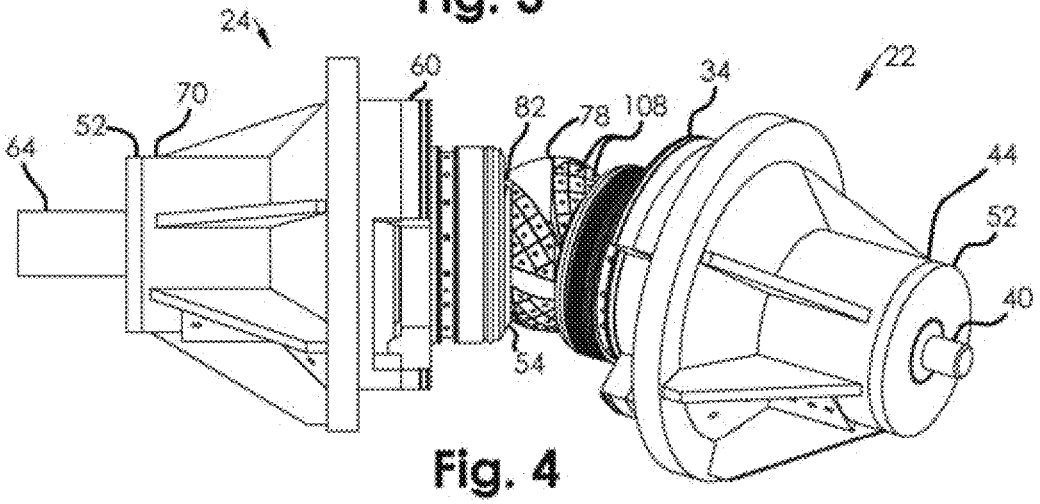
FIG. 4 is an isometric view of the example shown in FIG. 1 with several housing components removed to show the internal components.

As an example, the cross-sectional view of FIG. 65 shows an example where landings 206A, 206AB, 206BC, 206CD and 206D have frusto-spherical surface topology with substantially identical spherical centers to the rotors' spherical center 77 and the spherical center of the frusto-spherical cavity, such as the surface 114 defining cavity 114' shown in FIGS. 2-3. If the gap heights (distance between the landing and the adjacent surface) at these landing locations are initially equivalent, then a displacement of the rotor in FIG. 65 relative to the surface of frusto-spherical cavity 114' may decrease the gap height at landing 206D more than the gap height at landing 206A. The resulting gap heights may be calculated using trigonometric relationships and/or the "dot product". When the gap height at the landing 206D is near zero, the gap height at landing 206A may still be a substantial fraction of the gap height before the load was applied. The flow resistance at the landing 206D at this position may be substantially higher than the flow resistance at landing 206A. Thus, where one bearing pocket comprises substantially distant landings at the positions 206A and 206D, the load capacity may be substantially reduced in comparison to the configuration using bearing pockets 208A, 208B, 208C, 208D in the same longitudinal span. A similar explanation can be used to illustrate the general relationship between load capacity and the circumferential span of the bearing. This and other descriptions refer to one rotor (i.e. rotor 28) for particular landings, pockets, etc.

Radial hydrostatic bearings of other configurations than those shown, that use capillary orifices to supply a substantially cylindrical bearing surface are known in the art. Such a hydrostatic bearing may be capable of resisting radial loads. In one example, thrust hydrostatic bearings configured to use capillary orifices to supply a substantially circular planar bearing surface are also known in the art. It is conceived that such a hydrostatic bearing may be configured to resist thrust loads. Where a plurality of bearing pockets are used, such a hydrostatic bearing may be capable of also resisting moment loads. Such moment loads are problematic in that they may be capable to bend the shaft. FIGS. 66-69 show examples of restrictor bodies that could contain an appropriate capillary orifice. These restrictor bodies may be applied to radial or thrust embodiments of hydrostatic bearings. In one example, such restrictor bodies may be used in the driver/idler radial hybrid bearings 72/138 (FIGS. 2-8B) to form capillary-fed self-compensating hybrid bearings that may be capable of resisting radial loads. In one example, such restrictor bodies may be used in the front/rear cylinder hybrid bearings 118/120 (FIGS. 2-8B) to form capillary-fed self-compensating hybrid bearings that may be capable or resisting thrust loads and moment loads that would act to bend the shaft.

Supplying Capillary-Fed Self-Compensating Bearings

As described above, an example referencing FIGS. 61-65 shows how high-pressure fluid may be ported through one example of the rotating idler rotor shaft 40 to feed the spherical bearings. In this example at the location of the spherical bearings 134/136 (FIG. 2-5), the rotating component may not be circumferentially continuous. Therefore, in some applications, if the bearing pockets are placed on the stationary component, leakage rates may be substantially high when the valleys 82 (FIG. 5) of the rotor pass a given bearing pocket. In one example, the hybrid bearing with opposing bearing pockets shown in FIGS. 71A-71B and FIGS. 73-93 may be applied to the outer frusto-spherical rotor geometry if an even number of lobes 78 are present, in that pockets may exist on the diametrically opposite sides. However, an example with an odd number of lobes may provide a substantially higher amount of bearing surface area in the direction of the highest expected pressure-induced load. This may be an important consideration when designing an asymmetric bearing array, as the capacity to resist loads may be substantially dependent on the direction of the highest magnitude loads. The term "array" defined as a regular order or arrangement of a plurality of similar components.

FIGS. 2-8B and FIGS. 56-60C, illustrate an example configured where high pressure fluid may enter the compressor to supply the idler/driver radial hybrid bearings 136/134 and front/rear cylinder hybrid bearings 118/120 for the idler/driver. The idler/driver rotors in some examples are defined as first/second rotors and the terms used interchangeably herein. The terms first rotor and second rotor also used in some examples for rotor pairs that are idler/idler pairs, driver/driver pairs, and combinations thereof interchangeably. Supply line (port) 218 (FIG. 60A) in the housing base 58 is in fluid communication with the supply lines 220/221 (FIG. 2/60B) in the idler front bearing housing 34. The supply lines 218/220/221 are configured to supply the idler front cylinder hybrid bearings 118 and idler radial hybrid bearings 138. These bearings 118/138 are configured to resist axial/thrust and radial/bending moment loads on the idler rotor 28 respectfully. In the same manner, supply line (port) 552 (FIG. 59A) in the housing base 58 is in fluid communication with the supply lines 590/591 (FIG. 2/59B) in the driver front bearing housing 60 to supply the driver radial hybrid bearings 72 and driver front cylinder hybrid bearings 118. These bearings 72/118 configured to resist radial/bending moment loads and axial/thrust loads on the driver rotor 76 respectfully. The compressor 20 may be configured where high pressure fluid enters the compressor 20 through a supply line (port) 222 (FIG. 60B) in the idler rear bearing housing 44 to supply the idler rear cylinder hybrid bearings 120 which resist axial loads. In the same manner, supply line (port) 226 (FIG. 59B) in the driver rear bearing housing may supply the driver rear cylinder hybrid bearings 120 which resist axial loads. High pressure fluid may enter the compressor through supply line 224 (FIG. 60B) to feed the cavity 142 behind the idler rear cylinder 42. In the same manner, supply line 228 (FIG. 59B) may feed the cavity 142 behind the driver rear cylinder 42. High pressure fluid may enter the compressor through supply line 227 (FIG. 60A) to feed the cavity 140 behind the idler front cylinder 32 via line 229 in the idler front bearing housing 34. In the same manner, supply line 223 (FIG. 59A) may feed the cavity 140 behind the driver front cylinder 32 via line 225 in the driver front bearing housing 60.

Other Known Capillary Free Self-Compensating Hybrid Bearings

As disclosed in U.S. Pat. No. 5,281,032, some examples of self-compensating hydrostatic bearings may have other operating principles. In this example, FIG. 1 of U.S. Pat. No. 5,281,032 shows one of the hydrostatic bearing pockets, [62C], in fluid communication with the pocket [67A] via a fluid conduit [69A]. Brackets [ ] are used in the labels here to distinguish prior art components from the components of the novel device disclosed herein.

The term "restrictor pocket" is a term used herein to denote structures similar/equivalent to pocket [61A] and similar components (e.g., [61B], [61C] and [61D]). High pressure fluid may enter annular grooves [65A], [65B], [65C] and [65D] from holes [66A], [66B], [66C] and [66D], respectively. Immediately adjacent landings [68] ([68A], [68B], [68C] and [68D]) may restrict the flow and thereby regulate the pressure from the annular grooves [65A], [65B], [65C] and [65D] to the holes [67A], [67B], [67C] and [67D], which may be in fluid communication with bearing pockets [61A], [61B], [61C] and [61D] on the diametrically opposite side. The neutral position may be defined as a theoretically pressure-balanced scenario where the gap heights around the circumference of the cylindrical shaft are equivalent. Loads on the shaft may cause the shaft to move towards the stationary outer component. In the example where the gap height at the restrictor landing [68A] is increased relative to the neutral position, the flow resistance at this restriction may decrease. Thus, the pressure in the restrictor hole, [67A] may increase, up to the pressure of the immediately adjacent high pressure annular groove, [65A]. Given that the fluid conduit [69A] provides little flow resistance in comparison, the resulting pressure in the bearing pocket recess [62C] may be comparable to that in the restrictor hole [67A]. Since the projected radial area of the bearing pocket [61C] is larger than that of the restrictor pocket [64A], the net contribution of these diametrically opposite (offset) loads act to reduce the gap height at the restrictor inner landing [68A]. In one example, the restrictor [64C] has a gap height at the landing [68C] smaller relative to the neutral position. Thus, the flow resistance at such a restriction and resulting pressure drop may increase. Therefore, the pressure in restrictor hole [67C] and bearing pocket recess [62A] may decrease. The landings immediately adjacent to the drains [70A], [70B], [70C], [70D], [71A], [71B] and [71C] and respective bearing pockets ([62A], [62B], [62C], [62D]) or restrictor pockets ([65A], [65B], [65C], [65D]) may have a substantially linear pressure gradient. The combined effect from the [61A], [61B], [61C] and [61D] may overcome the diametrically opposite and offset net force from [64A], [64B], [64C] and [64D] to act to self-center the shaft relative to the stationary component. Although this offset net force may be small in proportion to the radial reaction load at [61A], [61B], [61C] and [61D], the offset net force may act to rotate the shaft. In some examples, this may be an undesirable consequence. It is conceived that the viscous drag and pumping requirement may be substantially increased in comparison to a capillary fed design with the same capacity to resist load in that there may be more landing areas and additional length exposed to drain pressure.

Novel Capillary Free Self-Compensating Hybrid Bearings with Restrictors in Bearing Pockets A novel self-compensating frusto-spherical hybrid bearing disclosed below may reduce the viscous drag and leakage/pumping requirement of the bearing disclosed in U.S. Pat. No. 5,281,032 and a method to accomplish same. This more compact arrangement may substantially increase the load capacity of the bearing when comparing bearings of equivalent size. A plurality of bearing pockets is disclosed herein, in one example substantially generated with a circular pattern of features with respect to a central rotating shaft axis. For the ease of the reader, only the operability of two diametrically opposite bearing pockets that are in fluid communication are labeled and discussed, but other bearing pockets that are in fluid communication with each other may operate in the same manner.

Figure 71A:
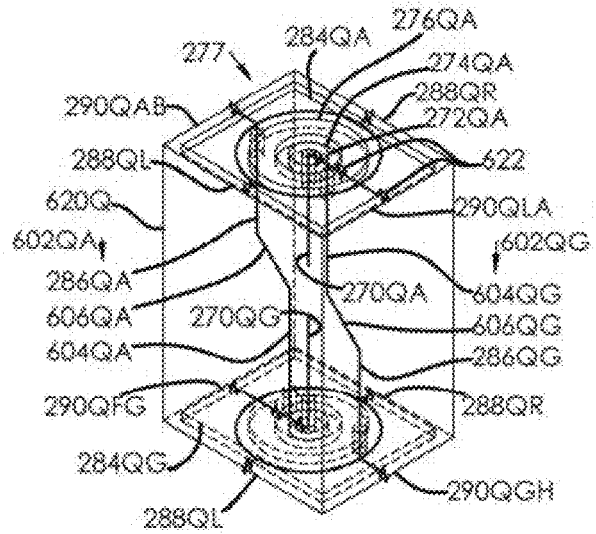
FIG. 71A is an isometric view of one example of a novel bearing with opposing bearing pockets.

In FIG. 71A, is shown an example of diametrically opposite bearing pockets. A schematic representation of the flow conduits and flow resistances across landings is provided for the reader to better understand how the bearing performance calculations are analogous to electrical circuit calculations as described in an above section. Flow resistance is depicted with an electrical resistance symbol 622 that is understood by those familiar with the art of electrical circuits. It is to be understood that solid lines represent substantially lower flow resistance in comparison to the flow resistance of passageways immediately adjacent to landings implying substantially low (negligible/irrelevant) pressure drop across those flow paths. Recesses in one example are configured to be deep, and fluid conduits large relative to small flow passageways at landings where pressure drops are expected.

Bearing pocket 284QA for example comprises surfaces defining a recess with immediately adjacent landings 290QAB/290QLA/288QR/288QL forming a perimeter. In this example, a substantially annular groove 274QA comprises surfaces defining a recess with immediately adjacent landings 276QA/272QA forming a perimeter around the groove 274QA. In one example there is an immediately adjacent component with surface topology substantially similar and in close proximity to that of all landings. In the example provided, component 620Q is floating while the immediately adjacent component 671 (FIG. 71D) is stationary. In one example the recesses, landings and fluid conduits contained in component 620Q could alternatively be contained in the immediately adjacent component 671 and one of these components may float relative to the other component via the pressurized fluid bearing system described herein.

The gap height at each landing is defined as the average normal distance between the components at the landing location. For example, looking to FIG. 2, the gap heights at the landings of the rotor hybrid bearings 136/134 are defined as the average normal distance between the landing locations of the rotors 28/62 and the inner frusto-spherical surface 114 of the housing cavity. It is to be understood that reference to "gap heights" refers to the gap heights at landings in that any changes to gap heights at recesses generally do not have a substantial impact on resulting pressures in bearing pockets. As an example, gap heights may only be a few thousands of an inch, or less, in comparison to holes that may be ⅛" of an inch, or less. In one example if the holes are drilled (as opposed to being created by another process such as 3D metal printing), it may be preferred for the diameter of the holes to be selected to be $1/30^{th}$ or less (e.g., $1/20^{th}$) of the length of the holes in that machining costs may be reduced, and "oversizing" holes may not have any substantially negative consequences. The term "neutral position" may be used to define a scenario where the gap heights at all diametrically opposite landings are equivalent. The neutral position represents a substantially unloaded scenario where all bearing pocket pressures are substantially equivalent to each other. The selection of gap heights at assembly may be dependent on the bearing pocket size, landing dimensions, viscosity of the fluid at the operating temperature, the expected heat generation, the design pressure differential, allowable leakage rates, the tolerances that can be achieved and other design parameters.

A substantially linear pressure gradient may exist across landings where turbulence is generally avoided and at low operating speeds. At higher operating speeds, i.e., relative speed between rotors 28/62 and housing surface 114, the pumping action of the hydrodynamic effect (see above definition) may influence pressure gradients. Turbulence may generally be avoided if the Reynold's number is below 2000 and the introduction of tiny vortices are avoided.

The depth of recesses, e.g., 274QA, may be several times larger than landing gap heights to achieve the desired negligible flow resistance across the recessed bearing pocket or (annular) restrictor groove. In one example the depth of recesses, may be 30-40 times larger, or more, than the landing gap heights. In the example provided in FIG. 71A, the bearing pockets 284QA/284QG are substantially rectangular and the recess referred to as (annular) restrictor groove 274QA is shown substantially circular/annular. It is to be understood that the landings, bearing pockets, grooves, etc. may be other shapes than those shown including elliptical or polygon shapes. Thus, the term "annular" is used for ease in description intended not to limit to a specific shape of "restrictor" components. The flow resistance at landings in one example is at least partially dependent on the perimeter, thickness, and gap height at landings.

The term "restrictor" is used herein to collectively refer to the centrally supplied hole 270QA, immediately adjacent landing 272QA, annular groove 274QA and landing 276QA. These elements would describe "restrictor A" for "bearing pocket A", 284QA of example "Q".

High pressure bearing fluid may be supplied to the bearing, specifically to inner groove 274QA via bearing supply line 270QA. This flow and pressure may be restricted by landing 272QA. (Annular) restrictor groove 274QA of this example is in fluid communication with the bearing pocket 284QG on the diametrically opposite side via fluid conduit 602QG. The flow resistance of fluid conduit 602QG may be negligible such that the pressure in annular groove 274QA is substantially equivalent to the pressure in bearing pocket 284QG on the diametrically opposite side. This fluid conduit 602QG is shown as three segments 604QG, 606QG and 286QG for the ease of the reader when more complex examples are shown that comprise similar labels. The flow and pressure exiting bearing pocket 284QG may be regulated by the landings 290QFG, 290QGH, 288QR and 288QL. Not shown in this example are optional bearing pockets that may be immediately adjacent to landings 290QFG and 290QGH and there may be relatively low pressure drains immediately adjacent to landings 288QR and 288QL for example. The flow and pressure exiting annular groove 274QA towards the bearing pocket 284QA on the diametrically same side may be regulated by the intermediate landing 276QA. It may be preferred for the flow resistance at landing 276QA to be much higher than that at landings 272QA, 288QR and 288QL in that the pressure in groove 274QA is in one example much different that the bearing pocket 284QA on the diametrically same side. When the groove 274QA and bearing pocket 284QG on the diametrically opposite side are capable of being substantially different than the bearing pocket 284QA on the diametrically same side, load capacity may be increased. In this manner, the net forces/pressure gradient in a restrictor may induce displacement substantially in the direction of the displacement/applied loads in contrary to the self-compensating effect produced from the bearing pockets. For this reason, it is intended for the bearing pockets to have a much larger projected area than the restrictors to increase the overall load capacity. It may also be preferred for the flow resistance at landings 290QFG and 290QGH to be higher than the flow resistance at landings 288QR and 288QL in that the pressures in adjacent bearing pockets may therefore be substantially different. The preferred flow resistance of landings 290QFG and 290QGH may substantially depend on the type of bearing that the bearing elements are being applied to. In one example, FIG. 71A may be applied as shown to create a double acting thrust bearing with a bearing pocket 284QG on the rear face and bearing pocket 284QA on the front face. In this example there is only one bearing pocket on each face and drain pressure may exist immediately adjacent to all of the landings 288/290. In one example, a plurality of bearing pockets shown in FIG. 71A may be applied circumferentially along a cylindrical shaft to create a radial bearing. In this example, the overall capacity to resist radial loads may be substantially dependent on bearing pockets of diametrically opposite sides to be at substantially different pressures. In this case, a larger number of pockets may be preferred (for example 12) and this segregation may decrease the circumferential lengths of drains 288QL/288QR relative to 290QAB and 290QLA for example. Therefore, this relative change in lengths may increase the flow resistance of landings 290QAB/290QLA relative to the flow resistance of landings 288QL/288QR, thereby allowing the bearing pocket 284QA to reach a pressure closer to drain pressure for example. If too many pockets are included, there may be diminishing returns on how much the load capacity may be increased in comparison to the excess frictional drag and heat generation that may be generated in the case where relative velocity may be present (e.g., a spinning shaft).

When the gap heights of landings of bearing pocket 284QA are smaller than they were in the neutral position, the respective flow resistances of those landings may be higher. A load reduction may cause component 620Q to displace such that these gap heights reduce at bearing pocket 284QA. This implies that the gap heights on the diametrically opposite bearing 284QG increase and the flow resistances of those respective landings decrease. A larger pressure differential may exist between bearing supply line 270QA and annular groove 274QA in that the flow resistance of the landing 272QA increased. Since annular groove 274QA and bearing pocket 284QG are intended to be substantially similar pressures, the decrease in flow resistance of the landings 288QR and 288QL may further decrease the pressure in bearing pocket 284QG. This discrepancy in fluid pressure may cause the component 620Q to reposition itself relative to the immediately adjacent component (not shown) until an equilibrium is reached. It is implied that a load caused such a displacement to occur, and that loads within the capability of the bearing are expected to be reacted without any metal-to-metal contact occurring via the self-compensating mechanism described.

It is to be understood that the pressure immediately adjacent to the drains 288QR or 288QL is expected to be lower than that of the supply pressure at 270QA for the bearing pocket to function in a self-compensating manner. The pressure in a bearing pocket 284 may be somewhere between the lowest drain pressure and the pressure that was supplied to it. For example, the pressure in bearing pocket 284QG may be between the drain pressures at the immediately adjacent landings 288QR and 288QL and the pressure at supply line 270QA. Immediately adjacent bearing pockets "F" and "H" are not shown in this example and are implied to optionally exist by the numbering of landings 290QFG and 290QGH. This numbering sequence used throughout for bearing examples describes landing 290QFG as the landing between bearing pocket "F" and "G" for example "Q". If the pressure at the immediately adjacent bearing pockets "F" or "H" (not shown) are lower than the drain pressure for bearing pocket 284QG (pocket "G"), then it may be possible for the pressure in pocket "G" to reach that low of a pressure. In one example the immediately adjacent pockets have lower drain pressure as an atypical scenario with the primary purpose of demonstrating the mathematical construct. If all bearing pockets are supplied with comparable pressure, as is preferred for typical applications, the intermediate landings 290QFG and 290QGH in one example have a comparable or higher flow resistance of that of the drain landings 288QR and 288QL. Another demonstration of the mathematical construct is that one of the drains may be at a pressure even in excess of the supply pressure. In such a case, the bearing may still function if the high pressure "drain" has a higher flow resistance than the landing immediately adjacent to the low pressure drain. In extreme examples, the pressure in the bearing pocket may still approach that of the low drain pressure because the substantially lower flow resistance at the low-pressure drain is expected to dominate the mathematics. Reaching a pressure in a bearing pocket close to that of the drain pressure implies that the diametrically opposite bearing pocket is near supply pressure and has substantially reduced gap heights.

Figure 71B:
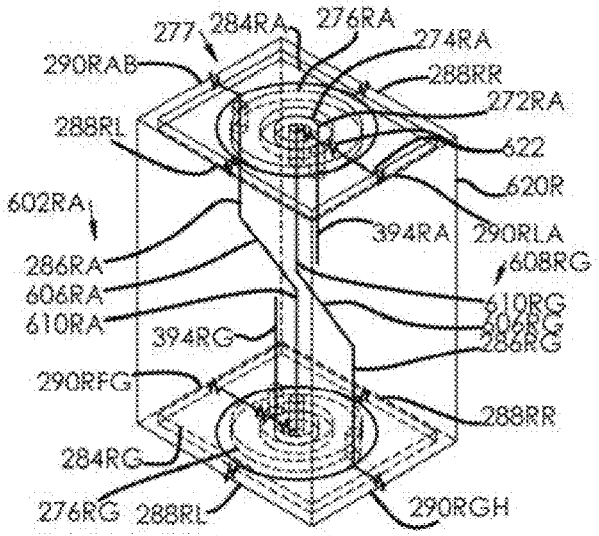
FIG. 71B is an isometric view of another example of a novel bearing with opposing bearing pockets.

Looking to FIG. 71B, another example "R" is provided where a similar numbering scheme is used to represent similar elements. This example differs from the previous example "Q" (FIG. 71A) in that the (annular) restrictor grooves of the restrictors are supplied, and a fluid conduit at the center of the restrictor is in fluid communication with the bearing pocket on the diametrically opposite side. For the same bearing and restrictor sizes, the overall pressures in the neutral position may be higher in example "R". In the case of a thrust bearing, there may be a higher bearing reaction load at the neutral position. In one example a radial bearing comprises a plurality of bearing pockets shown in FIG. 71B. In this arrangement, the pressure gradient across landings 276RA may be beneficial in the self-compensating effect in that the average pressure may be between the supply pressure in groove 274RA and the pressure in the adjacent bearing pocket 284RA. The pressure gradient contained within the periphery of landing 272RA may be counter-productive to the self-compensating effect. However, as shown, this projected area may be very small in comparison to the are contained in the periphery of landing 276QA FIG. 71A. Higher pocket pressures may result in a higher neutral position pumping flow rate and higher pump power requirements.

In example "R", supply line 394RA feeds a substantially annular restrictor groove 274RA. Flow and pressure to a central hole 610RG in this example is regulated by landing 272RA. The central hole 610RG forms a fluid conduit with fluid conduit 606RG and fluid conduit 286RG, the combination thereof referred to herein as fluid conduit 608RG. Fluid conduit 608RG supplies bearing pocket 284RG. Flow and pressure to immediately adjacent bearing pockets and/or drains may be regulated by landings 290RFG, 290RGH, 288RR and 288RL. The same self-compensating functionality described for example "Q" may apply with the same preferences and notations used above. For example, restrictor "A" refers to the outer landing 276RA, annular groove 274RA and inner landing 272RA. It may be preferred for the flow resistance of outer landing 276RG to be substantially higher than the landings 290RAB, 290RLA, 288RL and 288RR in that these landings define the perimeter of the bearing pocket 284RG and it may be desirable for the bearing pocket 284RG to have a minimum pressure (when said landings have gap heights larger than the neutral position gap height) substantially similar to the drain pressure adjacent to 288RL and 288RR. If the landing 276RG has a much smaller perimeter compared to the other landings 290RAB, 290RLA, 288RL, 288RR, this is one practical example on how to increase the flow resistance and it may coincide with making the restrictor more compact. Likewise, it may be preferred to make landing 272QA as compact as possible. When the gap heights at bearing pocket A are reduced from the neutral position, the flow resistances at restrictor A, including at landing 272RA may increase. A higher-pressure differential may exist across landing 272RA, reducing the pressure in the diametrically opposite bearing pocket 284RG. Simultaneously, the pressure in bearing pocket 284RA may increase as the flow resistances at restrictor G decreases. This discrepancy in fluid pressure may cause the component 620R to reposition relative to the immediately adjacent component facing the bearing pocket 284RA until an equilibrium is reached. It is implied that an offset load caused such a displacement to occur, and that loads within the capability of the bearing are expected to be reacted without any surface to surface (metal-to-metal) contact occurring via the self-compensating mechanism described. It is to be understood that the arrangement of opposing pockets shown in FIG. 71A or 71B could be used as shown to react loads substantially normal to the projected area of the bearing pockets. For example, a substantially planar arrangement of one or more pairs of the disclosed bearing pockets may react to thrust loads. If pockets are arranged circumferentially around a shaft for example, then they may react to loads radial to the shaft. The pockets may be arranged on a floating or stationary component and consist of a convex, concave, or planar topology for example. The normal vectors of opposing pockets do not need to be colinear as they are depicted in FIG. 71A-71B.

FIGS. 73-93 show several examples of the types of bearing depicted in FIG. 71A-71B in use on a stationary component 278A configured to be fitted around a shaft such as shafts 40/64. It is to be understood that the labeling notation is similar on similar bearing elements to imply a similar functionality. For example, flow resistances are still to be considered at landings and when gap heights (at bearing landings) are reduced from that of the neutral position, the pressure may increase in the same self-compensating manner as described above.

If the disclosed bearings are optionally applied where relative rotational motion is present, it may be preferred to have the segment of fluid conduit 286 entering the bearing pocket 284 vary by 30 to 60 degrees from the normal vector of the bearing pocket 284 recessed surface. For example, in example A (FIGS. 73-77), the fluid conduit 286AA directs flow at such an angle into the bearing pocket 284AA. This entry location in the example shown is immediately adjacent to the circumferentially "upstream" edge of the bearing pocket relative circumferential fluid movement in the preferred direction of rotation 612 relative to the adjacent component facing and immediately adjacent the bearing pockets. This circumferential fluid movement implies that the adjacent component(s) rotate relative to these components or these components rotate relative to the adjacent components. In either case, the preferred relative rotation is in the direction of arrow 612 as this represents the direction of circumferential fluid movement. The bearing elements may be included on either component. Typical applications may comprise of stationary outer components comprising of bearing elements with an inner rotating shaft.

It is to be understood that gap heights may be small enough at the landings and the rotational speed may be high enough in some cases for the shaft to pump fluid in the rotational direction. This fluid dynamic phenomenon, known as Couette flow, is accomplished by viscous drag forces acting on the fluid. This entry location immediately adjacent to this edge combined with the range of angles is conceived to be preferred in that it may minimize the generation of vortices as the fluid enters the pocket. Larger gap heights may increase the prevalence of turbulence and turbulence may increase heat generation. However, very small gap heights can increase heat generation via viscous shear. It may be beneficial to minimize heat generation in that some properties such as bearing fluid viscosity may be highly temperature dependent and cooling the bearing fluid may require power. Minimizing landing area may reduce viscous drag but may increase leakage. Increased leakage rates may reduce the overall device efficiency in that pumping power requirements may increase.

It is to be understood that in the examples shown in FIGS. 73-93 the adjacent component i.e., outer surface of shaft 64 which forms substantially small gap heights with the landings at the bearing surfaces. The components shown in FIGS. 73-93 may not require relative rotation to one another. Bearing pockets may resist loads substantially normal to the projected area of the bearing pockets.

Bearing Example A

Looking to bearing example A in FIGS. 73-77, a stationary inner component 278A of the hybrid bearing 282A may be shrink-fit, press-fit, or otherwise fastened to a stationary outer sleeve 280A. Shrink-fitting is a technique in which an interference fit is achieved by a relative size change after assembly. This may be achieved by heating or cooling one component before assembly and allowing it to return to the ambient temperature after assembly, employing the phenomenon of thermal expansion to make a joint. For example, the thermal expansion of a piece of a metallic drainpipe allows a builder to fit the cooler piece to it. As the adjoined pieces reach the same temperature, the joint becomes strained and stronger. A substantially cylindrical component, for example a rotating shaft, i.e., shaft 64, immediately radially inwards of the inner component 278A may have outer surfaces that may have substantially the same profile as the inner surfaces of the inner component 278A in that a small gap is formed between the components. Bearings are configured to resist loads substantially normal to the projected area of the bearing pockets. The hybrid bearing 282A may only substantially resist radial loads. However, the combination of two or more of these bearings on the same shaft may resist substantial bending moment loads that would act to bend the shaft.

Flow may enter hybrid bearing 282A via supply port 268A, which is in fluid communication with the centrally supplied restrictors via the supply holes 270A(A-L). Flow and pressure from 270AA may be regulated across inner landing 272AA before entering a substantially annular groove 274AA which is in fluid communication with the opposing bearing pocket 284AG via sequential fluid conduits 604AG, 606AG and 286AG. As was described for FIG. 71A, when gap heights are reduced at a bearing pocket the pressure and flow resistance of that pocket may increase while the pressure and flow resistance of the opposing bearing pocket may decrease. This may create a self-compensating effect until an equilibrium is reached with the applied load.

Bearing Example B

In FIGS. 78-82, a stationary inner component 362B of the hybrid bearing 282B may be fastened to component 280B. Flow may enter hybrid bearing 282B via supply port 268B, which is in fluid communication with restrictor annular grooves 274BA via the supply holes 270B(A-L). Flow and pressure from 274BA may be regulated across inner landing 272BA before entering the central hole 394BA which is in fluid communication with the opposing bearing pocket 284BG via sequential fluid conduits 604BG, 606BG and 286BG. As was described for FIG. 72, when gap heights are reduced at a bearing pocket the pressure and flow resistance of that pocket may increase while the pressure and flow resistance of the opposing bearing pocket may decrease. This may create a self-compensating effect until an equilibrium is reached with the applied load. This example contains a frusto-conical bearing surface. Displacements in the axial direction may increase or decrease gap heights uniformly. A uniform decrease of all gap heights may reduce the required pumping flow rate and increase expected heat generation and viscous drag from friction. The opposite effect is expected for a uniform increase of all gap heights from such an axial movement. Flow resistances may be uniformly increased or decreased for all bearing landings implying no change in pressure in any of the bearing pockets from a pure axial movement. A self-compensating effect may be expected from radial displacements or angular displacements that would otherwise act to bend the shaft (not shown).

Bearing Examples C and D

Figure 89:
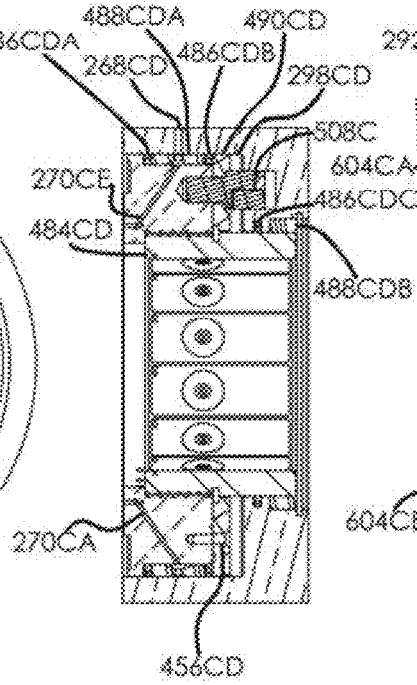
FIG. 89 is a cutaway view taken along section line 89-89 of FIG. 88.
Figure 90:
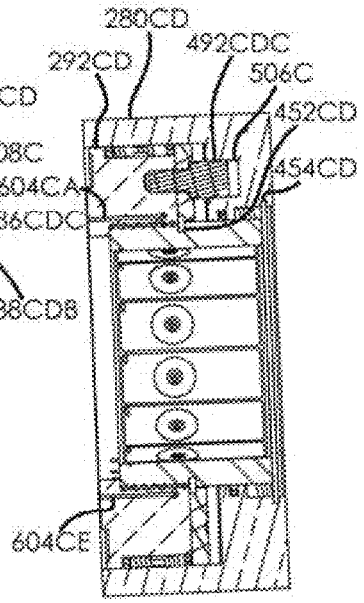
FIG. 90 is a cutaway view taken along section line 90-90 of FIG. 88.
Figure 91:
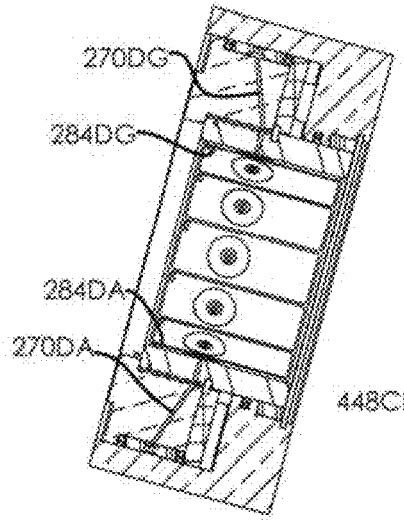
FIG. 91 is a cutaway view taken along section line 91-91 of FIG. 88.
Figure 92:
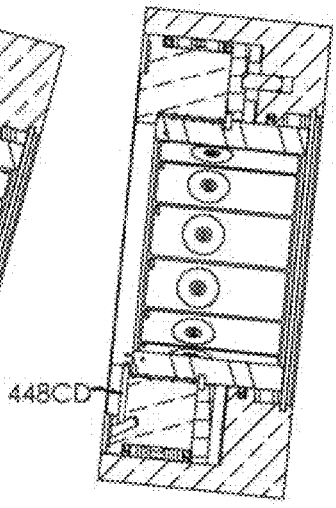
FIG. 92 is a cutaway view taken along section line 92-92 of FIG. 88.
Figure 93:
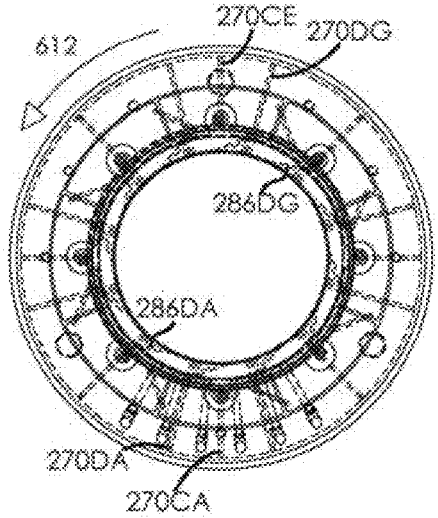
FIG. 93 is a front/hidden line view of the three components shown in FIG. 85.
Figure 94:
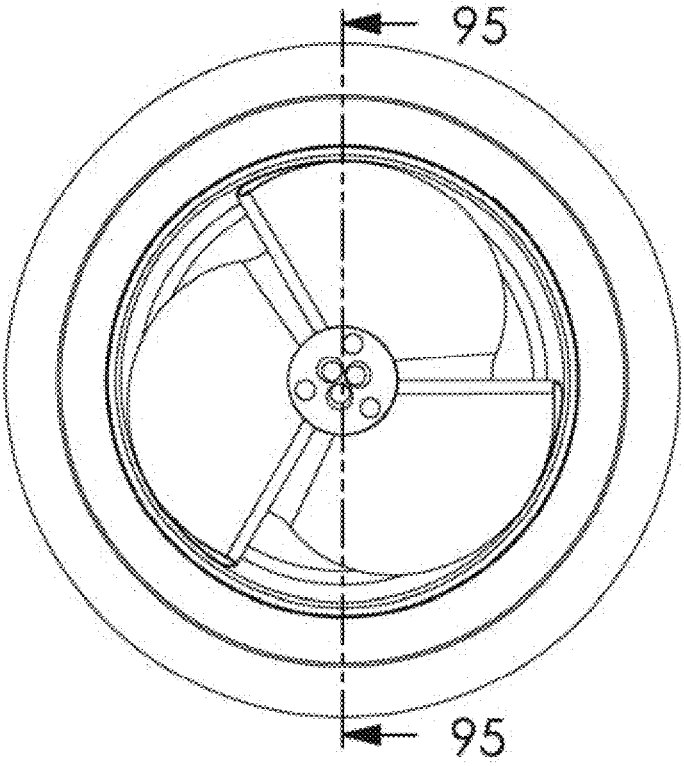
FIG. 94 is a front view of one example of some of the components shown in FIGS. 8A-8B.
Figure 95:
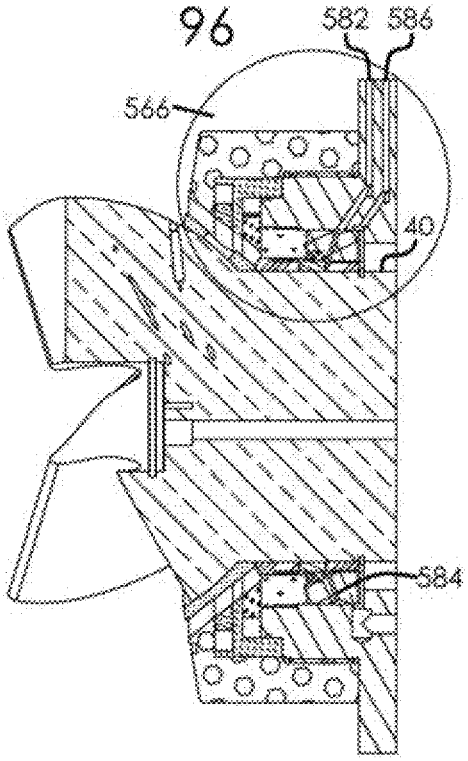
FIG. 95 is a cutaway view taken along section line 95-95 of FIG. 94.
Figure 96:
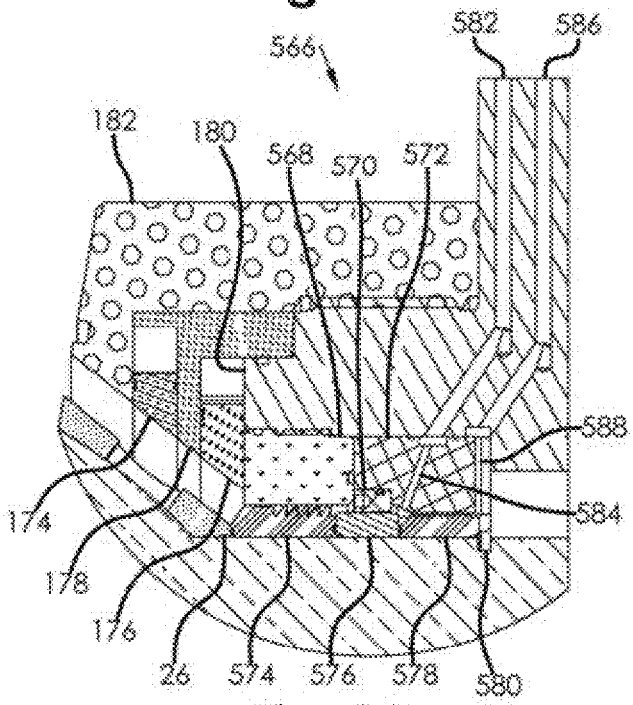
FIG. 96 is an enlarged view of the region 96 of FIG. 95.
Figure 97:
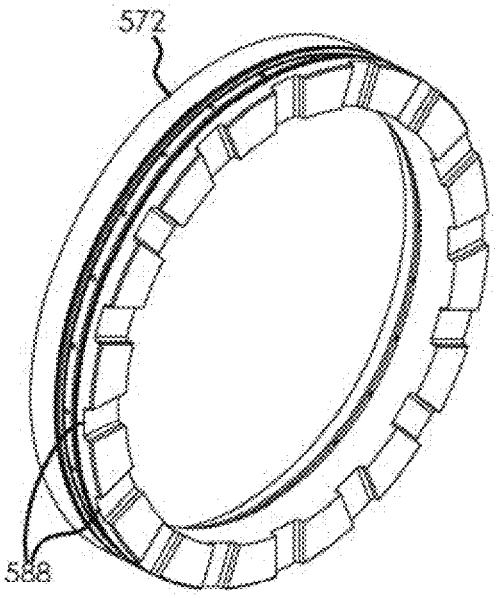
FIG. 97 is an isometric view of one of the components shown in FIG. 95.
Figure 98:
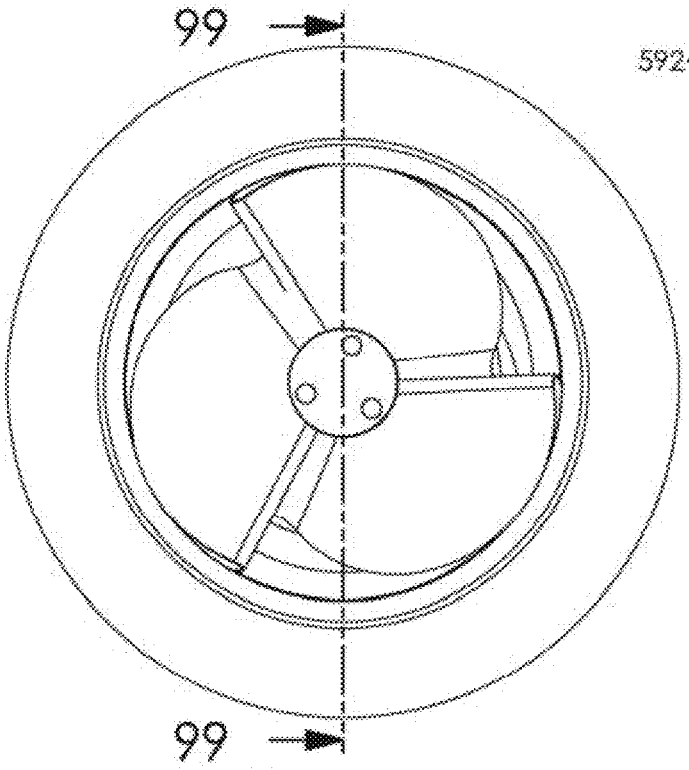
FIG. 98 is a front view of showing one example of some of the components shown in FIGS. 8A-8B.
Figure 99:
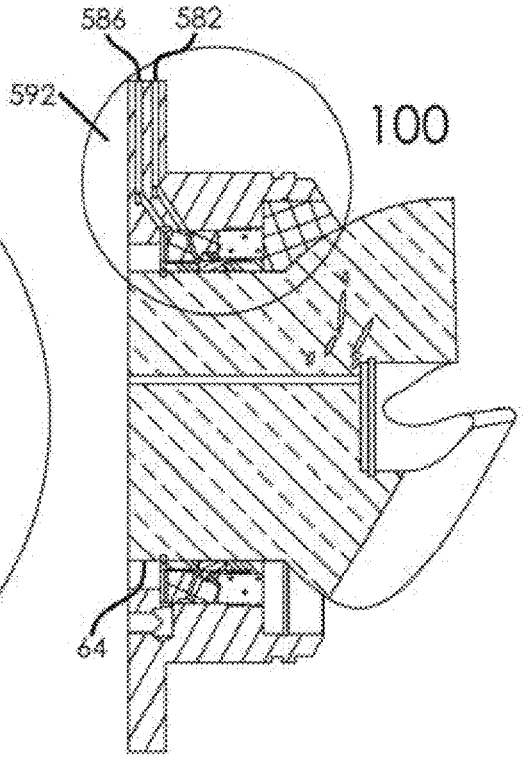
FIG. 99 is a cutaway view taken along section line 99-99 of FIG. 98.
Figure 100:
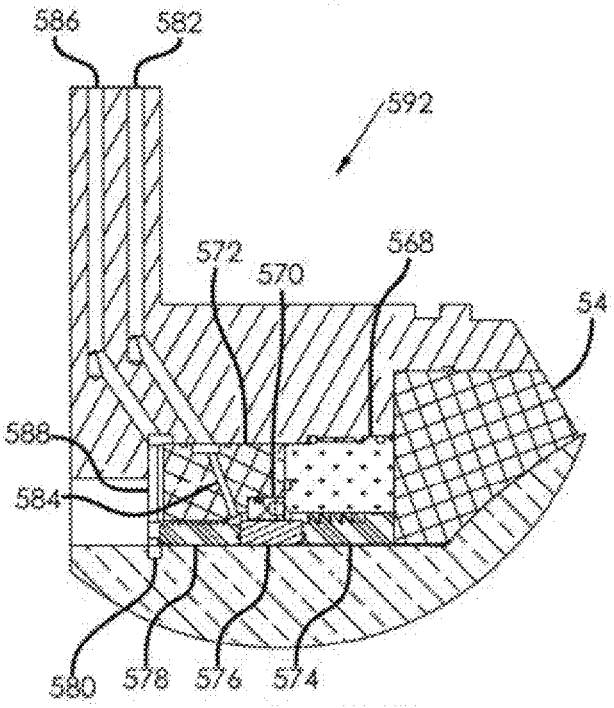
FIG. 100 is an enlarged view taken of the region 100 of FIG. 99.
Figure 101:
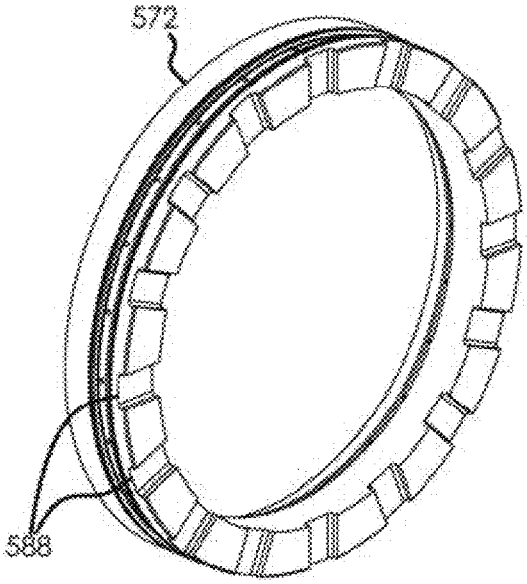
FIG. 101 is an isometric view of one of the components shown in FIG. 99.

The hybrid bearing 282CD shown in FIGS. 83-93 comprises the piston component 292CD, intermediate sleeve 482CD, inner component 484CD, seals 486CDA, 486CDB, 486CDC, "rider rings" 488CDA and 488CDB and end plate 490CD fastened together in one example by way of bolts, interference fit, press fit, welding, brazing, or other fasteners or fastening methods inside of an outer housing 494CD. Guide pins 492A, 492B and 492C may be fastened to the piston component 292CD. As seen in FIG. 89, guide pin 492CDC may form cavity 506C with the outer housing 280CD. Guide pins 492CDA and 492CDB may be constructed in the same manner. When used in combination, two or more guide pins may be used to substantially maintain rotational alignment of the outer housing 280CD with the end plate 490CD and piston component 292CD so that the drains holes 448CD are only required at the bottom of the bearing. These guide pins 492CDA and 492CDB may be configured to not interfere with how the piston component 292CD may be moved axially, when desired. Looking to FIGS. 89-90, if the fluid conduit 508C in a guide pin 492CD is sufficiently large, the pressure in the cavity 506C in one example may be substantially the same as the pressure in cavity 298CD. It is to be understood that guide pins may be used with other bearing examples disclosed herein that may be used to resist thrust and bending moment loads. Additionally, a rotating shaft with a radially extending member may form substantially small gaps with the adjacent bearing surfaces described below.

Supply holes 270C(A-H) and 270D(A-L) of respective bearing examples C and D are in fluid communication with supply port 268CD. Flow and pressure from 270C(A-H)/270D(A-L) may be regulated across inner landing 272CA/272DA before entering a substantially annular groove 274CA/274DA which is in fluid communication with the opposing bearing pocket 284CE/284DG via sequential fluid conduits 604CE/604DG, 606CE/606DG and 286CE/286DG. As was described for FIG. 71A, when gap heights are reduced at a bearing pocket the pressure and flow resistance of that pocket may increase, while the pressure and flow resistance of the opposing bearing pocket may decrease. This may create a self-compensating effect until an equilibrium is reached with the applied loads causing radial displacements or angular displacements that would otherwise act to bend the shaft.

Other Bearing Examples

Figure 6:
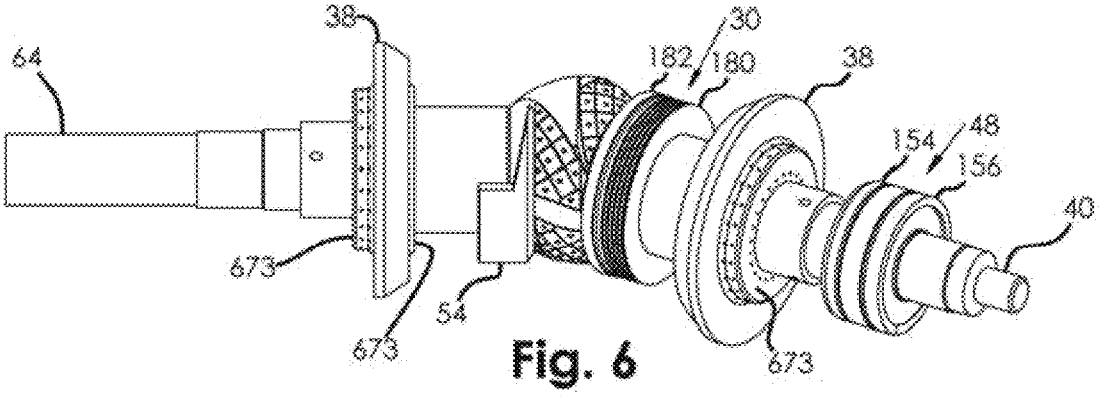
FIG. 6 is an isometric view of the example shown in FIG. 1 with several components removed to show several internal components.
Figure 7:
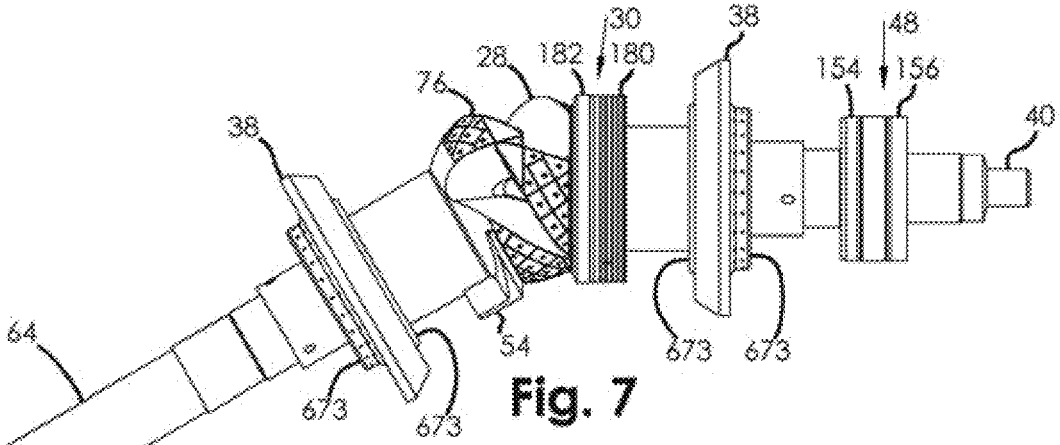
FIG. 7 is a top view of the example shown in FIG. 6.

In the example of FIG. 2 and FIGS. 6-7 the collars 38 are shown to comprise substantially planar surfaces 673 immediately adjacent to front/rear pistons 32/42. The planar surfaces offset from the pistons, thus forming substantially small gaps therebetween in bearings 118/120. Holes 108 of the example shown indicate where restrictor bodies 348A or 384B (FIGS. 65-69) may be fastened. One example of this capillary restrictor design is shown in FIGS. 65-69. This application of capillary restrictors at the locations shown around the circumference of the collars 38 may resist axial or angular displacements or deflections that would otherwise act to bend the idler/driver rotor shafts 40/64.

Figure 61:
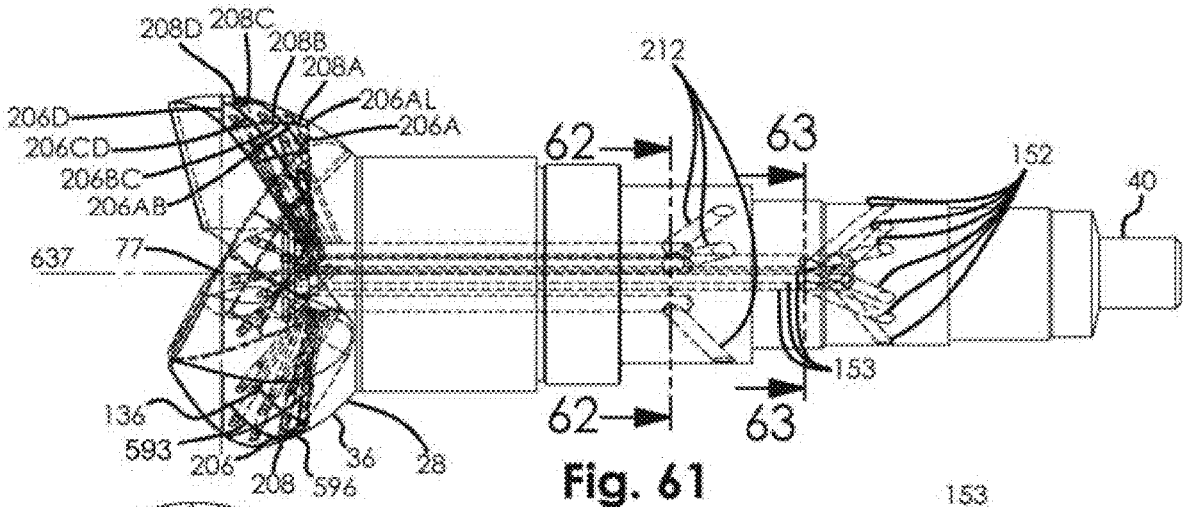
FIG. 61 is a side/hidden line view of several internal components of the example shown in FIG. 1.
Figure 62:
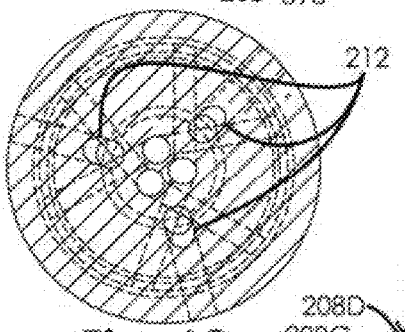
FIG. 62 is a cutaway hidden line view taken along section line 62-62 of FIG. 61.
Figure 63:
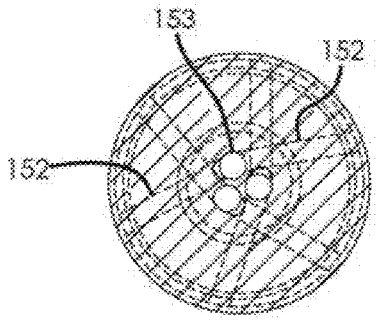
FIG. 63 is a cutaway hidden line view taken along section line 63-63 of FIG. 61.

In one example the capillary restrictors 348 and downstream bearing pockets 208 could alternatively be included in the bearing surfaces of the collars 38 (e.g., substantially planar surfaces 673 in FIGS. 6-7) and the front/rear pistons 32/42 may have substantially planar surfaces immediately adjacent. In the example of FIG. 61-63, the surfaces configured to supply fluid into a rotating component has been illustrated comprising hole 212 in the rotating part (e.g., idler rotor shaft 40) in continuous fluid communication with an immediately adjacent groove 211 (FIG. 60C) on a stationary component. Alternatively, the designs of either FIG. 71A or FIG. 71B may be incorporated into the collars 38 with supply lines 270 or 394 being fed in a similar manner. As an example, bearing pocket 284QA may be one bearing pocket of bearing 118, while bearing pocket 284QG may be one bearing pocket of bearing 120. As shown in FIG. 71A, these bearing pockets may directly oppose each other. When a plurality of bearing pockets is provided in bearings 118 and 120, these bearings may resist a combination of axial and angular displacements.

The designs of FIG. 71A and FIG. 71B may be modified by adding one or more capillary restrictor(s) to supply bearing pockets. Fluid conduit 286QG is configured to supply fluid to bearing pocket 284QG. A capillary restrictor 348 (examples in FIGS. 66-69) may be utilized parallel to fluid conduit 286QG such that the flows from each fluid conduit only become mixed in the bearing pocket 284QG. In this manner the flow resistance of the capillary restrictor 348 is in parallel to the equivalent flow resistance between the supply 270QA and bearing pocket 284QG on the diametrically opposed bearing surface. When applied to examples such as in Bearing Example C in FIGS. 83-93, Bearing Example C may be configured to resist axial and angular displacements. Bearing Example CD may be configured to resist axial, angular, and radial displacements.

Designs herein such as FIG. 71A and FIG. 71B may be modified by adding one or more capillary restrictor(s) in current flow paths such as in conduit 602QG or 270QA for example. If a substantially large percentage of the flow is forced through the capillary restrictor in one of these fluid conduits, then it functions as a series flow resistance.

Figure 71C:
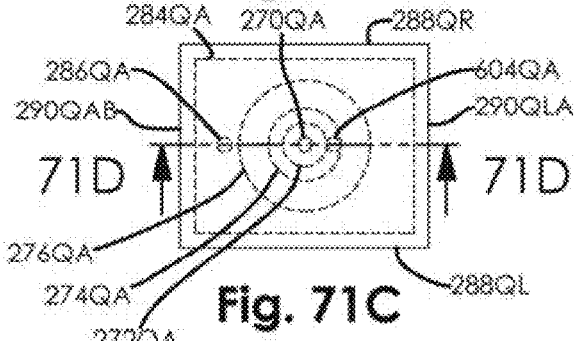
FIG. 71C is a hidden line/top view of the top portion of the example shown in FIG. 71A where an additional component is shown.

The hybrid bearing examples show bearing pockets 284 as recessed surfaces from the immediately adjacent landing surfaces. These recessed bearing pockets 284 are configured to reduce friction between the structure on which the bearing pocket is formed, and the adjacent surface having relative movement relative to the bearing pocket. In one example, shown in FIG. 71B the recessed bearing pockets 284 comprise a fluid inlet 394 of pressurized fluid and thus are configured to reduce friction between the component 620 and the adjacent abutting surface 671 of a component 671 shown in FIGS. 71C-71D. In one example the device is configured such that pressure distribution may not vary substantially within a pocket. The pressure distribution may vary substantially across landings wherein the flow restriction may be substantially higher. Alternatively, bearing pockets may also be configured without recessing the bearing pockets relative to the landings where a plurality of surfaces defining holes 286 are used to define the perimeter of a bearing pocket 284. These holes 286 in the example of FIG. 71A are in fluid communication with the substantially circular annular groove 274 at the diametrically opposite bearing pocket where the central holes 270 are supplied with high pressure fluid. In the modified design of FIG. 71B, where the circular annular grooves 274 are supplied with high pressure fluid, each central hole 610 is in fluid communication with the holes 286 in the diametrically opposite bearing pocket. The supply pressure at supply conduits of opposing bearing pockets in such an example may be at substantially the same pressure where the flow restriction in the connected fluid conduit is substantially lower than the flow restriction at the bearing surface, such as the landing area between the feeds and the drains. In one example the pressure-induced flow is laminar to have greater accuracy when using the calculation method herein. This pressure-induced flow is known the field of fluid dynamics as "Poiseuille flow". It is understood that laminar flow through a passageway of constant cross sectional area may produce a substantially linear pressure gradient from one end to the other. Examples with constant cross sectional flow area may include flow through a pipe, or flow through two parallel plates. These parallel "plates" may be paired concave/convex surfaces such as an outer housing and inner shaft of the hybrid bearing examples shown. When a relative velocity is imposed, frictional drag-induced flow (Couette flow) may act to "pump" the substantially incompressible liquid in the direction of relative component velocities (i.e., hydrodynamic effect). In the shaft example given, a circumferential flow of fluid creates additional pressure spikes at edges of bearing pockets that may contribute additional load capacity. This extra layer of complexity may be accounted for by Computational Fluid Dynamic (CFD) studies or other calculation methods known in the art. However, it is proposed to do a more simplified calculation approach that may underestimate the load capacity of a hybrid bearing when the hydrodynamic effect is present.

By providing a plurality of fluid inlets along the perimeter of where a bearing pocket is desired, the pressure between those fluid inlets may be substantially equivalent pressure and therefore may function as if the entire pocket were recessed, providing a substantially similar capacity to resist loads from the hydrostatic effect. For example, in FIG. 71A, bearing pocket 284QA is shown as recessed, defined by immediately adjacent landings 290QAB, 290QLA, 288QL, 288QR and by 276QA. Fluid inlet/hole 286QA is shown to supply bearing pocket 284QA. Alternatively, if the bearing pocket 284QA is not recessed, but a plurality of holes 286 and/or grooves exist defining perimeters of the said landings, the pressure distributions and gradients from the hydrostatic effect may be substantially similar in comparison to the recessed bearing pocket 284QA shown in FIG. 71A. If the bearing pocket with no recess is compared to a bearing pocket of the same size with a recess, the bearing pocket with no recess may have a substantially higher surface area with small gaps, which, in one example, may increase the hydro-dynamic effect and subsequently increase the overall load capacity of the bearing. This modification may produce relatively higher viscous drag and heat generation, so it may be important to weigh the anticipated benefit to overall load capacity, if any is expected, from the hydrodynamic effect. In examples where the load capacity of the bearing cannot be increased by other means (e.g., Increase bearing surface area and/or supply pressure), this modification may be utilized. In one example, the power losses and additional fluid heating from the additional viscous drag may be substantial and benefits from the hydrodynamic effect may rely on a minimum relative surface speed at the bearing surfaces.

Thermal Expansion Adjustment at Bearings

Figure 8:
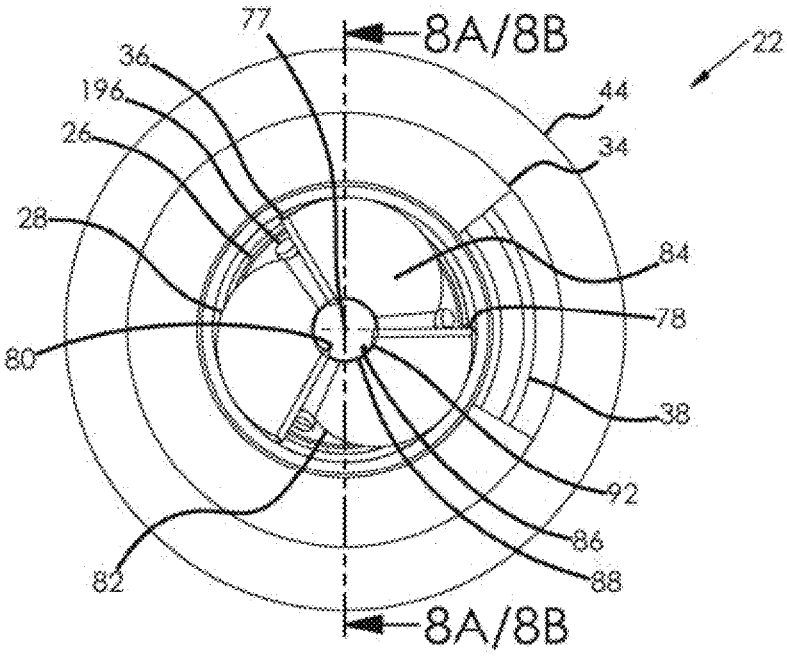
FIG. 8 is a front view of several internal components of the example shown in FIG. 1.
Figure 8A:
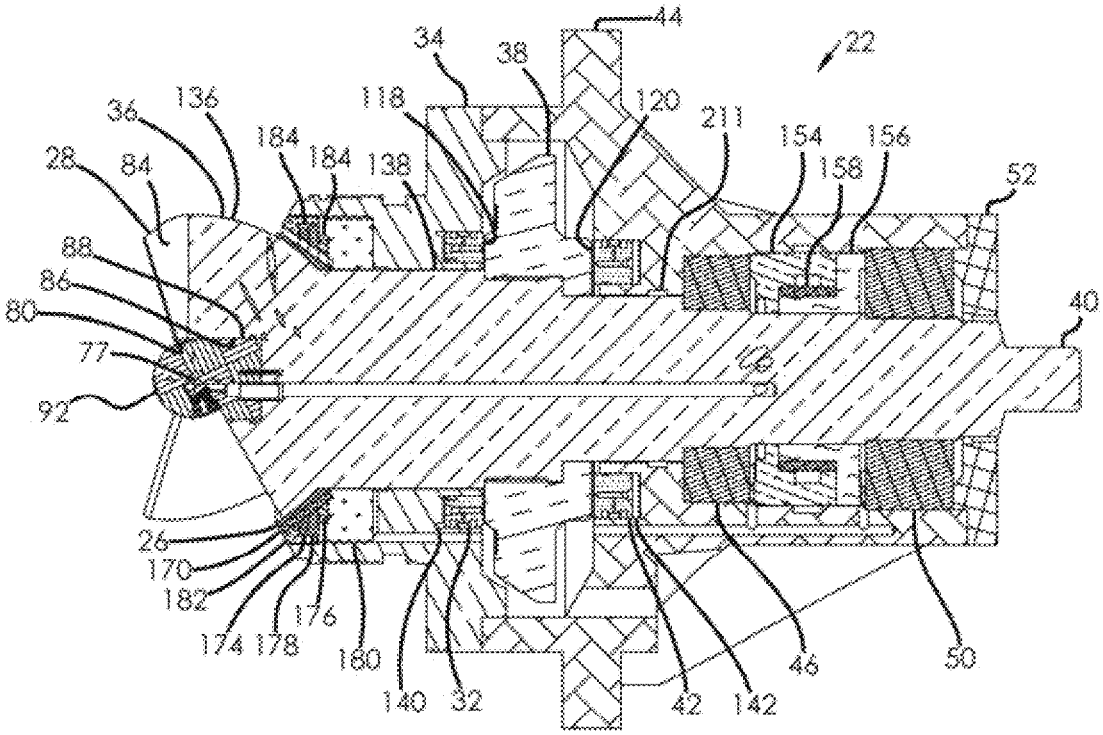
FIG. 8A is a cutaway view of the example shown in FIG. 8 taken along section line 8A-8A.
Figure 8B:
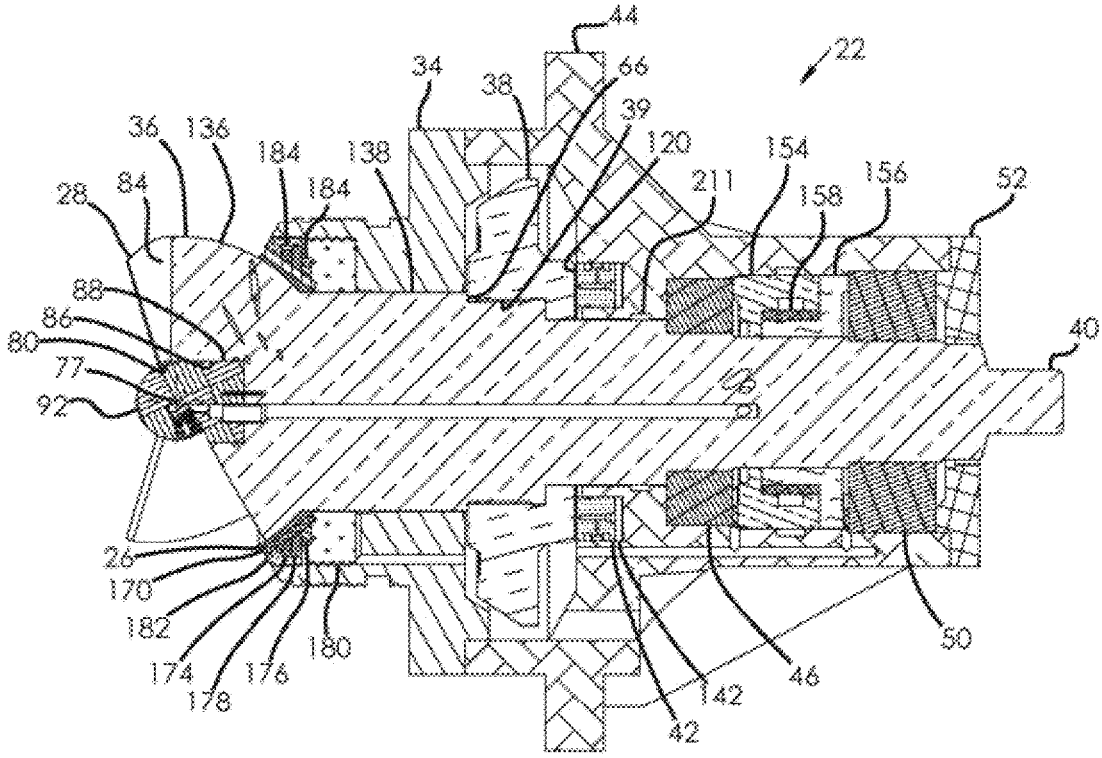
FIG. 8B is a cutaway view taken along section line 8B-8B of FIG. 8.

In one example, the hybrid bearing assembly 282CD in FIGS. 83-93 is configured to be used in place of the rear cylinder 42 in FIG. 8B. In this example, the front cylinder 32 (FIG. 8A) may not be needed. The piston component 292CD may be assembled with the intermediate sleeve 482CD, inner component 484CD, end plate 490CD and outer housing 280CD to form a cavity 298CD (FIG. 89). This cavity 298CD may be sealed using seals 486CDA, 486CDB, 486CDC and outer housing 280CD. Such a cavity may be functionally analogous to cavity 142 in FIG. 2 or FIG. 8A and may be used to axially translate the rear cylinder 42 relative to the idler/driver rear bearing housing 44/70, as discussed herein. The hybrid bearing assembly 282CD may resist radial loads, rider rings 488CDA and 488CDB may be used. These rider rings may be a removable component as shown, or as part of the piston component 292CD and outer housing 280CD. Groove 452CD may be configured to retain a split ring or equivalent so that the piston component 292CD, intermediate sleeve 482CD and inner component 484CD may be securely fastened to each other. Bolts or other fasteners or other fastening methods hold the end plate 280CD in place, thereby securing the seals 486CDA and 486CDB and the rider ring 488CDA. Hole 456CD is shown in FIG. 89 as an example of a structure where a bolt may be utilized for fastening the components. Groove 454CD may be configured to hold a retaining ring so that the rider ring 488CDB is secured to the outer component 280CD. The rider rings 488CDA and 488CDB allow the inner component 484CD (and attached components such as the piston 292CD) to translate axially relative to the stationary components (e.g., Outer component 280CD), as required, with minimal friction. The rider ring 488CDA may have its movement secured to the piston 292CD by fastening the end plate 490CD unlike how the rider ring 488CDB is shown to be secured to the stationary outer component 280CD. In either case, relative axial movements are expected at the rider rings 488CDA/488CDB. The low coefficient of friction of the rider ring 488CDA/488CDB allows this movement with relative ease, and since it is a softer material, it is expected to show signs of wear and may be inexpensively replaced, if required, with minimal or no wear on the adjacent outer housing 280CD or inner component 484CD, respectively.

Bearing Load Capacity

In one example, cross-communication may occur between grooves. Such cross-communication may reduce the load capacity of a bearing. For example, in FIG. 84, groove 606DA may be positioned in close proximity to groove 606LA and 606DB and thus in a non-tight fit configuration, some cross-communication (flow between adjacent grooves/pockets) may be encountered. The intermediate sleeve 482CD of FIG. 84 may be utilized in examples where many bearing pockets 284 are desired. Increasing the number of bearing pockets on a radial bearing may increase the capacity of the bearing to resist radial loads. Additional landing area may increase viscous drag and heating from friction in components in contact or near contact due to relative motion between them. In addition, a warmer exit temperature for the bearing fluid may require more power to cool the fluid down to the supply temperature. Since higher temperatures may decrease the viscosity, and therefore decrease the capacity for the bearing to resist loads, it may be desired in some applications to increase leakage rates to control this temperature increase. In some examples, the hydrodynamic effect may be particularly sensitive to viscosity while the hydrostatic effect theoretically may have minimal influence. This additional pumping power and other increases in parasitic power may be justified where the bearing is designed to be near maximum load capacity, but these tradeoffs should be understood when determining the number of bearing pockets. The 'thrust' bearing embodiments disclosed herein may be configured to resisting moment loads that would act to bend the shaft where a plurality of bearing pockets are used. If only one concentric annular bearing pocket were used, the bearing of some examples may not be capable of resisting moment loads that would act to bend the shaft. In applications where primarily thrust loads are anticipated, 8 or less bearing pockets may be an optimal choice in some applications, whereas more than 8 bearing pockets may be optimal in applications where primarily bending moment loads are anticipated.

Supplying Capillary Free Self-Compensating Hybrid Bearings with Restrictors in Bearing Pockets Examples shown in the drawings illustrate how capillary-fed self-compensating hybrid bearings may be supplied when incorporated in the rotary fluid flow device 20. For example, in FIG. 60A, a single supply line 218 is in fluid communication with the circumferential groove 219 is in fluid communication with a plurality of fluid conduits 221 (FIG. 60B) supplying a plurality of bearing pockets for the idler shaft hybrid bearings 138. In one example these same examples may apply in supplying capillary free self-compensating hybrid bearings 138/72/118/120 with restrictors 277 (FIG. 71A) in bearing pockets 284.

Figure 103:
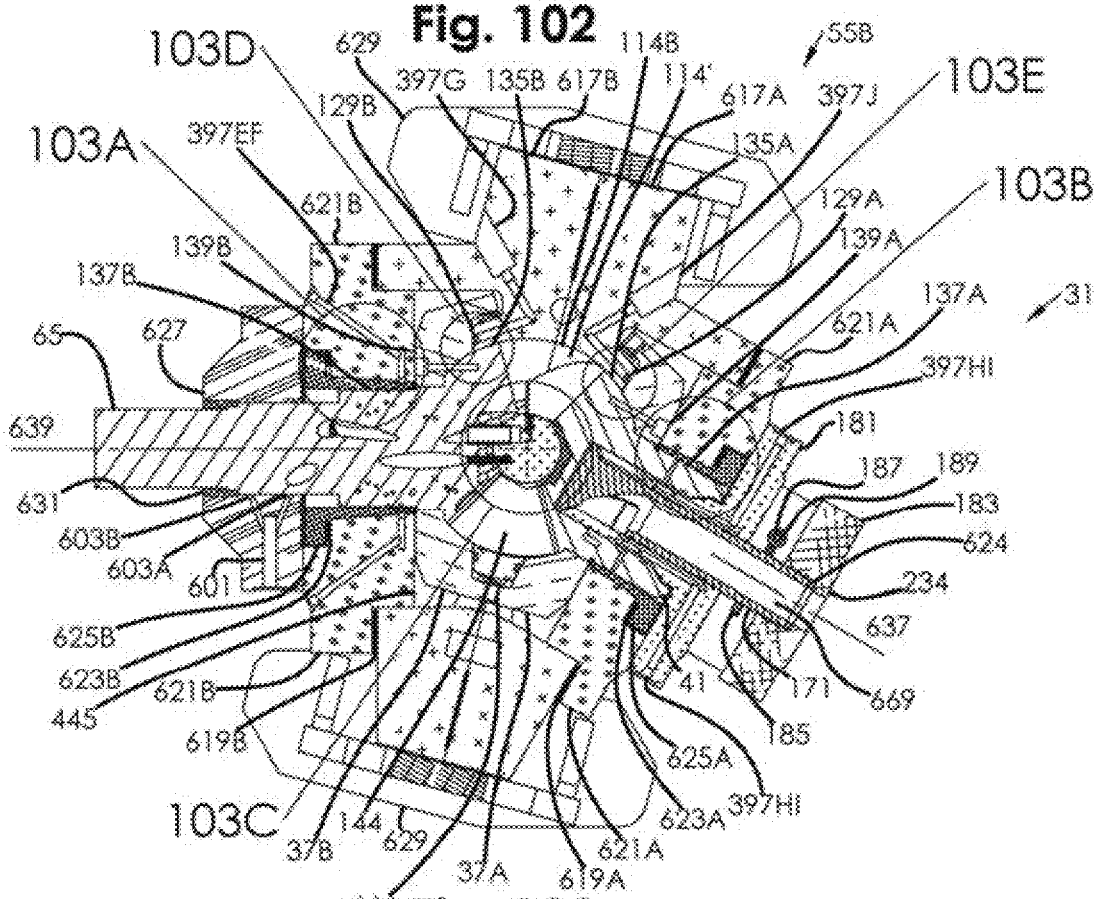
FIG. 103 is a cutaway view of the example shown in FIG. 102 taken along section line 103-103.

Novel Capillary Free Self-Compensating Hybrid Bearings with Opposed Restrictors and Bearing Pockets In the hybrid bearing examples shown in FIGS. 71A-71B and FIGS. 73-93, the restrictors 277 are configured within a bearing pocket 284QA on the diametrically opposite side of the bearing pocket 284QG. In one example, the bearing pocket 284QG is being supplied with fluid under pressure via supply line 270QA. This configuration is generally not applied to the idler/driver rotor hybrid bearings 136/134 in examples comprising an odd number of lobes, wherein the valleys 82 diametrically oppose lobes (78A and 78B). In examples where an even number of lobes are used, this configuration may be utilized. In another example, with an even number of lobes 78, the largest expected load is expected to occur at a valley 82, where there is minimal bearing support. Additionally, the loads that are expected at the idler/driver rotor hybrid bearings can be substantial. Substantial pressure-induced radial or axial loads may originate from the compression chamber 144. As the offset angle between the idler/driver rotor shaft axes 637/639 ("alpha angle") shown in FIG. 103 increases, the radial portion of the pressure-induced load increases and the axial portion decreases. Higher offset angles allow for higher volumetric throughput for a given rotor diameter and involute rotor profile, and thus are thought to be generally preferred up to upper limitations typically defined by the minimum diameter of the idler/driver rotor shafts 41/65. Such a minimum diameter of the idler/driver rotor shafts 41/65 may be substantially determined by their structural rigidity and strength as well as other factors including how other components may be assembled. In the example of FIG. 103, the idler rotor shaft 41 is shown to have components such as the primary gate 171 and primary gate housing 181 at the inside diameter. If the alpha angle is increased, the valleys 82A (FIG. 115) are cut deeper into the idler rotor shaft 41. To make the same arrangement possible, the idler collar 37A and idler rotor shaft 41 may be decreased in diameter. To maintain this same thickness of the idler rotor shaft 41, the primary gate 171 and primary gate housing 181 may need to be decreased in diameter. This may restrict the flow path in the discharge plenum 669 beyond what is desired and/or negatively influence the structural rigidity of those components and the idler rotor shaft 41 in that the structural rigidity may be substantially proportional to the magnitude of the outer diameter of these components.

In examples where the bearing pocket comprises restrictors 277, there is less area available to resist the loads and therefore the bearing supply pressure would have to be increased to achieve the same load capacity. Furthermore, if the rotor lobes (78A and 78B) comprise a relatively large diameter and mass, when their respective shafts are rotated at a relatively high rotational speed, the rotor lobes 78 may be pressured radially outwards towards the frustra-spherical surface 114 of the housing 55. In the absence of pressure induced loads from the chamber 144 (between rotors), this centrifugal loading could cause the rotor lobes 78 to deflect towards the inner frusto-spherical housing surface 114B (FIG. 103). This configuration comprising restrictors inside bearing pockets may not have a self-compensating effect for centrifugal loading or for thermal expansion, unlike the (optionally capillary fed) hydrostatic bearing designs disclosed herein. In the examples shown in FIGS. 102-163, the idler/driver rotor hybrid bearings 135A/135B (e.g., FIG. 120) may self-compensate for centrifugal loading and thermal expansion without using capillary restrictors. The idler/driver radial shaft (137A/137B), rear thrust (139A/139B) and front thrust (129A/129B) hybrid bearings may also self-compensate for centrifugal loading and thermal expansion without using capillary restrictors.

Figure 71D:
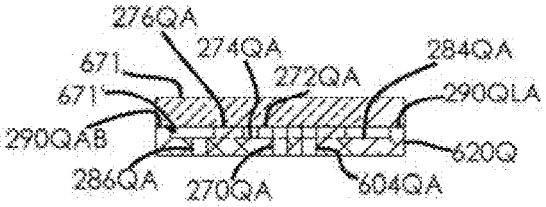
FIG. 71D is a cutaway view taken along section line 71D-71D of FIG. 71C.
Figure 72A:
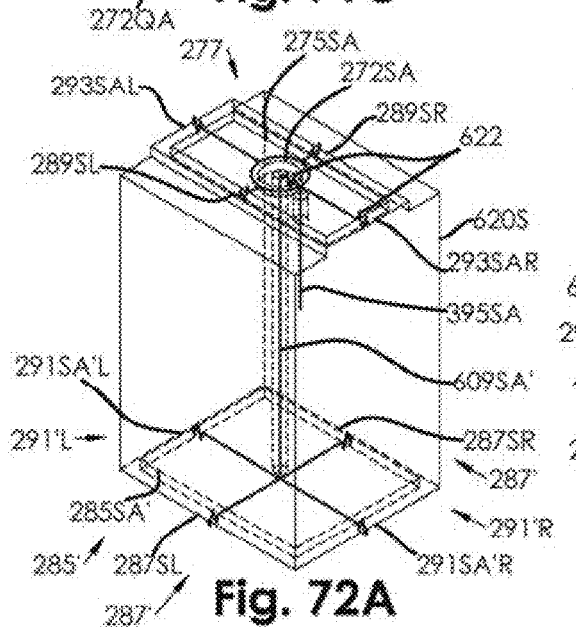
FIG. 72A is an isometric view of one example of a novel disclosed bearing without opposing bearing pocket(s).
Figure 72B:
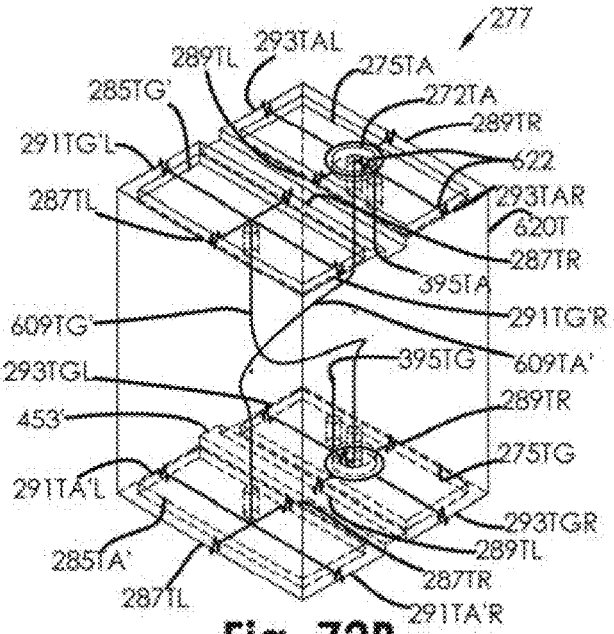
FIG. 72B is an isometric view of another example of a novel disclosed bearing without opposing bearing pocket(s).
Figure 73:
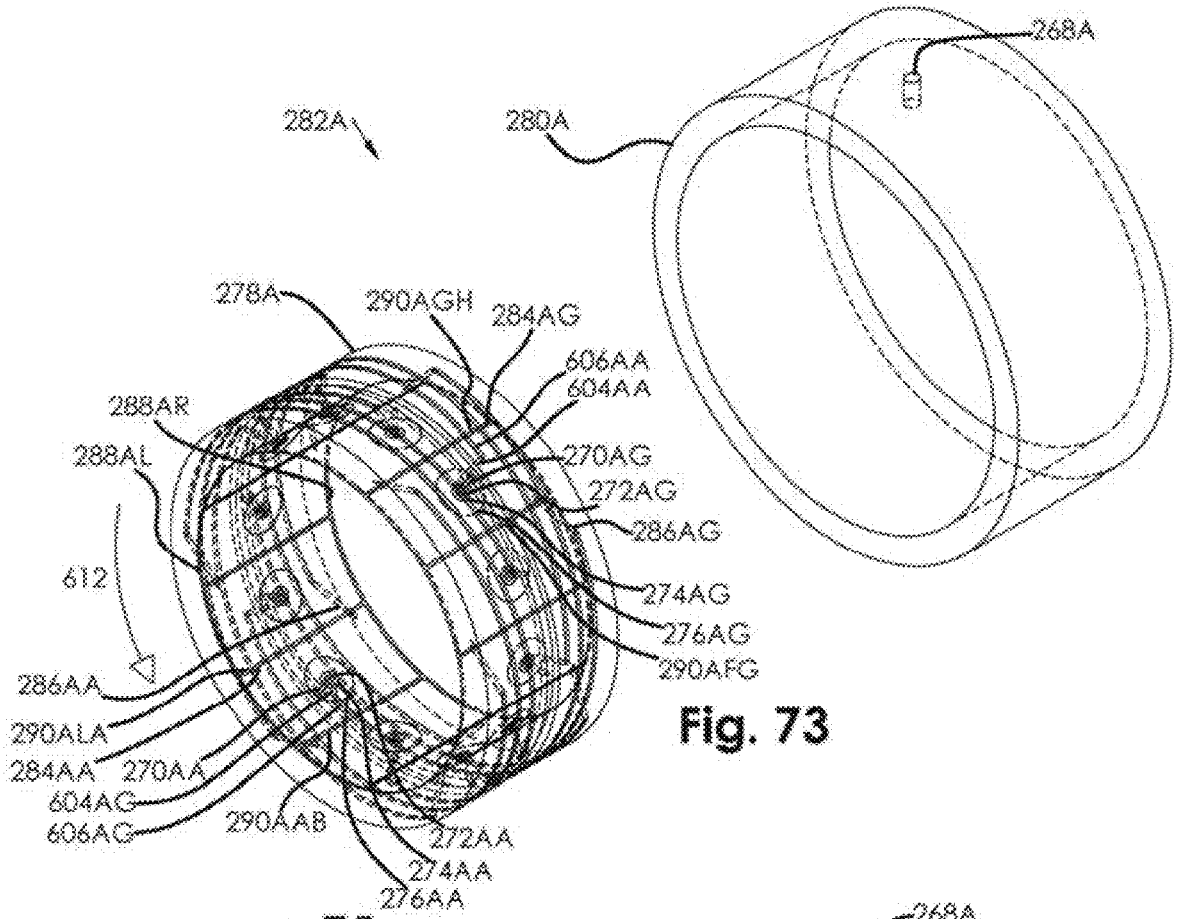
FIG. 73 is an exploded hidden line view showing an example of shaft hybrid bearings configured to resist radial loads in FIG. 1.
Figure 74:
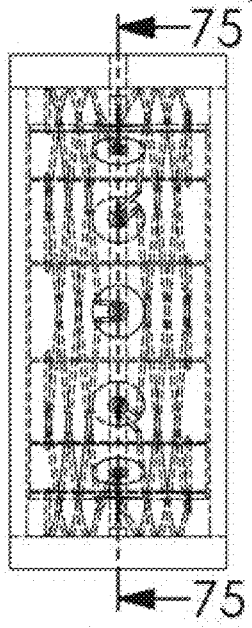
FIG. 74 is a side hidden line view of the components shown in FIG. 73.
Figure 75:
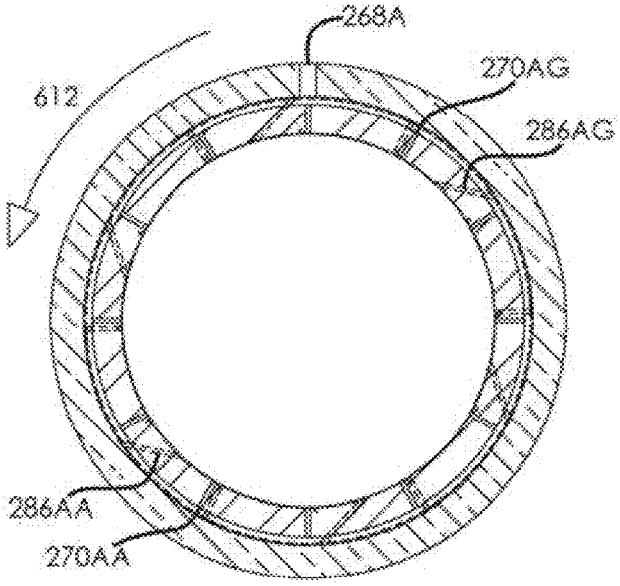
FIG. 75 is a cutaway hidden line view taken along section line 75-75 of FIG. 74.
Figure 76:
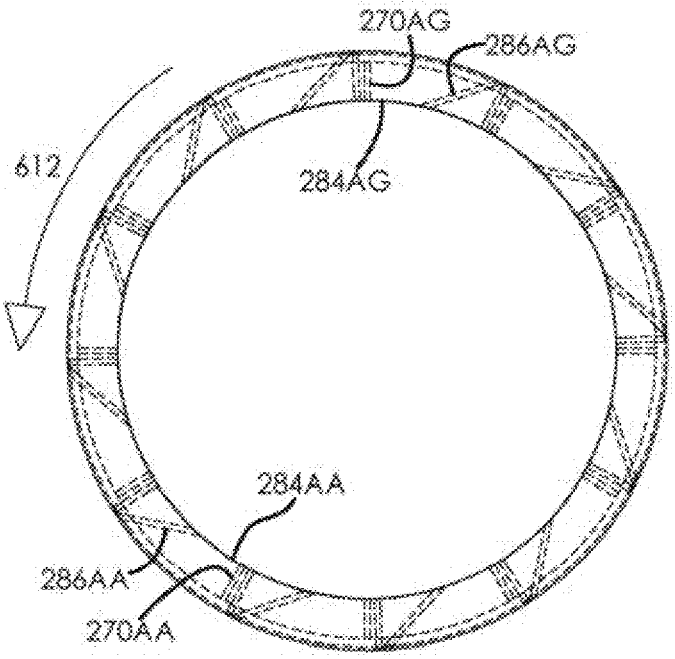
FIG. 76 is a front hidden line view of one of the components shown in FIG. 73.
Figure 77:
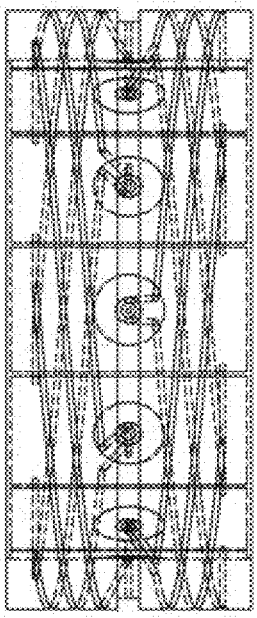
FIG. 77 is a side/hidden line view of the component shown in FIG. 76.
Figure 78:
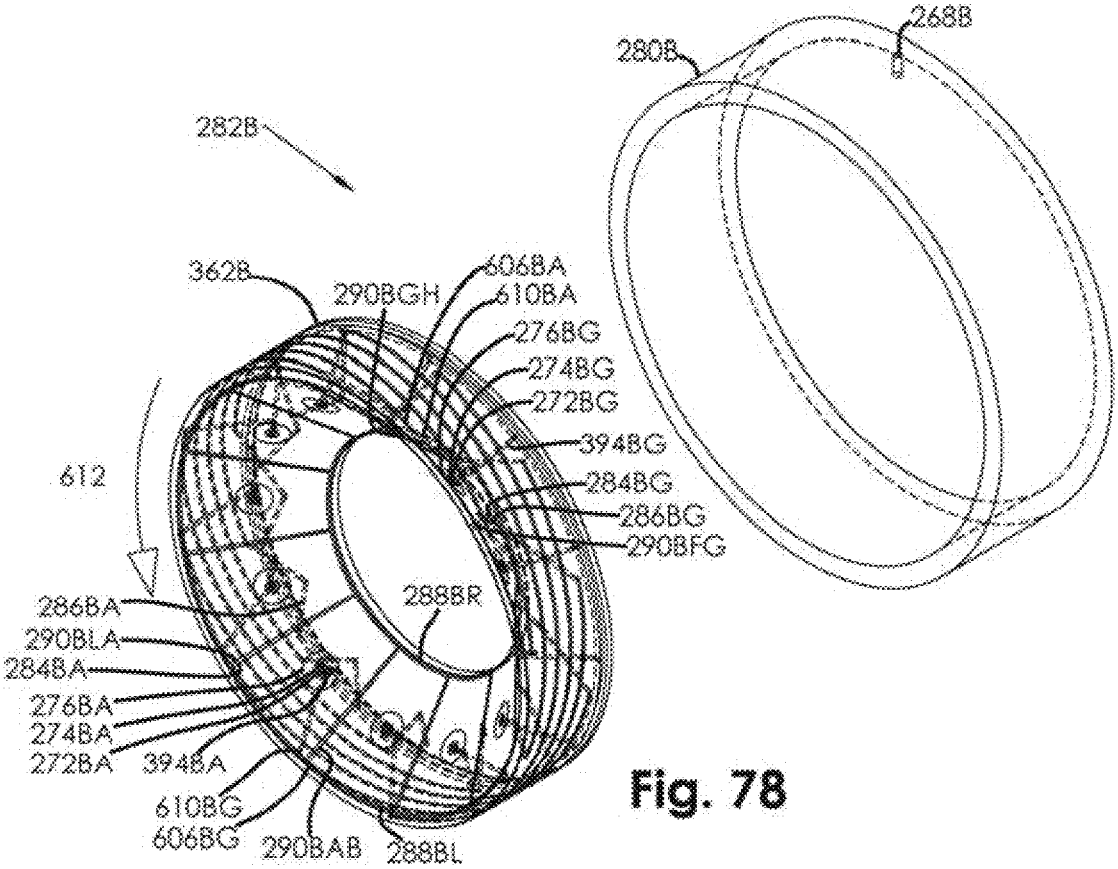
FIG. 78 is an exploded/hidden line view showing one example of combined shaft and thrust hybrid bearings in FIG. 1.
Figure 79:
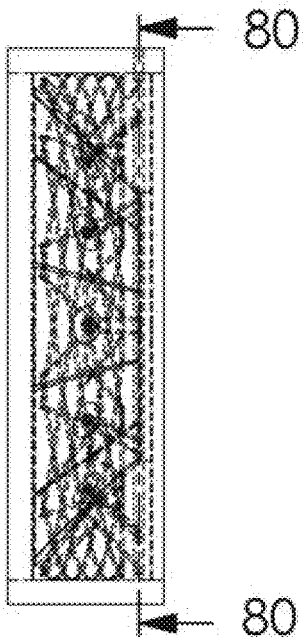
FIG. 79 is a side hidden line view of the components shown in FIG. 78.
Figure 80:
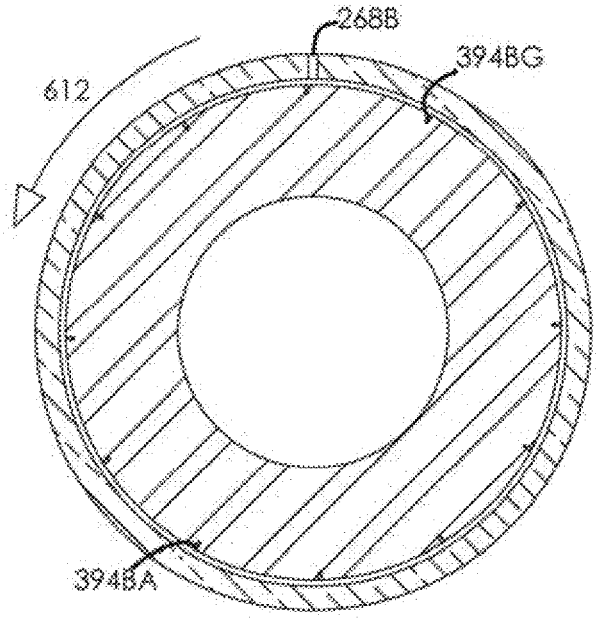
FIG. 80 is a cutaway view taken along section line 80-80 of FIG. 79.
Figure 81:
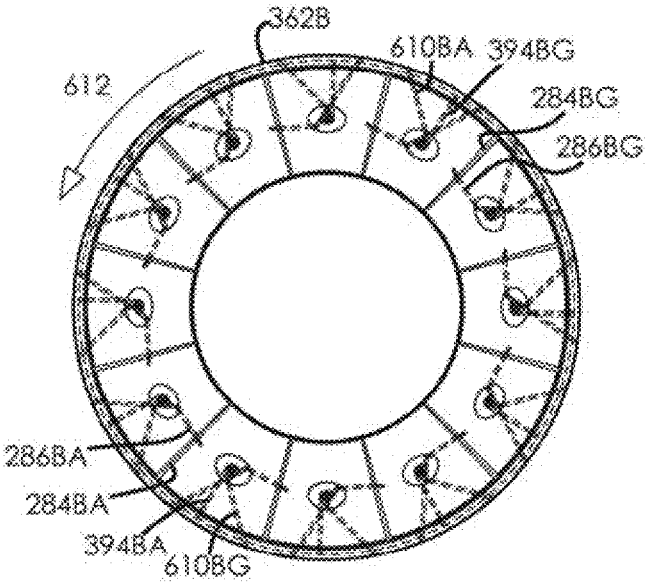
FIG. 81 is a front view of one of the components shown in FIG. 78.
Figure 82:
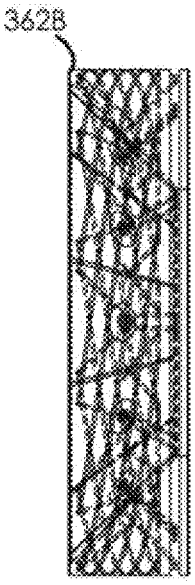
FIG. 82 is a side view of the component shown in FIG. 81.
Figure 83:
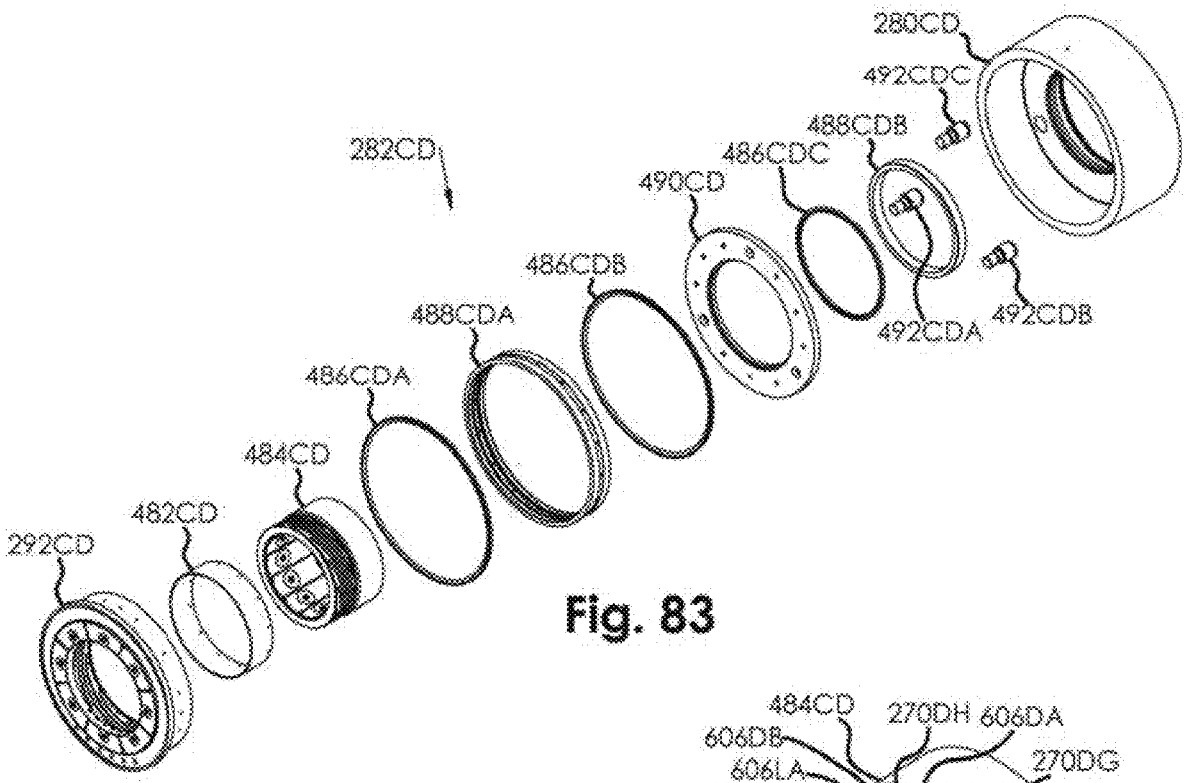
FIG. 83 is an exploded view showing one example of a rear or front cylinder from FIG. 1 with combined shaft and thrust hybrid bearings which may be configured to resist radial, axial, and bending moment loads.
Figure 84:
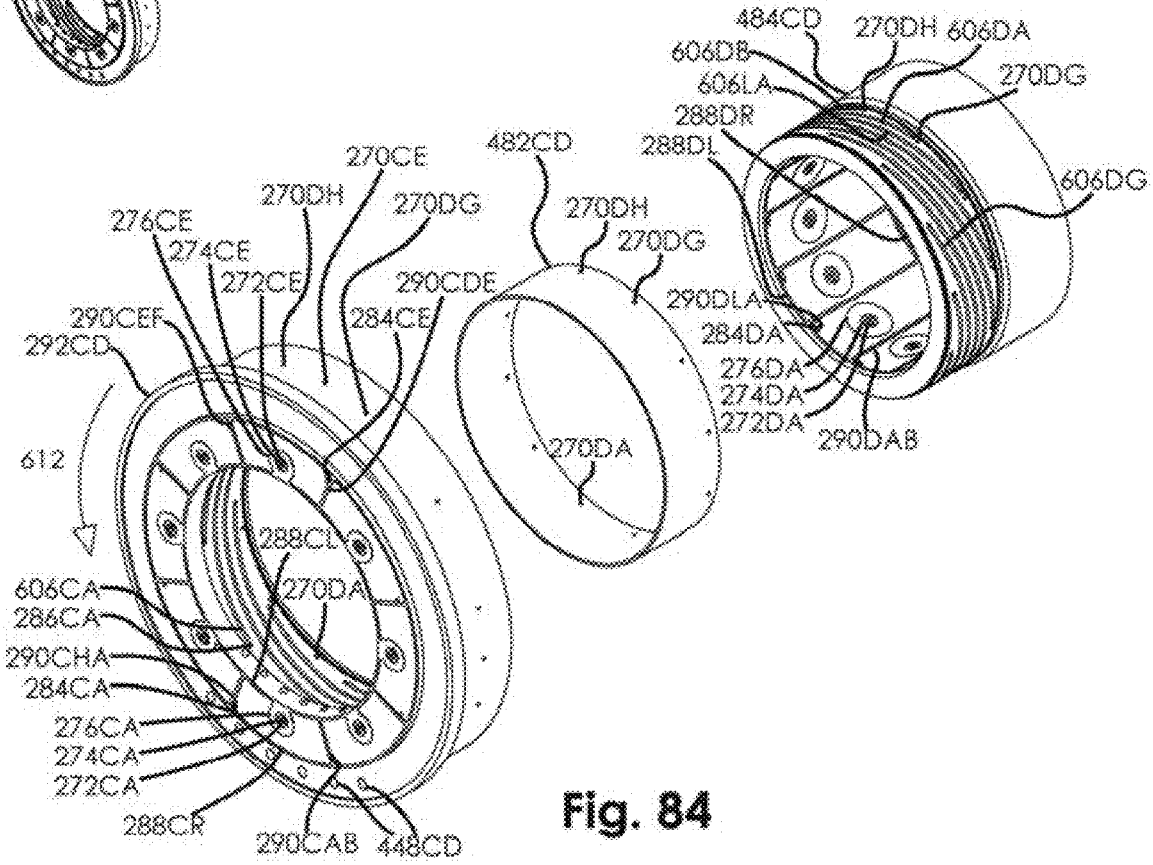
FIG. 84 is an exploded/isometric view showing one example of a rear or front cylinder from the example shown in FIG. 1 with combined shaft and thrust hybrid bearings which may be configured to resist radial, axial and bending moment loads.
Figure 85:
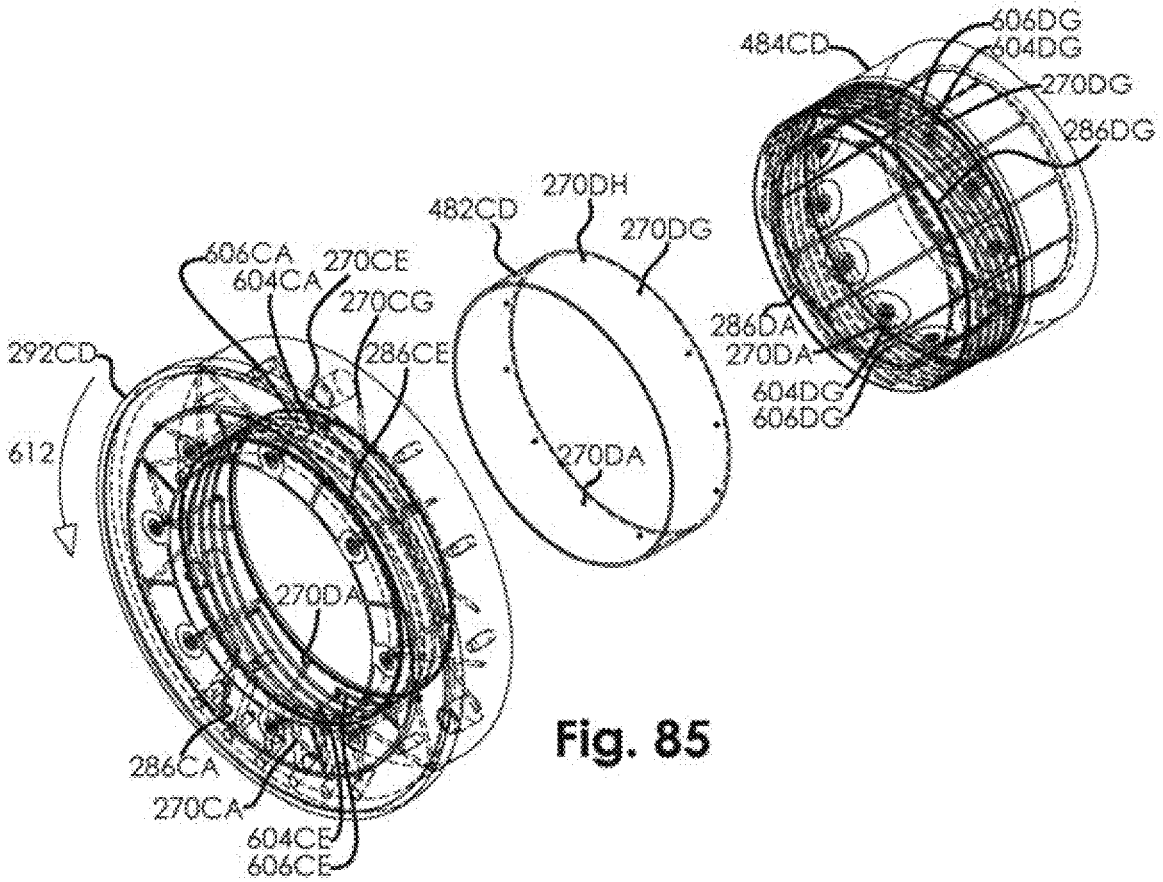
FIG. 85 is an exploded view of several components shown in FIG. 83.
Figure 86:
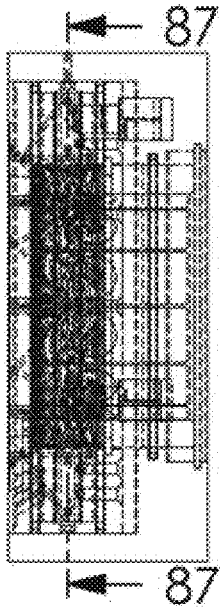
FIG. 86 is a hidden line view of several components shown in FIG. 83.
Figure 87:
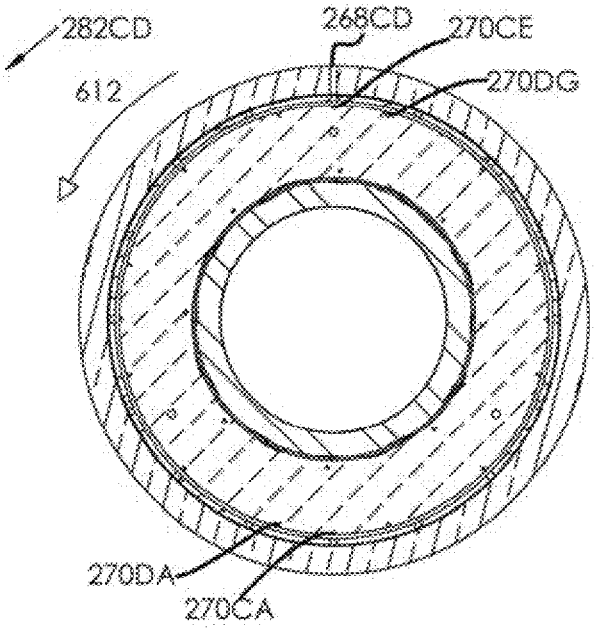
FIG. 87 is a cutaway view taken along section line 87-87 of FIG. 86.
Figure 88:
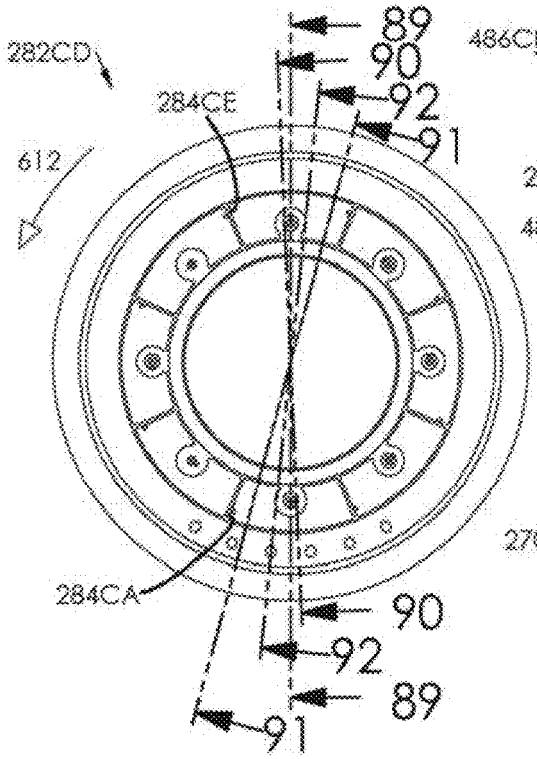
FIG. 88 is a front view of the components shown in FIG. 86.

A configuration utilizing a plurality of bearing pockets 285 is disclosed herein, in one example substantially generated with a circular pattern of features with respect to a central rotating shaft axis 637/639. For the ease of description, only the operability of two opposed bearing restrictors and bearing pockets in fluid communication are labeled and discussed, but other opposed bearing restrictors and bearing pockets in fluid communication with each other may operate in the same manner. As was shown in FIG. 71A, and FIGS. 71C-71D, the landings 290/288/276/274/272 on component 620 are understood to form substantially small gaps with respect to an immediately adjacent surface 671' of abutting component 671. In FIGS. 72A, 72B and 149 the landings 611/293/291/289/287/272 are understood to form substantially small gaps with respect to an immediately adjacent surface 671', as shown in FIG. 71D for the example of FIG. 71A.

The hybrid bearing examples shown in FIGS. 102-148 are configured to self-compensate for component deflections (e.g., from thermal expansion or centrifugal loading) and component displacements (e.g., from pressure induced-loads from the chamber) based on the principles described for the highly schematic hybrid bearing examples shown in FIGS. 72A-72B. A complete description of this configuration follows. The hybrid bearing examples shown in FIGS. 150-163 may be configured for self-compensation based on the principles described for the highly schematic hybrid bearing example of FIG. 149. A complete description of this configuration also follows.

FIGS. 72A, 72B, and 149, show examples comprising diametrically opposed restrictors 277 and bearing pockets 285. As was shown in the example of FIG. 71A and FIG. 71B, a schematic representation of the flow conduits and flow resistances 622 across landings is provided. As before, solid flow lines in the drawings represent negligible flow resistance, implying negligible pressure drop across those flow paths. Recesses 284/274/etc. may be sufficiently deep and flow conduits 270/286/etc. sufficiently large relative to small flow passageways at the landings 290 etc. where pressure drops are expected. The gap height at each landing is defined as the average normal distance between the components at the landing and the adjacent surface 671' at the landing. It is to be understood that reference to "gap heights" refers to the gap heights (measured orthogonal to the landing surface 293/291/289/287/272 (and 611 in FIG. 149) and the adjacent surface 671') at landings in that any changes to gap heights at recesses is not intended to have a substantial impact on resulting pressures in recesses. In the previous description of FIGS. 71A-71B specification text in regard to recess depth, fluid conduit size, linear pressure gradients and turbulence are applicable to the examples of FIGS. 72A, 72B, and 149. As recited above, any desired shapes may be used for many of the elements described herein. The rectilinear and elliptical structures are shown for ease in illustration. Since the flow resistance at landings may be dependent on the perimeter, thickness, and gap height, at the landings other shapes of landings and recesses may be selected deviating from the examples provided. As shown in FIGS. 72A, 72B and 149, a component 620S/620T/620U is floating so labeled in that it does not directly contact the adjacent surface (e.g., 671' of FIG. 71D) moving in relation thereto. In one example, the immediately adjacent component 671 is stationary, thus there is relative movement between the component 620S/620T/620U and the surface 671'. In one example, the recesses, landings and fluid conduits contained in the component 620S/620T/620U could alternatively be contained in the immediately adjacent component 671 and either component 620 or 671 may float relative to the other component via the pressurized fluid bearing system described herein. The preferred location for the bearing elements (i.e., pockets, landings, fluid conduits) may depend on the specific geometry of the parts, likely with some consideration in how the fluid conduits will connect the restrictors and bearing pockets and a desire to reduce the overall manufacturing costs and/or create a more compact assembly.

In the example of FIG. 72A, bearing pocket 285SA' comprises surfaces defining at least one recess 285' with immediately adjacent landings 291SA'L/291SA'R/287SL/287SR forming a raised or radially (relative to the center of the component 620S/620T/620U) projecting perimeter around the bearing pocket 285SA'. A substantially rectangular "supply recess" 275SA comprises surfaces defining a recess with immediately adjacent landings 293SAL, 293SAR, 289SL and 289SR forming an outer perimeter and adjacent landing 272SA forming an inner perimeter landing. The inner perimeter landing (e.g., 272SA) and surfaces defining a hole (e.g., 609SA') are referred to in this description as the "restrictor" 277 not to be confused with the capillary restrictors shown in FIGS. 65-69. High pressure fluid is supplied to the supply recess 275SA via bearing supply line/conduit 395SA. Flow and/or pressure may be restricted in the bearing by landing 272SA before entering the inner fluid conduit 609SA'. The inner fluid conduit 609SA' may have negligible flow resistance, and in one example is in fluid communication with the diametrically opposing bearing pocket 285SA'. The flow and pressure exiting bearing pocket 285SA' may be regulated by the landings 291SA'L/291SA'R/287SL/287SR. In one example bearing pockets 285 are provided immediately adjacent to landings 291SA'L and 291SA'R and may comprise pressure drains 287' immediately adjacent to landings 287SL and 287SR. In another example, the pressure at the recess/"drain" 291'L and/or recess/"drain" 291'R may be the same or higher than the high pressure fluid supplied to the supply recess 275SA. The flow and pressure exiting the supply recess 275SA may be regulated by landings 293SAL, 293SAR, 289SL and 289SR. It may be preferred for the flow resistance of landings 293SAL, 293SAR, 289SL and 289SR to be higher than the flow resistance of bearing pocket landings 291SA'L/291SA'R/287SL/287SR if the pressure adjacent to said supply recess outer landings is lower than the pressure adjacent to said bearing pocket outer landings. A large pressure differential at the supply recess 275SA outer landings may produce a larger than desirable leakage rate without contributing to the overall bearing capacity and in this example the supply recess outer landing flow resistances may be increased to reduce leakage but increase friction/heat generation. In one example, the supply recess 275SA may form a circumferentially continuous area with only landings 289SL and 289SR. In another example, the supply recess 275SA may be a shorter span (e.g., circumferential) than the respective bearing pocket 284, and a low pressure drain may exist immediately adjacent to 293SAL and 293SAR.

The opposed restrictor and bearing pocket structure of FIG. 72A is shown duplicated in FIG. 72B as laterally offsetting restrictor pockets 277 (and surrounding supply recess) 275 from the bearing pockets 285. This example, with alternating opposed restrictors 277 and bearing pockets 285, functions in the same manner as was described relative to FIG. 72A wherein like numbers denote like elements. For example, supply recess 275SA and 275TA may be analogous. A drain cavity 453' is shown between landing 287TR of bearing pocket 285TG' and landing 289TL of supply recess 275TA. However, as shown in the example of FIG. 149, this drain cavity 453' is not required in some applications, combining landings 287TR and 289TL. This combined landing is denoted as 611U in FIG. 149 and is shared by both the bearing pocket 285UG' and the supply recess 275UA. In this arrangement with alternating opposed restrictors and bearing pockets, it may be preferred for the landing 611U to have higher flow resistance, in one example substantially higher, relative to the other bearing pocket landings 287UL/291UG'L/291UG'R in that a lower pressure in bearing pocket 285UG' may be possible, thereby increasing load capacity. Where bearing pockets are located immediately adjacent to landings 291UG'L and 291UG'R, it may be preferred for the flow resistance of these landings to be higher than the flow resistance at landing 287UL in an example where a low pressure drain is immediately adjacent to landing 287UL, allowing the bearing pocket 285UG' the ability to reach a substantially similar low pressure, thereby increasing load capacity.

Bearing Examples E Through P Including Regulated Inner Ball Pressure—Applied to Example B In examples S/T/U of FIG. 72A/72B/149, fluid conduits 609 are fluidly connected between diametrically opposed restrictors 274 and bearing pockets 285. It is to be understood that since the hybrid bearing examples E, F, G, H, I, J, K, L, M, N, O and P shown on FIGS. 137-148 and FIGS. 152-163 use like numbering, the description above applies to fluid conduits 609 (E-P) and other like numbered elements to abbreviate this disclosure. The rotary fluid flow device 20 example shown in FIGS. 102-102E comprises hybrid bearing examples E to J (FIGS. 137-148). The rotary fluid flow device 20 example in FIGS. 150-151 shows hybrid bearing examples K to P (FIGS. 152-163). These examples of the rotary fluid flow device 20 comprise hybrid bearings configured to resist axial, radial, and/or bending moment loads, through the combination of individual recessed bearing pockets having varying pressures. This pressure exerted over an area (in the bearing pocket) results in a force that is dependent on the relative position of the "floating" component as explained herein.

Figure 103A:
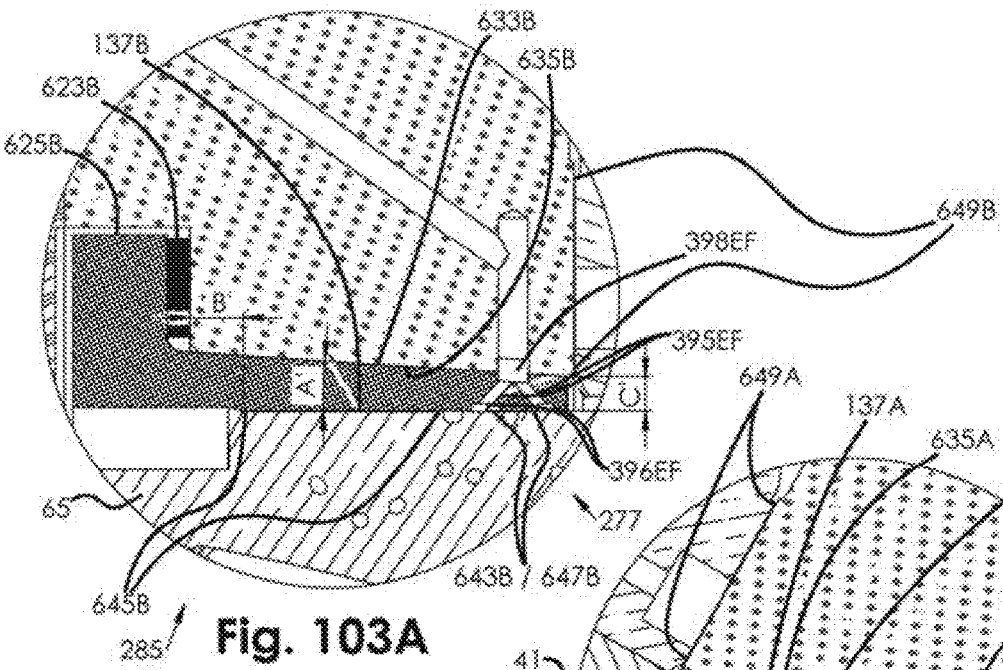
FIG. 103A is an enlarged view of the region 103A of FIG. 103.
Figure 103B:
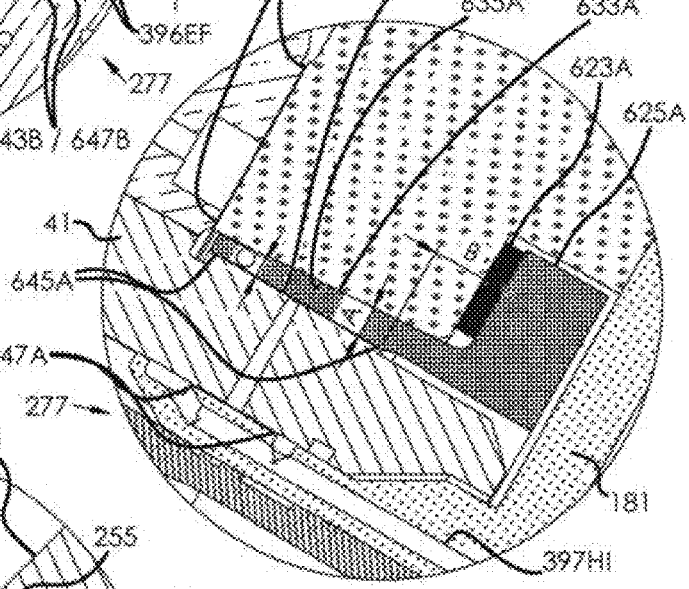
FIG. 103B is an enlarged view of the region 103B of FIG. 103.
Figure 103C:
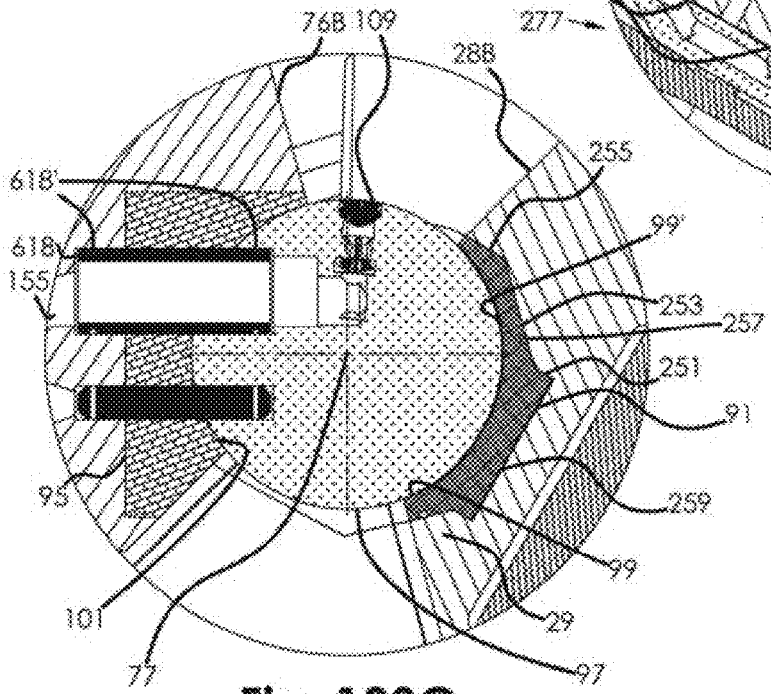
Figure 103D:
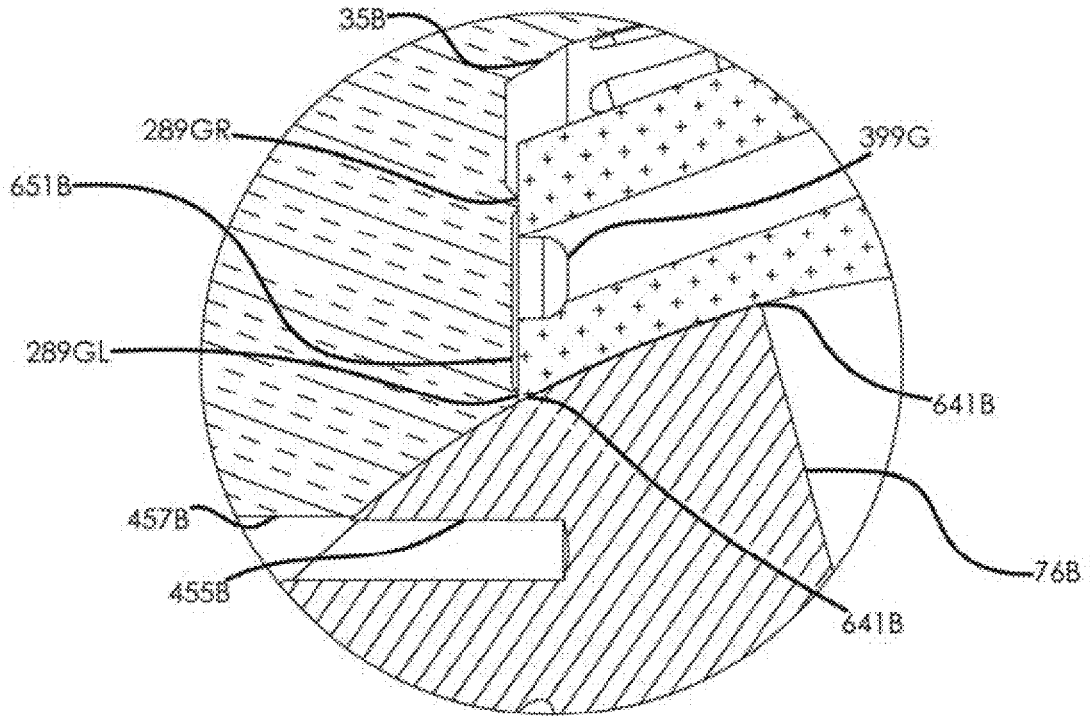
Figure 103E:
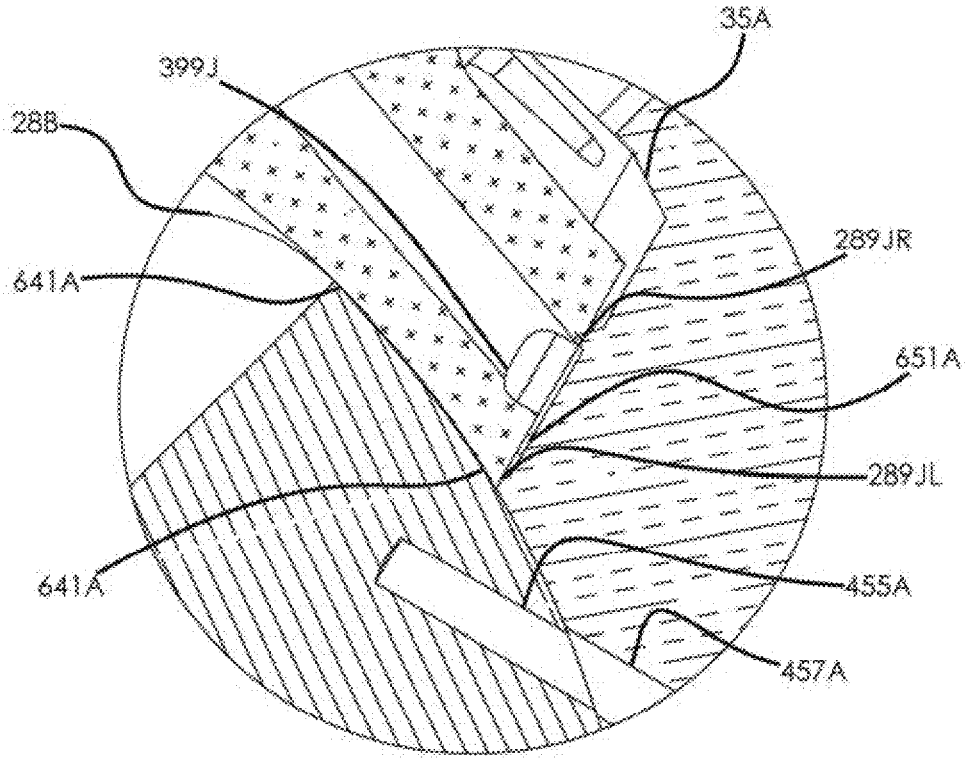

The idler/driver rotor hybrid bearings 135A/135B (FIG. 120) are configured to resist loads perpendicular to the recessed pockets 285. In one example where the rotors 28/76 axially separate from each other co-linearly with respect to their respective shaft axes 637/639 (FIG. 103), the substantially small gaps 641A/641B (FIG. 103E/103D) between the idler/driver rotor bearing pocket landings and the inner surface 114B of the housing 55B are reduced and this axial movement may not influence the gaps 643A/643B (FIGS. 103B/103A) at the restrictors 277. When the gap 645A/645B at the landings of a bearing pocket is reduced relative to the gap 647A/647B at the corresponding restrictor, the pocket pressure may increase until an equilibrium is reached. In this manner, deflection from thermal expansion and centrifugal loads may be reacted by the bearing. If the product of the temperature and the diameter at the rotor lobes is larger than at the rotor shaft, there may be self-compensation from thermal expansion. If the components are rotating relative to the adjacent surface (e.g., surface 114), substantially radial deflection may occur as a result of centrifugal loading that is proportional to the mass, geometry (e.g., diameter), and speed of rotation. If a rotor/rotor shaft is made of a common material and the rotor lobes 78 are a larger diameter than the rotor shaft, the rotor lobes 78 may experience larger (substantially) radially deflection relative to the restrictors 277. As shown in FIGS. 143-148 and in FIG. 103B, the idler rotor shaft hybrid bearings 137A for such an example may be configured to self-compensate in the same manner wherein the gap 645A at the landings 291/287 of a bearing pocket 285 is reduced relative to the gap at the corresponding restrictor gap 647A. Likewise, as shown in FIGS. 103B and 103E the idler (rear) thrust hybrid bearings 139A may self-compensate whenever the gap 649A at the landings of a bearing pocket is reduced relative to the gap at the corresponding restrictor gap 651A. If the collar 37A/37B (FIG. 103) contains an overhanging section 35A/35B, centrifugal loading may cause this section to deflect radially outwards and axially back, acting to separate the gear teeth. Axially thermal expansion of the idler rotor shaft and collar 37A relative to the idler flange 621A may also be self-compensated by this effect. Since the restrictor gaps 643, 647 and 651 increase in size as the pocket gaps 641, 645 and 649 decrease with expected loads, including the thermal expansion and centrifugal loading described, less deflection may be necessary to react the same load with this example compared to the previously described capillary-fed examples.

In one example the driver rotor shaft 65 in FIG. 103 is substantially similar to the idler rotor shaft 41 with a stationary component (not shown) similar/equivalent to the slide gate housing 181 forming small gaps (not shown) with restrictors at the inside diameter of the driver rotor shaft bore. An inner rotatable component (not shown) may be configured fit on the inside diameter of the stationary component e.g., housing 55), substantially equivalent in structure and function to the configuration of the primary gate 171 inside of the slide gate housing 181. This inner rotatable (shaft) component may be configured to transmit torque to the driver rotor shaft 65 via a spline connection. In another example, these components are fastened by way of bolts or other methods and devices.

In example E in FIGS. 103-103E and FIGS. 137-142, the gaps 645B at the driver shaft bearing pocket landings may be substantially equivalent to the gaps 643B at the driver shaft restrictors 277. In one example there may be little to no self-compensation for thermal expansion or centrifugal loading. In such an example when the bearing pocket landings 645B and restrictor landings 643B reduce (or increase in the case of thermal contraction) by substantially equivalent values, the pressures in the bearing pockets (and restrictors) may not change substantially. This lack of self-compensation may not be a concern in some applications where the deflections are a small fraction of the neutral position gap height. A practical method of minimizing these deflections is by minimizing the shaft diameter. Where thermal expansion and/or centrifugal loading only causes the bearing pocket to decrease by a larger amount than the gap, there may exist a self-compensating effect to those loads. For example, the gaps 641B at the driver rotor bearing pockets are shown in FIG. 103 and FIG. 103D with a larger diameter than the gaps 643B (FIG. 103A) at the driver rotor restrictors on the driver rotor shaft. In this example a self-compensation effect to those loads may be expected. The gaps 645B at the driver shaft bearing pockets are shown in FIG. 103 and FIG. 103A to be at substantially the same diameter as the gaps 647B for the corresponding driver shaft restrictors, so no self-compensation to thermal expansion or centrifugal loading is expected. However, these alternating opposed restrictors and bearing pockets located on diametrically opposite sides of the driver rotor shaft may still self-compensate to loads that may act to displace the shaft (e.g., pressure-induced from the compression or expansion of the gas in the chamber).

One example is configured where the driver rotor bearing restrictors 277 and driver shaft bearing restrictors 277 (see corresponding gaps 643B/647B in FIG. 103A) are positioned on the rearward side of the driver shaft bearings 285 (see corresponding gaps 645B). In one example the driver rotor shaft may be a smaller relative diameter at the (rearward) restrictor location than shown in the Figs.

An equivalent bearing sleeve 625B could be modified to form substantially small gaps 647, or an additional bearing sleeve or relatively stationary component could be used to form substantially small gaps such as 647B for the driver shaft bearing restrictors. Optionally the driver rotor bearings and driver shaft bearings may be configured to compensate for thermal expansion, centrifugal loading, and pressure-induced chamber loads.

In one example the pressure and flow through a bearing pocket 285 is regulated by the adjacent gaps 645, adjacent drain pressure(s), restrictor gaps, and adjacent supply pressure, configured that the resulting bearing pocket pressure is between the drain and supply pressures. In one example, when the flow is substantially restricted leaving a bearing pocket compared to entering, the pressure may be closer to the supply pressure than the drain pressure. This pressure acting on the bearing pocket area in this example resists the load until the component is no longer moving towards the adjacent stationary component. Flow resistance may be primarily dependent on gap heights; thus it is easiest to gain an understanding of how the bearings work by focusing on how the gap heights change at the bearing pockets and at the restrictors when the part displaces and/or deflects.

In the idler shaft hybrid bearings example H of FIGS. 103-103E and FIGS. 143-148, the (high pressure) supply port(s) 397HI for the idler rotor 41 is in fluid communication with the supply recess 275HI via surface defining cavity 398EF, surface defining holes 395EF and grooves 396EF. A plurality of holes 395EF may be incorporated. Substantial flow area in cavity 398EF and grooves 396EF may be configured to minimize pressure losses between the high pressure supply feed 397HI and the supply recess 275HI in that the pressure in a bearing pocket may not exceed the upstream pressure. The capacity to resist loads may be dependent on the pressure in supply recess 275HI rather than the pressure in supply feed 397HI. Drains 289HIL and 289HIR are configured to regulate the leakage of fluid exiting the supply recess 275HI. If working fluid (the fluid to be pumped, compressed, expanded) is immediately adjacent to drain 289HIR and is at a lower pressure than the supply recess 275HI, then the bearing fluid (fluid present in the bearings to reduce friction between moving components) may leak (undesired flow) into the working fluid, while preventing the working fluid to leak into the bearings. Bearing fluid flow to the fluid conduit 609HA' (others not labeled) is regulated by the restrictor landing 272HA before arriving in the bearing pocket 285HA'. Intermediate landings 291HA'L and 291HA'R are configured to separate adjacent bearing pockets wherein the pressure differential in those bearing pockets may differ substantially. Drains 287HL and 287HR regulate the leakage of fluid exiting the bearing pockets.

The idler rotor hybrid bearings example I is also shown in FIGS. 103-103E and FIGS. 143-148. Flow from the supply area 275HI to the fluid conduit 6091A' is regulated by the restrictor landing 2721A before arriving in the bearing pocket 2851A'. Intermediate landing 291IA'L separates adjacent rotor bearing pockets. Drains 2871L and 2871R regulate the leakage of fluid exiting the bearing pocket 2851A'.

FIGS. 103-103E and FIGS. 143-148 illustrate the idler thrust hybrid bearings 139A, example J, which may resist loads parallel to the idler shaft axis 637. This capacity to resist loads parallel with the idler shaft axis 637 for a given supply pressure in one example is proportional to the projected area of the bearing pockets perpendicular to the axis of the shaft. Therefore, the maximum projected area, comprises the pockets radially perpendicular to idler shaft axis 637. When a plurality of bearing pockets 285 are configured as shown, the idler or driver rear/front thrust bearing 139A/139B/129A/129B may be configured to resist loads that are parallel, but not co-linear with the axes 637/639 of the idler/driver shafts 41/65. These loads are referred to herein as bending moment loads in that they are not parallel to the axis of the shaft. It should be understood that the shortened name "idler thrust hybrid bearings" is not intended to imply that bending moment loads would not be resisted. The high pressure supply feed 397J for the idler thrust hybrid bearing example J of this example is in fluid communication with the supply recess 275J. Drains 289JL and 289JR regulate the leakage of fluid exiting the supply recess 275J. Flow to fluid conduit 609JA' (others not labeled) in this example is regulated by the restrictor landing 272JA before arriving in the bearing pocket 285JA'. Intermediate landings 291JA'L and 291JA'R separate adjacent bearing pockets 285 so that the pressure differential in those bearing pockets may differ substantially. Drains 287JL and 287JR regulate the leakage of fluid exiting the bearing pockets 285.

The compression chamber(s) 144 of this example are immediately adjacent to the drain 2871R (idler rotor bearing example I in FIG. 147) and the drain 289JL (idler thrust hybrid bearing example J). Where the bearing fluid pressure in the recessed supply recess 275J of the idler thrust hybrid bearing example J exceeds the maximum compression chamber 144 pressure, the bearing fluid from the recessed idler rotor bearing pockets 2851 (A'-I') may flow towards the compression chamber 144. This may be desirable in that the liquid barrier may prevent the working fluid of adjacent chambers from being in fluid communication at the bearing location. It may be desirable to minimize migration of working fluid from a higher pressure chamber to a lower pressure chamber, to improve volumetric throughput/efficiency. In this manner the bearing fluid used for the bearings may leak into the working fluid. It is of course still assumed that the high pressure supply feed 397HI of the idler rotor hybrid bearing example I would be at a higher pressure than the maximum compression chamber pressure for the bearing to function because the pressures observed in a given bearing pocket are expected to fall between the lowest drain pressure and the supply pressure. In one example, the pressure at the supply recess 275J of the idler thrust hybrid bearing example J may exceed the high pressure supply feed 397HI of the idler rotor hybrid bearing example I without substantially influencing the pressure of a given idler rotor bearing pocket, 285IA' where the flow resistance of drain 289JL and/or drain 287IL is substantially higher than the flow resistance of drain 287IR. Minor adjustments may be made, such as providing a pressure-regulated cavity immediately adjacent to drain 287IL. This alternative may be desirable in applications where it is not possible or easily configured to increase the flow resistance of drain 289JL and drain 287IL substantially above that of drain 287IR and the idler rotor high pressure supply feed 397HI is not substantially higher in pressure than the supply recess 275J of the idler thrust hybrid bearing example J.

One or more fluid conduits 613 may be configured supply high pressure fluid to the recess 99' of the convex frusto-spherical surface 99 of the idler insert 91 as shown in FIGS. 143-148. These fluid conduit(s) may be fed by annular groove 615 which is in fluid communication with fluid conduit 161 (FIGS. 111-114) of the housing 55B. The bearing fluid, coolant fluid, or other "sealing" fluid, flowing past the convex frusto-spherical surface 99 may enter the chamber 144 which may be desirable to seal chambers 144 from adjacent chambers at a varying pressure and provide cooling/heating in compression/expansion applications. It may be desirable for the pressure that reaches the concave frusto-spherical surface 99 to be higher than the maximum chamber pressure, which may be substantially similar to, but higher than the pressure in the discharge plenum 669 (FIG. 103), to ensure a positive flow into the chambers and promote said sealing. The maximum chamber pressure defined as the largest pressure allowed by the positioning of the primary gate 170 in combination with the volumetric throughput and rotational speed. When the position of the primary gate 170 is optimal, driver power may be minimized in that opening the chamber early or later may increase driver power requirements. The pressure differential required for the working fluid to exit the chamber may be dependent on the volumetric throughput, the density of the working fluid (e.g., pressure and composition of working fluid) and the time frame available (e.g., driver rotational speed. For example, high inlet pressures may have an associated higher volumetric throughput in comparison to lower inlet pressures. Higher pressures in the discharge plenum 669 may require that the working fluid has a relatively high density when it is discharged. A higher rotational speed may decrease the time available. In this manner, the combination of high inlet pressure, high discharge plenum 669 pressure and high rotational speed of the rotors may define a maximum chamber pressure in that a high pressure differential between the chamber 144 and discharge plenum 669 may be required to expel the working fluid in the available time frame. The pressure in the discharge plenum 669 may be substantially similar, but higher than the downstream gathering system pressure (not shown) in that a positive pressure differential may be required to cause the working fluid to exit the rotary fluid flow device 20. The pressure in the groove 615 may be lower, higher or the same as the pressure in the supply recess 275HI. Landing 289HIL may provide a flow resistance between the groove 615 and the supply recess 275HI. It may be desirable for the flow resistance at the landing 289HIL and the drain landing 653 to be substantially higher than the flow resistance at the convex frusto-spherical surface 99 if it is desirable for pressure measurements outside of the compressor to more closely follow the pressure that may be obtained in the recess 99'.

The regulation of this fluid pressure may be configured to optimize the bearing performance for varying combinations of inlet and discharge pressures. The fluid pressure may introduce a thrust load with respect to the respective idler/driver shaft axes 637/639 (FIG. 103). Therefore, in the absence of high pressure-induced thrust loads from the gas chamber pressure, the pressure at the recess 99' may be increased accordingly. This may reduce the variability of the loads, thereby minimizing axial displacement of the idler/driver trust hybrid bearings (139A, 139B, 129A and/or 129B in FIG. 103) from the neutral position, which may reduce viscous drag/driver power. The supply pressure entering holes 397HI may be regulated so that the resulting pressure at the recess 99' is between the working fluid supply pressure and the working fluid discharge pressure. This pressure entering the holes 397HI may be adjusted to a minimum driver power. In another example, a simple equation may be written in software code and maintained on a non-transitory medium (digital file) to be used in the control system comprising an equation proportional to the inlet and discharge pressures.

Figure 110:
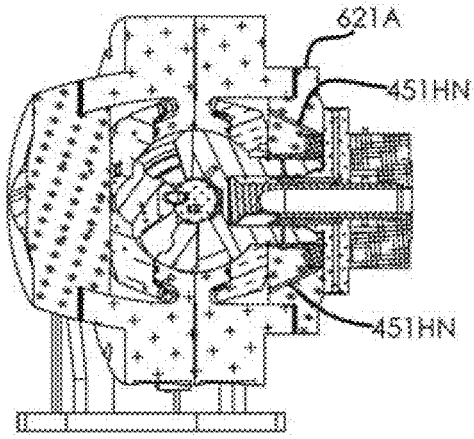

Fluid exiting drain 287JL and 287HR may be in fluid communication with the gear cavity 445 (FIG. 111) via holes 449J in the idler collar 37A. Fluid exiting drain 287JR and 289JR may enter the immediately adjacent gear cavity 445. Fluid exiting drain 287HL and 653 may be in fluid communication with the gear cavity 445 via holes 451HN (FIG. 110). The fluid in the gear cavity 445 may drain via holes 447 to the downstream fluid gathering system/oil sump (not shown).

In the driver shaft hybrid bearings example E of FIGS. 103-103E and FIGS. 137-142, the (high pressure) supply feed 397EF for the driver rotor is in fluid communication with the supply recess 275EF. Drains 289EFL and 289EFR regulate the leakage of fluid exiting the supply recess 275EF to the gear cavity 445 via the groove 456EK', and holes 453EK, 451EK' and 451EK (FIG. 109) and holes 449G in the collar 37B. Flow to the fluid conduit 609EA' etc. is regulated by the restrictor landing 272EA before flowing to the bearing pocket 285EA'. Intermediate landings 291EA'L and 291EA'R separate adjacent bearing pockets configured that the pressure differential in those bearing pockets may differ substantially. Drains 287EL and 287ER regulate the leakage of fluid exiting the bearing pockets. The driver rotor hybrid bearings example F is also shown in FIGS. 103-103E and FIGS. 137-142. Flow from the supply 275EF to the fluid conduit 609FA' may be regulated by the restrictor landing 272FA before arriving in the bearing pocket 285FA'. Intermediate landing 291FAI separates adjacent rotor bearing pockets. Drains 287FL, 287FR and 291FA'R regulate the leakage of fluid exiting the bearing pocket 285FA'.

FIGS. 103-103E and FIGS. 137-142 illustrate the driver thrust hybrid bearings example G may be configured to resist loads parallel to the driver shaft axis 639. This capacity to resist loads parallel with the driver shaft axis 639 for a given supply pressure is proportional to the projected area of the bearing pockets perpendicular to the axis of the shaft. Therefore, the maximum projected area, comprises the pockets perpendicular to the axis of the driver shaft axis 639. When a plurality of bearing pockets exist, as shown, the driver rear thrust hybrid bearing 1396 may be configured to resist loads that are parallel, but not co-linear with the axis of the shaft 65. These loads are referred to herein as bending moment loads in that they are not parallel to the shaft. It should be understood that the shortened name "driver thrust hybrid bearings" does not imply that bending moment loads would not be resisted. The high pressure supply feed 397G for the driver thrust hybrid bearing example G is in fluid communication with the supply recess 275G. Drains 289GL and 289GR are configured to regulate the leakage of fluid exiting the supply recess 275G. Flow to fluid conduit 609GA' (others not labeled) is regulated by the restrictor landing 272GA before flowing to the bearing pocket 285GA'. Intermediate landings 291GA'L and 291GA'R separate adjacent bearing pockets configured that that the pressure differential in those bearing pockets may differ substantially. Drains 287GL and 287GR regulate the leakage of fluid exiting the bearing pockets.

The compression chamber(s) 144 in one example are immediately adjacent to the recess 79A'. Recess 79A' comprises surfaces defined by landings 287FR, 79A'L and 79A'R. In one example, this region is comprised of landing 287FR. The recess 79A' may be periodically in fluid communication with the primary/secondary intake passageways 191/193 shown in FIGS. 105-108B. The secondary intake passageways 191/193 in one example may not be preferred to supply the recess 79A' in that the gap heights may periodically become substantially large, which may require substantial flow rates. A recess 79A' may be preferred over making the entire region part of landing 287FR in that viscous drag from friction may be substantially reduced. The instantaneous pressure of recess 79A' may be calculated in the same manner described above using an electrical circuit analogy with the flow resistances of the landings and boundary condition pressures. In one example, where the recess 79A' is in fluid communication with the primary/secondary intake passageways 191/193, the pressure may be substantially equivalent to the intake pressure. The compression chamber(s) 144 are immediately adjacent to recess 79A' (which is immediately adjacent to drain 287FR in driver rotor bearing example F) and the drain 289GL (driver thrust hybrid bearing example G). If the pressure in the supply recess 275G of the driver thrust hybrid bearing example G exceeds the maximum compression chamber pressure, then the fluid from the recessed driver rotor bearing pockets 285F (A'-I') may flow towards the compression chamber 144. This may be desirable in that the liquid barrier may prevent the working fluid from adjacent chambers from fluid communication (leaking) at the bearing location. It may be desirable to minimize migration of working fluid from a higher pressure chamber to a lower pressure chamber to improve volumetric throughput/efficiency. In this manner the bearing fluid used for the bearings may leak into the working fluid. In one example the high pressure supply feed 397EF of the Driver Rotor Hybrid Bearing Example F is at a higher pressure than the maximum compression chamber pressure (i.e., in one example this maximum chamber pressure is higher than, but substantially similar to the pressure in the discharge plenum 669) for the bearing to function because the pressures observed in a given bearing pocket are expected to fall between the lowest drain pressure and the supply pressure. As could be understood by those who perform the calculation method described herein, the pressure at the supply recess 275G of the driver thrust hybrid bearing example G may exceed the high pressure supply feed 397EF of the driver rotor hybrid bearing example F without substantially influencing the pressure of a given driver rotor bearing pocket, 285FA' if the flow resistance of drain 289GL and/or drain 287FL is substantially higher than the equivalent flow resistance of drain 287FR calculated as a series resistance to parallel resistances of landings 79A'L/79A'R. Minor adjustments, such as providing a pressure-regulated cavity immediately adjacent to drain 287FL would be possible. This alternative may be desirable in examples where it is not possible to increase the flow resistance of drain 289GL and drain 287FL substantially above that of the equivalent flow resistance described above (i.e. drain 287FR with landings 79A'L/79A'R) and the driver rotor high pressure supply feed 397EF is not substantially higher in pressure than the supply recess 275G of the Driver Thrust Hybrid Bearing Example G.

Figure 109:
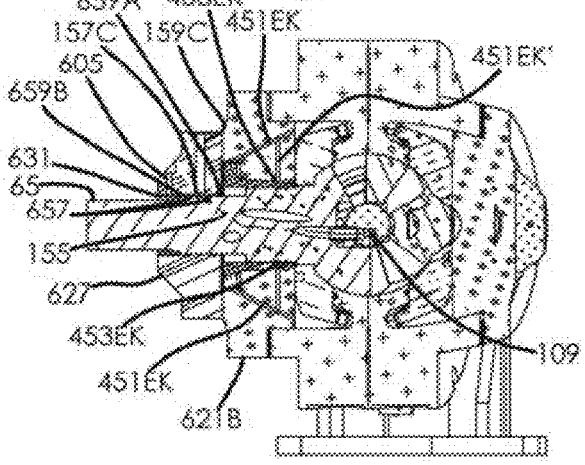

Fluid exiting drain 289EFR (FIG. 137) and 287GL (FIG. 139) may be in fluid communication with a gear cavity 445 (FIG. 111) via holes 449G in the driver collar 37B. Fluid exiting drain 287GR and 289GR may enter the immediately adjacent gear cavity 445. Fluid exiting drain 287EL may be in fluid communication with the gear cavity via holes 451EK (FIG. 109). Fluid exiting drain 287ER and drain 289EFL may be in fluid communication with the gear cavity 445 via the groove 453EK', holes 453EK' and holes 451EK, respectively. The groove 453EK' (FIG. 137) and downstream holes may be sized accordingly for the expected flow to reduce the pressure differential in that it may be desirable for the drain pressure to be lower immediately adjacent to bearing pockets to increase the capacity to resist loads. The fluid in the gear cavity 445 may drain via holes 447.

In one example the highly schematic hybrid bearing example S (FIG. 72A) were implemented in examples F, G, H, I, J and the highly schematic hybrid bearing example T (FIG. 72B) was implemented in example E. In the case of the idler/driver rotor hybrid bearing examples I/F, the restrictors and bearing pockets are diametrically offset and on different cylindrical/frusto-spherical topologies, respectively. The rotor bearing pockets, for example pocket 285FA' in FIG. 141, were described as having high pressure adjacent to one of the landings, for example 287FL. This is still in the spirit of the highly schematic hybrid bearing example S (FIG. 72A) in that there is at least one landing in which the bearing fluid may drain from.

The rotary fluid flow device 20 example in FIGS. 150-151 show hybrid bearing examples K to P (FIGS. 152-163). Fluid conduits 609 K, L, M, N, O, P are equivalent to fluid conduits 609 E, F, G, H, I, J, respectively. It is to be understood that the corresponding supply recesses, restrictors and bearing pockets are also equivalent, so, for the ease of the reader, only the differences are described herein. The highly schematic bearing example U shown in FIG. 149 is implemented in the driver shaft hybrid bearing example K (FIGS. 152-157). In this example the groove 453EK' (i.e., lower pressure drain of FIG. 137) is not utilized between the restrictors and bearing pockets. The combination of landings 287ER and 289EFL are labeled as landing 611K in FIG. 152. The drain 289EFR of FIG. 137 is not utilized in this example, extending the supply recess 275EF of FIG. 137 into the supply recess 275KL of FIG. 152. As shown in FIGS. 152-157, this supply recess 275KL is in fluid communication with the supply recess 275M (FIG. 156) via holes 395M. Therefore, the pressure immediately adjacent to landing 287ML may be substantially equivalent to the pressure in supply recess 275KL and 275ML. As shown in FIG. 151, this cavity 396KLM at the supply recess 275KL may be supplied by holes 397KLM on the driver side. The idler side in this example comprises a cavity 396NOP supplied by holes 397NOP. As shown in FIGS. 150-151 and FIGS. 158-163, the cavity 396NOP is in fluid communication with via holes 395NO in the idler rotor 41' and holes 395P in the idler collar 37A', providing high pressure bearing fluid to supply recess 275NO and 275P, respectively. Looking to FIGS. 150-151, in one example the bearings are supplied by (in fluid communication with) cavity 397NOP and holes 397KLM. Idler/driver bearing sleeves 625A'/625B' may be shortened to provide cavities 396NOP/396KLM. The idler bearing sleeve in both examples 625A/625A' does not have supply or drain holes. In the example of FIGS. 150-151, the driver bearing sleeve 625B' no longer has supply holes (e.g., 395EF in FIG. 103A) or drain holes (e.g., 453EK in FIG. 109). Drains 451EK (FIG. 109) and 451HN (FIG. 110) and gear cavity drains 447 (FIG. 11) may still be required for landings 287KL, 287NL and 653. Landings 289PR, 287PR, 287MR and 289MR may still drain into the immediately adjacent gear cavity, as was done in previous examples.

A common supply recess such as 275EF (FIG. 137) or 275HI (FIG. 145) forms a fluid conduit to restrictor landings 272EA, 272FA, 272HA and 272IA, respectively. This may make a more compact arrangement than shown in other examples. In one example a high pressure supply is configured immediately adjacent to the restrictor landings. Restrictors could comprise individual supply grooves. Individual supply grooves could be at different supply pressures, preferred in some cases depending, for example, on the projected area of the bearing pockets and loads expected.

Bolt holes 457A/457B in the idler/driver collars 39A/39B are shown in FIGS. 145 and 139 and FIGS. 103D-103E configured to be co-linearly aligned with bolt holes 455A/455B in the idler/driver rotors 28B/76B to securely fasten the collars 37A/37B to the respective rotors 28B/76B. This is one example of a method of fastening the collars 37A/37B to respective rotors 28B/76B. The bolt heads in the recessed bearing pockets may introduce turbulence and therefore may increase undesirable heat generation. Alternatively, the recessed bearing pocket could be moved radially outward relative to the axis of rotation of the rotor to a larger diameter so that the bolts are not in the pocket, but the increased friction from viscous drag could be less desirable. This may also make a more compact arrangement than shown in other examples.

In one example the substantially rectangular grooves may be substantially elliptical, circular, a polygon, or other shape in that the functioning of the restrictors is dependent on the perimeter of the shape surrounding the groove and its width. Likewise, the perimeter of recessed bearing pockets may be a variety of shapes and placed on varying topologies with some examples provided such as the rotor bearing pockets 285FA' (FIG. 141) and 285IA' (FIG. 148).

Adjustment of Bearing Gaps—Example B

The restrictor landings such as 272HA and 272IA (FIG. 145) and restrictor landing 272EA (FIG. 137) were shown on cylindrical surfaces. In other examples, a tapered (frusto-conical) surface is desired to achieve the desired gap heights during assembly. Tapers may be easier to work with in some applications where the gap height can easily be measured, and a component comprises a minimal number of high tolerance surfaces. In the example shown in FIGS. 102-103, where the bearing sleeves 137A/137B are omitted, the idler/driver rotor flanges 621A/621B could be extended radially inwards define the bearing gaps at the idler/driver shaft bearings 137A/137B. This inner surface may be a conical frustum surface with a small angle that it is nearly cylindrical. The idler/driver shafts 41/65 in one example have substantially identical surface topology and the bearing elements may be substantially identical to that shown in FIGS. 137-148. In such an example, the axial positioning of the idler/driver flanges 621A/621B with respect to the axes 637/639 may define the gap height at the tapered shaft bearings 137A/137B. This axial positioning in one example may undesirably increase or decrease the gap height at the planar thrust bearings 139A/139B. It may be desirable to have an independent adjustment method to configure/adjust bearing gap heights during the assembly procedure as described below. The idler/driver bearing sleeves 625A/625B allow for the independent control of bearing gap heights in that the large first shims 619A/619B may be sized accordingly so that when the idler/driver flanges 621A/621B are fastened to the idler/driver housings 617A/617B, the desired gap at bearings 139A/139B may be achieved. The small second shims 623A/623B may be sized accordingly so that when the bearing sleeves 625A/625B are fastened to the idler/driver flanges 621A/621B the tapered surfaces 633A and 635A on the idler side and the tapered surfaces 633B and 635B on the driver side may influence the respective gap heights 645A (FIG. 103B) and 645B (FIG. 103A) at the idler/driver shaft bearings 137A/137B. In this manner, fasteners such as bolts may be used to fasten the bearing sleeves 625A/625B to the idler/driver flanges 621A/621B, allowing the fasteners to be tightened to a desired torque specification since the adjustment of the gaps may be driven by the size of the shim rather than relying on varying the tension produced by the fastening method, if any. Engaging two tapered surfaces as shown provides a clamping force on a part at the inside diameter of the components (e.g., a Morse taper). The bearing sleeves 625A/625B may be configured to be less massive (smaller and lighter) than the idler/driver flanges 621A/621B which may allow for a much easier assembly of the tight fitting components over the respective idler/driver shafts 41/65. Furthermore, the adjustable nature of the bearing sleeves allows for fine tuning adjustments of the gaps for the idler/driver shaft bearings 137A/137B. Looking to FIGS. 103A-103B, the taper angle A/A', and thickness C/C' at the thinner end may be critical parameters influencing the extent of the adjustments required on small second shims 623A/623B. Finite element analysis or other calculation methods known in the art may be performed to estimate the radial deflection expected with respect to axial adjustments of the bearing sleeves 625A/625B. Depending on the results of these finite element analyses or calculation methods, the radial deflection may not be uniform near the shims (i.e., near the flanges of the bearing sleeves). The results may indicate for example that the portion of the bearing sleeves 625A/625B forming gaps 643A, 643B, 645A, 645B, 647A and 647B may have a substantially uniformly radial deflection with respect to axial adjustments and this region may be some distance B/B' from the end of the tapered engagement 635A/633A and 635B/633B. A uniform gap height for the bearing restrictors and bearing pockets may be desired to allow a bearing restrictor or bearing pocket to reach a pressure close to drain pressure or supply pressure without metal to metal contact occurring. The maximum load capacity of a bearing (while avoiding metal to metal contact) may therefore be reduced if the gap heights at restrictor or bearing landings are not uniform in the neutral position.

Supplying Capillary Free Self-Compensating Hybrid Bearings with Opposed Restrictors and Bearing Pockets As described above, the hybrid bearing examples utilizing diametrically opposed restrictors and bearing pockets are shown configured to be applied the examples shown in FIGS. 102-103, where high pressure bearing fluid may enter the compressor via supply lines 397HI, 397EF, 397J and 397G. The hybrid bearing examples of K-P are applied in FIGS. 150-151, where high pressure bearing fluid may enter the compressor via supply lines 397NOP and 397KLM.

Assembling the Rotary Fluid Flow Device—Example A

The rotary fluid flow device 20 shown in several examples differs from known prior art in several ways. In the example "A" shown in FIGS. 1-22, such a rotary fluid flow device 20 results in a wider operating range, fewer parts, reduced size and reduced weight, in many examples, over prior art examples for device with equivalent fluid flow (volume) characteristics. It is conceived that such a rotary fluid flow device 20 may have improved overall efficiency and reduced maintenance costs over prior art, when compared at medium and high fluid flow (volume) scenarios within the operating range.

In the example "A" shown in FIGS. 1-22, the rotary fluid flow device 20 comprises an idler rotor sub assembly 22 and driver rotor sub assembly 24. In one example, the idler rotor sub assembly 22 and driver rotor sub assembly 24 are assembled independently and then connected in combination with the housing 55A including housing base 58 and housing cover 56 to form the rotary fluid flow device 20. In this example, the rotary fluid flow device 20 comprises an idler rotor neckband 26 (FIG. 8B) fastened to an idler rotor 28. In one example the idler rotor neckband 26 (FIG. 8B) is fastened to the idler rotor via an interference fit connection, fasteners, brazing, welding, or other suitable fastening methods or components.

Figure 37:
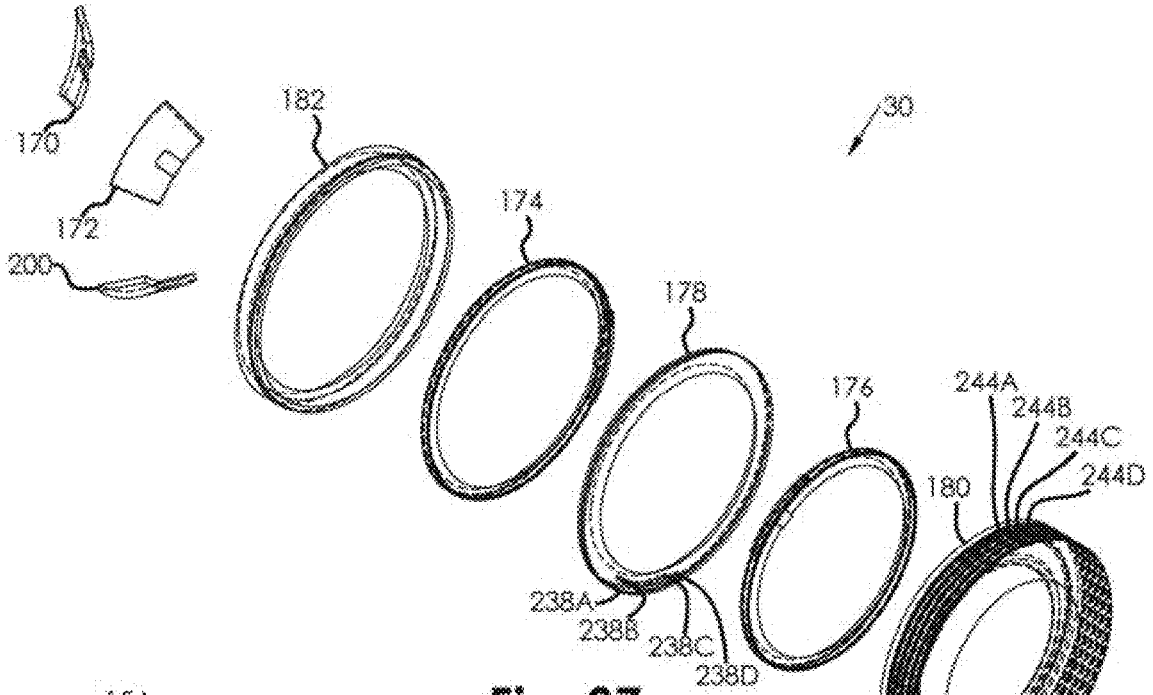
FIG. 37 is an exploded hidden line view of several components of the example shown in FIG. 1.

The idler rotor neckband 26 in one example comprises surfaces defining holes 196 aligned with each idler rotor valley 82. The holes 196 in the idler rotor neckband 26 form a different shape and reduced circumferential length (see FIG. 18) in comparison to the openings 675 that are formed by the faces of the idler/driver rotors (28/76) at the edges of the frusto-spherical surfaces 114 (FIG. 2). The shape of the neckband is configured to reduce the complexity of the primary/secondary gates 170/172 and discharge seal 200 on the sliding seal ring assembly 30 (FIG. 37). In one example, the smaller circumferential length may increase the range of compression ratios achieved by the rotary fluid flow device 20. The sliding seal ring assembly 30 and front cylinder 32 in one example are fastened to the idler front bearing housing 34 and configured to be repositioned along the idler shaft 40 adjacent to the idler rotor outer frusto-spherical surfaces 36, while remaining roughly concentric to the idler rotor shaft 40. The collar 38 in one example is fastened to the idler rotor shaft 40. The pitch of the collar threads 39 is formed (cut, machined, or cast) relative to the shaft rotation so that the collar 38 remains tight against an idler shaft landing 66 (FIG. 8B) of the shaft 40 as the rotor assembly 20 spins. In other examples, other fasteners or fastening methods may be utilized. A bolt or other fasteners, or fastening methods, could be used as a secondary method to ensure the collar 38 remains tight. The rear cylinder 42 is inserted into the idler rear bearing housing 44 and the idler rear bearing housing 44 is fastened to the idler front bearing housing 34 by way of bolts or other fasteners or fastening methods. In examples utilizing a front conventional bearing 46, the front conventional bearing 46 is inserted, followed by the hydraulic assembly 48 and the rear conventional bearing 50. These components in one example are secured by fastening the endcap 52 to the idler rear bearing housing 44 by way of bolts or other fasteners or fastening methods.

Figure 11:
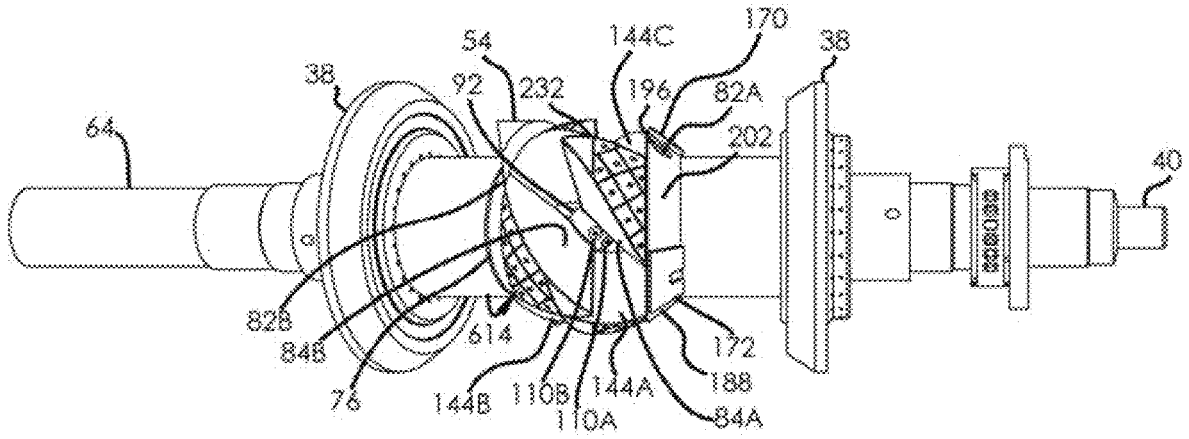
FIG. 11 is a side view taken from the opposing side shown in FIG. 9.

The intake gate 54 is fastened to the driver rotor radial bearing by way of pins, or other fasteners or fastening methods. Alternatively, the housing cover 56 and housing base 58 could contain these intake gate 54 surfaces. As seen in the example in FIGS. 33-34, the working fluid enters the compressor through the intake connection 112, which is in fluid communication with the intake passageway 186 and the surfaces of the intake gate 54. As seen in FIG. 932, the valleys 82B of the driver rotor 76 rotate past the stationary surfaces of the intake gate 54. In this manner, as seen in FIG. 11, the surfaces of the intake gate 54 may seal the chamber 144A between rotors after the maximum volume position.

As shown in FIG. 2, the front cylinder 32 is fastened to the driver front bearing housing 60 and is configured to be repositioned linearly adjacent to the driver rotor outer frusto-spherical surfaces 62, while remaining substantially concentric to the driver rotor shaft 64. The collar 38 is fastened to the driver rotor shaft 64. The pitch of the collar threads 39 is formed (cut or cast) relative to the shaft rotation so that the collar 38 remains tight against driver shaft landing 68. In other examples, other fasteners or fastening methods may be utilized. A bolt or similar fastener can be used as a secondary measure to ensure the collar 38 remains tight against the landing 68. In one example, the rear cylinder 42 is inserted into the driver rear bearing housing 70 and the driver rear bearing housing 70 is fastened to the driver front bearing housing 60 by way of bolts, other fasteners, or other fastening methods. In examples utilizing a front conventional bearing 46, the front conventional bearing 46 is inserted, followed by the spacer 71 and the rear conventional bearing 50 when utilized. These components may be secured by fastening the endcap 52 to the driver rear bearing housing 70 by way of bolts or other fasteners or fastening methods. By utilizing a removable collar 38, the device 20 may be configured to fit a circumferentially continuous part such as the driver front bearing housing 60 between two radially extending members (i.e., driver rotor outer frusto-spherical surfaces 62 and collar 38). It may not be desirable to split a circumferentially continuous tight tolerance surface that forms a bearing, such as the surface of the driver radial hybrid bearing 72, in that the edges at the surfaces may need to be sharp to minimize or eliminate any effects of the split. In the example of FIGS. 1-2, the housing base 58 and housing cover 56 have inner frusto-spherical surfaces 114 that may preferably fit as concentrically together as possible, with sharp edges at the joint to minimize any leakage in the generally axial directions of the shafts 637/639. In another example, the components are produced by machining techniques such as by 3D metal printing for example, which may allow the rotors 28/76 to be constructed as shown without any splits in the housing components. In one example, the manufacturing costs may be lower and surface finish may be improved when using more commonly available manufacturing techniques (to-date), such as machining and grinding processes. In the example of FIG. 2-5, the driver front bearing housing 60 is circumferentially continuous, forming a circumferentially continuous tight tolerance surface that forms part of the driver radial hybrid bearing 72. Space is very limited within the housing to fit the components and fluid passageways (e.g., fluid passageways to hybrid bearings) while ensuring adequate stiffness and ease of assembly and maintenance. The housing 55A or shroud components that are adjacent to the rotors 28/76 may be configured to not deflect significantly under pressure. A more compact arrangement may be possible for substantially radial bearings when circumferentially continuous surfaces/components are utilized, such as the driver front bearing housing 60 for the driver radial hybrid bearing 72 in that not splitting this component may allow the component additional stiffness for a given size. Such deflection may degrade the performance of a hybrid bearings film that is formed between these components.

Figure 70A:
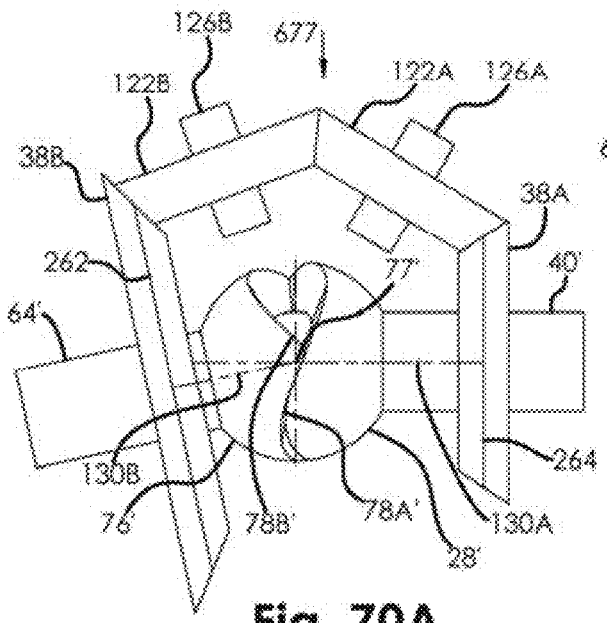
FIG. 70A is a highly schematic top view showing one example of internal components of the example shown in FIG. 1 including an index gear arrangement that may be applied for idler/driver rotor shafts with differing rotational speeds, as may be desired for idler/driver rotors with differing numbers of lobes.

The indexing gear arrangement 677 of FIG. 70A, applied in FIG. 2 proved challenging for selecting a suitable housing architecture as the surfaces defining bolt holes utilized to fasten housing components should not interfere with the indexing gear arrangement. When utilized, conventional bearings used on the driver rotor shaft 64 and idler rotor shaft 40 should not be repositioned for routine maintenance activities. This is often desired because of the tight tolerances that are required at the hybrid bearing locations. Furthermore, the type and location of optional seals immediately adjacent to the housing cover 56 may be designed such that re-attaching the housing cover 56 may not compromise the integrity of those seals. In one example, an operator would not damage any seals when removing, maintaining, and reinstalling the housing cover 56 or other components of the housing 55A.

After the driver rotor assembly 24 and idler rotor assembly 22 are assembled in one example these assemblies will not require disassembly for a period at least greater than scheduled maintenance periods, if not the lifetime of the rotary fluid flow device 20.

In the example shown in FIGS. 1-5, the driver rotor assembly 24 and idler rotor assembly 22 may be fastened to the housing base 58 by way of bolts or other fasteners or fastening methods. After the idler rotor assembly 22 and driver rotor assembly 24 are fastened to the housing base 58, the housing cover 56 may be fastened to the housing base 58. The housing cover 56 may also be fastened to the idler rotor assembly 22 and driver rotor assembly 24 to minimize the overall size and weight of the rotary fluid flow device 20 in that this may be a stiffer arrangement. In one example, the housing 74 is sufficiently rigid stiffness along the length of the fluid flow device.

Rotor Insert Examples for Assembly

Figure 40:
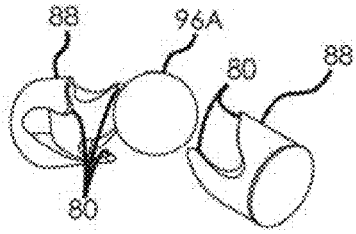
FIG. 40 is an exploded and enlarged view showing an example of the inner frusto-spherical surface shown in FIG. 39 comprising a full spherical ball.
Figure 41:
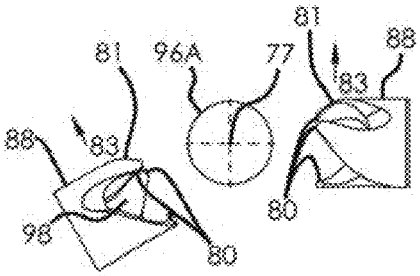
FIG. 41 is another view of the example shown in FIG. 40.

In one example, to facilitate the idler rotor 38 and driver rotor 76 to mesh properly, as shown in FIG. 5 and FIGS. 39-41, the respective rotor lobes 78 may span axially over half of the circumference of a sphere. These lobes 78 in one example may form overhangs 80 as shown in FIGS. 8A-8B, and FIG. 39 show lobes 78A/78B and valleys 82A/82B of the idler rotor 28 and driver rotor 76, respectively. It is to be appreciated that the driver rotor 76 in one example may have lobes 78B and valleys 82B as shown in FIG. 39 in one example forming substantially an identical surface (face) as the idler rotor 28. In one example, the minimum distance between two opposing rotor lobes 78 of a given rotor could be smaller than the diameter of the radially inner spherical surface 96A that may occupy that space (FIGS. 39-41).

In the case of a rotary fluid flow device 20 comprising single lobe rotors, this assembly concern does not exist. In a single lobe example, balancing issues and reduction in volumetric throughput may be undesirable. To make assembly possible with rotor surfaces that contain more than one lobe 78, in past designs, these rotor lobes 78 needed to be relieved at the inner diameter. However, removing the overhanging material 80 of the rotor lobe surfaces has the potential to increase leakage via a larger gap between the concave frusto-spherical surfaces 98 and the convex frusto-spherical or fully spherical surfaces (e.g., 96A in FIG. 41).

Figure 50:
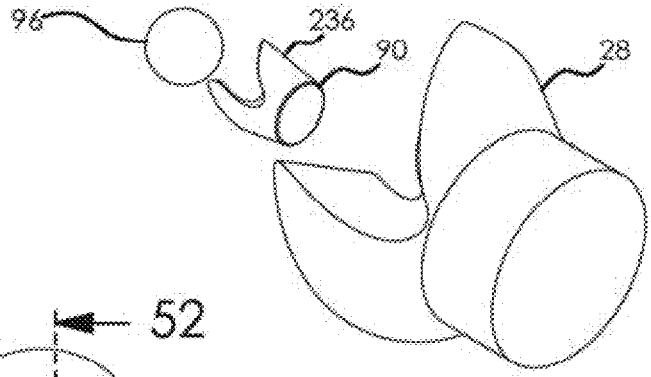
FIG. 50 is an exploded view showing an example of an idler insert/driver insert component of the example shown in FIG. 39. The FIG. 39 example is substantially cylindrical (see FIG. 2)
Figure 51:
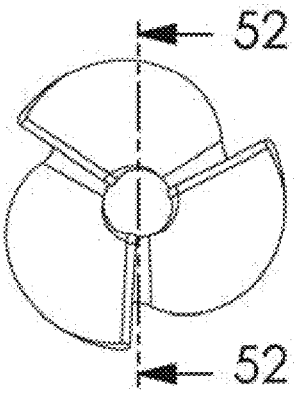
FIG. 51 is a front view of the example shown in FIG. 50.
Figure 52:
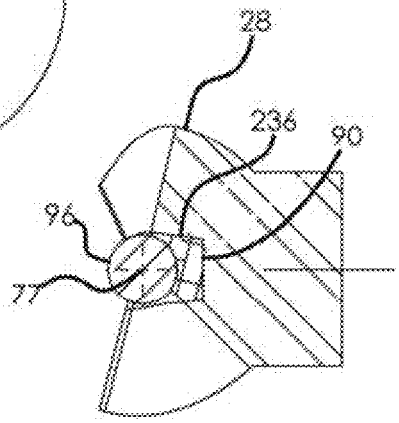
FIG. 52 is a cutaway view taken along section line 52-52 of FIG. 51.

In the example shown in FIG. 8B and FIGS. 39-41, the idler/driver rotor surfaces comprise radially outer axial surface 84, and radially inner axial surface 86. An interface occurs between a radially outer surface 88 of an idler insert 90 and the idler/driver rotor radially inner surface 86. The term "interface" is used to define a configuration where these radially immediately adjacent surfaces may be in contact, or substantially in contact. When the cantilever 81 (FIG. 41) immediately adjacent to overhangs 80 is minimal thickness and/or comprises of a material with a low stiffness/modulus of elasticity, there can be considerable flexibility in the radial direction 83 at the overhangs 80. As seen in the example shown in FIGS. 40-41, this flexibility allows the radially inner spherical insert 96 to be inserted when it would not otherwise fit. In this example, a continuous spherical insert 96A is shown rather than an insert comprising a frusto-spherical surface 92. As shown in FIGS. 50-52, other shapes, such as a frusto-conical surface 236 could be used instead of a cylindrical outer surface 88.

Figure 53:
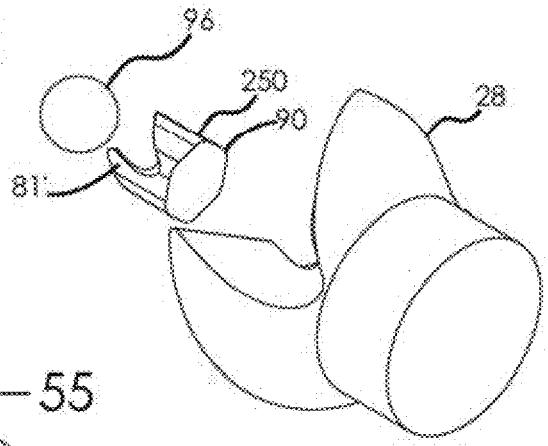
FIG. 53 is an exploded view showing an example of the idler insert or driver insert shown in FIG. 39 comprising a segment of a-multi-faced-geometric outer surface.
Figure 54:
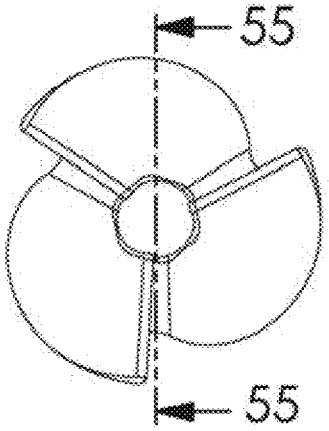
FIG. 54 is a front view of the example shown in FIG. 53.
Figure 55:
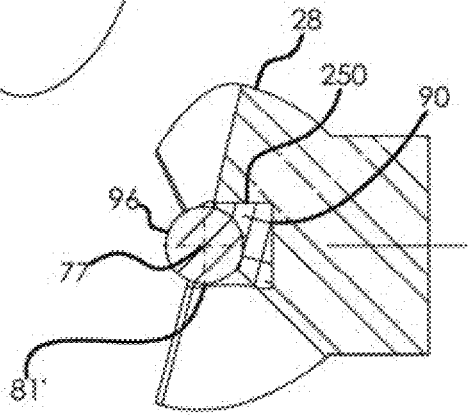
FIG. 55 is a cutaway view taken along section line 55-55 of FIG. 54.
Figure 56:
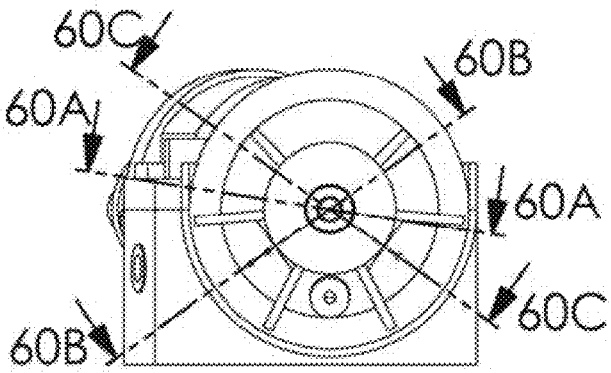
FIG. 56 is a rear view of the example shown in FIG. 1.
Figure 57:
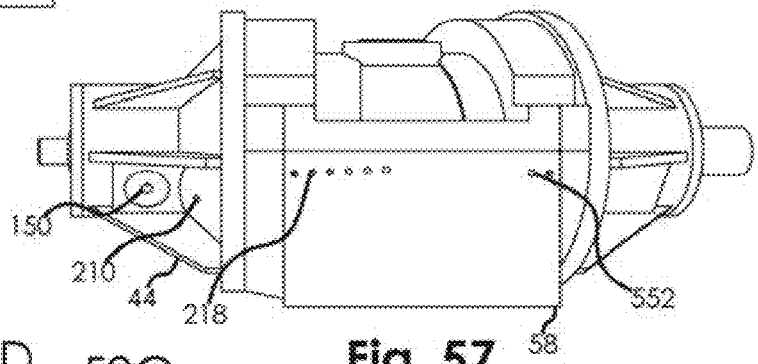
FIG. 57 is a side view of the example shown in FIG. 1 shown from the opposing side.
Figure 58:
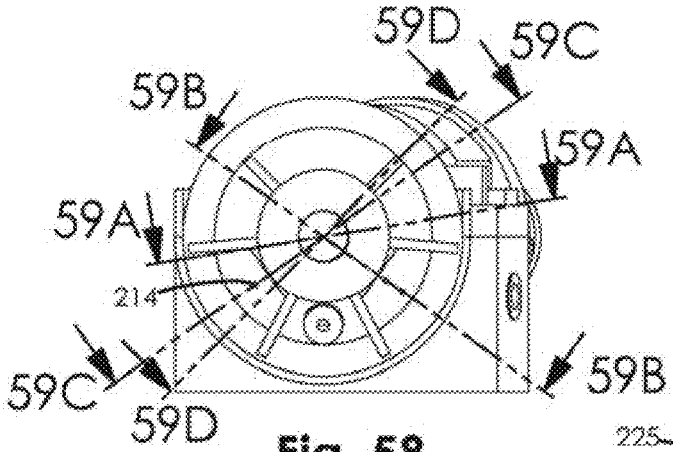
FIG. 58 is a front view of the example shown in FIG. 1.

These examples may be configured wherein rotation of the idler insert 90 relative to the idler rotor 28 is permitted. In another example it may be advantageous to incorporate shapes configured to prohibit rotation of the insert 90 relative to the rotor 28. For example, as shown in FIGS. 53-55, incorporating a multi-faced prism 250 at the interface would act as a keyway to prevent rotation of the idler insert 90 relative to the idler rotor 28. In the example of FIGS. 8A-8B, the idler insert 90 comprises a cylindrical outer surface 88 comprising within an idler rotor inner frusto-spherical surface 92. Therefore, the idler insert 90 can be inserted axially into the idler rotor 28. As an example, in FIG. 39, pins 252 are used to prevent rotation of the idler insert 90 relative to the idler rotor 28. Likewise, the driver insert 94 may be inserted axially into the driver rotor 76, with the relative rotation between these components secured with pins or other fastening methods and components. A cylindrical interface may require pins or another method to prevent rotation of the idler insert 90 relative to the idler rotor 28. However, this shape may be preferred over a multi-faced prism 250 in one example as the overhangs 80 may have a consistent thickness. If the interface comprises a multi-face prism 250, then as shown in the example in FIGS. 53-55, to achieve the same flexibility in the overhangs, there may be local regions 81' in the overhangs that are thinner in comparison. In one example, contact between the idler insert 90 and driver insert 94 can be minimized or eliminated by injecting high pressure fluid between the frusto-spherical surfaces (92 and 98) of these components (FIG. 2). In low enough torque applications, the axial idler/driver rotor surfaces 84A/84B or axial idler/driver insert surfaces 85A/85B or inner surfaces 86 could be designed appropriately to facilitate torque transfer without the need for other indexing methods.

In one example, as shown in FIG. 39 and FIG. 2, the outer (concave) frusto-spherical surface 92 defining part of the chambers 144 may be a unitary construction with the idler insert 91. In another example, these components may also be a unitary construction with the idler rotor 28, removing the need for the pins 252 that otherwise minimized or eliminated relative rotational movement of said components and the tubes 618 that minimized or eliminated undesirable fluid leakage between the idler rotor 28 and idler insert 91.

Figure 42:
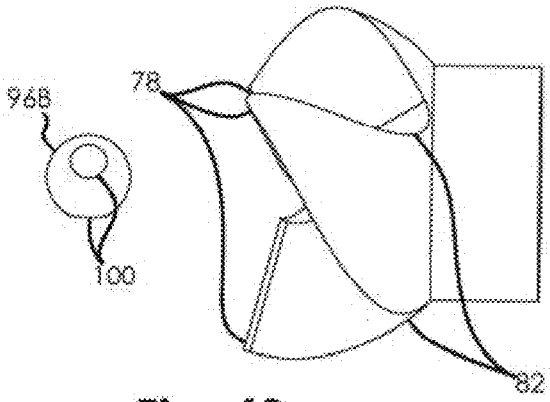
FIG. 42 is an exploded elevation view showing one example of a rotor with a partial frusto-spherical surface at the radial center of the rotor.
Figure 43:
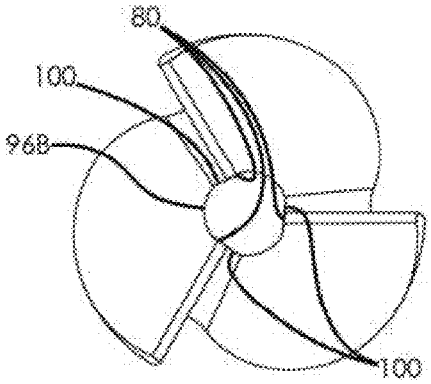
FIG. 43 is a face view of the example shown in FIG. 42.

In the example shown in FIGS. 42-43 the radially inner frusto-spherical surface 96B may be substantially spherical, comprising reliefs 100 or non-spherical surfaces. Placing reliefs 100 at the radially inner frusto-spherical surface provides one example where reliefs are not required at the overhangs 80 nor are the idler/driver inserts of FIGS. 39-41 are not required. It is conceived to be optimal if one relief were placed at each overhang 80. In one example, the frusto-spherical component 96B can be rotated appropriately while being assembled with the idler/driver rotors (28/76) and repositioned after assembly. This repositioning of the inner frusto-spherical surface after assembly is configured for the inner frusto-spherical surface 96B to form tight gaps at the overhangs 80, thereby minimizing leakage between the component 96B and the surface 98 of the inserts 90/94. This component containing a frusto-spherical outer surface 96B can be fastened by way of bolts, set screws, adhesives, welding, brazing, or other fasteners or fastening methods to the idler/driver rotors (28/76) or to the idler/driver inserts (90/94).

Figure 44:
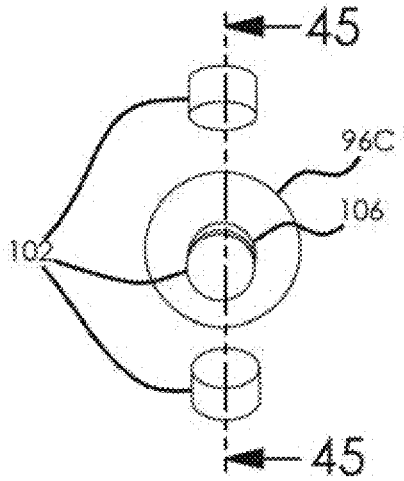
FIG. 44 is an exploded view showing an example of the inner frusto-spherical surface shown in FIG. 43 comprising adjustable components.
Figure 45:
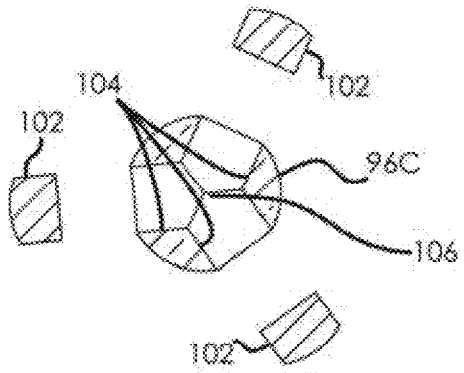
FIG. 45 is a cutaway view taken along section line 45-45 of FIG. 44.
Figure 46:
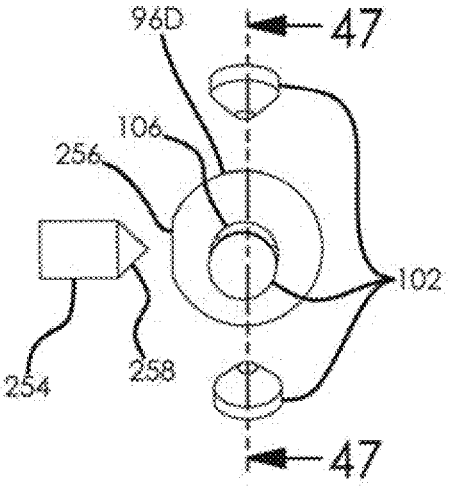
FIG. 46 is an exploded view showing another example of the inner frusto-spherical surface comprising adjustable components.
Figure 47:
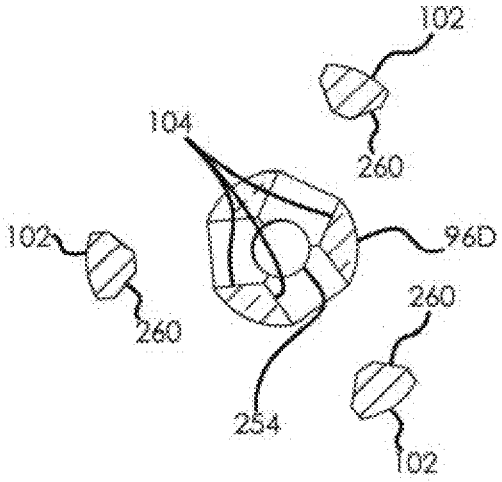
FIG. 47 is a cutaway view taken along section line 47-47 of FIG. 46.
Figure 48:
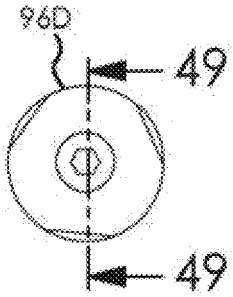
FIG. 48 is an elevation view of the example shown in FIG. 46.

In the example shown in FIGS. 44-45 the radially inner frusto-spherical surface 96C contains openings 104 configured to receive pistons 102. During assembly, these pistons 102 are substantially recessed in their respective openings 104. After assembly, the inner cavity 106 inward of the pistons 102 may be supplied with high pressure fluid, pressuring the pistons 102 radially outwards to contact the idler/driver rotor insert surfaces 98. In one example, the piston repositions radially outward to contact the overhangs 80 (FIG. 43) of the insert 96. The position of the inner frusto-spherical component 96(B-D) may be fastened to the idler/driver insert 90/94 by way of bolts or other fasteners or fastening methods.

Figure 49:
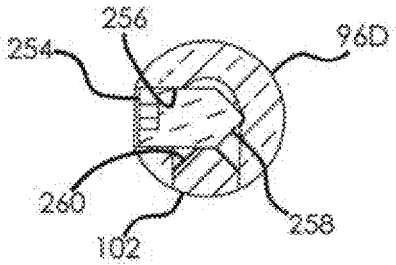
FIG. 49 is a cutaway view taken along section line 49-49 of FIG. 48.

In one example the pistons contact the overhangs to eliminate or minimize leakage in this region for the device performance. As seen in the example in FIGS. 46-49, a set screw 254 may be tightened into a hole 256, causing axial translation of a tapered surface 258. This tapered surface 258 on the set screw contacts a wedge 260 on the radially inward face of the pistons 102, causing the pistons 102 to extend radially outwards until the tapered surface 285 is in contact with and presses against the idler/driver rotor surfaces (FIG. 49). Alternatively, if it is desired to pre-load the pistons 102 into the immediately adjacent idler/driver rotor surfaces (not shown), then it can be understood that the axial length of the pistons 102 should be larger in that tapered surface 285 and wedge 260 would remain in contact when the set screw 254 is tight.

In the example shown in FIGS. 102-103C and FIG. 115, the coolant fluid passes through the driver insert 95 via conduit 155. The tubes 618 may comprise O-rings in the O-ring grooves 618' permitting flow through the tube inner diameter 618". These tubes 618 may act as pins, resisting rotation of the driver insert 95 relative to the driver rotor 76B. The (hexagonal) male protrusion 251 of the idler insert 91 may be substantially the same size and shape as the mating (hexagonal) female cavity 251' of the idler rotor, which may resist rotation of the idler insert 91 relative to the idler rotor 28B. Additionally, the male protrusion 251 is shown with outer mating surfaces consisting of a frusto-conical (tapered) surface 253 and frusto-cylindrical surface 255. This smaller diameter of the (hexagonal) shape comprises the frusto-conical (tapered) surface 253. This configuration of surface 253 may enable additional material 29 (FIG. 103C) to exist at the immediately adjacent portion of the idler rotor 28B, while still allowing space for the holes 613A/613B in the idler rotor 28B/idler insert 91; holes which supply the (inner ball) recess 99' with a pressurized fluid via fluid conduit 613 (FIG. 147).

On example comprises an O-ring set in the O-ring groove 257 so that the pressurized fluid from the adjacent holes 613A/613B may not migrate beyond the O-ring groove 257 to pressurize the back face 259 of the idler insert 91. If a pressure differential exists, the idler insert 91 may remain seated against the idler rotor 28B, minimizing or eliminating long term wear of the components if metal-to-metal contact is avoided.

Assembling the Rotary Fluid Flow Device—Example B

Looking to FIGS. 102-104A and FIG. 113, example B of the rotary fluid flow device 20 may be assembled, in one example, as follows. Methods of fastening may include bolts or other fastening methods known in the art. The idler rotor 28B may be inserted into the idler housing 617A. The idler collar 37A may then be fastened to the idler rotor 28B, followed by the big idler shim 619A and idler flange 621A being fastened to the idler housing 617A. The idler insert 91 may be connected to the driver insert 95 and inner ball 97 and then those meshed components may be inserted into the idler rotor 28B. Tubes 618 may be inserted into the driver insert 95. The driver rotor 76B may then be connected to the driver insert 95 and idler rotor 28B simultaneously. The driver housing 617B may be fastened to the idler housing 617A, followed by the driver collar 37B being fastened by to the driver rotor 76B. The (big) first driver shim 619B and driver flange 621B may be fastened to the driver housing 617B, followed by the (small) second driver shim 623B and driver bearing sleeve 625B fastened to the driver flange 621B and the small idler shim 623A and idler bearing sleeve 625A fastened to the idler flange 621A. The components described above may be substantially held in place, with the only opportunity for deflection may be substantially small in that the gap heights selected for the hybrid bearings are substantially small, in some cases being on the order of thousands of an inch or smaller.

The primary gate 171 may be inserted into the primary gate housing 181, followed by the primary gate gear 185 being fastened to the primary gate 171. A shim 624 may be inserted into the primary gate actuator 183 before those components are fastened to the primary gate housing 181. The primary gate assembly 31 may then be fastened to the idler flange 621A.

Figure 104A:
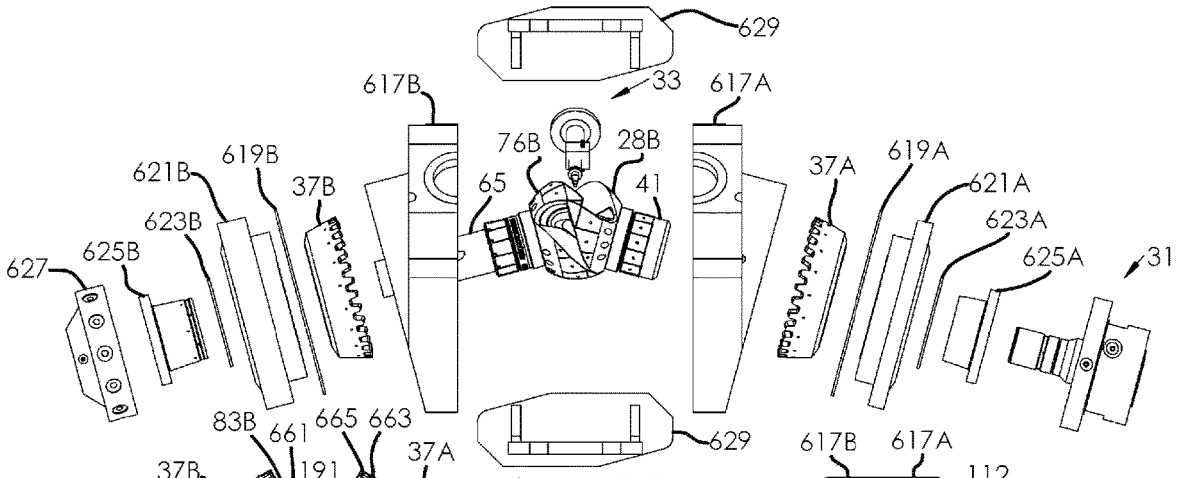
Figure 108A:
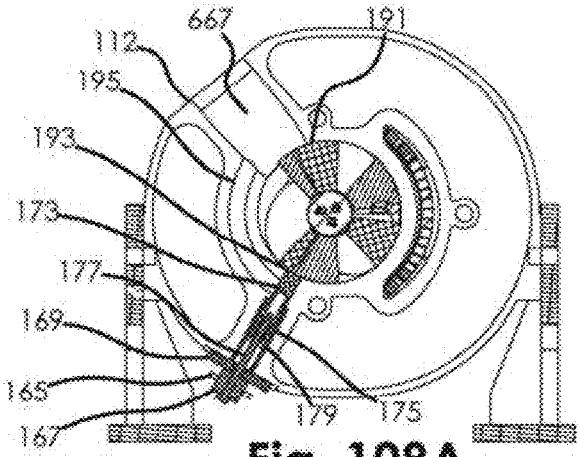

The capacity control assembly 33 shown in FIG. 104A and with a cross section shown in FIG. 108A may be assembled by fastening the secondary gate fastener 179 to the secondary gate 173 and inserting those into the secondary gate housing 175. The actuator body 167 with attached actuator input shaft 165 and threaded component 177 may be inserted into a bore hole of the blind flange 169. In one example the threaded component has a self-locking thread pitch (e.g., ACME thread) in that periodic pressure-induced loads from the chamber 144 may not axially translate the secondary gate 173. The capacity control assembly 33 may be fastened to the idler/driver housings 617A/617B, ensuring that the threaded component 177 is engaged with the secondary gate fastener 179.

The driver endcap 627 may be fastened to the driver flange 621B. The mechanical seal components 631 may be inserted on the driver side, which may be followed by an additional flange, if required to hold the mechanical seal components 631 in place.

It is to be understood that other assembly techniques and order of operations that are known in the art may be applied. The merits of these techniques may be primarily judged based on how accurately the components may be positioned while minimizing damage such as scratches or other damage on bearing surfaces.

Assembling

Adjustments—Example A

In the example shown in FIGS. 1-5, previous difficulties encountered in producing rotor-rotor assemblies, housing and other components concentric to the center of a sphere, have been reduced where the idler rotor assembly 22 and driver rotor assembly 24 are assembled in the housing base 58 and housing cover 56 and the idler rotor assembly 22 and driver rotor assembly 24 are configured for internal adjustment.

Concentric positioning of the idler rotor assembly 22 and driver rotor assembly 24 can be adjusted relative to the housing base 58 and housing cover 56 bore holes 116 by inserting shim(s) 204 (FIG. 3) between the idler rotor assembly 22 and driver rotor assembly 24. In one example, the shims 204 disclosed may be flat plane shims. They may be produced of soft metals such as aluminum or brass. While thinner or thicker shims 204 may be used, thin shims are most commonly from 0.001 inch to ¼ inch in thickness. In one example, as a result of manufacturing tolerances, the idler rotor assembly 22 may be 0.001 inch lower than desired. By adding a shim 204 (FIG. 3) that is 0.001 inch in thickness, the spacing there between is adjusted. In one example, the relative axial positions of the idler rotor 28 and the driver rotor 76 are adjusted internally relative to their respective assemblies and therefore also relative to the center of the spherical cavity 114. This internal adjustment on both the idler rotor 28 and the driver rotor 76 may be accomplished after the fluid flow device is assembled, and before the fluid flow device is used to transport/pump the working fluid, with further adjustment while the fluid flow device is in operation. This adjustment method facilitates easier positioning of the rotors in relation to each other during assembly in that the adjustment method allows greater degree of freedom of the collar location and/or the collar manufacturing accuracy or positioning. During a cold start-up, components may be near or at the temperature of the surroundings. The axial expansion the of idler rotor shaft 40 and driver rotor shaft 64 as measured between the center of the spherical cavity 114 and the nearest surface of the collar 38 could be significantly different than the expansion of the surrounding housing components in the same direction under varying design conditions and varying conditions surrounding the device. This arrangement may make it possible to maintain very thin gaps between the front cylinder 32 and the collar 38 and rear cylinder 42 and the collar 38 under most operating conditions. Controlling the axial position of a shaft may be desirable in other industries. U.S. Pat. No. 4,801,099 shows a method " . . . to generate a hydrostatic stabilizing force on the rotating shaft in an axial direction in a controlled manner, so as to constantly counteract fluctuating axial thrust forces acting on the displaceable rotating shaft and to maintain a predetermined clearance range of the grinding space . . . ". Maintaining a small gap in some examples is important as the front cylinder 32 and rear cylinder 42 comprise of hybrid bearing pads (118 and 120), which require tight gaps to be present including during start-up, to minimize leakage and maximize the stiffness of the bearings. In addition, the foregoing assembly method makes it possible to control the gap height at the hybrid bearings (134, 136, 72, 138, 118, 120) within acceptable tolerances.

Compensation for Thermal Growth and Assembly Tolerances—Example A

In the example shown in FIG. 8A, a cavity 140 between the front cylinder 32 and the idler front bearing housing 34. Similarly, a cavity 142 is formed between the rear cylinder 42 and the idler rear bearing housing 44. In one example, a control system is used to maintain the desired amount of fluid in these cavities (140, 142) on the idler rotor assembly 22 and driver rotor assembly 24 (FIG. 2) to maintain the desired nominal gap between the front cylinder 32 and collar 38 and desired nominal gap between the rear cylinder 42 and collar 38. This gap is calculated by utilizing averaged outputs from position sensors that compensation to compensate for thermal expansion is achieved, and small fluctuations caused by variable loads (e.g., pressure-induced) do not affect compensation. In one example, these position sensors (not shown) are located on the collar 38, immediately adjacent to the collar on the idler rotor shaft 40, or driver rotor shaft 64 to sense and react to the axial position of the collar relative to the front cylinder hybrid bearings 118 and rear cylinder hybrid bearings 120.

Compensation for Thermal Growth and Assembly Tolerances—Example B

In the example of FIGS. 102-103, the distance between the rotors' spherical centers 77 and the rear/front thrust bearings (139A, 139B, 129A and 129B) at the collars 37A/37B may be substantially smaller than the example A (FIGS. 1-2) distance between the rotors' spherical centers 77 and rear/front thrust bearings (118/120) at the collars 38 for a rotary fluid flow device 20 of equivalent volumetric capacity and performance (e.g., maximum compression ratio capability and maximum discharge pressure). If the range of thermal expansion is within an acceptable range with respect to bearing performance, and metal-to-metal contact is not expected, the adjustable piston system of example A (FIGS. 1-2) may not be required.

Removing Front or Rear Cylinder—Example A

FIG. 8B shows an example where the front cylinder 32 is not used for example in some loading scenarios. The front cylinder 32 of FIG. 8A may be used to resist axial movement of the idler/driver rotor shafts (40/64) towards each other. For some loading scenarios, the idler/driver rotor shafts (40/64) may comprise sufficient forces acting to separate each other to balance with the (self-compensating) rotor hybrid bearings (134 and 136) and rear cylinder hybrid bearings 120. As an example, the pressure of the working fluid and the pressurized fluid at the idler/driver rotor inner frusto-spherical surfaces (92/98 in FIG. 2) may produce axial forces that act to separate the idler/driver rotor shafts (40/64). Increasing the surface area and/or pressure of the sealing fluid (which in one example is the bearing fluid and/or the coolant fluid) at the idler/driver rotor inner frusto-spherical surfaces (92/98 in FIG. 2) may eliminate the requirement of the front cylinder 32 shown in other examples for a given set of loading scenarios. Increasing the size/diameter of the inner frusto-spherical surface 92 may reduce volumetric throughput, and increasing the pressure supplied to the idler/driver rotor inner frusto-spherical surfaces (92/98 in FIG. 2) may reduce overall efficiency. In one example the rear cylinder 42 from the example shown in FIGS. 1-8B may alternatively be removed in scenarios where loading may always act on the collars 38 in the direction of the rotors' frusto-spherical centers 77. The pressure on the idler/driver rotor bearings 136/134 may cause such a deflection if the combined force from the working fluid in the chambers 144 and force contribution from the inner frusto-spherical surfaces (92/98 in FIG. 2) is small. The surface area and/or pressure of the fluid at the idler/driver rotor inner frusto-spherical surfaces 92/98 may be minimized to minimize this force contribution. This load at the idler/driver rotor frusto-spherical surfaces 92/98, combined with the pressure-induced loads from the working fluid and the front cylinder hybrid bearings 118 may be substantially balanced with the loads that act to push the idler/driver rotor shafts (40/64) together. If additional load is required to push the idler/driver rotor shafts (40/64) together, this could be applied in the form of higher than atmospheric pressure acting on any relevant idler/driver rotor shaft (40/64) faces and/or at the collar 38, including where the rear cylinder 42 would otherwise be placed.

Indexing Gear Arrangements—Example A

In the example shown in FIGS. 2-3, the front cylinder hybrid bearings 118 and rear cylinder hybrid bearings 120 resist axial loads (e.g., pressure-induced) that act in line (axially) of the respective idler shaft 40 or driver shaft 64. In one example, these hybrid bearings comprise of multiple bearing pockets with potentially different (simultaneous) pressures. In one example the hybrid bearings 118, 120 also resist bending moment loads (e.g., pressure-induced) that may act to bend the respective idler shaft 40 or driver shaft 64 along their axes of rotation. In one example torque is transferred from the collar 38 on the driver rotor shaft 64 to the collar 38 on the idler rotor shaft 40 in one example via indexing gears 122. Each indexing gear 122 may be supported by conventional bearings 124 on the indexing gear shaft 126. Gear teeth of the indexing gears 122 in one example may not wear significantly in that they make contact in a clean, controlled, environment (within housing 55A) where the largest foreign particle can be no larger than what the lubricating fluid filtration system allows. Since the working fluid in the chamber 144 may contain much larger particles, direct torque transfer between the rotor lobes 78 is minimized and/or contact may be substantially reduced or eliminated completely. The lubricating fluid may be injected at a higher pressure than previously capable between these locations to prevent any working fluid from entering the gear teeth region at the interface of the indexing gears 122. Placing both gear teeth and the hybrid bearings 118/120 on the collars 38 allows these components to be as close as possible in this arrangement to the chamber 144, allowing part and gap sizes to be minimal without compromising on overall size, weight and leakage/efficiency. The front cylinder hybrid bearings 118 and rear cylinder hybrid bearings 120 resist moment loads (e.g., pressure-induced) close to the spherical cavity 114 to minimize the required rotor shaft diameter, by minimizing the deflection of the rotor shaft. Likewise, the indexing gearing arrangement, comprised of the indexing gears 122, conventional bearings 124 and indexing gear shafts 126 may be produced more compact than previous designs due to its proximity to the spherical cavity 114.

One example of this gearing arrangement is made sufficiently non-compliant (rigid) to minimize, and/or eliminate any torque transfer directly between the rotor axial surfaces (i.e., 84A and 84B in FIG. 39). Since the magnitude of the torque transfer varies substantially between varying design scenarios (e.g., Varying suction and discharge pressures in the case of a compressor), a "pre-loaded" system is sophisticated and/or may require adjustment. The term "pre-loaded" is used to describe loads that are applied to a component or system of components before operation. As an example, when bolts are initially tightened, this initial (axial) tension in the bolt is referred to as a "pre-load". In this example, the "pre-load" of a bolt is commonly designed to be higher than any subsequent loads (e.g., Pressure-induced, thermal expansion, etc.) that would lower the total tensile load in the bolt. A "pre-loaded" gearing arrangement may involve applying relative torsional loads between components. This torsional "pre-load" may be applied to be approximately equal in magnitude and opposite in direction to expected loads (e.g., pressure-induced) to minimize and/or eliminate any torque transfer directly between the rotor surfaces. However, these expected loads (e.g., pressure-induced) can vary significantly for varying conditions (e.g., Suction and discharge pressure, working fluid capacity control etc.). Therefore, a non-compliant (rigid) arrangement is advantageous to minimize, and/or eliminate any torque transfer directly between rotor surfaces. Furthermore, the rotational direction of the driver rotor shaft 64 in combination with the idler/driver rotor (28/76) geometry should be considered to minimize the torque transferred through the indexing gearing arrangement. Pressure-induced loads at the chamber act to separate the idler/driver rotor (28/76) surfaces at high pressure region(s), which can significantly increase the torque transferred through the indexing gearing arrangement. As seen in the example shown in FIG. 18, when the driver rotor shaft 64 is rotated in the counter-clockwise direction (when viewed from the back), the end of the stroke occurs with the driver rotor lobes 78B adjacent to the valleys 82A of the idler rotor 76. When the driver rotor shaft 64 is rotated in the clockwise direction (when viewed from the back), the end of the stroke occurs with the idler rotor lobes 78A adjacent to the valleys 82B of the driver rotor 28. Combinations of rotor geometry variables are optimized for a given driver rotor shaft 64 rotational direction to minimize the torque transferred through the indexing gearing arrangement. The combination of a substantially non-compliant indexing arrangement and minimized torque transfer through an indexing arrangement in one example minimizes, and/or eliminates any torque transfer directly between rotor surfaces.

A typical gear arrangement where two gears share a common shaft theoretically could be used. In one example, the gear shaft would be substantially large to minimize torsional lag. Such an embodiment may require custom roller bearings and/or hybrid bearings to handle the higher surface speeds in combination with high radial loads. The bearing surface speeds could be reduced by increasing the size of the gears on the gear shaft, but this still leads to a typical gear arrangement being quite large. The example shown in FIGS. 2-4 comprises a dual axis gear 122 arrangement such that the indexing gears 122 mesh directly with each other, thereby minimizing the indexing gear shaft 126 diameter. This is accomplished as the torsional stiffness is obtained from the direct transfer between the gears. Minimizing the indexing gear shaft 126 diameter results in a device wherein the surface speeds the conventional bearings 124 experience may be much lower than with a larger shaft. This gear arrangement is conceived to be much more compact and stiffer than known devices, thereby minimizing size, weight, and cost.

As shown in the example shown in FIG. 70A, one such example of an indexing gear arrangement can be applied to idler/driver rotors (28A/76B) with varying numbers of lobes 78A'/78B'. One such example is disclosed in U.S. Pat. No. 8,562,318 "Multiphase Pump With High Compression Ratio". In such an example, the rotor with a larger number of lobes may operate at a slower rotational speed in relation to the opposing rotor. In one example this device is configured to operate at speeds that exceed that of a traditional reciprocating engine design. Traditional speeds in the range of 750 to 1200 and up to 1800 RPM are known in the art. Our rotary fluid flow device in one example is operable at up to 3,600 rpm. In one example, it may be advantageous to drive the driver rotor shaft 64' with a larger number of lobes than the idler rotor shaft 40', so that less, or no speed reduction is required. In the example shown in FIG. 70, the driver rotor 76' comprises three lobes 78B', and the idler rotor 28' comprises two lobes 78A'. Therefore, in the case of a rotary arrangement, in one example, the rotational speed of the idler rotor shaft 40' may be 1.5× greater than the rotational speed of the driver rotor shaft 64'. To accomplish this speed change in one example, the gear pitch diameter 262 on the driver rotor shaft collar 38B would be that same ratio (i.e., 1.5×) greater than the gear pitch diameter 264 on the idler rotor shaft collar 38A. The normal distances between each collar 38A/38B and the rotors" spherical centers 77' are shown as distance 130A and distance 130B in FIG. 70A. In the example shown, distance 130B is equal to half of the gear pitch diameter 264 on the idler rotor collar 38A. In this example, distance 130A is equal to half of the gear pitch diameter 262 on the driver rotor collar 38B. For values of "130B" that are lower than half of the idler rotor gear pitch diameter 264, values of "130A" are lower than half of the gear pitch diameter 262 on the driver rotor collar 38. For values of "130B" that are larger than half of the idler rotor gear pitch diameter 264, values of "130A" are higher than half of the gear pitch diameter 262 on the driver rotor collar 38B. These relative dimensions are not dependent on the sizes of the indexing gears 122B/122A. In the example shown in FIG. 70A, the indexing gears 122B/122A have equivalent gear pitch diameters as this reduces the maximum rotational speed expected in the indexing gear shafts 126B/126A.

Figure 70C:
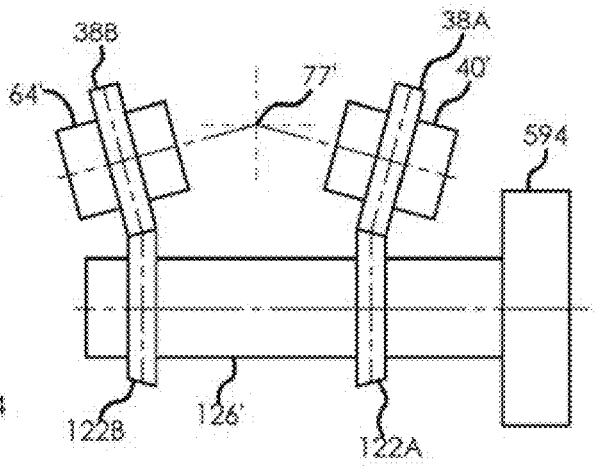
FIG. 70C is a highly schematic top view showing another example of an index gear arrangement.
Figure 70B:
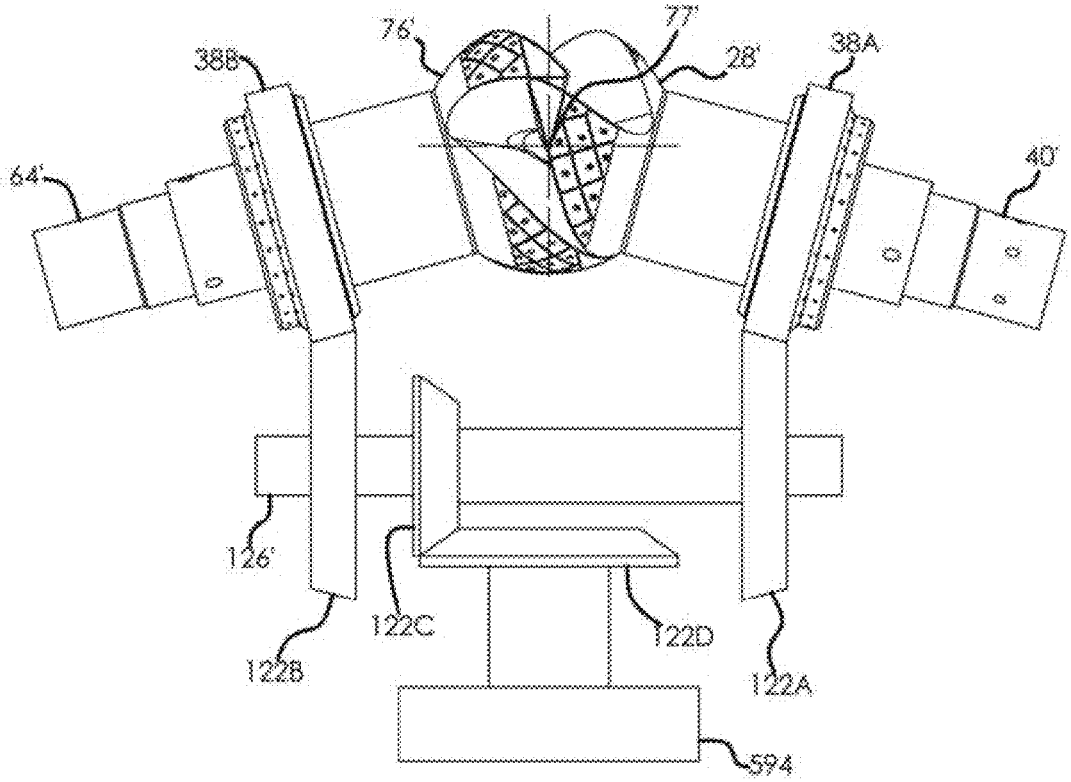
FIG. 70B is a highly schematic top view showing one example of another index gear arrangement.

In the example shown in FIG. 70B, the driver/rotational power source (e.g., engine or motor) output shaft may be connected to the driver coupling flange 594. Index gear 122A, 122B, 122C and 122D may be fastened to their respective shafts by conventional structures and methods. As the driver coupling flange 594 rotates, this drive torque may be transferred between index gear 122D and index gear 122C. Index gear shaft 126' in this example is configured to transfer this torque to index gears 122A and 122B, which comprise gear teeth intermeshed with gear teeth on the collars 38A/38B. Where the gear pitch diameters of the collars 38A/38B are substantially equivalent to each other, and the gear pitch diameters of index gear 122A and 122B are substantially equivalent to each other, then the rotational speed of the driver rotor shaft 64' and idler rotor shaft 40' may be substantially equivalent. Thus, this indexing gear arrangement of this example is configured to minimize or prevent contact between the rotor surfaces. The gear pitch diameters of the gear teeth on the collars 38A/38B and the indexing gears 122(A-D) result in a predictable impact on the amount of torque and rotational speed available at each respective axis. The rotary fluid flow device 20 may have the highest volumetric throughput when the rotor shafts 64'/40' are spinning at the maximum allowable rotational speed. Thus, if a driver is limited by having a lower maximum allowable rotational speed, but it may produce excess output torque, it may be advantageous to have a higher than 1:1 speed increase ratio between the driver coupling flange 594 and rotor shafts 64'/40'. As an example, it may be possible to obtain the desired speed increase ratio by replacing index gears 122C and 122D. In another example, the gear pitch diameter of indexing gears 122A and 122B may be increased and/or the gear pitch diameter of the gears on the collars 38A/38B may be decreased. Torsional lag in one example is defined as the relative twist and corresponding time-delay between two locations in the rotary fluid flow device 20. If the torsional lag from the driver coupling flange 594 to the respective rotors 76'/28' varies substantially, the surfaces of the rotors 76'/28' may contact. Thus, the spacing of index gear 122C between index gears 122A/122B and the torsional stiffness of indexing gear shaft 126' on each side of the index gear 122C may be important variables to optimize in that the torsional lag from index gear 122C to the respective rotors 76'/28' may be substantially equivalent. By making this torsional lag substantially equivalent, it may be possible to minimize the size of the indexing gear shaft 126', which may reduce overall size and weight and may make smaller pitch diameters of index gear 122C possible. This arrangement may also alleviate any requirement for conventional bearings to position the shafts during assembly.

In the highly schematic example shown in FIG. 70C, the shaft may be connected to the driver coupling flange 594. During operation of the device 20, this shaft is connected to a power source e.g., engine, motor, etc. It may be desired for the indexing gear shaft 126' to be much larger relative to the other components than shown in the example shown in FIG. 70B to minimize torsional lag introduced by the indexing gear shaft 126' between indexing gear 122B and 122A. Index gear 122A/122B may be coupled to the indexing gear shaft 126' by conventional structures and methods. Alternatively, the gear teeth profiles may be integrated into the indexing gear shaft 126'. As the driver coupling flange 594 rotates the indexing gear shaft 126', this drive torque may be transferred between index gear 122A/122B and the gears on the collars 38A/38B. Where the gear pitch diameters of the collars 38A/38B are substantially equivalent, and the gear pitch diameters of indexing gears 122A/122B are substantially equivalent, the rotational speed of the driver rotor shaft 64' and idler rotor shaft 40' may be substantially equivalent. Thus, this indexing gear arrangement may minimize or prevent contact between the rotor surfaces while providing a fluid seal therebetween. Where the gear pitch diameters on the indexing gears 122A/122B exceed the gear pitch diameter on the collars 38A/38B, the rotor shafts 64'/40' may have a higher rotational speed than the indexing gear shaft 126' which is the input shaft in this example. Shaft(s) may be hollow to substantially decrease weight without substantially increasing torsional lag.

In the example shown in FIG. 2 gear teeth are located on the collars 38. These collars may be fastened to the respective idler/driver rotors 28/76 by way of bolts or other fastening methods known to persons skilled in the art. Keeping the collars 38/gears 122 as separate components from the rotors may reduce manufacturing costs and improve tolerances since the frusto-spherical surfaces of the rotors can be more easily ground. As the driver coupling flange 594 rotates the drive rotor shaft 64, this drive torque may be transferred between the gears on the collars 38. This may be a preferred arrangement in applications where the spinning rotor assembly 20 is driven by a motor. In one example a commonly available motor operation speed is 3600 RPM, which is still within the range of the spinning rotor assembly 20 acceptable operating range, without an external gearbox being required. In one example a commonly available engine operation speed is 750-1200 RPM, requiring a speed increaser, such as an external gearbox for the driver shaft 64 to have an operation speed of 3600 RPM. A higher operation speed may be commonly desirable for the rotary fluid flow device 20 in that higher volumetric throughput may be expected. In one example a gearbox may require maintenance and an engine may comparatively require more frequent and costly maintenance in comparison to a motor. This more compact arrangement may reduce the cost, size, and weight of the spinning rotor assembly 20.

Pressurized Gear Cavity/Bearing Drain Pressure—Example B

In the example shown in FIGS. 102-103 and FIG. 111, the contact area of the gears 664 is contained in a gear cavity 445. It may be common practice for a gear cavity to be at or near ambient pressure and flooded with air. Some low surface speed applications may be flooded with a liquid lubricant or flowable grease at low pressure. In one example of the rotary fluid flow device 20, the pitch diameters of the collars 37A/37B may be around 23" with a rotational speed of around 3600 RPM, classifying it as a high surface speed application. Where this cavity 445 is flooded with the bearing fluid/lubricant instead of a gas, the relative increase in viscous drag (and required drive torque) and heat generation may reduce efficiency and reduce the lifespan of the gears. In one example, a liquid is sprayed into the gas-flooded cavity onto the contact area of the gears for cooling (not shown) as is understood by those skilled in the art. It may be best to direct the spray on the contact area immediately before contact occurs, after contact occurs, or a combination. Either approach is possible with the examples provided. The fluid from the hybrid bearings is shown in the example provided to drain into the pressurized gear cavity and depending on the temperature, this flow of bearing fluid and coolant fluid may or may not be of benefit in keeping the gear contact area at an acceptably low temperature to minimize scuffing. In one example there may be little to no coolant fluid that reaches gear cavity 445 if the landing 659A has substantially high flow resistance.

In the provided example, the gear cavity 445 and attached bearing fluid/coolant fluid drain conduit 447 is immediately adjacent to the previously discussed bearing drain landings as a drain that is at a lower pressure than the bearing supply pressures. Therefore, regardless of the flow resistances at the landings, the adjacent pocket pressures are expected to be somewhere between this gear cavity drain pressure and the respective bearing supply pressure(s). A very low pressure, (e.g., near ambient pressure), in the gear cavity, could maximize the load capacity of the idler/driver shaft bearings 137A/137B in that the bearing pockets on one side of a shaft could reach a low pressure (e.g., near drain pressure) when the local gap height is increased while bearing pockets on the opposing side reach a high pressure (e.g., near supply pressure). The supply pressure may therefore be reduced to achieve the same load capacity as an arrangement with higher drain pressures. The idler/driver thrust hybrid bearings 139A/139B shown in the examples G and J may be able to reach a much lower resistive thrust load than otherwise possible if the bearing pockets may approach the drain pressure. Such a scenario may be important in applications where very low gas pressures are expected in the chamber. The maximum capacity to resist large thrust loads may remain unchanged in that this capacity may be dominated by the supply pressure. When the drain pressure is reduced without altering the supply pressure this may increase the flow rate/leakage from the bearing. If the supply pressure was realized by a pump, additional flow and power may be required and more expensive downstream equipment (e.g., separation and heat exchangers) may be required to handle the higher flow rate. Typical compressor lubricants (e.g., PAG or PAO formulations that may be commonly used in screw compressors) may absorb increasing portions of the working fluid (e.g., natural gas) at increasing pressures.

As the lubricant pressure drops, some of this working fluid in gas form that was in solution with the bearing fluid may be liberated from the bearing fluid. If this de-gassing/foaming occurs in the hybrid bearings, this may be undesirable in that the bubbles are in some examples desired to increase the compressibility of the hydrodynamic fluid films in the bearing. If this fluid film is not continuous, the actual pressure wave (and resulting load capacity) may not be predictable. The lubricant may change from a liquid to a gaseous state (cavitation) in any local regions that drop in pressure below the lubricant's vapor pressure (e.g., below atmospheric pressure). Cavitation may rupture the oil film and cause the adjacent solid components to wear (e.g., metal rotor faces, gear teeth, adjacent relatively moving surfaces of rotors, shafts, etc.). Although the average bearing pocket pressure may not drop below the bearing drain pressure, there may be local regions that do drop below this drain pressure. Computational Fluid Dynamic (CFD) studies or tests may be performed to predict cavitation. Cavitation may also be avoided by having a bearing drain pressure well above the vapor pressure of the lubricant, which may be well above ambient pressure. Alternatively, if a relatively high supply pressure is selected in relation to the expected loads, the bearing drains may be at atmospheric pressure, but the bearing pockets may not reach such low pressures in that the full resistive load capacity of the bearing is not required.

A high enough drain pressure may optionally allow the bearing fluid to drain from holes 447 (FIG. 111) into the intake plenum 667 (FIG. 108A) of the compressor via piping that may be external to the rotary fluid flow device 20. If the bearing fluid/coolant fluid in this drain 447 has substantially heated beyond the working fluid temperature, it may be desirable to cool the bearing fluid/coolant fluid in that the warmer bearing fluid may expand the working fluid, reducing the volumetric throughput. Cooling can be accomplished by methods known in the art (e.g., a heat exchanger). The resulting pressure in the gear cavity may be governed by the pressure drop in the lines between the gear cavity and the intake plenum 667. A pressure regulator may be used to achieve a desired pressure in the gear cavity. By introducing the bearing fluid/coolant fluid into the intake of the compressor, the compressor driver (e.g., engine or motor) may boost the bearing fluid/coolant fluid pressure to the discharge pressure. This may reduce the work required to further boost the bearing fluid/coolant fluid pressure to above discharge pressure to supply the rotor hybrid bearings. Alternatively, a pump or other conveying method may be used instead, which may be necessary if the gear cavity pressure is lower than the compressor intake pressure.

The gear cavity pressure may exceed the discharge pressure and working fluid may drain into any components downstream of the compressor (e.g., piping or gas-liquid separator). It may be preferred to separate the bearing fluid/coolant fluid from the working fluid at discharge pressure and then only boost the pressure of the bearing fluid to the bearing supply pressure, which for at least the rotor hybrid bearings may exceed the discharge pressure. In one example, this may save power otherwise used for pumping/conveying the fluid to high pressure. In one example, the coolant fluid may not be further boosted from the pressure downstream rotary fluid flow device 20, which in one example, is substantially similar to the pressure in the discharge plenum (669). If gas is not present in the pump or other pressure boosting method, there may be no additional working fluid that is absorbed in the working fluid. Therefore, there may be no de-gassing of the lubricant if the gear cavity pressure exceeds the discharge pressure. However, designing the gear cavity to withstand the higher pressure with minimal deflections may require additional material and a higher cost.

As discussed above, it may be preferred for high speed applications to flood the gears in the gear cavity with a gas, in one example to substantially reduce parasitic losses and heat generation from frictional drag. After the unit is initially assembled or after it is shut-down in the field, the gear cavity may be filled with atmospheric pressure air, removing any other fluids, working fluids, and working fluids. It may be preferred to supply the hybrid bearings with high pressure oil before the shaft is rotated to avoid metal-to-metal contact. This may imply that the gear cavity pressure increases to above atmospheric pressure, which could reduce the volume the gas occupies substantially. For example, this volume reduction could be 100× or more if the gear cavity pressure is 100× higher than atmospheric pressure. As seen in FIG. 111, this gas volume may become trapped in the gear cavity if the oil drain 447 is at the bottom of the gear cavity in that gravity may have a tendency for the denser oil/liquid to collect at the bottom with respect to the lower density working fluid (e.g., gas). Additional gas can be pumped into or out of the gear cavity via intermittent fluid communication through hole 446 as required with a higher or lower pressure gas source. In applications where the gear cavity pressure exceeds discharge pressure, a compressor may be configured to move the gas, or other conveying methods known to those skilled in the art such as a liquid jet gas ejector for example. In examples where a liquid jet gas ejector is used, a portion of the high pressure bearing fluid may be used to motivate gas to move from the discharge into the gear cavity until the gears are flooded with gas.

Bearing Layout and Design—Example A

In the example shown in FIG. 2, the driver rotor shaft 64 and idler rotor shaft 40 bearing arrangement minimize difficulties encountered in rotor-rotor arrangements. As mentioned above, in one example there are tight tolerances (small gaps) at the hybrid bearings (134, 136, 72, 138, 118, 120). The driver rotor 76, driver rotor shaft 64, idler rotor 28 and idler rotor shaft 40, may encounter forces causing the components to deflect in the direction of high loads, creating the potential to have rotor to rotor, or rotor to housing contact. Torsional loads may result in rotor-to-rotor deflection and friction. Axial loads may deflect the rotors away from each other, which may result in rotor-housing contact. Radial loads or bending moment loads at the chamber are more likely to cause rotor-housing contact if the relative stiffness of the idler rotor shaft 40 and driver rotor shaft 64 are comparable, because both floating components may move in a similar radial direction simultaneously. Contact may occur at the inner ball; this contact is preferably avoided but it may depend on tolerance stack-up. Radial loads at the indexing gear (from transferring the drive torque) may cause rotor-housing deflection. This contact would increase wear and heat generation, such wear is subsequently expected to increase leakage and/or lead to failure. In one example the high radial loads at the chamber should be resisted as close as possible to the chamber to minimize any bending of the shafts 40/64, thereby minimizing each shaft diameter. As the angle between the idler rotor shaft 40 and driver rotor shaft 64 is increased, it is possible to minimize the rotor shaft (40, 64) diameter for a given target flow rate and RPM but increase of this alpha angle may be at the expense of higher radial loads acting on the rotors (28 and 76). The axial thrust load that may be generated is potentially high at high discharge pressures and it is potentially very low at low discharge pressures. Furthermore, hybrid bearings (134, 136, 72, 138, 118, 120) are commonly positioned such that they do not contact adjacent surfaces during installation. A temporary clamp may be used during installation to avoid this contact and potentially the requirement for conventional bearings. If the driver/rotational power source is coupled to one of the rotor shafts this can be a potential misalignment concern that is mitigated by the temporary clamp or conventional bearings. Conventional bearings (46 and 50) may be used to assure the positioning of the hybrid bearings (134, 136, 72, 138, 118, 120). The conventional bearings 46/50 may be provided in an arrangement where they are installed easily.

Some examples may utilize split-bearings in a fluid flow device capable of the specifications listed herein. Split bearings typically have low rated capacities and therefore commonly have lower life expectancy than bearings that are not split. It is often not feasible to solely use conventional bearings (46 and 50) to absorb the high loads that can be expected from the fluid flow device (rotary fluid flow device 20) disclosed herein operating in the designed specification range listed herein. The rotor hybrid bearings (e.g., 134 and 136) disclosed herein may resist large radial loads without inducing moment loads that may occur from an offset radial reaction force. Radial hybrid bearings (72 and 138) configured in close proximity to the rotors' spherical centers 77 may be used to provide additional radial support to the rotor hybrid bearings (134 and 136). This extra stiffness may be necessary in some examples to resist the high radial loads (e.g., pressure-induced) and the radial load contribution from the indexing gear arrangement 132. In one example, this support is as close to the chamber as possible for this arrangement so that the size of the rotor shaft can be minimized. Immediately adjacent front/rear cylinder hybrid bearings (118/120) at opposing axial sides of the collar 38 provide the appropriate reaction force for the wide range of thrust loads (e.g., pressure-induced) that are possible. In one example, these axial sides of the collar 38 are comprised of a plurality of bearing pockets 284 configured to resist moment loads. Such moment loads may be induced from the axial thrust load occurring parallel, but not co-linear to the idler/driver rotor shaft (40/64). In one example, immediately adjacent, and furthest from the chamber 114 are the front conventional bearings 46 and rear conventional bearings 50. The spacing between the roller bearings (if used) allows the conventional roller bearings on one example to provide moment support for the idler/driver rotor shaft (40/64) to center the cantilevered weight of the rotors 28/76 prior to the engagement of the hybrid bearings.

Relative reduction in shaft diameter at this location is achieved in one example in that the large loads created (e.g., pressure-induced) during operation are resisted primarily by the hybrid bearings (134, 136, 72, 138, 118, 120). This relative reduction in shaft diameter reduces bearing surface speeds, allowing for relatively smaller roller bearings to be selected for design speeds. Including speeds of up to 3600 RPM or more and installation is manageable, while still achieving a high lifespan.

In the example shown in FIG. 2, the configuration/placement of driver/idler rotor hybrid bearing (134/136) minimizes the required shaft diameter by resisting high radial loads as close as possible to the chamber 114, allowing higher capacity loading scenarios for a given rotor size. Additionally, flooding the gap between the idler/driver rotor outer frusto-spherical surfaces (36/62) and housing components (housing base 58 and housing cover 56) with a bearing fluid minimizes and/or prevents gas leaking from higher pressure chamber(s) to lower pressure chamber(s) at this location, as well as from the chamber(s) to the gap surrounding the idler/driver rotor shafts (40/64). Known mathematical formulas provide a simplified method to obtain the capacity of a symmetric spherical bearing comprising a circumferential series of recessed bearing pads that drain into ambient (or near ambient) pressure. As illustrated in the example shown in FIGS. 4-5 and FIG. 61, the contour of the valleys 82 of the rotor surfaces may prohibit a fully circumferential row of recessed hybrid bearing pockets 208 that cover a large portion, or all, of the available outer frusto-spherical rotor surface area 36/62. In addition, adding drain channel(s) and drilling drain holes in one example of either rotor may result in a significant amount of both working fluid and bearing fluid collecting at drain pressure which may reduce compressor efficiency significantly. These holes may significantly weaken the rotor, add to machining costs, and increase the required fluid pumping power to supply the hybrid bearing. Providing a rotor bearing fluid supply pressure greater than the maximum working fluid discharge pressure may increase bearing capacity and ensure a positive flow of bearing fluid from the bearing supply line into the immediately adjacent working fluid in the chambers. This flow reduces the likelihood of contaminates from the compression volume plugging the capillary restrictors, which may render the bearing non-functional. In a one-dimensional array, each hybrid bearing pocket 208 has two immediately adjacent bearing pockets and two immediately adjacent drain channels. A multi-dimensional array comprises at least one hybrid bearing pocket 208 with as few as one immediately adjacent drain channels and at least one hybrid bearing pocket 208 with at least three immediately adjacent hybrid bearing pockets. Arranging the hybrid bearing pockets 208 in a multi-dimensional asymmetric array 593 without low pressure drains may increase stiffness, making higher capacity loading scenarios possible. As described above, the load capacity/stiffness of a multi-dimensional array 593 of hybrid bearing pockets 208 on the rotor outer frusto-spherical surfaces (36 and 62) may exceed that of a one-dimensional array on idler/driver rotors (28/76). Frictional drag may also be reduced by eliminating the need for additional landings surrounding drain areas. The centers 596 of the hybrid bearing pads in the multi-dimensional array 593 are not all circumferentially aligned. Rather, it is conceived that the size and position of the hybrid bearing pads improves the overall capacity/stiffness of the bearing, while reducing parasitic losses, such as frictional drag and additional pumping power.

In the example shown in FIGS. 2-5, any of the hybrid bearings may have additional capacity/stiffness at high enough relative surface speeds from the hydrodynamic effect. Although this extra contribution from the hydrodynamic effect may be obtained by increasing the surface area of landings or not recessing bearing pads, it is conceived that this is an inferior solution for this fluid flow device. The substantial increase in frictional drag and the required imposition of a minimum RPM for the device to be operating at (to benefit from the hydrodynamic effect) reduces efficiency. It is conceived that the optimal solution contains minimal landing lengths that should be calculated as a minimum ratio of length to gap height, without being smaller than practical. Should a substantially small scratch or other damage occur to the landing, the landings should not be so small that the bearing is rendered non-functional.

Bearing Layout and Design—Example B

In the example shown in FIGS. 102-103, the idler/driver shafts 41/65 and corresponding rotors are each supported by three hybrid bearings 137A/135A/139A and 137B/135B/139B, each resisting loads perpendicular to the respective bearing pockets. In one example, front thrust hybrid bearings 129A/129B may be used in place of, and/or in combination with the above listed rear thrust bearings 139A/139B. In one example this may be achieved by implementing the Example T (FIG. 72B) hybrid bearings rather than the currently shown Example S (FIG. 72A) hybrid bearings. If front thrust hybrid bearings 129A/129B are used in place of the previously described rear thrust hybrid bearings 139A/139B, the front thrust bearings may be implemented with Example S (FIG. 72A) hybrid bearings as one example.

The idler/driver rotor hybrid bearings 135A/135B may resist loads perpendicular to the frusto-spherical rotor surfaces 62B/36B (FIG. 115), while the idler/driver shaft hybrid bearings 137A/137B may resist loads perpendicular to the respect idler/driver shafts. This radial reaction force on the shaft may resist the rotation of the shaft caused by moment loads that would act to bend the shafts about their respective axes 637/639. The idler/driver thrust hybrid bearings 139A/139B and/or 129A/129B may be configured to resist loads in the axial direction parallel to the respective shaft axes 637/639. When the net loads are offset of the shaft axes 637/639, thrust bearing pockets (e.g., 285JA/in FIGS. 145 and 285GA' in FIG. 139) may be at varying pressures, moment loads may be resisted. Configuring a bearing arrangement where bearings have overlap on the loads that they may resist may be important to make the bearing more stable and less susceptible to deflection from pulsing or vibrating loads. The gear loads and pressure-induced gas loads may require axial/bending moment support, which may be provided by the idler/driver thrust hybrid bearings. This compact combination of the hybrid bearings on each respective shaft may make it possible to forego additional support further from the compression chamber 144.

Fluid Injectors—Example A

Having a very compact rotor architecture makes it challenging to install fluid injector(s) 110 configured to spray atomized coolant fluid into the compression chamber 144 (FIGS. 11-14), when desired. Fluid injectors 110A/110B may wear out over time, so it is of benefit if they can be easily removed from the conduits they are connected to. Placing fluid injectors 110 on certain locations within the frusto-spherical housing surfaces 114 (FIG. 3) may interfere with the operation of the driver/idler rotor hybrid bearings (134/136) and the effectiveness is expected to be less predictable because of the liquid ring that may be formed at the outside diameter of the chamber 114. Placing fluid injectors 110 on stationary components allows the fluid injectors 110 to spray into the chamber for a limited range of the possible injection window in that the fluid injectors 110 do not follow the movement of the compression/expansion chamber 144.

A liquid seal 232 (FIGS. 11-14) between the rotors is also disclosed to minimize working fluid leakage. Placing fluid injectors 110 in the idler rotor surfaces or driver rotor surfaces comprises complex surfaces in some examples with tight tolerances. Additionally, fluid injectors 110 may be retained in a manner where vibrations will not loosen the components relative to their support structure. The resulting recirculated volume that is created is minimal, or liquid flooded to minimize volumetric efficiency losses.

As seen in the example of FIGS. 2-11, configuring the fluid injectors 110A/110B in the radially inner frusto-spherical surface 92 is conceived. In one example the location of the fluid injectors 110 at this surface may be immediately adjacent to the chamber until the chamber is substantially smaller in volume. This reduction in chamber volume may be so substantial that the fluid injectors 110 may be unobstructed in providing coolant oil to the chamber for the entire compression stroke for a typical application of the rotary fluid flow device 20. This placement at the inner frusto-spherical surface 92 of the compression chamber 144A is configured to minimize the volume of coolant fluid that sprays directly on the nearby idler/driver rotor axial surfaces 84A/84B without first having sufficient interaction time with the gas. The surface area to volume ratio of atomized droplets injected by the injectors 110A/110B may decrease after collisions with each other or chamber walls (i.e., 92, 84A and 84B in FIGS. 14 and 114 in FIG. 2). Since these larger droplets have less capability to transfer heat in the desired timeframe, it is advantageous to minimize these occurrences.

Maintenance—Example A

In the example of FIGS. 1-2, if maintenance is required on the rotor bearing restrictors 348 (FIGS. 65-67) or fluid injectors 110 discussed herein, maintenance may be performed by unfastening the intake connection 112 (and attached section of piping) and removing the housing cover 56.

Fluid Injectors—Example B

In example A of the rotary fluid flow device 20 (FIGS. 1-2), the fluid injectors 109 are shown as part of the idler insert 90. In example B of the rotary fluid flow device 20 (FIGS. 102-103), the fluid injectors 109 are included in the inner ball (concave inner frusto-spherical chamber surface) 97. As shown in FIG. 103C, hollow pins 618 allow coolant through, while maintaining the inner ball and assembled fluid injectors 109 removably fastened to the driver insert 95. This allows the fluid injectors 109 to follow the compression chambers 144 for the entire compression stroke for a typical application of the rotary fluid flow device 20.

To ease in installation and removal of fluid injectors 109 into surfaces defining openings 111, a snap-in connection is disclosed, which may not loosen during vibratory service and/or during the intermittent/pulsing loads that the fluid may exert on the fluid injectors. The fluid injectors 109 configured to be easily replaceable, produce a desired flow rate, and provide small orifices resulting in small droplet size. As shown in FIGS. 116-118C, one or more coolant fluid injectors 109B may be inserted into separate openings 111 in the inner ball 97. When sufficient axial force is used to insert the fluid injector 109 into the openings 111, tapers 115 on the fluid injector mating with tapers 115' of the inner ball may cause the legs 128 to deflect radially inwards toward the axis of the insert 109. When fully inserted, as shown in FIG. 118C, foot surfaces 117 of the fluid injector mate with inner surface 117' of the ball 97. A tapered shoulder 113 on the fluid injector may seat on the tapered shoulder 113' of the inner ball such that the legs 128 may be substantially pre-loaded in tension. To minimize or eliminate leaking around the nozzle which may be undesirable, an O-ring groove 127 may contain an O-ring. In this inserted configuration, the snap-in connection may resist substantial axial forces expected from the varying fluid pressures. Fluid may flow around the fluid injector legs 128 and through the inner ball holes 123 before arriving at the fluid injector holes 121. It is to be understood that the fluid injector holes 121 may be configured with a minimum cross sectional area to fit the injector removal tool legs 119' but may otherwise vary substantially in cross sectional area. For example, one type of spray pattern that may be suitable for use is a hollow cone spray pattern. Persons skilled in the art are familiar with a plurality of geometries that have been known to produce such a spray pattern. For example, the upstream and downstream terminations of the holes 121 may be increased in cross sectional area with a smooth transition to the diameter shown and this may produce such a spray depending on the pressure differential available and other factors known in the art. The fluid injectors 109 as described herein applicable to other structures than those described herein.

Maintenance—Example B

Figure 105:
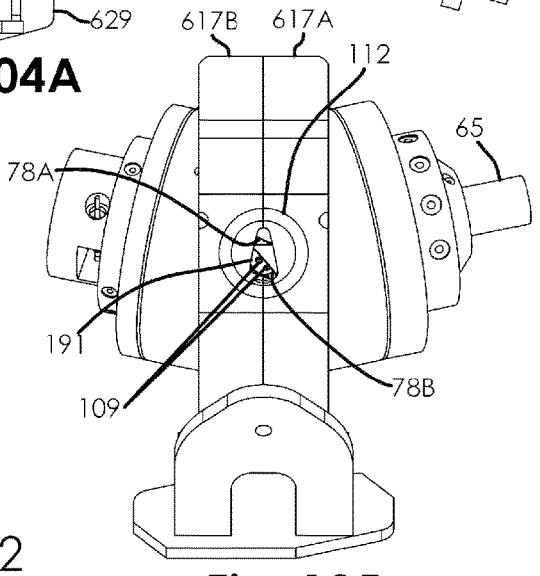

In the example provided in FIGS. 102-103, which do not comprise rotor bearing capillary restrictors, and the housing may not require removal to remove or service the coolant fluid nozzles 109. As illustrated in FIG. 105, when the intake conduit is removed from the intake connection 112, it may be possible to see the fluid injector(s) 109 when looking through the intake port 191. Some rotational positioning of the driver shaft may be desired to have full access to fluid injector(s) 109 that require replacement. This rotational positioning of the driver shaft may be accomplished manually by rotating the drive shaft 65 or via the driver (e.g., engine or motor).

A customized fluid injector removal tool 655 as shown in FIGS. 116-118 may comprise legs 119' that may be inserted into the holes 121 of the fluid injector and subsequently holes 123 of the inner ball before contacting the tapered fluid injector surface 119. Sufficient axial force may cause the legs 128 to deflect radially inwards until the interface 117/117' between the fluid injector and inner ball is disengaged. While the legs 119' of the removal tool continues to hold the fluid injector in this position, the tool 655 may be used to remove the fluid injector 109A from the holes 111. In one example, an expandable tool or component, for example a rivet, may be inserted in hole 121' and subsequently expanded. When expanded, the tool (not shown)

may be used to remove the fluid injector 109A in that the axial removal forces acting on the tapered surface 119 may promote enough inward radial deflection of the legs 128 for the component to be removed. In one example, the nozzles 109 comprise a frusto-spherical surface 125, although other surfaces may be used.

Being able to easily and efficiently remove and replace nozzles e.g., nozzles 109 may be an advantage to alleviate long term wear concerns, for example from erosion.

Cooling Injection Control with the Hydraulic Assembly—Example A

Low compression ratio cases may not require any additional coolant fluid to be injected for cooling purposes, while higher compression ratio cases may require a significant amount of coolant fluid to be injected. The flow rate of coolant fluid that is required to transfer heat in the short timeframe available (e.g., thousands of a second) may be minimized by atomizing smaller fluid droplets, in that smaller fluid droplets have a higher surface area to volume ratio. This results in the coolant fluid being at a more homogeneous temperature with the working fluid. A larger pressure differential can be used to reduce droplet sizes. Therefore, the amount of required coolant fluid can be minimized by keeping the supply pressure constant, while adjusting the length of time that the injection occurs for. There are further efficiency gains that can be made by controlling when injection begins. Inlet gas temperatures may often range between 5° C. and 20° C. However, it may not be cost effective to cool the coolant fluid to 20° C. or less in environments where ambient temperatures can reach 20° C. or higher. In the case of a gas being compressed in the fluid flow device, it may heat up significantly. If the coolant fluid is injected into the chamber while it is warmer than the gas temperature, the thermodynamic process may not be as efficient as it could be, which may result in more required driver power. Likewise, if the coolant fluid is injected into the chamber while it is cooler than the gas temperature, this isn't ideal either.

Figure 38:
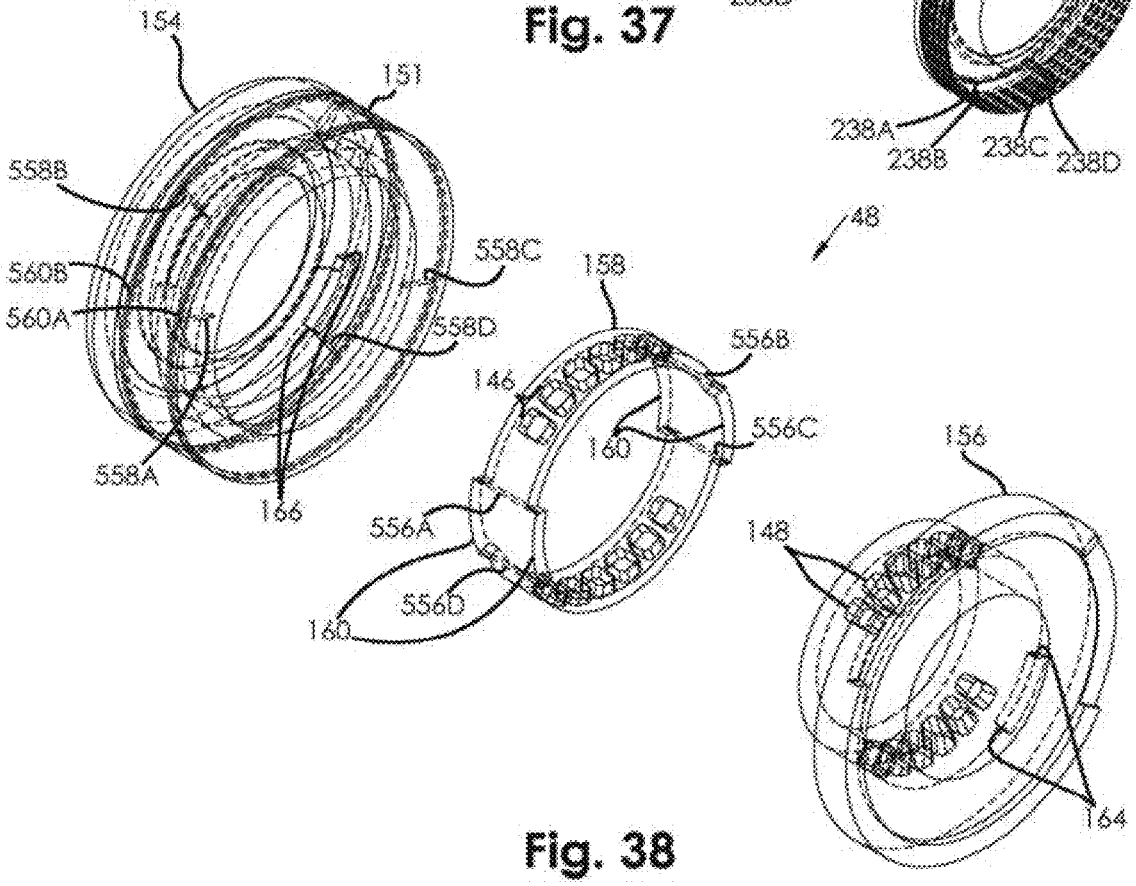
FIG. 38 is an exploded hidden line view of several components of the example shown in FIG. 1.
Figure 60A:
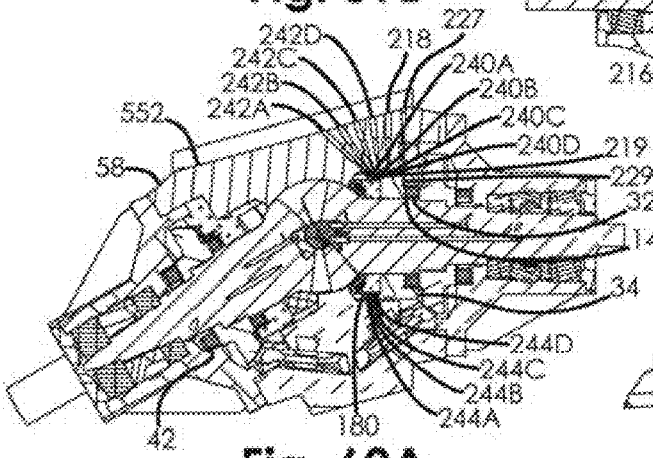
FIG. 60A is a cutaway view taken along section line 60A-60A of FIG. 56.
Figure 60B:
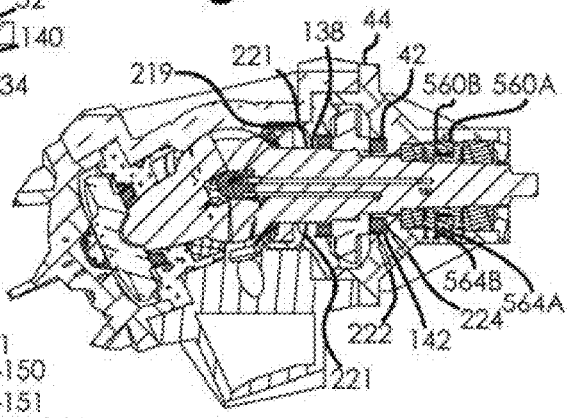
FIG. 60B is a cutaway view taken along section line 60B-60B of FIG. 56

In the example shown in FIGS. 6-7 and FIG. 38, the hydraulic assembly 48 is configured to facilitate adjustment of the flow rate of the coolant fluid from near zero to 100% flow, and ranges there between. Looking to FIG. 57 and FIG. 60C, coolant fluid may enter the injection port 150 in the idler rear bearing housing 44 before entering the supply port 151 in the stationary outer hydraulic sleeve 154. As shown in the example shown in FIGS. 9-32, flow rate adjustment may be accomplished by adjusting the size, shape, and position of stationary coolant fluid passageway(s) (146 and 148). This may vary the portion of a revolution where substantial flow through the shaft surface openings/injection ports 152 (FIG. 33) in the (rotating) idler rotor shaft 40 (FIG. 61) is permitted thereby varying when and how much fluid may enter the chamber during compression. In the example shown in FIGS. 61-63 and FIGS. 9-11, each rotor compression chamber 144 is fed through at least one injection line 153 in the idler rotor shaft 40, with flow entering at the injection ports 152 and culminating at the fluid injector(s) 110 immediately adjacent to a compression chamber 144. In one example, each injection port is in fluid communication with one and only one injection line 153. For example, in FIG. 11 fluid injectors 110A/1106 are immediately adjacent to and in fluid communication with compression chamber 144A. Compression chamber 144A in this example may be at the maximum volume position with its compression stroke beginning immediately thereafter. The injection ports 152 and injection line 153 (not shown) that supply fluid injectors 110A/1106 may not be providing substantial flow of coolant fluid to compression chamber 144A at this time. Rather, injection port 152 shown in FIG. 11 to be in fluid communication with the stationary coolant fluid passageway(s) (146 and 148) may have an injection line 153 (not shown) culminating at the fluid injectors (not shown) of compression chamber 144B. This compression chamber 144B may be amid its compression stroke; that is, reducing (or increasing in the case of an expansion stroke) in volume while the chamber 144B is substantially sealed in that the pressure may vary with respect to the preceding position. In one example, a pair of injection ports 152 (FIG. 63) are configured on directly (diametrically) opposing sides of the rotor shaft and simultaneously feed each respective injection line 153, so that the pressure-induced radial loads on the idler rotor shaft 40 may be balanced. In one example, the hydraulic assembly 48 shown in the exploded view of FIG. 38 comprises an inner sleeve 156, a circumferentially sliding hydraulic valve 158, and a stationary outer hydraulic sleeve 154. The inner sleeve 156 in one example is a stationary component immediately radially adjacent to the injection ports 152 of the idler rotor shaft 40 and immediately radially adjacent to inner sleeve 156 is the sliding hydraulic valve 158. This sliding hydraulic valve 158 in one example is largely stationary but has the capability to slide circumferentially around the idler rotor shaft 40 when the pressure in cavities 162 (FIG. 60C) may be modified via a control system in combination with a valve. In one example this valve is a three-way, or five-way valve. The inner sleeve 156 and sliding hydraulic valve 158 components in one example comprise openings (146/148) configured to align with injection ports 152 in the idler rotor shaft 40 when injection is to occur in each compression chamber 144 for a given stroke. The cavities 162 may be formed with the circumferential clearance between the pistons 160 on the hydraulic valve 158 and the pistons 164/166 on the stationary inner sleeve 156 and outer sleeve 154, respectively. Substantial longitudinal movement of the hydraulic valve 158 may be hindered by the stationary inner sleeve 156 and outer sleeve 154. These cavities 162 in one example are in fluid communication with holes 556 (A-D) in the hydraulic valve 158, which may be in fluid communication with holes 558 (A-D) and grooves 560A and 560B in the stationary outer housing 154. Groove 560A is in fluid communication with holes 558A and 558C. Groove 560B is in fluid communication with holes 558B and 558D. In examples where holes 556 (A-D) in the hydraulic valve 158 do not provide a substantial flow resistance, then the cavity pressures 162 on these axially distant ends of the hydraulic valve 158 may be substantially the same. In such examples, the pressure-induced thrust forces on the hydraulic valve may be substantially balanced, which may minimize friction and wear. When the pressure at the groove 560A and connected cavity 162 differs from the pressure at the groove 560B and connected cavity 162; the hydraulic valve 158 may slide circumferentially. As shown in FIG. 60B, the grooves 560A and 560B may be in fluid communication with ports 564A and 564B in the rear idler bearing housing 44 respectively. In the example provided, piping fittings may be connected to ports 564A and 564B to complete a substantially closed circuit with cavities 162 adjacent to the pistons 160 of the hydraulic valve 158. Thus, in examples where a control system is used with a three-way or five-way valve with these connections 564A and 564B, fluid pressure may be used to circumferentially slide the hydraulic valve 158.

In the example shown in FIGS. 9-32 and FIG. 38, the openings (146/148) on these components span substantially equivalent circumferential lengths. Alternatively, the circumferential lengths of the openings 146 on the sliding hydraulic valve 158 may be made circumferentially shorter or otherwise have a smaller or larger cross-sectional opening than the circumferential lengths of the openings 148 on the inner sleeve 156. This size adjustment could be done by occluding or partially occluding at least some of the openings 146 on the sliding hydraulic valve 158.

Figure 9:
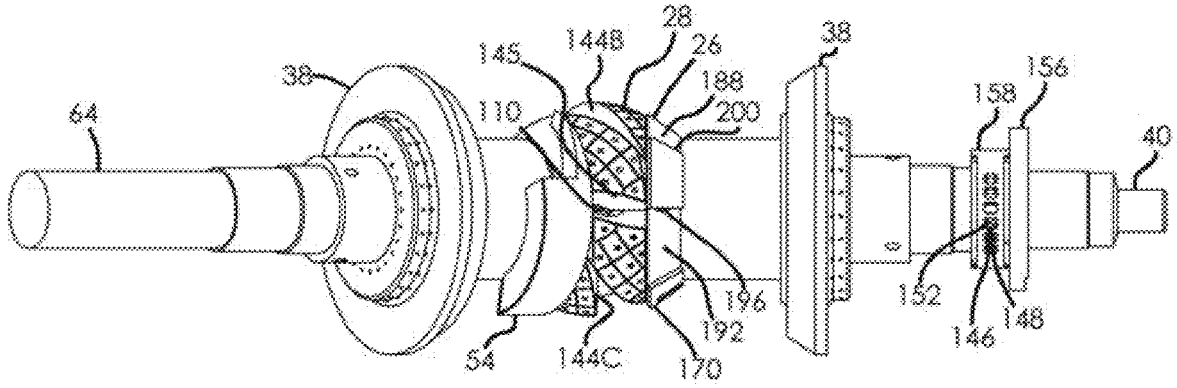
FIG. 9 is a side view of the example shown in FIG. 1 with several components removed to show internal components configured to direct the flow of the working fluid and coolant fluid with the rotors in a first rotational position.
Figure 10:
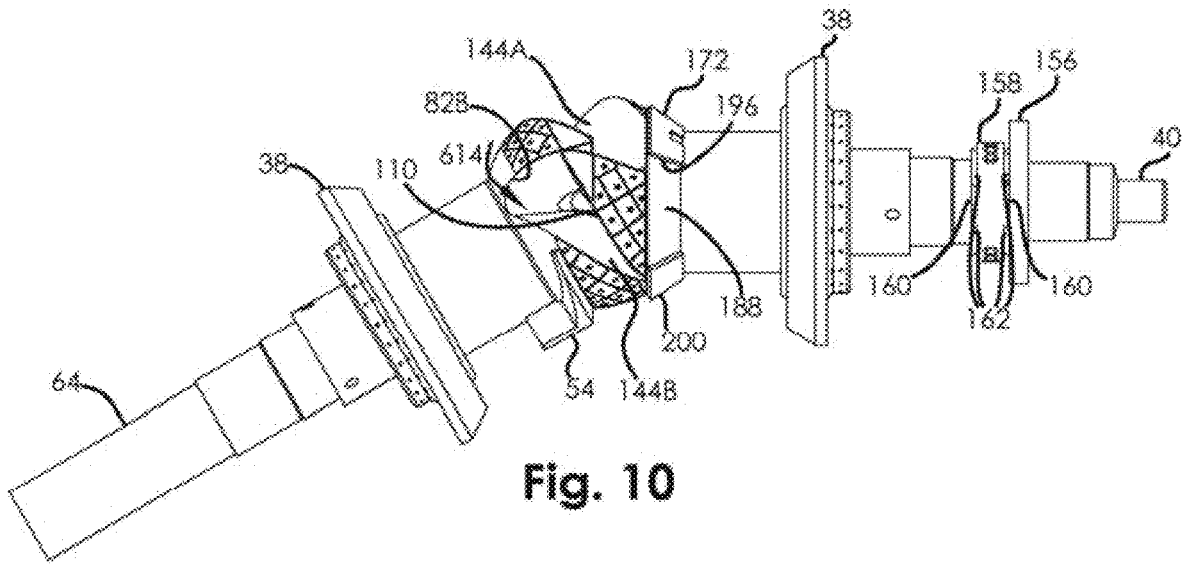
FIG. 10 is a top view of the example shown in FIG. 9.

In the example shown in FIGS. 9-11, these openings (146/148) are aligned with the injection ports 152, configured such that a maximum amount of coolant fluid passes towards the chamber during the compression stroke as the injection ports 152 align with the passageway created by the openings (146/148). In the example shown in FIGS. 21-23, the sliding hydraulic valve 158 may be adjusted such that the passageway created by the openings (146/148) may be smaller, for example half as large as that in FIGS. 9-11. In the absence of pressure regulation, in one example approximately half the amount of coolant fluid would enter each compression chamber 144 due to such a reduction in the opening size.

Figure 24:
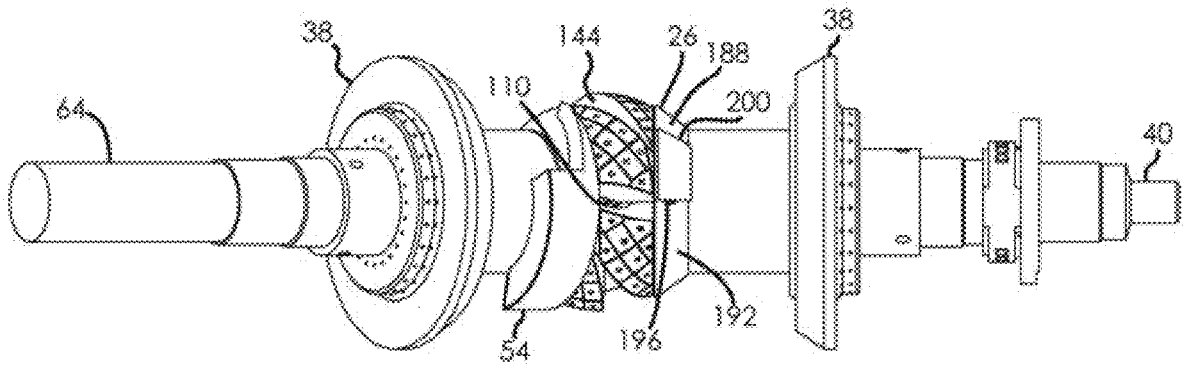
FIG. 24 is an elevation view of the example shown in FIG. 1 with several components removed to show components configured to direct the flow of the working fluid and coolant fluid with the rotors in the first rotational position.
Figure 25:
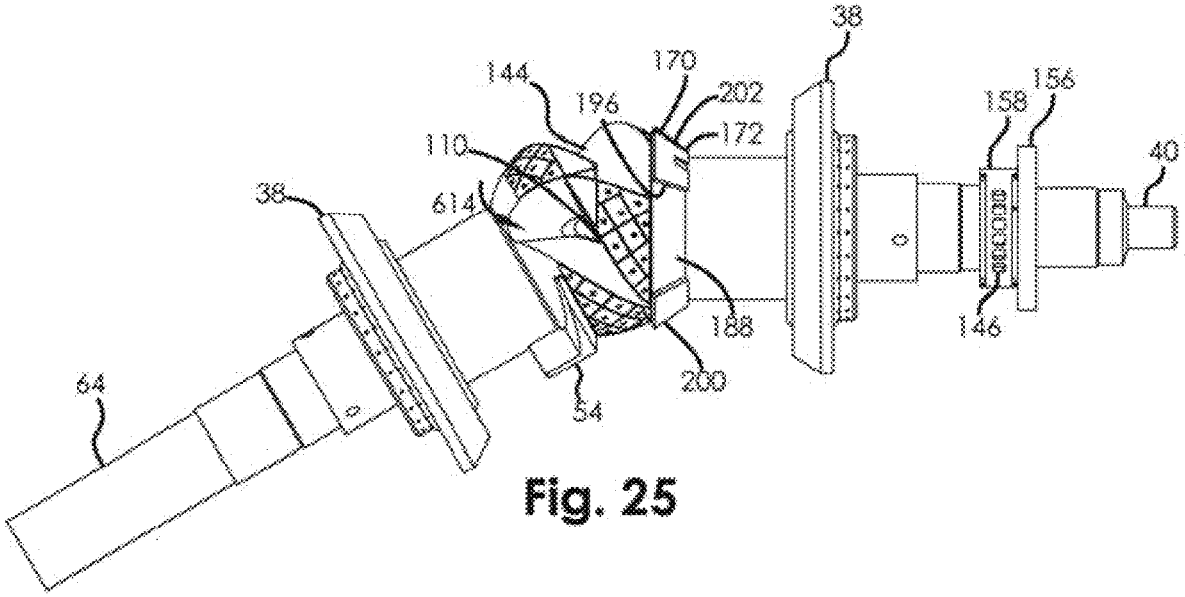
FIG. 25 is a top view of the example shown in FIG. 24.
Figure 26:
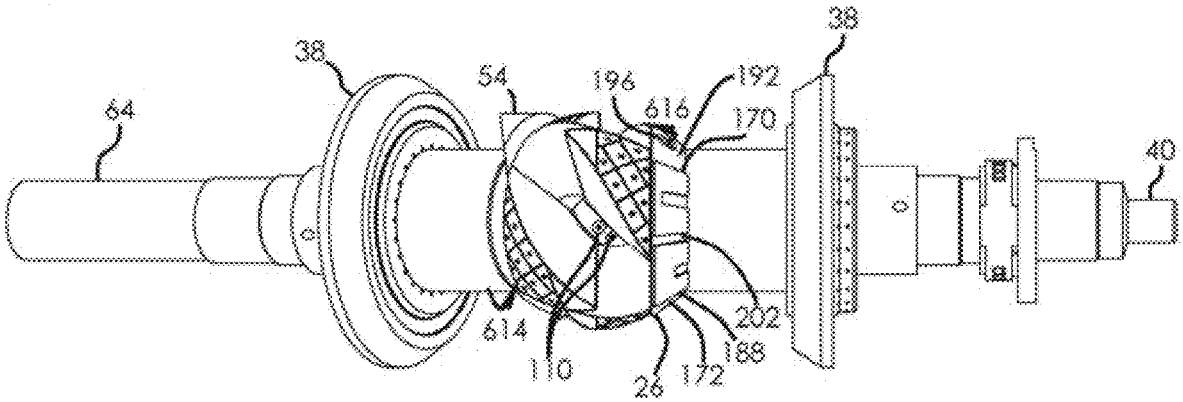
FIG. 26 is an elevation view taken from the opposing side of the example shown in FIG. 24.

In the example shown in FIGS. 24-26, the combination of openings (146/148) may not form a substantial passageway for the coolant fluid to enter injection ports 152 and therefore, little to no coolant fluid is expected to be provided to the compression chambers 144. These examples illustrate how two of the parameters including duration of injection, start time and finish time of fluid injection may be adjusted during operation of the rotary fluid flow device 20 by controlling the size, shape, and position of the coolant fluid passageways (formed by openings 146/148) in the hydraulic assembly. To have control of the duration of injection, start time and finish time independently, during operation, this control could be made possible by adding an additional sliding hydraulic valve immediately radially adjacent to the shown hydraulic valve 158. In the example shown in FIG. 38, the sliding hydraulic valve 158 comprises pistons 160 which engage circumferentially adjacent cavities 162 (FIG. 60C) relative to the stationary inner hydraulic sleeve piston surfaces 164 or stationary outer hydraulic sleeve piston surfaces 166.

Figure 60C:
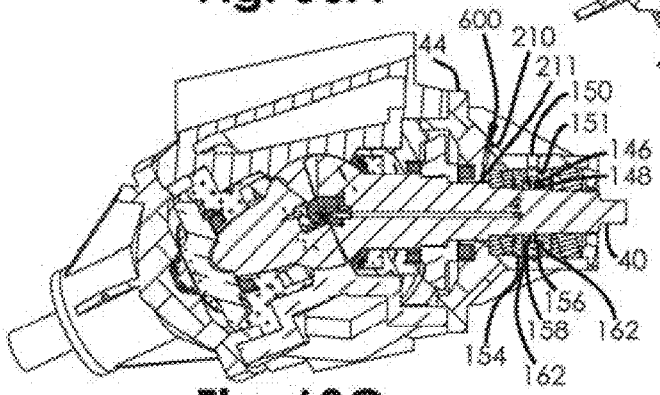
FIG. 60C is a cutaway view taken along section line 60C-60C of FIG. 56.

A control system can be used with valves, (e.g., A three-way or five-way valve) to modify the pressure in these cavities 162 (FIG. 60C). In this manner, it is possible to control the discharge temperature of the fluid exiting the fluid flow device. Wherein the coolant fluid flow rate is controlled by limiting the length of time of injection rather than the pressure, the smallest possible atomized droplets can still be achieved for partial cooling cases, with the intent of reducing coolant fluid requirements and improving compressor efficiency. By adjusting when injection begins, it may be possible to maximize compressor efficiency.

In examples where gear teeth are included on the sliding hydraulic valve 158, an attached gear arrangement is configured to make adjustments manually and/or with an (electric) motor, solenoid, etc. Although other methods of actuating the sliding hydraulic valve 158 are available, pressure-activated methods are thought to be the most cost-effective and compact.

Cooling Injection Control with the Hydraulic Assembly—Example B

Figure 107:
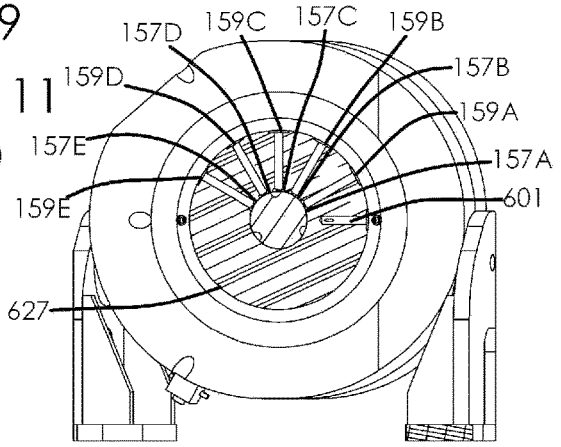

In the example shown in FIGS. 102-103 and FIG. 107 the driver endcap 627 has a plurality of recessed fluid galleries 157 (A-E). In one example these fluid galleries 157 are intermittently in fluid communication with one injection port 155 per chamber in the driver shaft 65 for a given revolution of the shaft 65. As shown in FIGS. 137-142, when fluid enters an injection port 155 in the driver shaft 65, the injection port 155 is in fluid communication with a compression chamber 144. Pressure drop is minimized in the passageway 155 itself to maximize the amount/pressure/rate of flow and available pressure at the fluid injectors 109. A tube 618, optionally with O-ring grooves 618' (holding sealing O-rings) may be used to both act for rotationally securing the driver insert 95, and to minimize leakage when transferring the coolant fluid into the driver insert 95. A higher pressure may be desirable at the entrance of the fluid injectors 109 to minimize the droplet sizes in the spray and to maximize flow capabilities per nozzle.

Small droplet sizes may constitute sizes on the order of 40 microns. Such small droplets have a high surface area to volume ratio to more efficiently/homogeneously transfer heat between the cooling oil and the working fluid/process gas in a timeframe that may be on the order of only milliseconds. If only larger droplets can be obtained, more coolant fluid may be required to prevent the working fluid from exceeding the desired discharge temperature in the millisecond scale timeframe available for compression.

The recessed fluid galleries 157 (A-E) can be strategically placed as shown on the side of the shaft opposite to the largest expected loads at that location for any of the load combinations in the compressor specification. Therefore, although the design is not pressure balanced, it may actually be an advantage in that the maximum expected net load reacted at the bearings may be reduced. As shown in FIG. 109 and FIGS. 137-142, the routing of the passageway 155 to the fluid injectors 109 can be adjusted to accommodate varying positioning of the fluid galleries; for example, as shown in FIGS. 137-142 the fluid gallery 157C and injection nozzles 109 may be on substantially diametrically opposite side of the rotor shaft 65.

To address how the cooling requirements vary widely for varying combinations of compression ratios and working fluid volumetric throughput, coolant lines 159 (A-E) supplying the respective recessed fluid galleries 157 (A-E) may be turned on or off. In this stepwise manner, a range of acceptable discharge temperatures may be achieved with simple inexpensive on/off style valves known to those skilled in the art. By varying how many recessed fluid galleries 157 (A-E) are supplied with fluid, it may be possible to adjust the amount of coolant that makes it in the chamber without reducing the available pressure. It may be possible to only spray coolant fluid in the chamber during compression. This may be an overall efficiency advantage if the coolant fluid is warmer than the working fluid in that it may be desirable to fit a larger mass of cooler gas in the compression chamber, seal it, compress the gas until the gas reaches close to the same temperature as the working fluid, and then spray cooling oil to minimize further temperature increases from compression.

If built-in capacity control is used, compression is expected to begin later. Cooling injection can also begin later by modifying which recessed fluid galleries are supplied with fluid. This concept combined with having a consistent spray in the compression chamber during compression may be a notable improvement to efficiency compared with what is known to-date, such as the simple pressure-regulated designs that oil-flooded rotary screw compressors employ.

In one example the circumferential spans of fluid galleries 157 may be of different lengths to one another and more than one hole 159 may supply a given fluid gallery if desired to minimize pressure drop for example.

In one example, a pressure balanced design may be possible using similar methods disclosed in example A of the rotary fluid flow device 20. In FIG. 61, radial coolant line pairs 152 on diametrically opposite sides of the (idler) shaft 40 were shown to feed axial holes 153. As shown in FIG. 38, the fluid passageways 146 of the hydraulic valve 158 and fluid passageways 148 of the stationary inner hydraulic sleeve 156 were mirrored on diametrically opposite sides. These methods enabled a pressure balanced design. In example B of the rotary fluid flow device 20, a similar plumbing arrangement in the driver shaft 65 could be done with coolant line pairs on diametrically opposite sides of the shaft accepting coolant. This combined with the fluid galleries 157 shown in FIG. 107 being mirrored on diametrically opposite sides could enable the example of FIG. 107 to be pressure balanced. Such a configuration may be desirable if the pressure-induced radial loads on the driver shaft 65 are high enough in magnitude to produce a net maximum load in substantially the same direction on the driver rotor shaft bearings 137B (FIG. 103). The magnitude of the pressure-induced load at the fluid galleries 157 (FIG. 107) may be varied substantially with varying fluid pressures and the diameter of the driver shaft 65. Additionally, the axial length of the driver shaft 65 that is under asymmetric pressure loading may substantially influence said load.

In FIG. 103, line 601 may supply grooves 603, which may be located on each side of the fluid galleries 157. Landings 657 may axially separate fluid galleries 157 from supply grooves and the flow therebetween may be substantially restricted by substantially small gap heights at the landings 657. These grooves may limit the asymmetric pressure loading on the shaft to within the grooves 603 and if none of the fluid galleries 157 are supplied with fluid, the grooves 603 may be supplied with a high pressure fluid substantially similar or higher to the maximum pressure in a compression chamber 144 to prevent the working fluid from leaking back through the injection lines 155. As shown in FIG. 109, landing 659A may restrict the flow to or from the gear cavity 445 and landing 659B may restrict the flow past the mechanical seal components 631, draining from line 605 preferably into the intake of the compressor (not shown). If the line 605 and connected passageway (not shown) to the intake has substantially low flow resistance relative to the landing 659B, the pressure at the mechanical seal components 631 may be substantially similar to the intake pressure. This may be desirable in that a lower pressure and a substantial amount of cooling provided by the flowing fluid past the seal may extend the expected lifespan substantially.

Sliding Seal Ring Assembly/Intaking and Discharging—Example A

In one example the rotor architecture is very compact, thus the recirculated volume in the working chamber that conventional valve designs introduce could significantly reduce the volumetric efficiency of the fluid flow device. This compact architecture combined with a high design RPM of the fluid flow device (i.e. Up to 3600 RPM or more) makes it challenging to efficiently intake and discharge the working fluid in and out of working chambers. Restricting the available flow area that can intake into the chamber potentially creates a pressure drop which reduces the amount of gas that makes it into the chamber prior to compression, thereby reducing volumetric efficiency. Restricting the available flow area at the discharge of the chamber increases fluid velocities and wear, which reduces expected component lifespans. A severe enough restriction at the discharge may cause the pressure in the chamber to rise significantly above the designed discharge pressure, which increases the driver work required. A high enough spike in pressure above the design pressure could result in catastrophic failure of the entire rotary fluid flow device 20. Pressure-activated valves at the inlet or discharge often require relatively high lifts at relatively high design RPMs (e.g., 3600 RPM or more). The moving component(s) may need to travel relatively far to provide enough flow area. Accelerating the moving component to the open or closed position in some examples takes a significant amount of time (e.g., thousands of a second) relative to the chamber volume changes at high rotational speeds of the rotary fluid flow device 20, even if this movement were assisted by high pressure fluid forces (e.g., hydraulic fluid). While the moving component is traveling to the open position, it is still creating a restriction. Likewise, when the valve is intended to close, it takes time to move to the closed position, meanwhile allowing fluid from the discharge to enter the chamber. Furthermore, based on the relatively far distances that the moving components needs to travel in a relatively short amount of time (i.e., A maximum design speed of 3600 RPM or higher is much higher than most compressors in the same power range), the impact forces may be far above industry standards and may lead to premature valve failure. Since impact forces are a product of both the velocity and mass of the moving component(s), configurations that used many components with lower mass were evaluated. Decelerating the moving component before impact was also evaluated. In many valves, it is very important that the gas passageways open and close when desired, and stay closed. Industry invests a lot of effort in modifying valves to maintain the appropriate performance in varying suction and discharge pressures. It is typical for the suction pressure that is available for a compressor to decline over time, and as this happens, the compressor becomes less efficient because the valve may only optimally be designed for a specific pressure and any adjustments require the compressor to be turned off, which can be a significant cost when considering the opportunity cost involved with lost production.

When utilizing an engine driver, it can be advantageous to maintain constant, or near constant, driver power requirements without changing the driver speed significantly from its ideal rated speed and HP of the engine driver. It would also be advantageous to not be required (to avoid downtime) to turn off a compressor when modifying a compressor's operating capabilities when attempting to maintain constant HP draw to suit the driver and/or to adapt to the changing production scenarios experienced at the inlet of a compressor. The initial phases of production from a gas field will typically involve higher flows and higher inlet pressures than experienced with subsequent production over time and thus higher HP throughput for a given fixed volume compressor at a given speed. Rather than select an engine driver with maximum HP capabilities to match the initial, and often shorter, high volume high pressure phases of production from a new field, a producer may prefer to size the engine driver to meet the production scenarios associated with more gradual changes post new production that have lower pressures and lower volumes and thus lower HP requirements. This is because typically the greater the HP rating of an engine, the higher the price, and to maximize efficiency of an engine driver one may want to maximize the time of the production curve where the engine is operating closest to its ideal HP rating. However, if utilizing a fixed volume compressor at the initial stages of production with high inlet pressures and high volumes, the compressor capacity and HP draw are expected to be much lower at lower inlet pressures and volumes without making significant changes to a reciprocating compressor such as adding additional compressor stages and/or resizing cylinders. If a producer wanted to "oversize" (utilize a fixed volume compressor that runs below capacity initially so that it can accommodate the lower inlet pressures and throughput associated with post new production) a conventional reciprocating compressor, operating in such a condition could result in significant compressor inefficiencies. Therefore, it is obvious to persons skilled in the art, that it would be desirable to have a compressor that can vary volumetric throughput at different inlet pressures to maintain constant, or near constant, engine power usage and/or to have the compressor adapt to changing compressor inlet conditions. This is expected to eliminate the costs associated from modifying components and the opportunity cost associated with the lost production while the compressor is shut-down.

In the example shown in FIGS. 6-37, the sliding seal ring assembly 30 uses relative motion between the compression elements (i.e., idler rotor 28 and driver rotor 76) and component(s) located immediately adjacent to open and close passageways for the working fluid to discharge or intake into the compression chamber 144 when desired. The intake gate 54 and sliding seal ring assembly 30 reduces or eliminates the need for independently actuated methods of opening and closing working fluid passageways. These working fluid passageways are configured to be in the correct location during start-up. The size and location of these passageways can be adjusted even while the fluid flow device is running. After the idler/driver rotor shafts 40/64 have reached the desired speed, only relatively slow adjustments may be required. This adjustment may reduce or eliminate the need to repeatedly (substantially) accelerate and decelerate components.

Working fluid passageways in one example may be large in that they are opened very quickly and naturally as the rotors 28/76 spin past stationary openings formed by the adjacent components allowing the working fluid to enter or exit the compression chambers 144. In one example, no components must quickly accelerate out of the way and then back out of the way of the passageway(s). At high RPMs, the flow area for the gas ramps up, and then down much faster than alternative methods, such as valves, which allows for a significant improvement in overall efficiency. This is especially true at higher flow rate scenarios. Adjustments on the inlet passageway(s) allow for 0%-100% flow reduction by keeping the passageway(s) open past the maximum possible chamber volume. This adjustment on the inlet can be used to unload the driver by 0%-100%, minus the parasitic losses from friction etc. Materials located directly adjacent to the passageway(s) can be removed with minimal ease from the exterior of the fluid flow device when it is shut down, which may be important to address long-term wear concerns. This maintenance would only be done if required, and may involve removing the housing cover 56, followed by the primary gate 170 and/or secondary gate 172.

In the example shown in FIG. 37, an exploded view of the sliding seal ring assembly 30 is shown. In this example the primary gate 170 may be retained by the primary gate ring 174 and the secondary gate 172 is retained by the secondary gate ring 176. The slide gate spacer 178, slide gate housing 180 and slide gate nut 182 are stationary components that may collaboratively restrain longitudinal movement of the primary gate ring 174 and secondary gate ring 176. Circumferential clearance between the slide gate spacer 178 and primary gate 170 and the slide gate spacer 178 and secondary gate form cavities 184 (FIG. 8B). A control system can be used with a three-way or five-way valve to modify the pressure in these cavities 184. In this manner, it may be possible to control the position of the primary gate 170 and secondary gate 172, thereby allowing for 0%-100% flow reduction and pressure ratios of 1, or near 1 to 110×, or higher. These cavities 184 in one example are in fluid communication with holes 238(A-D) in the slide gate spacer 178 and slide gate housing 180, which are in fluid communication with grooves 244(A-D) at the outer periphery of the slide gate housing 180. Seals (e.g., O-rings) may be used immediately adjacent to the grooves 244(A-D) to minimize or eliminate fluid communication between these grooves. As seen in FIG. 60A, these grooves 244(A-D) may be in fluid communication with respective surfaces defining holes 240 (A-D) in the idler front bearing housing 24 and holes in the housing base 58, terminating at the periphery of the compressor. In the example provided, piping fittings may be connected to holes 242A and 242C to complete a substantially closed circuit with cavities 184 adjacent to the pistons of the primary gate ring. Thus, if a control system is used with a three-way or five-way valve with connections 242A and 242C, fluid pressure may be used to circumferentially slide the primary gate ring 174 and connected primary gate 170. Piping fittings may be connected to holes 242B and 242D to complete a substantially closed circuit with cavities 184 adjacent to the pistons of the secondary gate ring 176. Thus, if a control system were used with a three-way or five-way valve with these connections 242B and 242D, fluid pressure may be used to circumferentially slide the secondary gate ring 176 and connected secondary gate 172.

Looking to FIGS. 9-20, four rotational positions of the rotors are shown for the example provided. The flow of the working fluid entering or exiting a chamber is labeled as 614 and 616, respectively. Each position includes three projected views showing the driver shaft on the left hand side to best observe the primary gate 170 and secondary gate 172 positions with respect to the compression chambers 144. For the ease of the reader, the reader may wish to study the labels provided for the intake gate 54, discharge seal 200, primary gate 170 and secondary gate 172 to best understand the orientation of the projected views. The first, second, third and fourth rotational positions show a 0, 30, 60 and 90 degree rotational position in FIGS. 9-11, FIGS. 12-14, FIGS. 15-17, FIGS. 18-20, respectively. It is to be understood that since there are three lobes, and since one third of a revolution is calculated as 120 degrees, if a 120 degree rotational position were shown, it would look identical to the 0 degree rotational position. A given chamber may fill with gas for approximately 240 degrees until a maximum volume is reached. Likewise, this maximum volume may decrease for approximately 240 degrees in the example provided. This decrease in maximum volume is implied to contain the compression and subsequent discharging portions of the stroke to near zero volume. However, this decrease in volume may also optionally contain fluid communication to the inlet if capacity control is used to decrease volumetric throughput. If the chamber is left open to the inlet while the maximum possible volume is reduced by half, the volumetric throughput and required power is expected to reduce by substantially the same factor. It is to be understood that since 480 degrees of rotation are required for a full intake and discharge stroke to take place for a given chamber in this example, that there are times when more than three chambers may exist simultaneously. However, only three injection lines 153 may be required to supply fluid injectors 110 at the three idler rotor valleys 84A in that location at the idler rotor inner frusto-spherical surface 92 may be in fluid communication with a chamber for a large portion if not all of the compression portion of the stroke. During the discharge portion of the stroke there may be minimal or no benefit to spray cooling oil. Furthermore, a pressure differential may be required to spray to oil in the chamber, so this implies that a pressure boost from a pump or other device requiring energy consumption may be required to flow the oil in the chamber during the discharge portion of the stroke.

Figure 12:
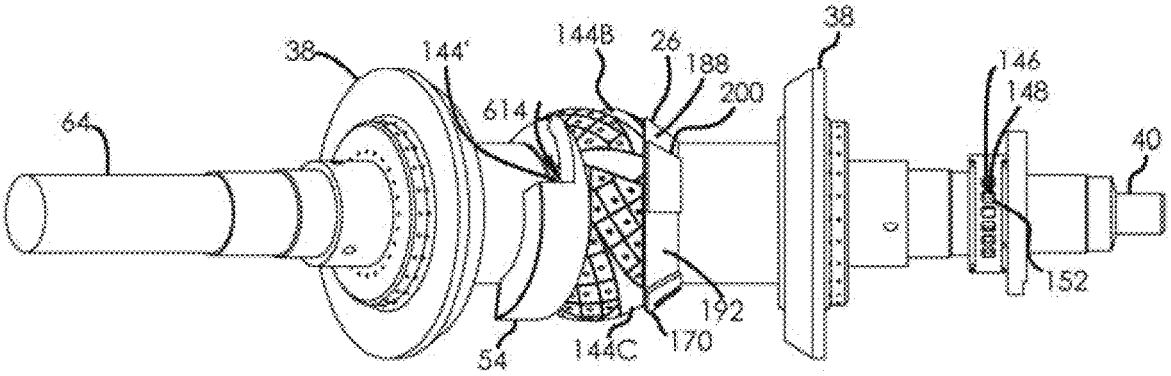
FIG. 12 is a side view of the example shown in FIG. 1 with several components removed to show internal components configured to direct the flow of the working fluid and coolant fluid with the rotors in a second rotational position.
Figure 13:
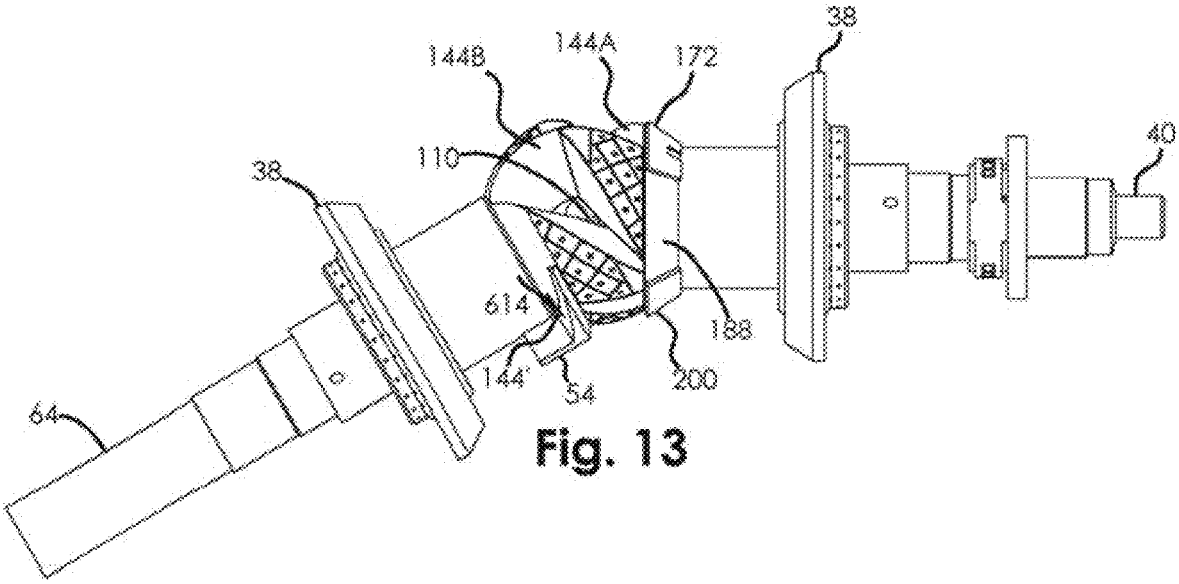
FIG. 13 is a top view of the example shown in FIG. 12.
Figure 14:
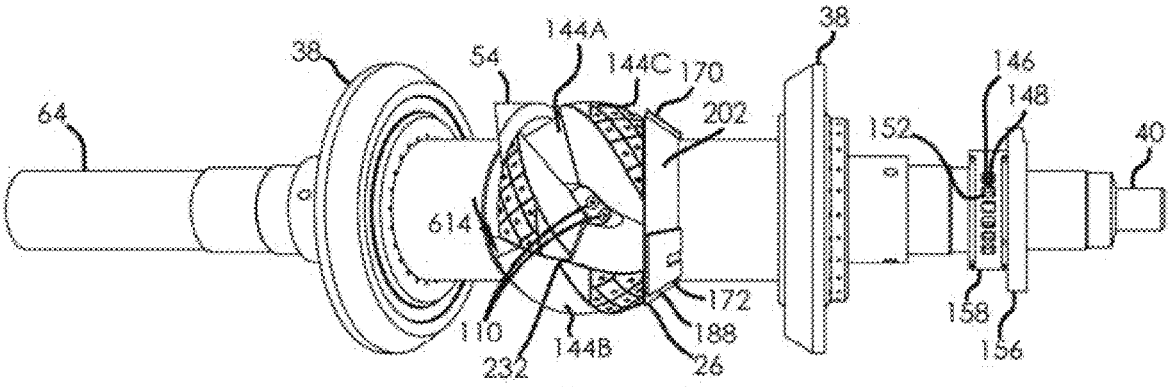
FIG. 14 is a side view taken from the opposing side shown in FIG. 12.

In FIG. 11, compression chamber 144A is shown to be in the maximum volume position, forming chambers 144B and 144C. In FIGS. 12-14, FIGS. 15-17 and FIGS. 18-20 chamber 144A is shown to decrease with each 30 degree incremental change to the drive shaft 64 position. It is to be understood that chamber 144A in FIGS. 18-20 would look substantially the same as chamber 144C in FIGS. 9-11 with a subsequent 30 degree rotation. Near this point in time, the teardrop volume 145 is separated from the chamber 144A in the 120 degree position (labeled as 144C). Following chamber 144C through 30 degree incremental rotations subsequently from FIGS. 9-11, FIGS. 12-14, FIGS. 15-17 and FIGS. 18-20 therefore show what chamber 144A would appear to look like at the 120, 150, 180 and 210 degree rotational positions, respectively. In FIGS. 12-14, the teardrop volume 145 is shown to be in fluid communication with chamber 144B; a chamber that may currently be intaking. Any partially compressed gas in the teardrop volume 145 may combine with this lower pressure intake gas. It is also implied that the chamber 144A would substantially be at zero volume at the 240 degree rotational position when referring back to FIG. 9.

The only substantial volumes present in FIGS. 9-11 may be chambers 144(A-C) and the teardrop volume 145. In FIGS. 12-14, a reduced volume chamber 144' has been shown that has been increased from near zero volume. Flow 614 into this chamber may begin the intaking process. A subsequent 30 degree rotation from the chamber 144' in FIGS. 18-20 implies that chamber 144' at the implied 120 degree rotational position would look identical to chamber 144B in the 0 degree position of FIGS. 9-11. Chamber 144B in FIGS. 18-20 may look identical to chamber 144' in the 210 degree rotational position. After a subsequent 30 degree rotation, chamber 144' in the 240 degree rotational position is expected to look identical to chamber 144A in FIGS. 9-11. This is expected to be the maximum volume position.

Figure 15:
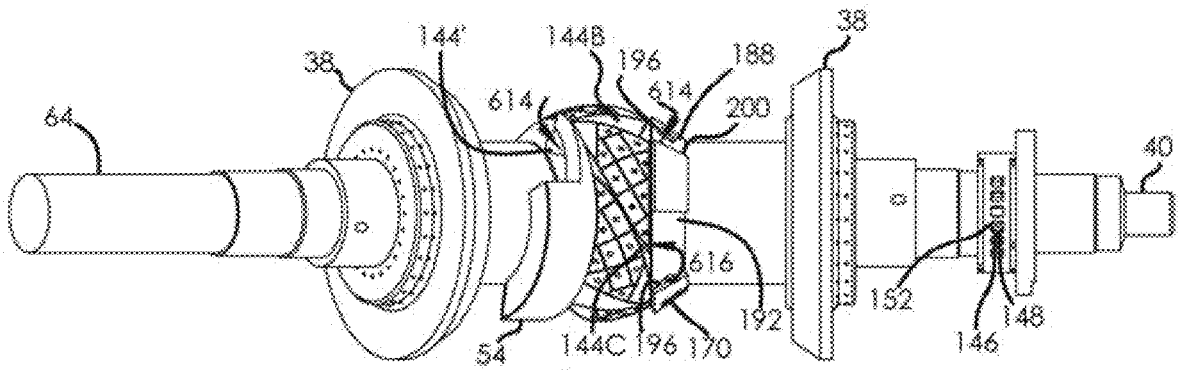
FIG. 15 is a side view of the example shown in FIG. 1 with several components removed to show internal components configured to direct the flow of the working fluid and coolant fluid with the rotors in a third rotational position.
Figure 16:
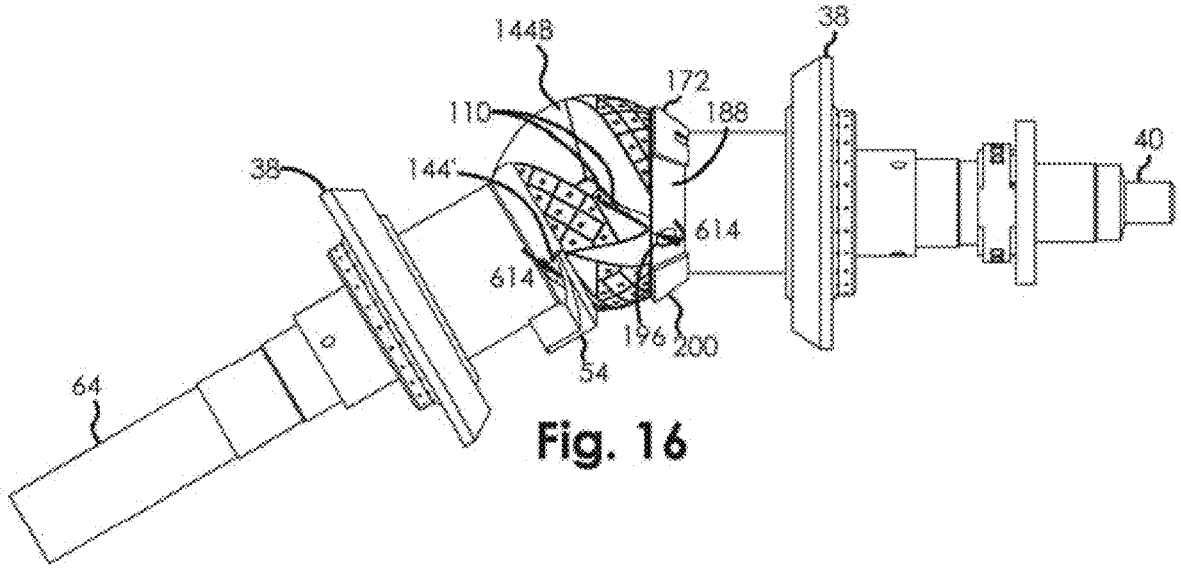
FIG. 16 is a top view of the example shown in FIG. 15.
Figure 17:
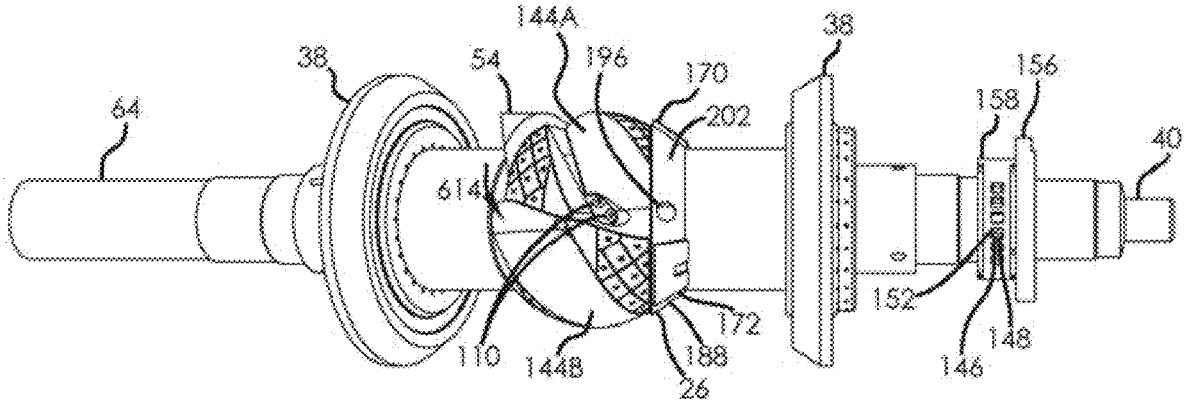
FIG. 17 is a side view taken from the opposing side shown in FIG. 15.
Figure 18:
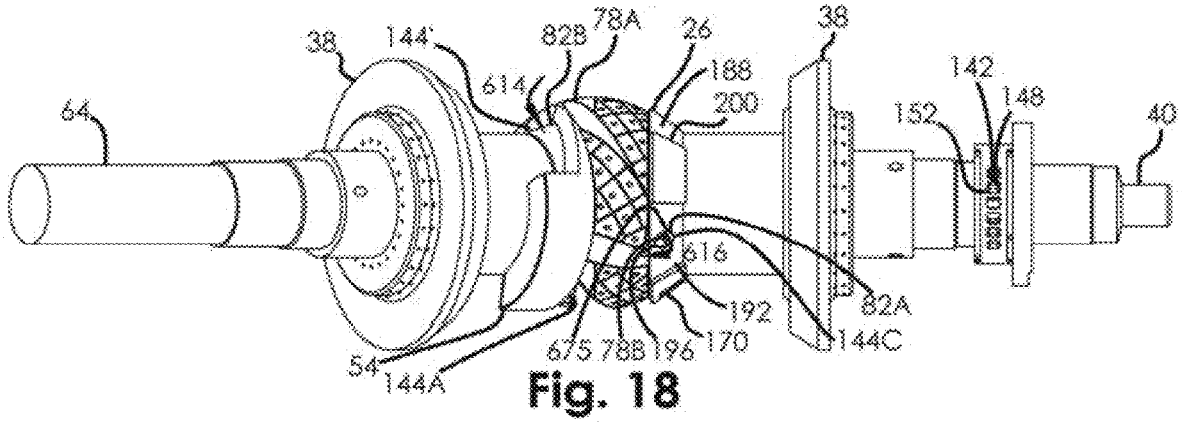
FIG. 18 is a side view of the example shown in FIG. 1 with several components removed to show internal components configured to direct the flow of the working fluid and coolant fluid with the rotors in a fourth rotational position.
Figure 19:
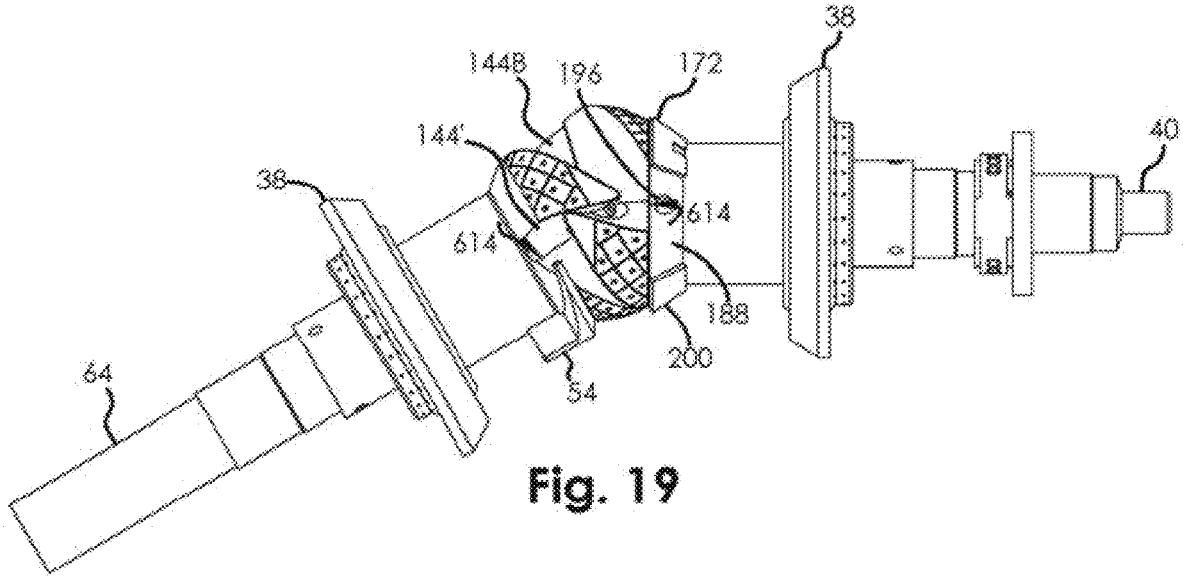
FIG. 19 is a top view of the example shown in FIG. 18.
Figure 20:
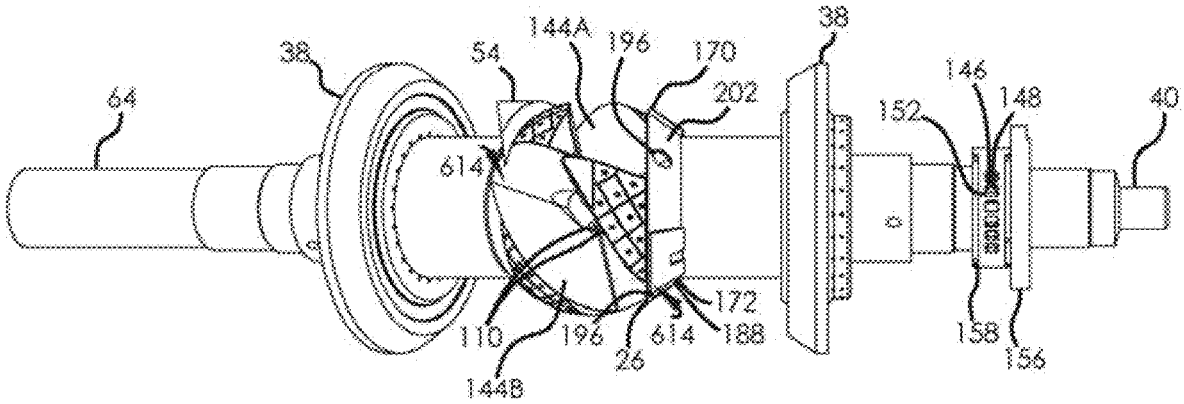
FIG. 20 is a side view taken from the opposing side shown in FIG. 18.
Figure 33:
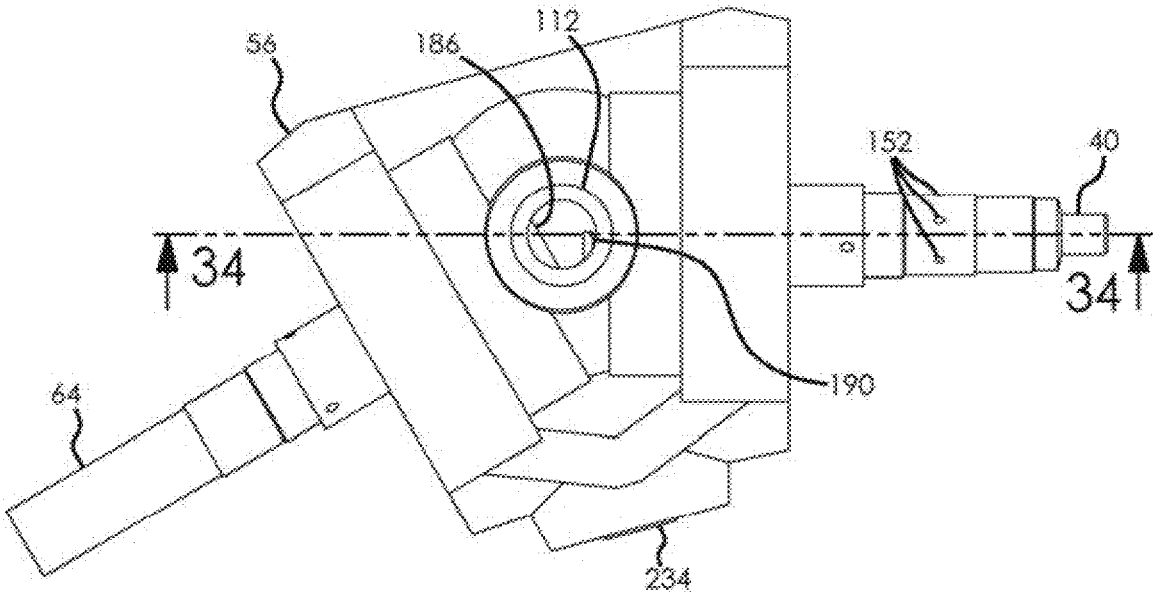
FIG. 33 is a top view of the example shown in FIG. 1 with several components removed.
Figure 34:
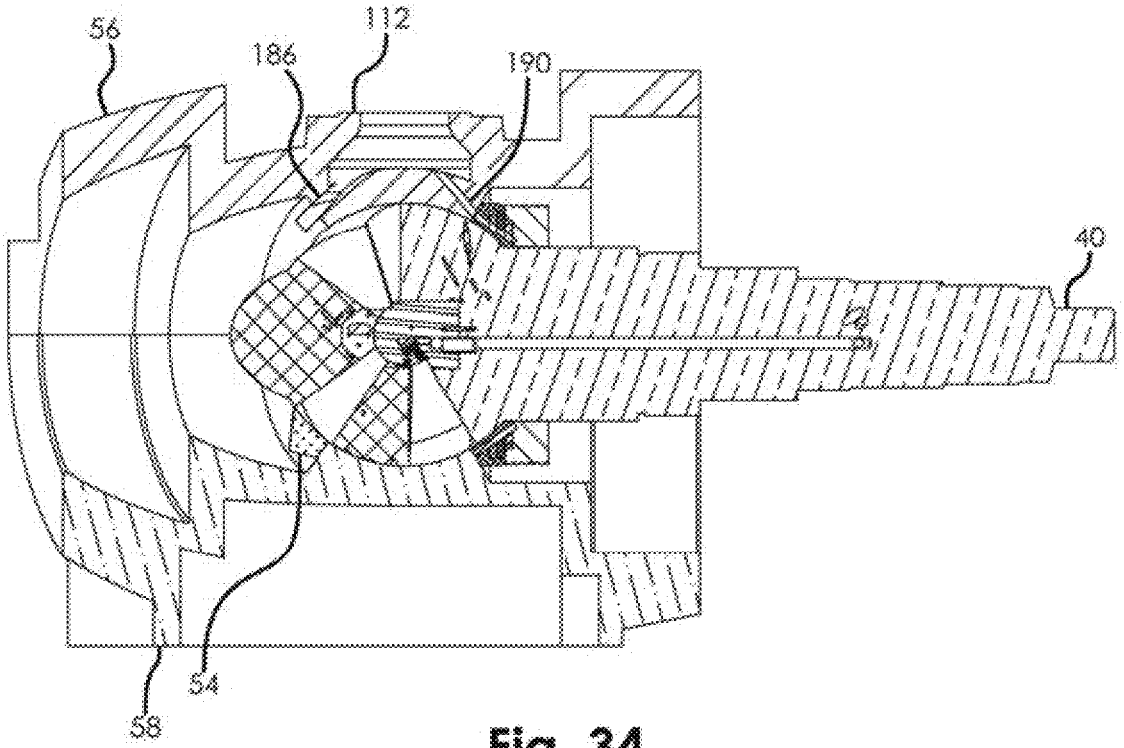
FIG. 34 is a cutaway view taken along section line 34-34 of FIG. 33.
Figure 35:
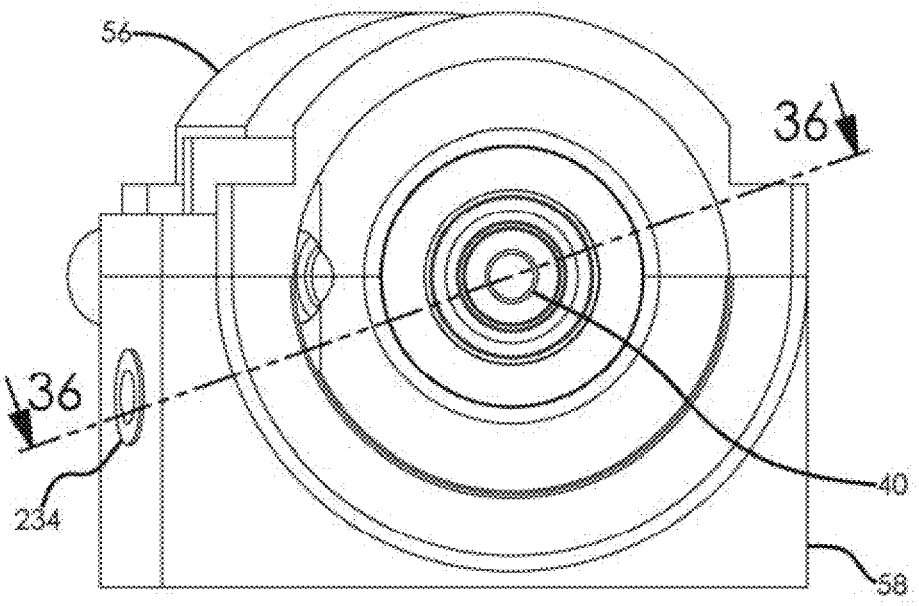
FIG. 35 is a side view of the example shown in FIG. 1 with several components removed to show components configured to direct the flow of the working fluid.
Figure 36:
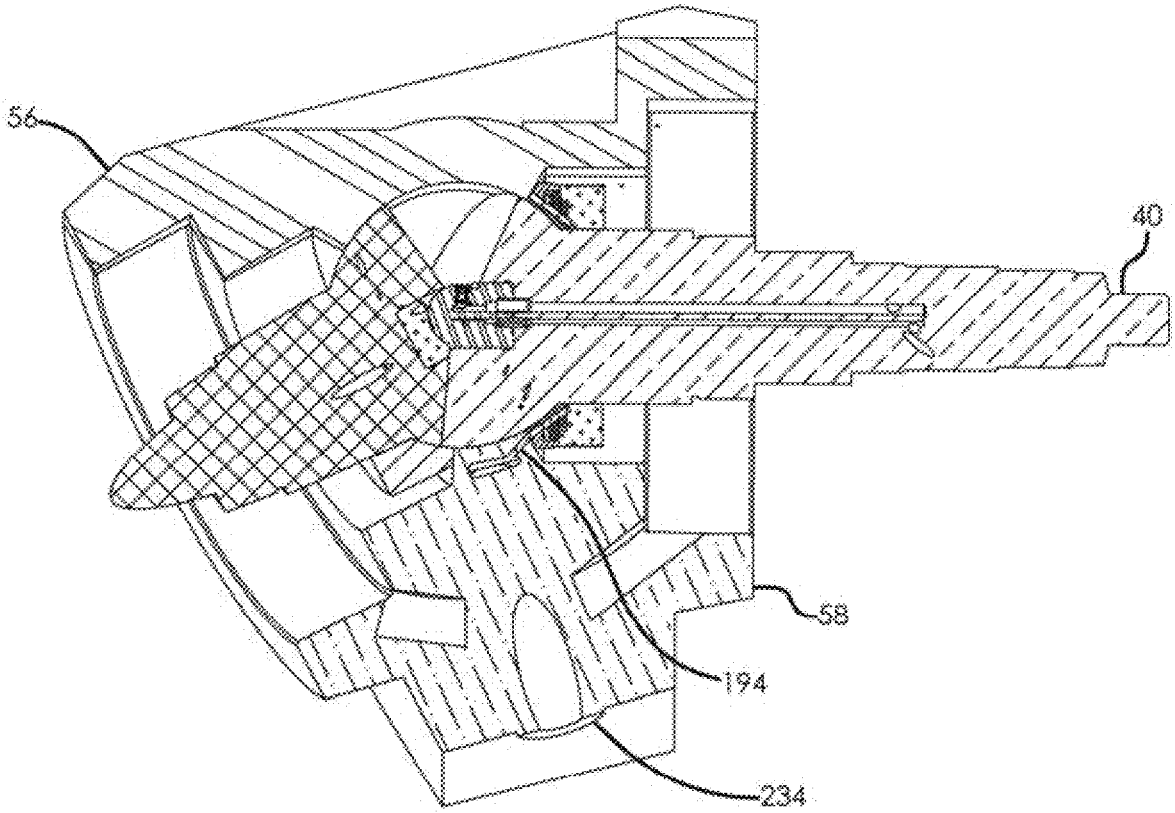
FIG. 36 is a cutaway view of FIG. 35 taken along section line 36-36.

The example of FIGS. 33-34 discloses the intake connection 112 is in fluid communication with the intake passageway 186 and secondary intake passageway 190. As described above, when a chamber 144 reaches maximum volume, such as chamber 144A in FIG. 11, the rotation of the driver rotor valleys 82B past the stationary surfaces of the intake gate 54, in this example, may periodically disrupt the fluid communication between the chamber 144A and the intake passageway 186. The neckband 26 may be fastened to the idler rotor 28 such that holes 196 in the neckband 26 remain immediately radially of the idler rotor valleys 84A. Adjusting the position of the intake gate 54 may not be required for volumetric capacity control of the working fluid. The secondary intake passageway 190 consists of one or more fixed holes in the housing cover 56 that are in fluid communication with the intake cavity 188 (FIG. 10) between the discharge seal 200 and the secondary gate 172. This substantially stationary intake cavity 188 is intended to be periodically in fluid communication with the chamber 144 between the rotors 28/76. In the example of FIGS. 9-11, where no volumetric capacity control is shown, the intake cavity 188 may no longer be in fluid communication with the chamber 144A (at maximum volume) via the hole 196 in the idler rotor neckband 26. When the chamber 144 lacks fluid communication to the intake connection 112, the pressure of the working fluid in the chamber 144 may rise as the volume in the chamber 144 is decreased. As seen in FIGS. 15-17, after 60 degrees of rotation, the volume of this chamber 144A, has decreased and is in fluid communication with the sliding seal ring recirculated cavity 202 via an idler rotor neckband hole 196. The cavity 202 is formed between the secondary gate 172 and primary gate 170. This cavity 202 may not ever be in substantial fluid communication with the secondary intake passageway 190 or the discharge passageway 194. This cavity 202 may allow the device to recirculate gas from the previous chamber that was in fluid communication via the idler rotor neckband hole 196. When the sliding seal ring recirculated cavity 202 initially begins periodic fluid communication with a chamber 144A, the working fluid in recirculated cavity 202 may be at higher pressure, expanding into the lower pressure chamber 144A. Since the chamber 144A may not be in fluid communication with the secondary intake passageway 190 at this time, this expansion may provide a boost in pressure in the chamber 144A. This arrangement may be a power loss in that the compression and subsequent expansion process may not be thermodynamically reversible if the temperature fluctuates. However, since the chamber 144A is not in fluid communication with the intake passageways 186/190 in this position, it is conceived that these power losses are not substantial when compared with the total power requirement of the rotary fluid flow device 20. In the example shown in FIGS. 18-20, after 90 degrees of rotation, the discharge cavity 192 may be in fluid communication with this chamber 144C via an idler rotor neckband hole 196. It is to be understood that chamber 144A in the 210 degree position is expected to be of equivalent volume and look identical to chamber 144C in FIGS. 18-20, implying the same discharging behavior shown by arrow 616. It is also to be understood that if the primary gate 170 were positioned circumferentially closer to the discharge seal 200, chamber 144C would be expected to still be in its compression stroke and that this may represent an even higher compression ratio scenario than shown in the example. This discharge cavity 192 may be in fluid communication with the discharge connection 234 via the discharge passageway 194 (FIG. 36). Thus, the pressure of the working fluid in the chamber 144 (e.g., chamber 144C from FIGS. 18-20) may not substantially exceed the pressure of the working fluid at the discharge passageway 194 if the primary gate 170 is in the appropriate position for the expected compression ratio. In one example, a control system may be used that attempts to minimize the input driver power consumption by adjusting the position of the primary gate 170 in that opening the chamber 144 early or late to the discharge passageway 194 may result in increased power consumption. In the example shown in FIGS. 11-20, the secondary gate 172 is positioned so that there may not be capacity control, and the primary gate 170 was positioned for a high compression ratio case. When comparing the example shown in FIGS. 9-11 to the example shown in FIGS. 21-23 which is also at the 0 degree rotational position, it can be understood that the intake cavity 188 is extended circumferentially by adjusting the position of the secondary gate 172. The circumferential adjustment of the primary gate 170 may be somewhat comparable to that of the secondary gate 172 to allow for a comparable compression ratio.

In the example shown in FIGS. 9-11, the idler/driver rotor shafts (40/64) are in the first rotational position, referred to as the 0 degree position. In the example shown in FIG. 11, the chamber 144A may be at its maximum possible volume, in position to be sealed by the intake gate 54 in a following stage of rotation. The fluid injectors 110A/1106 are not obstructed by the driver rotor 76. Minimal or no flow is expected in this position, as the injection ports 152 that feed these fluid injectors 110A/1106 via the axial holes in the shaft 153 (not shown) are not substantially aligned with the respective openings (146/148) in the hydraulic assembly. In this example, the injection ports 152 that are aligned with the openings in the hydraulic assembly (146/148) may supply coolant fluid to the chamber 144C (FIGS. 9-11). A partial view of the chamber 144A that is near maximum volume is shown in FIG. 10 as the passageway from the intake cavity 188 through the neckband hole 196 may be sealed by the secondary gate 172. In the example shown in FIG. 18, a chamber 144C is near the end of its stroke as the working fluid exits the hole 196 in the neckband 26 into the discharge cavity 192 before the hole 196 is sealed by the discharge seal 200. At this point in time the fluid injectors 110 (not shown) may be substantially obstructed by the driver rotor 76 which may substantially prevent flow into the chamber regardless of if the respective injection ports 152 are aligned with openings (146/148) to permit such flow, which in this example is not the case.

Figure 21:
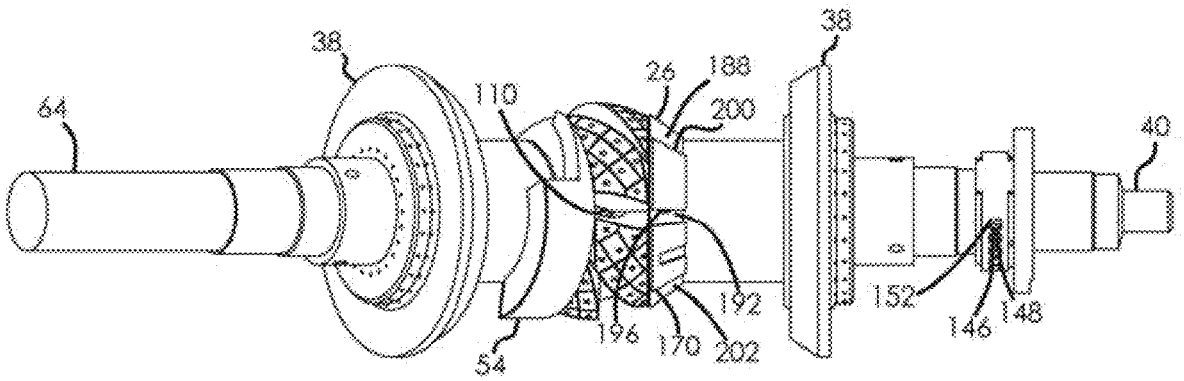
FIG. 21 is an elevation view of the example shown in FIG. 1 with several components removed to show the path of the working fluid and coolant fluid with the rotors in the first rotational position. This Fig. shows the coolant injection control functionality and gates moving for bypass, capacity control and discharge ratio control.
Figure 22:
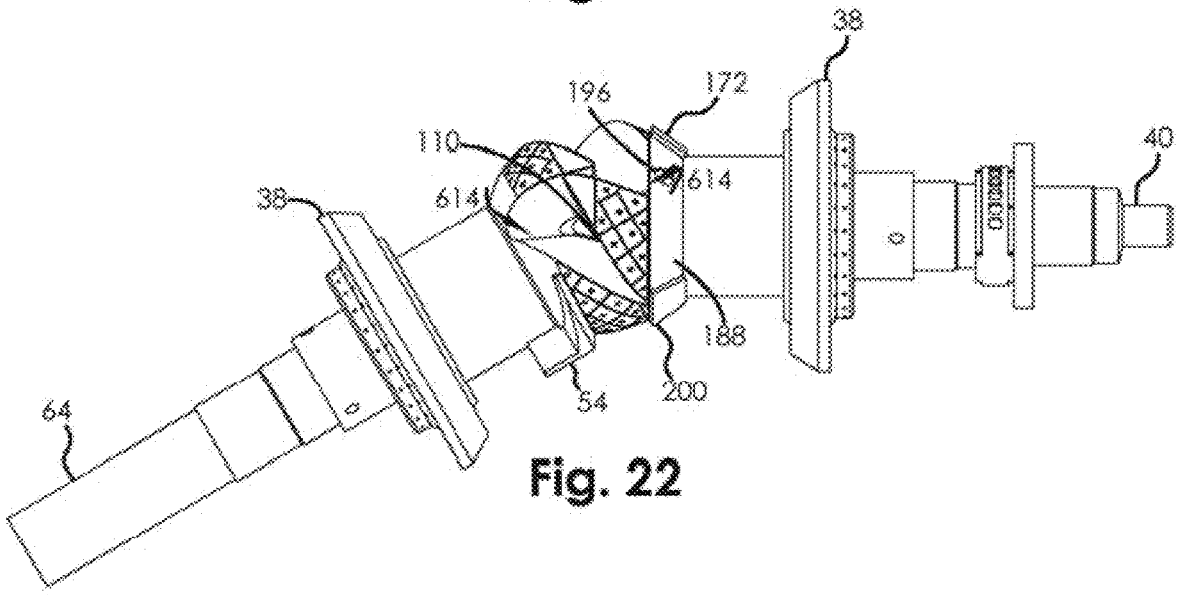
FIG. 22 is a top view of the example shown in FIG. 21.
Figure 23:
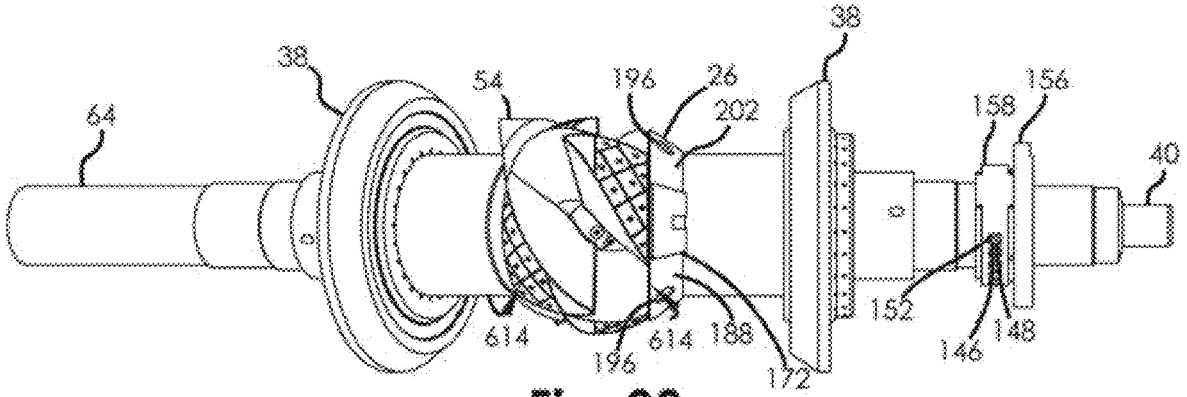
FIG. 23 is an elevation view taken from the opposing side of the example shown in FIG. 21.

In the example shown in FIGS. 21-23, capacity control on both the working fluid and coolant fluid is shown for a high compression ratio scenario when the idler/driver rotor shafts (40/64) are in the first rotational position.

In the example shown in FIGS. 24-26, the primary gate 170 and secondary gate 172 circumferential positions may be appropriate for a low compression ratio scenario, showing the idler/driver rotor shafts (40/64) in the first rotational position. The sliding hydraulic valve 158 circumferential position is in the fully closed position to minimize and/or prevent the coolant fluid from reaching the chambers 144.

Figure 27:
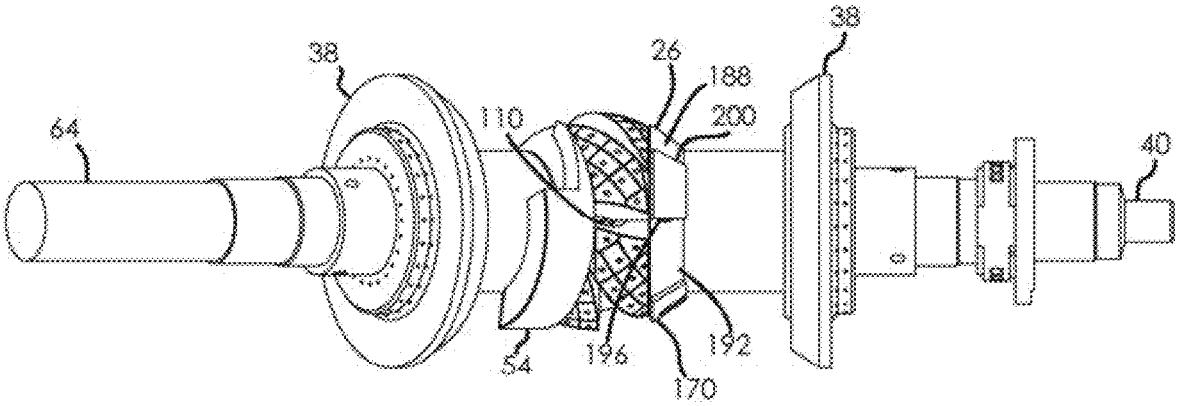
FIG. 27 is an elevation view of the example shown in FIG. 1 with several components removed to show components configured to direct the flow of the working fluid and coolant fluid with the rotors in the first rotational position.
Figure 28:
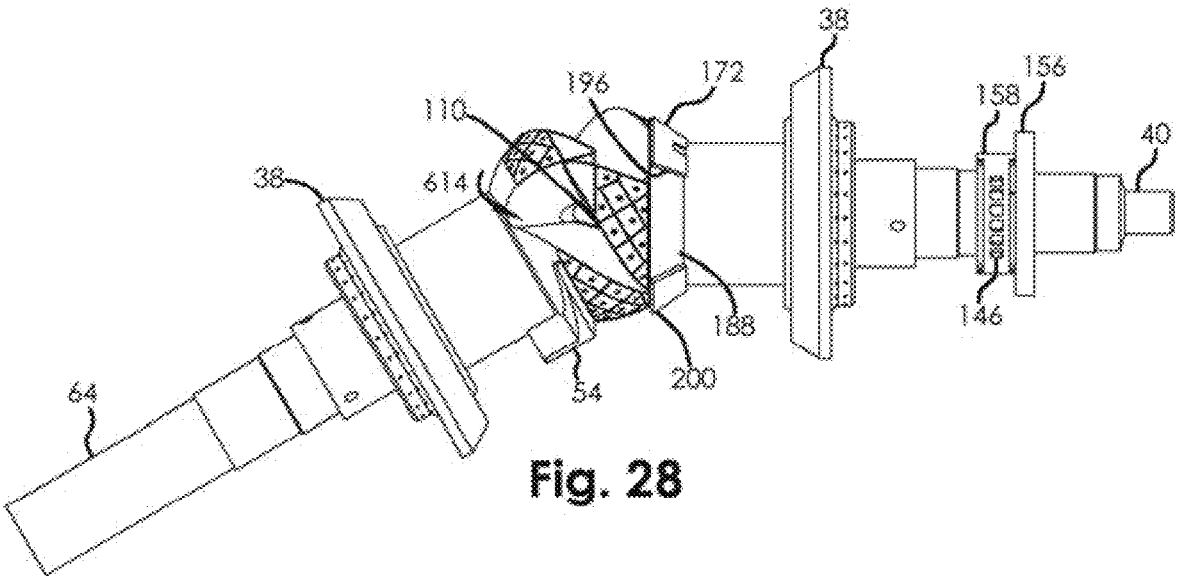
FIG. 28 is a top view of the example shown in FIG. 27.
Figure 29:
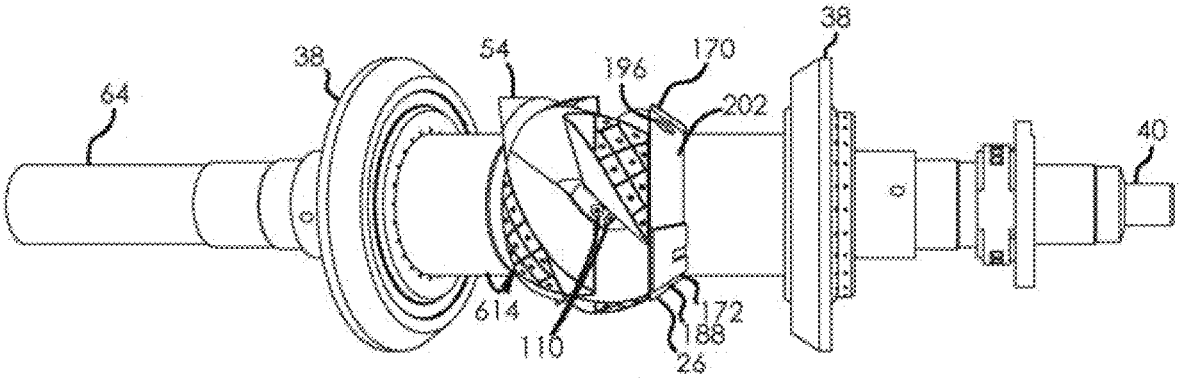
FIG. 29 is an elevation view taken from the opposing side of the example shown in FIG. 27.

In the example shown in FIGS. 27-29, the primary gate 170 and secondary gate 172 circumferential positions are adjusted for a low compression ratio scenario where working fluid capacity control is shown. The idler/driver rotor shafts (40/64) are shown in the first rotational position, and the sliding hydraulic valve 158 circumferential position is in the fully closed position to minimize and/or prevent the coolant fluid from reaching the chamber.

Figure 30:
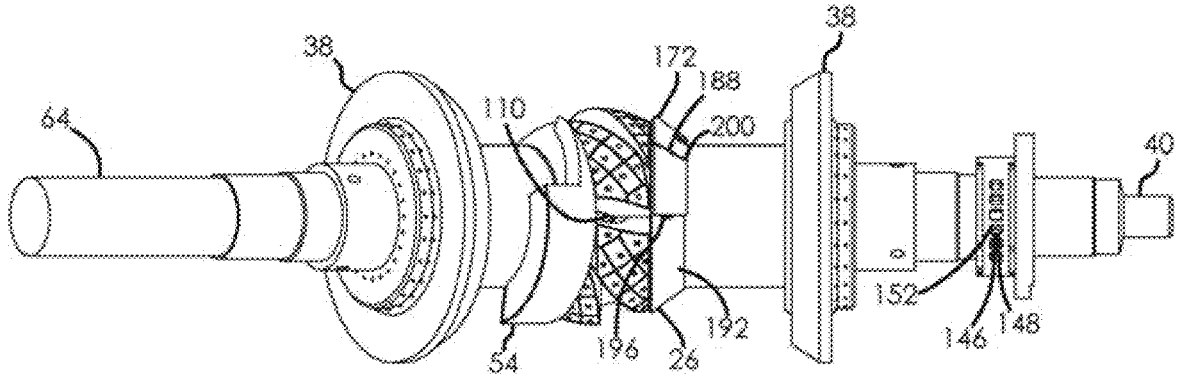
FIG. 30 is an elevation view of the example shown in FIG. 1 with several components removed to show components configured to direct the flow of the working fluid and coolant fluid with the rotors in the first rotational position.
Figure 31:
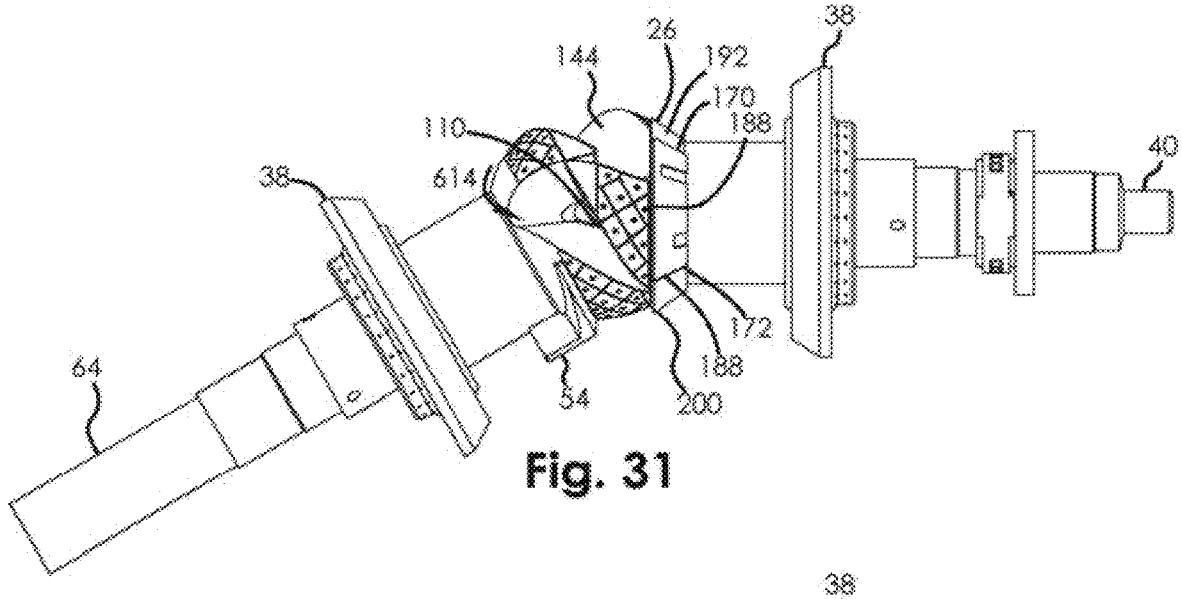
FIG. 31 is a top view of the example shown in FIG. 30.
Figure 32:
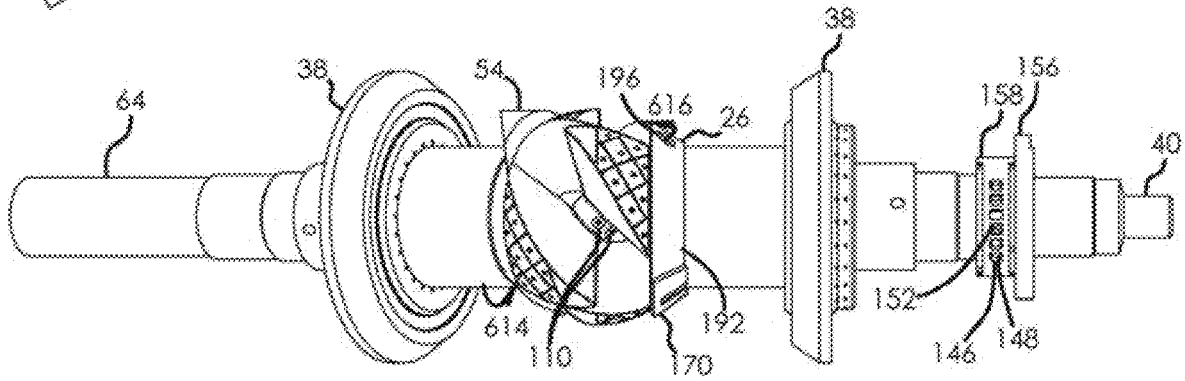
FIG. 32 is an elevation view taken from the opposing side of the example shown in FIG. 30.

In the example shown in FIGS. 30-32, the circumferential positions of the primary gate 170 and secondary gate 172 are aligned for a complete bypass scenario where little to no compression work is done. For example, this positioning may be used when the idler/driver rotor shafts (40/64) are initially accelerated during start-up. The idler/driver rotor shafts (40/64) are in the first rotational position, and the sliding hydraulic valve 158 circumferential position is in the fully open position to provide an example of how the coolant fluid can reach the chamber 144.

Sliding Seal Ring Assembly/Intaking and Discharging—Example B

Figure 104B:
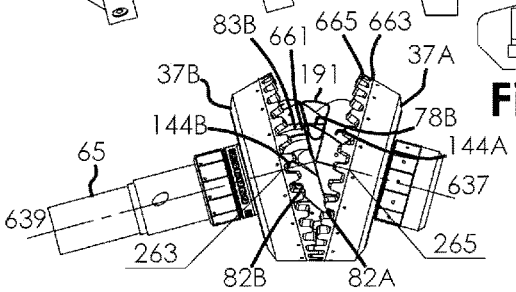

In the example shown in FIGS. 102-103 and FIG. 104B, the valleys 82A/82B of the rotors are covered by the collars 37A/37B allowing the collars 37A/37B to be closer to one another in a compact arrangement without reducing the area available for the rotor hybrid bearings shown in example A of FIGS. 1-2. Given these compact axial positions, the idler/driver gear pitch diameters are further reduced by cantilevered/axially extending members 663 of the collars 37A/37B on which the gear teeth 665 reside. Without the cantilevered portion 663, the idler/driver gear pitch diameters may be noticeably larger, represented by dimensions 265/263 for example.

A lower diameter of the collars 37A/37B at a given speed may reduce deflections at the gear teeth 665 from centrifugal loading in the dual gear arrangement if the axial extending members/cantilevered portion 663 of the collars are still substantially stiff. It may still be possible to allow gas to enter the chambers 144 through the driver collar 37B via a port for each chamber 144 at each driver rotor valley 82B. In this manner, the collar 37B with a port in it (not shown) may operate in a similar fashion to the neckband 26 component, with neckband holes 196 and sliding seal ring assembly 30 of example A (FIGS. 1-2). This port at the outside diameter of the chamber may be substantially gas filled at the end of a stroke and therefore may introduce a substantial efficiency penalty from this recirculated volume. In FIGS. 104B-105 the intake port 191 formed from the idler/driver housings 617A/617B may only have lobes 78A/78B and not valleys 82A/82B immediately adjacent to it as the drive shaft 65 is rotated. Grooves 661 in the driver rotor axial faces 83B allow the chamber volumes 144B at valleys 82B on the driver side to maintain fluid communication with the chamber volumes 144A at the lobes 78B on the driver side.

The first, second, third and fourth rotational positions of the rotors are shown in Examples A/B of the rotary fluid flow device 20 in FIGS. 9-11/119-121, 12-14/122-124, 15-17/125-127, 18-20/128-130, respectively. This comparison may be useful for the reader to understand how the grooves 661 may enable newly formed chambers 144 to be in fluid communication with the intake port 191 via the fluid communication with the adjacent chamber 144. For example, in the first rotational position shown in FIG. 119, a chamber 144' begins to form with fluid seal lines 232C' and 232'B between the rotor faces. However, seal line 232'B may not be effective in sealing chamber 144' from the adjacent teardrop shaped volume 145 if the flow area in the groove 661 is sufficiently large. In the second rotational position shown in FIG. 122, the teardrop shaped volume 145 has been shown to be mixed with chamber 144B and the combined volume is denoted as chamber 144B. In this example, chamber 144' has expanded by several times or more in volume. If this chamber were sealed, the pressure in chamber 144' may drop by several times or more in that it may be proportional to the change in volume. However, if the seal line 232B' is not effective with flow from chamber 144B entering chamber 144' via fluid communication through the groove 661, then the pressure in chamber 144' may be substantially similar to the pressure in chamber 144B. The filling of chamber 144' at early stages of the chamber's formation may be desirable in that the expansion of the working fluid (gas) in the chamber may otherwise drop the chamber pressure low enough to cavitate the liquid lubricant. Cavitation may cause undesirable wear of the rotor materials and the expansion may reduce the efficiency of the compressor.

As shown in the second rotational position of FIG. 123, chamber 144B is in fluid communication with the intake port 191. Each incremental rotational position may show a 30 degree rotational increment of the driver shaft 65. For example, the first rotational position may show when chamber 144A is at its maximum possible volume (FIG. 121) that it is still in fluid communication with the intake and the second rotational position (FIG. 124) may show that chamber 144A has decreased slightly in volume from this maximum possible volume before fluid communication with the intake port 191 is interrupted by the idler lobe 78A. This example demonstrates that the cross sectional flow area of the intake port 191 may optionally be increased without compromising on the space available for the adjacent idler/driver rotor hybrid bearings 135A/135B in that it may not be desirable for bearing pockets to be in fluid communication with the intake port 191 as described in an above section.

Depending on factors such as the driver shaft rotational speed and specific flow geometry, there may be some pressure drop associated with a substantially large flow rate of working fluid passing through the intake port 191 into the chambers. This pressure drop may imply a decrease in volumetric throughput in a positive displacement device and it may be reduced by increasing the cross sectional flow area of the intake port 191. Computational Fluid Dynamic studies or other calculation methods known in the art may be performed to determine if it is more desirable to have a larger intake port 191 that may maintain fluid communication with chambers 144 slightly beyond their maximum possible volumes.

In some cases, a built-in method of volumetric throughput reduction may be desirable. In one example, an engine driver may have insufficient power available to operate the rotary fluid flow device 20 at the engines rated speed range. In this case, the power required by the engine driver and volumetric throughput of the rotary fluid flow device 20 may be decreased by means of built-in capacity control. A range of 0 to 100% turn-down (and anywhere between) was disclosed in example A (FIGS. 1-2). However, in many applications a more limited range of built-in turn down may be acceptable. For example, some modern engines may be capable of up to a 50% speed reduction. This may imply that discrete incremental built-in turn down options may be combined with changing the speed of an engine driver to achieve a continuous range of capacity control. In the case of a motor driven by a Variable Frequency Drive (VFD), this continuous range of capacity control may be achieved by the VFD with or without any built-in turn down options.

As seen in FIG. 124, when the drive shaft is rotated to the second rotational position shown, the chamber 144A may become sealed if the secondary intake passageway 193 shown is sealed by the secondary gate 173, as shown in the closed position in FIG. 108A. A method known to those skilled in the art, such as hydraulic or electric actuation for example may be used to control the position of the secondary gate 173. This adjustment can occur over a number of seconds, so that impact velocity is minimized and so that a small worm gear (not shown) may be used in the actuator body 167. The input shaft 165 of the actuator body may be rotated manually or by an electric motor (not shown) for example to cause rotation of the threaded component 177. The rotation of the threaded component 177 in one direction may cause axial movement of the secondary gate 173 away from the closed position (FIG. 108A) towards the open position (FIG. 108B) and vice versa.

Figure 108B:
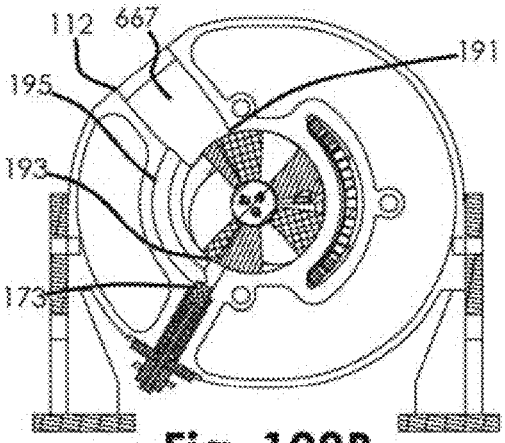

In FIG. 108B, the secondary gate 173 is shown in the open position and allowing a chamber 144 to be in fluid communication with the working fluid in the intake plenum 667 via the secondary intake passageway 193 and intermediate fluid passageway 195. Therefore, if the pressure drop in the fluid passageway 195 is substantially low, the pressure in the chamber 144 may be substantially equivalent to the intake pressure. In the second rotational position of FIG. 124, chamber 144A may no longer be in fluid communication with the primary intake port 191. If the secondary gate 173 is in the open position, as the chamber 144A decreases to the third/fourth rotational positions in FIG. 124/FIG. 127 the volume may decrease by several times without the pressure substantially increasing as flow exits the secondary intake port 193. It is to be understood that in the fifth rotational position (not shown), chamber 144A may look substantially identical to chamber 144C in FIG. 121. At this position it is shown that there may no longer be fluid communication with the secondary intake port 193.

As seen in FIGS. 119-121 and FIG. 131, the chamber 144C may already be in fluid communication with the discharge plenum 669 if the primary gate 171 is rotated in a position to allow this; for example, in the position shown in FIG. 114. If the discharge plenum 669 is in fluid communication with the intake plenum 667 via the chamber 144C, they may be substantially the same pressure. This lack of pressurization of the chamber 144C may be important when initially starting the compressor as it may be advantageous to ramp the speed up while the compressor has minimal loading. Looking to FIGS. 131, 132, 133 and 134, it can be seen that in sequential 30 degree incremental increases in driver shaft rotational position, the chamber 144C may always be in fluid communication with the discharge plenum 669. The primary/secondary intake ports 191/193 would not be shown in the planar cross sectional view shown, but they have been added for the reader to more easily understand how the chambers 144 (A-C) and their respective discharge ports 197 (A-C) may be in fluid communication with the discharge plenum 669 when this primary gate 171 is not obstructing this passageway. The flow of working fluid exiting chambers is denoted as 616.

In FIG. 135, the same first rotational position as shown in FIG. 131 is shown, but the primary gate 171 is in the position shown in FIG. 136 compared to the position shown in FIG. 114 that relates to FIGS. 131-134. The circumferential spans of the recirculated volume 203 may vary substantially. This volume may be analogous to the recirculated volume 202 in example A of the rotary fluid flow device (FIGS. 1-2) in that partially compressed working fluid may expand into the sequential chamber that is in fluid communication.

In FIG. 135, the chamber 144C may not be in fluid communication with the intake plenum 667, discharge plenum 669 or adjacent chambers (144' and 144B). Therefore, the pressure in the chamber 144C may increase before it is in fluid communication with the discharge plenum 669. It should be understood that varying positions of the primary gate 171 are appropriate for varying pressure boost requirements between the intake and discharge pressures. If built-in turndown is used to extend the fluid communication between the chamber 144 and the intake plenum 667, the primary gate 171 may be adjusted accordingly to minimize inefficiencies from opening early or inefficiencies and safety concerns with over-pressuring the chamber when opening late. Controlling the position of the secondary gate 173 is one example of built-in turndown. It should be understood that multiple secondary gates 173 may be used or other means of capacity control/built-in turndown that are still in the spirit of the invention.

The circumferential position of the primary gate 171 shown in FIGS. 131-135 may be controlled by methods known in the art, such as by hydraulic or electric actuation. In FIG. 103, a small worm gear 187 on an input shaft 189 is shown to be intermeshed with gear 185. The input shaft 189 may be rotated manually, or by other methods known in the art to relatively slowly adjust the rotational/circumferential position of the primary gate 171 via the gear 185. Flow entering the compressor via the primary/secondary intake ports 191/193 may enter the chamber 144. When in the chamber 144, the flow may enter the discharge plenum 669 via the respective chamber discharge port 197. In the example provided, the discharge port 197 is substantially at the inner diameter of the chamber 144. If centrifugal loading causes the heavier liquid elements to fling to the outside diameter of the chamber relative to the lighter gaseous working fluid elements, the recirculated volume in the discharge port 197 may be substantially liquid filled as a portion of liquid attempts to exit the chamber at the end of the stroke. Since liquids are substantially incompressible, the effective recirculated volume that substantially attributes to compressor inefficiencies may be the portion of the recirculated volume that is gas filled. Therefore, it may be desirable to locate the discharge port at the inside diameter of the chamber 144 as shown. Additionally, it may be desirable for the exit of the discharge port 197 to terminate at the inside diameter of the idler rotor, and preferably not substantially varying in diameter, as shown. This may promote a higher liquid to gas ratio in the port at the end of the stroke and improve overall efficiency.

Shaft Seal Assembly—Example A

As disclosed herein, the working fluid may enter and exit the rotary fluid flow device 20. Seals near the chamber may prevent the working fluid from entering undesirable areas in the rotary fluid flow device 20. U.S. Pat. No. 4,078,809 proposed a shaft seal assembly for a rotary machine. However, this proposed invention may require a "buffer gas" and additional axial space. Since these requirements may be detrimental to the overall size, weight and cost of the rotary fluid flow device 20, an improvement is described below for example A (FIGS. 1-2).

In FIGS. 94-97, an example is shown where the sliding seal ring assembly 30 of FIGS. 6-7 and FIG. 37 is modified from that previously described to accommodate an immediately adjacent idler shaft seal assembly 566. In the example shown in FIG. 96, a slide gate nut 182 may be fastened onto the slide gate housing 180 to axially restrain the primary gate ring 174, slide gate spacer 178 and secondary gate ring 176. The idler shaft seal assembly 566 of this example comprises the seal nut 568, seal 570, spacer 572, front labyrinth 574, shaft ring 576 and rear labyrinth 578. In one assembly sequence, before the sliding seal ring assembly 30 is installed, the spacer 572 and seal 570 may be secured axially by the seal nut 568. The front labyrinth 574, shaft ring 576 and rear labyrinth 578 may be secured to the idler rotor shaft 40 as an interference fit connection. Groove 580 may contain a split ring (not shown) which may restrain the front labyrinth 574, shaft ring 576 and rear labyrinth 578 from moving axially in the presence of substantial thrust loads (e.g., pressure-induced). The front labyrinth 574 may be near or in contact with the neckband 26, which may reduce the fluid communication that may occur between sliding seal ring cavities 192, 188 and 202 (FIGS. 12-14). Inner surfaces of the stationary shaft assembly components (568, 570 and 572) may be near or in contact with the outermost radially extended surfaces of the rotating shaft assembly components (574, 576 and 578). High pressure fluid may enter the idler shaft seal assembly 566 via hole 582, which is in fluid communication with holes 584 in the spacer 572. The seal 570 may initially be in contact with the shaft ring 576 when no substantial pressure differential exists across the seal. If the pressure at the front (i.e., chamber side) of the seal is larger than the pressure at the rear of the seal, this may further deflect surfaces of the seal 570 towards the shaft ring 576. Thus, if the seal surfaces are flexible/compliant, such as that of a lip seal, the seal 570 may prevent the working fluid from bleeding to the rear of the seal when the rotary fluid flow device 20 is not in operation. However, when the idler rotor shaft 40 is rotating at a substantial speed, the seal surfaces in a conventional application may wear substantially to the point where they may become non-functional. For example, the maximum speed of PTFE is typically 40 m/s. In one example, lip seals are typically designed to have surfaces in constant contact with the opposing rotating component. The expected wear of the seal may be a function of both the relative surface speed at the contact surface and the magnitude of the pressure differential that is deflecting the seal into the rotating component. Therefore, it may be beneficial to use a pressurized fluid film to maintain a small gap at the seal surfaces during operation, which may solve the wear problem that conventional applications face in that this may minimize or prevent contact from occurring between the components during operation. If the high pressure fluid supplied at the rear of the seal (during operation) is enough higher than the pressure at the front (i.e., chamber side) of the seal, the seal may lift off the shaft ring and, in effect, the seal would experience no direct contact with the shaft. Therefore, the combination of higher pressure, when in operation, on the front of the compliant seal (e.g., lip seal) and higher pressure on rear of the seal during shut-down provides a potential method of providing a barrier for the working fluid in both cases even in high speed examples, traditionally a major design challenge. In traditional reciprocating compressors, a substantial volume of working fluid (e.g., methane) escapes through the packing seals of the compressor. The method disclosed above represents the potential of a compressor that may not leak the working fluid. The pressure differential across the seal may need to be limited to avoid over-stressing the component from deflecting too far. A minimal pressure differential is desirable such that the flow lifts seal surfaces and prevents overheating while minimizing the leakage rate. This fluid film may bleed towards the chamber, with the leakage rate and pressure regulated by the front labyrinth 574. This positive pressure differential may prevent the working fluid from passing the seal during operation. As an example, the positive pressure differential across the seal could be compromised if a pump supplying the high pressure fluid was disengaged. In this case, the rotary fluid flow device 20 may be disengaged. The higher pressure working fluid may force any fluid collected in the front labyrinth 574 towards the front faces of the seal until the seal engages the shaft ring 576. Hole 586 may be in fluid communication with the grooves 588 in the spacer 572 forming a cavity that may be at a lower pressure than that supplied by hole 582. Thus, the high pressure fluid supplied from hole 582 and holes 584 may bleed away from the chamber to the rear of the rear labyrinth 578. The rear labyrinth 578 may minimize the leakage that occurs. Labyrinths may be beneficial at the front labyrinth 574 and rear labyrinth 578 locations in that they may regulate the flow rate and may be made of a softer material than the seal nut 568 and spacer 572. This softer material, compared with a more compliant geometry may reduce tolerance stack-up concerns on the rotary fluid flow device 20 where the labyrinths are initially in contact with stationary components, the labyrinths may wear down. Initial contact with a non-compliant material could render the rotary fluid flow device 20 non-functional. Likewise, if loads (e.g., pressure-induced) were to cause the idler rotor shaft 40 to move radially towards the stationary components, contact of non-compliant components may lead to excessive heat generation and may render the rotary fluid flow device 20 non-functional.

In FIGS. 98-101, an example is shown where the intake gate 54 of FIGS. 6-7 is shortened axially relative to other examples to accommodate an immediately adjacent driver shaft seal assembly 592. The driver shaft seal assembly 592 comprises the seal nut 568, seal 570, spacer 572, front labyrinth 574, shaft ring 576 and rear labyrinth 578. The spacer 572 and seal 570 may be secured axially by the seal nut 568. The front labyrinth 574, shaft ring 576 and rear labyrinth 578 may be secured to the driver rotor shaft 64 as an interference fit connection. Groove 580 may contain a split ring (not shown) which may restrain the front labyrinth 574, shaft ring 576 and rear labyrinth 578 from moving axially in the presence of substantial thrust loads (e.g., pressure-induced). Inner surfaces of the stationary shaft assembly components (568, 570 and 572) may be near or in contact with the outermost radially extended surfaces of the rotating shaft assembly components (574, 576 and 578. High pressure fluid may enter the driver shaft seal assembly 592 via hole 582, which is in fluid communication with holes 584 in the spacer 572. The seal may be flexible/compliant and operate in the same manner that is outlined above for the idler shaft seal assembly 566. It is to be understood that all the driver shaft seal assembly components (568, 570, 572, 574, 576 and 578) may be the same and operate in the same manner as the respective idler shaft seal assembly components (568, 570, 572, 574, 576 and 578).

Shaft Seal Assembly—Example B

In the example shown in FIGS. 102-103, the only dynamic seal is the mechanical seal 631 on the drive shaft which is a vendor supplied item used in rotating machinery used to seal a working fluid. The lack of wearable components in the rotary fluid flow device 20 may be very desirable from a maintenance cost and reliability standpoint.

Dual Expander/Compressor in the Same Unit

There may be applications where it is desirable for the rotary fluid flow device 20 to be operated as both a compressor and an expander successively. Patent W 2017/19872 A1 states the "invention is mainly intended to the production of high pressure gas, particularly air, and use of its potential energy, for the purpose of power transmission and energy storage". This may "circumvent the intermittency of some renewable energy sources such as solar and wind sources". Scroll or screw units are described as being capable of being compressors when run in one direction and expanders when the shaft is allowed to rotate in the opposite direction. These are both positive displacement devices that form seal lines defining chambers that reduce in volume to compress a gas or increase in volume when the shaft is rotated in the opposite direction to expand a gas. This application, as well as many others, have highlighted the potential benefits of achieving compression/expansion, especially isothermal compression/expansion, in the same unit. This is especially true when the same shaft is mechanically connected to a unit that is capable of being either a motor or a generator depending on the direction of rotation. In this application, the scroll/screw units preferably have a discharge pressure of 10 to 40 bar (145-580 psig). To the best of the knowledge of the author, there are no commercially available expander/compressor units that have been proven to reliably operate beyond that 350 psig. If there are some that have discharge pressures of up to 580 psig, it is still desirable to produce much higher pressure air for some applications and to produce additional power generation for Compressed Air Energy Storage (CAES). This could be on the order of thousands of psig. The methods proposed in this Patent W 2017/19872 A1 intend to achieve pressures beyond the capabilities of units that are capable of both compression and expansion. Beyond this pressure range, separate trains of compressors (e.g., integrally geared centrifugal compressors) with attached motors and separate trains of expanders (e.g., turbo expanders) may be used with attached generators. These are relatively expensive multi-stage adiabatic compression and adiabatic expansion trains that typically require inter-stage cooling. It may be obvious to someone skilled in the art that if the rotary fluid flow device 20 is proven to reliably boost atmospheric pressure air to thousands of psig, near isothermally, it may be desirable in a Compressed Air Energy Storage (CAES) application. Using US Patent application 2017/19872 A1 as an example, the scroll/screw units may be replaced by the single stage rotary fluid flow device 20, and the buffer gas tank that was discharge of the scroll/screw units (when compressing) may just be the final air storage vessel or cavern, eliminating many pieces of equipment.

The principles related to how the chamber may decrease or increase in size for to compress/expand are the similar for scroll/screw compressor/expander units because they are all positive displacement devices. When operated as a compressor, chambers 144 were described in example A (FIGS. 1-2) to be at a maximum volume when in fluid communication with the intake 112 and a lesser volume when the discharge port 234 becomes in fluid communication with the chamber 144. The primary gate 170 was described to be positioned so that when the pressure in the chamber 144 is substantially similar to the pressure at the discharge port 234, the two volumes are in fluid communication shortly thereafter. Examples of these varying chamber sizes are shown in FIGS. 9-20 and FIGS. 119-130 (example B). It is to be understood that the rotor geometry and chambers 144 in both of these examples are substantially identical with the differences lying in how the working fluid enters and exits the chambers 144. When compressing, the driver is expected to do work on the gas to rotate the shaft as shown. If the driver were de-coupled from the shaft or permitted to rotate freely, the gas pressure may cause the shaft to rotate in the opposite direction. In example B, high pressure gas in the discharge plenum 669 may fill chamber 144C in the fourth, third, second and then first rotational positions as shown in FIGS. 134, 133, 132 and 131, respectively, as the chamber 144C expands in volume. The discharge port 197C of chamber 144C may be subsequently sealed in the next rotational position, which may look substantially identical to the discharge port 197A of chamber 144A in FIG. 134. In FIG. 133, the discharge port 197A is in fluid communication with the recirculated cavity 203, which may be at a lower pressure before mixing. In the next rotational position of FIG. 132 and FIGS. 122-124, if no built-in capacity control is desired in that the secondary intake passageway is substantially obstructed, the chamber 144A may be sealed. FIG. 131 and FIGS. 119-121 show the chamber 144A in fluid communication with the primary intake port 191, allowing the working fluid to exit the lower pressure intake plenum 667 of the rotary fluid flow device 20.

As the chamber volume 144 expands when it is sealed, the pressure may reduce until the chamber is in fluid communication with the lower pressure intake plenum 667 via the primary and/or secondary intake ports 191/193. The drive shaft is preferably coupled to a motor/generator for compression/expansion processes although work on the drive shaft may be used to drive another piece of equipment. For the same primary gate 171 position, the expansion ratio may be substantially similar to the previous compression ratio. The peak and average loads may also be substantially similar to the reverse compression process with a somewhat reverse/mirrored load curve. The primary gate 171 position may be adjusted to make varying expansion ratios possible. When the secondary gate 173 is axially positioned as shown in FIG. 108B in that the secondary intake port 193 is not obstructed, a reduction in volumetric throughput and a reduction in power may be expected. In one example this built-in capacity control may be preferred if an attached generator or device harnessing input power from the driver shaft 65 are not able to make use of the power expected without a reduction in capacity control. It may be desirable to have a high temperature gas in the discharge plenum 669 prior to an expansion process with enough coolant fluid introduced to maintain near isothermal (non-adiabatic) expansion in that this may increase power generation. In the case of an expansion process followed by a compression process, it may be desirable to achieve a polytropic coefficient of less than 1.0, implying better than isothermal efficiency in that the working fluid temperature is decreased after the compression process and increased after the expansion process by using a coolant that is cooler or warmer than the working fluid, respectively.

The gears, hybrid bearings, primary gate and cooling injection system may have no substantial preferential direction for shaft rotation. It may be advantageous to supply differing fluid galleries 157 with oil, which may be accomplished on the fly by switching which valves are open.

Rotary Fluid Flow Device Assembly Advantages

In summary of key past challenges presented herein, the rotary fluid flow device 20 design requirements vary significantly when comparing the extreme ranges of what the fluid flow device is capable of. High discharge pressure cases significantly undermine the capacity of the idler/driver rotor hybrid bearings 135A/136 and 135B/134 and to account for of the increased drain pressure. In some examples, it may be desired to increase the supply pressure for high discharge pressure cases. These high discharge pressure cases can produce exceptionally high loads, especially when the suction pressure is also high. The supply pressure of the spherical hybrid bearings, shaft hybrid bearings and hybrid bearings at the collars may be adjusted as desired. The combination of these hybrid bearings and the gearing/indexing of the rotors in one example provide a high volume rotary compressor capable of inlet or discharge pressures of at least 2000 psig. This operating range may represent most compression applications on the market today in that these pressures exceed the operating pressure of a typical pipeline. In one example, the rotary compressor may be capable of boosting the pressure of the working fluid from near atmospheric pressure to at least 5000 psig. This combination of inlet and discharge pressures may represent what is desired to inject carbon dioxide deep underground as part of a carbon capture initiative. Bearing supply pressure should be minimized for lower discharge pressure, lower load, cases, to minimize unnecessary power consumption. High compression ratio cases that have high flow demand a significant amount of coolant fluid to be injected compared to low compression ratio cases that may not even require cooling. The addition of injection cooling into the fluid flow device 20 may allow for very high compression ratios. In one example, the pressure boost of near atmospheric pressure to at least 5000 psig may be possible in the single stage of compression. In example A (FIGS. 9-11), the sliding hydraulic valve 158 and secondary gate 172 positions may be adjusted to regulate the discharge temperature of the working fluid. In example B (FIGS. 102-103), the discharge temperature of the working fluid may be adjusted by switching which fluid galleries 157 (FIGS. 107-109) are supplied coolant. If desired, the operating speed of the rotary fluid flow device 20 could be decreased to allow for additional heat transfer to take place in the short duration available which may reduce the coolant volume requirements, if any. Fluid flow device components need to be designed to withstand design pressures, often with minimal deflection in a compact arrangement. Idler hybrid bearings 135A/136, 137A/138, 129A/118, 139A/120 and driver hybrid bearings 135B/134, 137B/72, 129B/118, 139B/120 have small gaps and these gap heights would change when the rotary fluid flow device is at room temperature versus when the fluid flow device has reached thermal equilibrium. Furthermore, depending on the properties of the working fluid that is being compressed or expanded, and the required compression/expansion ratio, the discharge pressure and thermal expansion of the driver rotor shaft 64/65 and idler rotor shaft 40/41 may vary. Deflection from thermal expansion may be self-compensated by the mechanisms discussed for the hybrid bearings. However, in cases where the deflection from thermal expansion may be much larger than the hybrid bearing gap heights in the neutral position, the required reaction load expected from the hybrid bearing may be a large portion or even much greater than the pressure-induced loads from the chamber 144 or other loads. Therefore, in example A of FIGS. 1-2, without the advancements discussed herein, at the collar 38, changes in thermal expansion (or contraction) may attempt to exceed the design gap sizes and in some cases may exceed the load capacity of the bearing, implying metal-to-metal contact. Overall size, weight, cost, mechanical efficiency, the number of parts, and assembly ease are all important design parameters. In example A shown in FIGS. 1-8B, the fluid flow device solves these challenges in the following ways. All components are designed to withstand the maximum loading conditions that could occur for any of the cases in the wide design range. The bearing supply pressure is adjusted to what is required for the current design case. The sliding seal ring assembly 30 in one example is capable of 0-100% turndown (minus parasitic losses such as friction) without having to modify components, and without having to shut-down the fluid flow device. The load balanced sliding hydraulic valve 158 of the hydraulic assembly 48 can be used to adjust the coolant fluid flow rate between near zero to 100% flow, or anywhere between. The mechanism to adjust for thermal expansion at the collar 38 makes small gap heights at the adjacent hybrid bearing surfaces (118/120) possible. Alternatively, an even more compact example B, is shown in FIGS. 102-103, where the hybrid thrust bearing surfaces (129A, 129B, 139A, 139B) may be axially close enough to the rotors' spherical centers 77 to substantially reduce thermal expansion to be of small enough consequence in the desired temperature operating range.

In example A of FIGS. 1-2, the presence of self-compensating hybrid bearing surfaces (118/120) on an adjustable component integrates the functionality of both components. The collar 38, arrangement of indexing gears 122, driver/idler rotor hybrid bearing (134/136), bearing arrangement and housing arrangement combine to make the fluid flow device as compact and light as possible, thereby reducing size, weight and material cost. Using the collar 38 as both a hybrid bearing surface for indexing purposes via gear teeth allows for a short distance between the gears and is a method for reducing torsional lag on the rotary fluid flow device 20. The compactness of the rotary fluid flow device was further enabled by placing high volume atomizing fluid injectors 110 in the idler rotor inner frusto-spherical surface 92. The driver/idler radial hybrid bearings (72/138) and front/rear cylinder hybrid bearings (118/120) may drain to near atmospheric pressure so that the housing containing the adjacent low pressure cavities can be of minimal size, weight and material cost, while maximizing the capacity of the bearings. Alternatively, the even more compact example B (FIGS. 102-103) with only two gears may make a high-pressure gear cavity 445 feasible, if desired.

Novel Features Including but not Limited to:

A rotary fluid flow device (20) comprising: a housing (55) comprising a concave frusto-spherical inner housing surface (114); a first rotor (76) comprising a convex frusto-spherical first rotor outer surface (62) adjacent the inner housing surface (114), at least one lobe (78) defining at least one valley (82), a first rotor center (77) at the radial center of the first rotor outer surface (62); a first rotor hydrostatic bearing (134) formed on the first rotor outer surface (62); the first rotor hydrostatic bearing (134) comprising; at least one first rotor fluid port (108) through the first rotor outer surface (62), a surface defining a bearing pocket (208) around the first rotor fluid port (108), a landing (206) around the bearing pocket (208); the landing (206) protruding radially outward from the bearing pocket (208) relative to the center (77) of the first rotor (76); and the landing (206) immediately adjacent the inner housing surface (114) forming a fluid seal thereto. The rotary fluid flow device (20) as recited herein further comprising in one example: the first rotor hydrostatic bearing (134) formed of an array 593 of at least one first rotor landing (206) on the first rotor outer surface (62) of each lobe (78); and wherein the array 593 is substantially identical on each lobe (78) of the first rotor (76). The rotary fluid flow device (20) may be arranged wherein the first rotor hydrostatic bearing (134) is of a multi-dimensional array 593. The rotary fluid flow device (20) may be arranged, wherein the hydrostatic bearings (134) comprise: a source of bearing fluid, at a bearing fluid supply pressure, the source of bearing fluid in fluid communication with the first rotor fluid port (108); a source of working fluid having a fluid conduit (186) through the housing (55) to a chamber (144) defined in part by the valley (82) of the first rotor, the working fluid to be compressed in the chamber (144) to a working fluid pressure as the first rotor (76) rotates relative to the housing (55); wherein the bearing fluid supply pressure exceeds the working fluid pressure. The rotary fluid flow device (20) as recited may further comprise: a second rotor (28) comprising a convex frusto-spherical first rotor outer surface (36) adjacent the inner housing surface (114), at least one lobe (78) forming at least one valley (82), the valley (82) of the second rotor positioned around the lobe (78) of the first rotor (76), a second rotor center (77) at the radial center of the first rotor outer surface (36); a second rotor hydrostatic bearing (136) formed on the second rotor outer surface (36); the second rotor hydrostatic bearing (136) comprising; at least one second rotor fluid port (108) through the second rotor outer surface (36), a surface defining a bearing pocket (208) around the second rotor fluid port (108), a landing (206) around the bearing pocket (208); the bearing landing (206) protruding radially outward from the bearing pocket (208) relative to the center (77) of the first rotor (76); and the landing (206) immediately adjacent the inner housing surface (114). The rotary fluid flow device (20) may be arranged wherein at least the first rotor hydrostatic bearing (134) is radially offset from the valley (82) of the first rotor (76). The rotary fluid flow device (20) may be arranged wherein the first rotor hydrostatic bearing (134) is configured to drain to the valley (82). The rotary fluid flow device (20) may further comprise: a first shaft (64) extending from the first rotor (76), the first shaft (64) axially opposed to the lobes (78) of the first rotor (76); a fluid conduit (216) in fluid communication with the first rotor fluid port (108); and the fluid conduit (216) extending substantially axially along the first shaft (64). The rotary fluid flow device (20) may further comprise: a second shaft (40) extending from the second rotor axially opposed to the lobes (78) of the second rotor (28); a fluid conduit (212) in fluid communication with the second rotor hydrostatic bearing (136); and the fluid conduit (212) extending substantially axially along the second shaft (40).

A rotary fluid flow device (20) comprising: a first rotor (76) comprising a convex frusto-spherical first rotor outer surface (62) adjacent the inner housing surface (114), at least one lobe (78) forming at least one valley (82), a first rotor center (77) at the radial center of the first rotor outer surface (62); the first rotor (76) comprising a first rotor insert surface (86) at a radial center of the lobe (78), valley (82), the first rotor insert surface (86) having an axis substantially parallel to a rotational axis (639) of the first rotor (76); an insert (94) removably positioned within the first rotor insert surface (86); and the insert (94) configured to cooperate with a second rotor (28) and form a fluid seal thereto. The rotary fluid flow device (20) may further comprise: the insert (94) comprising a frusto-spherical inner surface (98); and a frusto-spherical insert (92/96) removably inserted into the frusto-spherical inner surface (98) of the insert (94). The rotary fluid flow device (20) may further comprise: the second rotor (28) comprising a second rotor insert surface (86) at a radial center of the lobe (78), valley (82) of the second rotor (28), the second insert surface (86) having an axis substantially parallel to a rotational axis (637) of the second rotor (28); an insert (90) removably positioned within the second rotor insert surface (86); the insert (90) of the second rotor configured to cooperate with the insert (94) of the first rotor (76) to form a fluid seal thereto. The rotary fluid flow device (20) may further comprise: at least one fluid injector (110) on the insert (90); the at least one fluid injector (110) substantially aligned with the valleys (82) of the second rotor (28); at least one fluid insert conduit (153) extending through the insert (90) to the second rotor (28) substantially parallel to the axis of rotation of the second rotor (28); and the fluid insert conduit (153) extending through the second rotor (28). The rotary fluid flow device (20) may be arranged wherein the fluid injectors (110) are removably attached to the insert (90). The rotary fluid flow device may be arranged wherein the fluid injectors (110) are selectively supplied with a cooling fluid. The rotary fluid flow device (20) may further comprise: the second rotor (28) attached to a shaft (40) comprising a substantially cylindrical outer surface; fluid shaft surface openings (152) extending substantially axially within the second shaft (40) from the fluid insert conduits (153); and a housing conduit (150) on the housing (55) aligned with the shaft surface openings (152) to permit passage of fluid from a housing (55) about the shaft (40) to the fluid injectors (110). The rotary fluid flow device may further comprise: a plurality of radially opposed shaft surface openings (152) fluidly connected to each insert conduit (153). The rotary fluid flow device (20) may further comprise: a sliding sleeve (158) mounted to the housing (55) encircling the shaft (40) about the shaft surface openings (152); the sliding sleeve (158) having a plurality of surfaces defining openings (146) there through; and the openings (146) sequentially aligning with one or more shaft surface openings (152) to provide an intermittent fluid conduit between the housing fluid conduit (150) and the fluid injectors (110). The rotary fluid flow device (20) may be arranged wherein the sleeve (154) comprises: an inner sleeve (156) having the surfaces defining openings (148) there through; a sliding sleeve (158) having surfaces defining openings (146) there through aligned with the surfaces defining openings (148) though the inner sleeve (156); and the sliding sleeve (158) sealed to the inner sleeve (156) and configured to rotate relative thereto to adjust the alignment of the surfaces defining openings (146) through the sliding sleeve relative to the surfaces defining openings (148) though the inner sleeve so as to selectively restrict fluid flow to the injectors (110). The rotary fluid flow device (20) may further comprise: an inner sleeve (627) having the surfaces defining openings (159) there through; the openings (159) on the inner sleeve (627) selectively supplied with fluid. The rotary fluid flow device (20) may be arranged wherein the first rotor inner surface (86) is a geometric shape selected from the list consisting of: frusto-cylindrical, frusto-conic, and multi-faced prism.

A rotary fluid flow device (20) comprising: a housing (55); a second rotor (28) having a rotor shaft (40) within the housing (55), an outer surface with a hydrostatic bearing (134) engaging an inner surface (114) of the housing; a collar (38) fitted to the rotor shaft (40); the collar (38) having a forward surface axially facing the second rotor (28); the collar (38) having a rearward surface axially facing away from the second rotor (28); a forward self-compensating hydrostatic bearing (118) engaging the forward surface of the collar (38); and wherein the forward self-compensating hydrostatic bearing (118) offsets force exerted by the hydrostatic bearing (134) between the second rotor outer surface and the inner surface (114) of housing (55). The rotary fluid flow device (20) may further comprise: a rearward self-compensating hydrostatic bearing (120) engaging the rearward surface of the collar (38); wherein the rearward self-compensating hydrostatic bearing (120) is configured to offset force exerted by the pressure-induced force of the working fluid in a compression chamber (144) defined in part by the housing (55). The rotary fluid flow device (20) may further comprise: a gearing arrangement mechanically connecting the second rotor (28) to a first rotor (76); and wherein the collar (38) cooperates with the gearing arrangement to index the second rotor (28) to the first rotor (76).

A rotary fluid flow device (20) comprising: a housing (55); a second rotor (28) having a rotor shaft (40) within the housing (55), an outer surface with a hydrostatic bearing (134) engaging an inner surface (114) of the housing; a collar (38) fitted to the rotor shaft (40); the collar (38) having a forward surface axially facing the second rotor (28); the collar (38) having a rearward surface axially facing away from the second rotor (28); a rearward self-compensating hydrostatic bearing (42120) engaging the rearward surface of the collar (38); wherein the rearward self-compensating hydrostatic bearing (42120) is configured to offset force exerted by the pressure-induced force of the working fluid in a chamber (144).

A rotary fluid flow device (20) comprising: a housing (55) comprising a concave frusto-spherical inner housing surface (114); a first rotor (76) having a convex frusto-spherical first rotor outer surface (62) adjacent the inner housing surface (114), lobes (78) forming valleys (82) there between; a first rotor center (77) at the radial center of the first rotor outer surface (62); a second rotor (28) having a frusto-spherical second rotor outer surface (36), lobes forming valleys there between, a second rotor center (77) at the radial center of the second rotor outer surface (36); a gearing arrangement comprising: a first gear (38B) coupled to the first rotor (76); a second gear (38A) coupled to the second rotor (28); a third gear (122B) engaging the first gear (38B); and a fourth gear (122A) engaging the third gear (122B) and the second gear (38A); the gearing arrangement thus transferring rotational torque between the first rotor (76) and the second rotor (28). The rotary fluid flow device may be arranged wherein: the third gear (122B) and the fourth gear (122A) are fixed to and rotate with a common shaft (126').

A hydrostatic bearing (620) comprising: a first outer bearing landing (290) surrounding at least one bearing pocket (284); an abutting component (671) having an abutting surface (671') immediately adjacent the first outer bearing landing (290); wherein the hydrostatic bearing (620) is configured to move relative to the abutting surface (671) of abutting component (671); at least one first fluid port (270/394) surrounded by the first bearing landing; and first fluid port (270) configured to supply bearing fluid under pressure through the hydrostatic bearing (620) between the bearing pocket (284) and the surface (671'). The hydrostatic bearing (620) may further comprise: at least one first restrictor landing (272) forming a restriction surrounding the first fluid port (270); at least one first restrictor groove (274) surrounding the first restrictor landing (272); an intermediate landing (276) immediately adjacent the abutting surface (671'); the intermediate landing (276) surrounding the first restrictor groove (274); bearing pocket (284) and the first outer bearing landing (290) surrounding the intermediate landing (276). The hydrostatic bearing (620) may further comprise: at least one first restrictor landing (272) forming a restriction surrounding the first fluid port (270); at least one first restrictor groove (274) surrounding the first restrictor landing (272); an intermediate landing (276) immediately adjacent the abutting surface (671'); the intermediate landing (276) surrounding the first restrictor groove (274); bearing pocket (284) and the first outer bearing landing (290) is opposed to the intermediate landing (276). The hydrostatic bearing (620) may further comprise: a second outer bearing landing (290QGH) diametrically opposed to the first outer bearing landing; the second outer bearing landing (290QGH) surrounding at least one bearing pocket (284); an abutting component (671) having an abutting surface (671') immediately adjacent the second outer bearing landing (290QGH); at least one first fluid port (270) surrounded by the second outer bearing landing (290QGH); and first fluid port (270) configured to supply bearing fluid under pressure through the hydrostatic bearing (620) between the bearing pocket (284) and the surface (671). The hydrostatic bearing (620) may be arranged wherein the second outer bearing landing (290QGH) is diametrically opposed to and laterally offset from the first outer bearing landing (290). The hydrostatic bearing (620) may be arranged wherein the second outer bearing landing (290QGH) is diametrically opposed to and laterally offset from the first outer bearing landing (290) on the surface of a shaft, wherein the second outer bearing landing is radially opposed to and laterally offset from the first outer bearing landing relative to a rotational axis of the shaft. The hydrostatic bearing (620) may further comprise: a second outer bearing landing (290QGH) laterally adjacent to the first outer bearing landing; the second outer bearing landing (290QGH) surrounding at least one bearing pocket (284); the abutting surface (671') immediately adjacent the second outer bearing landing (290QGH); at least one fluid port (270) surrounded by the second bearing landing (290); and the fluid port (270) configured to supply bearing fluid under pressure through the hydrostatic bearing (620) between the bearing pocket (284) and the surface (671'). The hydrostatic bearing (620) may further comprise: a second fluid port (286); and the second fluid port (286) in direct fluid communication with the bearing pocket (284). The hydrostatic bearing (620) may further comprise: a third fluid port (286); the third fluid port (604) in direct fluid communication with a first restrictor groove (274). The hydrostatic bearing (620) may further comprise: a second outer bearing landing (290QGH) diametrically opposed to the first outer bearing landing (290); the second outer bearing landing (290QGH) surrounding at least one bearing pocket (284); an abutting component (671) having an abutting surface (671') immediately adjacent the second outer bearing landing (290QGH); at least one first fluid port (270) surrounded by the second outer bearing landing (290QGH); and the first fluid port (270) surrounded by the second outer bearing landing (290QGH) in fluid communication with the fluid port (270/394) surrounded by the first bearing landing. The hydrostatic bearing (620) may further comprise: a capillary restrictor (348) fitted into the first rotor fluid port (108). The hydrostatic bearing (620) may further comprise: a capillary tube (344) fitted into the capillary restrictor (348).

A rotary fluid flow device (20) comprising: a sliding primary gate assembly (31) comprising in turn; a discharge plenum (669) selectively fluidly coupling a chamber (144) defined in part by lobes (78) and valleys (82) of a first rotor (76), lobes (78) and valleys (82) of a second rotor (28), and an inner surface of a housing (55) around the first rotor (76) and second rotor (28); a discharge port (197) in fluid communication with the chamber (144); and a primary gate (171) selectively providing a fluid communication between the discharge port (197) and the discharge plenum (669). The rotary fluid flow device (20) may be arranged wherein the discharge plenum (669) comprises an inner surface of a shaft (41) fixed to the second rotor (28B). The rotary fluid flow device (20) may be arranged wherein the primary gate (171) extends axially into the discharge plenum (669). The rotary fluid flow device (20) may be arranged wherein the primary gate (171) is fixed to the housing (55).

A rotary fluid flow device (20) comprising: a first rotor (76) comprising at least one lobe (78B), at least one valley (82B), an axis of rotation (639); a second rotor (28B) comprising at least one lobe (78A), at least one valley (82A), an axis of rotation (637) offset from and intersecting the axis of rotation of the first rotor; the lobe of the first rotor, the valley of the second rotor forming a first rotor chamber (144A); the lobe of the second rotor, the valley of the first rotor forming a second rotor chamber (144B); and a groove (661) in a first rotor axial face (83B) forming a fluid conduit between the first rotor chamber (144A) and the second rotor chamber (144B). The rotary fluid flow device (20) may be arranged wherein the fluid conduit formed by groove (661) is sealed intermittently. The rotary fluid flow device (20) may further comprise a discharge port (197A) in the valley (82A) of the second rotor (28). The rotary fluid flow device (20) may further comprise a fluid conduit (669) in fluid communication with the discharge port (197A) and a shaft (4141) fixed to the second rotor (28).

A fluid injector (109) comprising: an outer surface (125); at least one surface defining a fluid injector hole (121) forming a fluid conduit though the outer surface (125); the fluid injector (109) comprising at least one injector leg (128) with a foot surface (117) projecting from the injector leg (128); the foot surface (117) adjacent a tapered fluid injector surface (119) aligned with the injector hole (121); and the fluid injector (109) configured to deflect and release the fluid injector (109) from a receiving component (97) as a force directed through the fluid injector hole (121) engages the tapered fluid injector surface (119).

A shaft seal assembly. The seal assembly may be arranged wherein the assembly includes a compliant shaft seal. The seal assembly may be arranged wherein the compliant shaft seal does not contact the shaft during normal operation.

A method of operating a compliant shaft seal, the method comprising injection higher pressure fluid one side of a compliant seal during operation and a working fluid acting on the opposite side of the compliant seal during shut down. The method of operating a compliant shaft seal wherein the shaft seal does contact the shaft during normal operation. The method compliant shaft seal wherein the seal assembly acts as a working fluid barrier during operation and shut down. The method of compliant shaft seal where the relative surface speed of the compliant seal, contacting during operation, would be greater than 40 meters per second.

A method of reducing torsional lag on a indexed rotary positive displacement device the method comprising of using a hydrostatic bearing member in combination with a gear surface.

A method of operating a compressor having a frusto-spherical inner housing surface and rotors combined with a frusto-spherical inner surface that define a compression chamber, the method comprising the steps of: moving a working fluid into the compression chamber such that a single stage pressure ratio is at least 1:1; the outlet temperature of the gas being expelled through the outlet port is less than 150 degrees Celsius; and wherein thrust and radial loads/displacement produced in response to the compression of the gas by the rotors are counteracted by the hydrostatic bearings; and wherein axial and radial deflections produced in response to thermal expansion and centrifugal loading, when applicable, are counteracted by the hydrostatic bearings. The method of operating a compressor further comprising injecting liquid coolant into the compression chamber during said compressing. The method of operating a compressor further wherein the coolant is injected via injectors installed on a moving component. The method of operating a compressor wherein the absolute outlet pressure of the working fluid expelled from the compression chamber through an outlet port exceeds the absolute inlet pressure of the working fluid at the inlet port by a ratio between 1:1 and 370:1. A method for lowering the friction, increasing load capacity and decreasing leakage of a self-compensating, rotary hydrostatic bearing; the method comprising the steps of: providing a central hole, adjacent substantially circular landings, adjacent restrictor grooves and adjacent substantially annular landings included within a bearing pocket and whereby the substantially annular grooves are in fluid communication with a bearing pocket on the diametrically opposite side of the rotary hydrostatic bearing.

A method for lowering the friction, increasing load capacity and decreasing leakage of a self-compensating, rotary hydrostatic bearing; the method comprising the steps of: providing a supply conduit, adjacent substantially circular landings, adjacent substantially annular grooves and adjacent substantially annular landings included within a bearing pocket and whereby the substantially annular grooves are in fluid communication with a bearing pocket on the diametrically opposite side of the rotary hydrostatic bearing.

The rotary fluid flow device as herein further comprising: sliding gates (170) upon outer frusto-spherical rotor surfaces, the sliding gates selectively restricting fluid flow between housing ports (112) and a chamber (144) formed between a valley of the first rotor and a valley of the second rotor. The rotary fluid flow device may further comprise a neckband (26) between the second rotor and the sliding gates.

A method of dynamically controlling the pressure boost and expansion ratio of a rotary fluid flow device such method comprising the following steps. When in compression mode; selectively adjusting the discharge port opening; controlling the discharge temperature of the working fluid to 150 Celsius or the working fluid by selectively adjusting the volume of coolant liquid being injected into the fluid flow device; monitoring the discharge temperature of the working fluid and the volume of liquid coolant being injecting into the fluid flow device; the measured discharge temperature and the measured liquid coolant volumes in communication with a electronic control device. When in expansion mode (running the unit in reverse): selectively adjusting opening of the port used for discharge in compression mode; controlling the discharge temperature out of the port used for inlet when in compression to +10 Celsius or above by adjusting the volume of heating liquid being injected into the fluid flow device. Monitoring the discharge temperature of the working fluid and the volume of heating liquid being injected into the fluid flow device. The measured discharge temperature of the working fluid and the measured heating liquid volumes in communication with an electronic control device.

A method of allowing a rotary fluid flow device to work as both an expander and compressor in the same device, such method consisting of: providing a frustical device with seal line that allows for pressure boost in compression mode in one direction and for expansion in the opposite direction.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative device/apparatus and methods, and illustrative examples shown and described. Accordingly, departures may be made from such details without departing from the spirit or scope of applicants' general concept.

We claim:

1. A rotary fluid flow device comprising:

a housing;

a first rotor having a rotor shaft within the housing, an outer surface with a hydrostatic bearing engaging an inner surface of the housing;

a collar fitted to the rotor shaft;

the collar having a forward surface axially facing the first rotor;

the collar having a rearward surface axially facing away from the first rotor;

a forward self-compensating hydrostatic bearing engaging the forward surface of the collar; and wherein the forward self-compensating hydrostatic bearing offsets force exerted by the hydrostatic bearing between the first rotor outer surface and the inner surface of the housing.

2. The rotary fluid flow device as recited in claim 1 further comprising:

a rearward self-compensating hydrostatic bearing engaging the rearward surface of the collar;

wherein the rearward self-compensating hydrostatic bearing is configured to offset force exerted by the pressure-induced force of the working fluid in a compression chamber defined in part by the housing.

3. The rotary fluid flow device as recited in claim 1 further comprising:

a gearing arrangement mechanically connecting the first rotor to a second rotor; and wherein the collar cooperates with the gearing arrangement to index the first rotor to the second rotor.

4. The rotary fluid flow device as recited in claim 1 comprising:

a rearward self-compensating hydrostatic bearing engaging the rearward surface of the collar.

5. A rotary fluid flow device comprising:

a sliding primary gate assembly comprising in turn;

a discharge plenum selectively fluidly coupling a chamber defined in part by lobes and valleys of a first rotor, lobes and valleys of a second rotor, and an inner surface of a housing around the first rotor and second rotor;

a discharge port in fluid communication with the chamber;

a primary gate selectively providing a fluid communication between the discharge port and the discharge plenum; and wherein the discharge plenum comprises an inner surface of a shaft fixed to the second rotor.

6. A rotary fluid flow device (20) comprising:

a first rotor comprising at least one lobe, at least one valley, an axis of rotation;

a second rotor comprising at least one lobe, at least one valley, an axis of rotation offset from and intersecting the axis of rotation of the first rotor;

the lobe of the first rotor, the valley of the second rotor forming a first rotor chamber;

the lobe of the second rotor, the valley of the first rotor forming a second rotor chamber; and a groove in a first rotor axial face forming a fluid conduit between the first rotor chamber and the second rotor chamber; and a fluid conduit in fluid communication with a discharge port and a shaft fixed to the second rotor.

7. The rotary fluid flow device as recited in claim 6 wherein the fluid conduit formed by the groove is sealed intermittently.

8. The rotary fluid flow device as recited in claim 6 comprising the discharge port in the valley of the second rotor.

* * * * *